US006032473A

United States Patent [19]

Morimoto et al.

[11] Patent Number: 6,032,473

[45] Date of Patent: Mar. 7, 2000

[54] REFRIGERANT CIRCULATING SYSTEM

[75] Inventors: Osamu Morimoto; Fujio Hitomi; Moriya Miyamoto; Hidekazu Tani; Tomohiko Kasai, all of Wakayama; Yoshihiro Sumida, Hyogo; Hitoshi Iijima, Shizuoka, all of Japan

[73] Assignee: Mitsubishi Denki Kabushiki Kaisha, Tokyo, Japan

[21] Appl. No.: 08/957,738

[22] Filed: Oct. 24, 1997

Related U.S. Application Data

[62] Division of application No. 08/681,488, Jul. 23, 1996, which is a continuation of application No. 08/386,648, Feb. 10, 1995, Pat. No. 5,654,322.

[30] Foreign Application Priority Data

May 30, 1994 [JP] Japan ..... 6-116966
Nov. 25, 1994 [JP] Japan ..... 6-291331

[51] Int. Cl.[7] ..... F25B 1/00; F25B 41/04

[52] U.S. Cl. ..... 62/205; 62/215; 62/502

[58] Field of Search ..... 62/205, 502, 215

[56] References Cited

U.S. PATENT DOCUMENTS 5,186,012 2/1993 Czachorski et al. ..... 62/114
5,499,508 3/1996 Arai et al. ..... 62/502 X

FOREIGN PATENT DOCUMENTS 0 586 193 A1 3/1994 European Pat. Off. .
0 631 095 A2 12/1994 European Pat. Off. .
5-24417 4/1993 Japan .
5-66503 9/1993 Japan .
5-77942 10/1993 Japan .
6-101911 4/1994 Japan .
6-101912 4/1994 Japan .

OTHER PUBLICATIONS

U.S. application No. 08/957,738, filed Oct. 24, 1997, Osamu et al., pending.
U.S. application No. 09/138,747, filed Aug. 24, 1998, Daisuke et al., pending.

*Primary Examiner*—William Wayner
*Attorney, Agent, or Firm*—Oblon, Spivak, McClelland, Maier & Neustadt, P.C.

[57] ABSTRACT

A refrigerant circulation system of the present invention includes a compressor, a condenser, a evaporator, a throttle device and a control unit. The control unit controls a composition of a refrigerant circulating in the refrigerant circulation system based on a temperature and pressure of the refrigerant of an inlet and outlet portion of the compressor, condenser, evaporator and throttle device. The control unit controls to open and close the throttle device to change the composition of the refrigerant circulating in the refrigerant circulation system.

7 Claims, 40 Drawing Sheets

--→ FOR REGENERATIVE OPERATION WHILE PERFORMING A COOLING OPERATION

→ FOR REGENERATIVE PROCESS

--→ FOR HEATING PROCESS

REFRIGERANT CIRCULATING SYSTEM

This application is a division of Ser. No. 08/681,488 filed Jul. 23, 1996, which is a continuation of Ser. No. 08/386,648 filed Feb. 10, 1995, now U.S. Pat. No. 5,654,322.

BACKGROUND OF THE INVENTION

1. Field of the Invention

The present invention relates to a refrigerant circulating system for a refrigerating and air conditioning system or the like using a refrigerant made of a nonazeotropic mixture including several types of refrigerants.

2. Description of the Conventional Art

FIG. 67 shows a conventional refrigerating and air conditioning system using a nonazeotropic refrigerant mixture including several types of refrigerants as disclosed, for example, in Examined Japanese Patent Publication No. Hei. 6-12201. In FIG. 67, a compressor 1, a heat exchanger 2 at the load side, the main throttle devices 3 and 4, and a heat exchanger 5 at the heat source side are connected by refrigerant pipings to form a main circuit for a refrigerating cycle. To the top part of the refrigerant rectifying column 8, a column-top storing tank 11 is connected by a refrigerant piping 17 and a refrigerant piping 18 with a refrigerant source 9 arranged thereon. A column-bottom storing tank 12 is connected to the bottom part of the above-mentioned refrigerant rectifying column 8 by a refrigerant piping 19 and a refrigerant piping 20 with a heating source 10 disposed thereon.

Between the heat exchanger 2 at the load side and the heat exchanger 6 at the heat source side, the column-top storing tank 11 is connected by a refrigerant piping 21 on which an opening/closing valve 15 is disposed, and the column-bottom storing tank 12 is connected by the refrigerant piping 22 on which an opening/closing valve 16 is disposed. To the upstream side of the heat exchanger 6 at the heat source side, the column-top storing tank 11 is connected by a refrigerant piping 23 having an auxiliary throttle device 5 and an opening/closing valve 13 disposed thereon, and the column-bottom storing tank 12 is connected by a refrigerant piping 24 having an auxiliary throttle device 5 and an opening/closing valve 14 disposed thereon. Then, a flow-out port from the column-top storing tank 11 to the refrigerant piping 23 is provided in the bottom area of the column-top storing tank 11, and a flow-out port from the column-bottom storing tank 12 to the refrigerant piping 24 is provided in the bottom area of the column-bottom storing tank 12.

In the construction described above, the vapor of the nonazeotropic mixed refrigerant (hereinafter referred to as "the refrigerant") at a high temperature and a high pressure as compressed by the compressor 1 flows in the direction of the arrow mark A, so as to be condensed by the heat exchanger at the load side to feed into the main throttle device 3. In a normal operation, the opening/closing valves 15 and 16 are kept closed, so that the refrigerant flows as it is into the main throttle device 4, and the refrigerant which has reached a low temperature and a low pressure is evaporated by the heat exchanger at the heat source side 6 and is fed back into the compressor 1.

In a case where the composition of the refrigerant flowing in this main circuit is to be changed, the opening/closing valves 13 and 15 are closed, and the opening/closing valves 14 and 16 are opened so that the composition of the refrigerant flowing in the main circuit is changed into a composition very rich in constituents at a high boiling point. Then, a part of the refrigerant flowing in the main circuit which has come out of the main throttle device 3 flows into the opening/closing valve 16 which is being kept open while the remainder of the refrigerant flows into the main throttle device 4 and flows in the same circuit as in the normal operation. On the other hand, the refrigerant which has flown into the opening/closing valve 16 enters the column-bottom storing tank 12. Some part of the refrigerant which has thus entered the column-bottom storing tank 12 flows into the auxiliary throttle device 5 via the opening/closing valve 14 which is being kept open and then flows together with the refrigerant flowing in the main circuit at the upstream side of the heat exchanger at the heat source side 6, and the remaining part of the refrigerant flows into a refrigerant piping 20 having the heating source 10 disposed thereon, where the refrigerant is heated and thereby turned into vapor, the refrigerant moving upward in the refrigerant rectifying column 8. At such a time, the refrigerant liquid stored in the column-top storing tank 11 moves downward in the refrigerant rectifying column 8 via refrigerant piping 17 so as to contact with the refrigerant vapor moving upward in the refrigerant rectifying column 8 to conduct a gas-liquid contact, thereby producing a rectifying effect as it is generally known.

In this manner, the refrigerant vapor becomes richer in constituents at low boiling points as it moves upward, and the refrigerant vapor is led into a refrigerant piping 18 having a cooling source 9 disposed thereon, where the refrigerant vapor is liquefied and stored in the column-top storing tank 11 since the opening/closing valve 13 is closed. Thus, the rectifying process just described is repeated until only the refrigerant very rich in constituents at low boiling points is stored in the column-top storing tank 11. Therefore, the composition of the refrigerant which flows in the main circuit is made very rich in constituents at a high boiling point.

On the other hand, to make the composition of the refrigerant flowing in the main circuit rich in constituents at low boiling points, the opening/closing valves 13 and 15 are kept open while the opening/closing valves 14 and 16 are kept closed. Then, a part of the refrigerant flowing in the main circuit which comes out of the main throttle device 3 flows into the column-top storing tank 11 via the opening/closing valve 15. However, since the opening/closing valve 13 also opens, a part of the refrigerant flowed into the column-top storing tank 11 flows together with the refrigerant flowing in the main circuit through the refrigerant piping 23 and the auxiliary throttle device 5. The remaining part of the refrigerant flows into the refrigerant rectifying column 8 by way of the refrigerant piping 17 and moves downward. At this time, a part of the refrigerant stored in the column-bottom storing tank 12 is heated by the heating source 10 so as to move upward in the refrigerant rectifying column 8, thereby getting into its gas-liquid contact with the refrigerant fluid moving downward in the same refrigerant rectifying column 8 and performing the rectifying process. In this manner, the downward-moving refrigerant liquid gradually become richer in constituents at a high boiling point, and, since the opening/closing valve 14 is closed, the refrigerant liquid is stored in the column-bottom storing tank 12. Then, as this rectifying process is repeated, only the refrigerant very rich in constituents at a high boiling point is stored in the column-bottom storing tank 12. Therefore, the composition of the refrigerant flowing in the main circuit is made very rich in constituents at low boiling points. Other techniques for circulating a nonazeotropic mixed refrigerant has been known to be taught, for example, in Examined Japanese Patent Publication Nos. Hei. 5-40221 and Japanese Patent Publication No. 4-23625.

In the conventional refrigerant circulating system for the refrigerating and air conditioning system described above, the rectified constituents are stored in the refrigerant rectifying column. Consequently, the conventional refrigerant circulating system can not cope with a sharp change of the pressure such as a time of a start-up of the compressor where the density of the refrigerant is not constant in the refrigerant circuit. In addition, the complicated structure and large size of the refrigerant rectifying column itself require a high cost.

Further, such a conventional refrigerating and air conditioning system does have no means for detecting or judging the composition of the refrigerant and cannot therefore be controlled in a manner suitable for its composition. Accordingly, it is not always to be possible to perform an efficient operation of the system. In addition, the conventional refrigerating and air conditioning system has to be controlled in very complicated operations.

SUMMARY OF THE INVENTION

It is an object of the present invention to provide a refrigerant circulating system making an adjustment of the composition of the refrigerant in the refrigerant circuit promptly at the time of not only a steady operation but also such an unsteady operation as a start-up of the system and operating with a composition adjusting mechanism in a simplified structure so as to realize a reduced cost for the refrigerant circulating system.

It is the other object of the present invention to provide a refrigerant circulating system which estimates the composition of the refrigerant circulating in the refrigerant circuit while the system is being operated and then making an appropriate change of the composition of the refrigerant. It is another object of the present invention to provide the refrigerant circulating system which performs a control suitable for the composition of the refrigerant in the operation.

In order to realize the above object, a refrigerant circulating system of the present invention using a refrigerant made of a nonazeotropic mixture including a plurality of types of refrigerants comprises: a refrigerant circuit having a compressor, a condenser, a throttle and an evaporator which are connected in order; and a bypass piping having an opening/closing mechanism, the bypass piping bypassing at least one of the compressor, the condenser, the first throttle device and the evaporator; wherein the opening/closing mechanism is opened and closed to adjust the composition of the refrigerant while the refrigerant is circulated in the refrigerant circuit.

Accordingly, the refrigerant circulating system of the present invention is capable of controlling the high pressure and the low pressure in the refrigerating cycle and always performing a very stable and highly efficient operation.

In order to realize the other object, a refrigerant circulating system of the present invention using a refrigerant made of a nonazeotropic mixture including a plurality of types of refrigerants; comprises: a compressor for compressing the refrigerant; a first heat exchanger for condensing the refrigerant during a cooling operation and evaporating the refrigerant during a heating operation; a main throttle device for changing pressure of the refrigerant flowing therethrough; a second heat exchanger for evaporating the refrigerant during a cooling operation and condensing the refrigerant during a heating operation; a low pressure receiver for storing a liquid refrigerant therein; and a control unit for controlling an opening degree of the main throttle device.

Accordingly, the refrigerant circulating system of the present invention is capable of control an opening and closing of the throttle device so as to adjust a composition of the refrigerant flowing in the refrigerant circulating system.

BRIEF DESCRIPTION OF THE DRAWINGS

In the accompanying drawings.

DETAILED DESCRIPTION OF THE PREFERRED EMBODIMENTS

The detailed description of the preferred embodiments of the present invention will be described referring to the accompany drawings as follows.

First Embodiment

Figure 1:
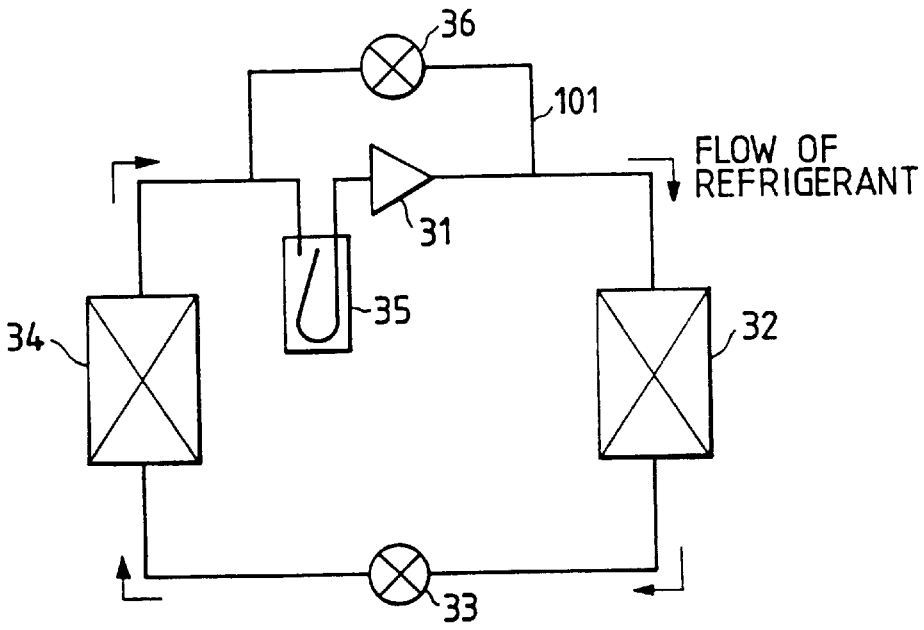
FIG. 1 is a refrigerant circuit diagram of a first embodiment of the present invention.

Now, a first embodiment of a system of the present invention will be described with reference to the accompanying drawings. FIG. 1 is a circuit diagram illustrating the refrigerant circuit in the basic system in the present invention. In FIG. 1, a compressor 31, a heat exchanger 32 at the heat source side, a throttle device 33, a heat exchanger 34 at the load side, and a low pressure receiver 35, are connected in the serial order to form the main circuit. In addition, a bypass pipe 101 bypasses the refrigerant from the discharge port side of the compressor 31 to the suction side of the low pressure receiver 35, and an opening/closing mechanism 36 is positioned above the bypass pipe 101. In addition, it should be noted that the heat exchanger 32 at the heat source side is to be a condenser in case of the cooling operation, and the heat exchanger 34 is to be an evaporator in case of the cooling operation. This is also applied to embodiments described later.

The refrigerant used for this refrigerant circulating system is a blend of hydrofluorocarbon refrigerants of HFC32, HFC125, and HFC124a or an azeotropic mixed refrigerant including a mixture of HFC23, HFC25, and HFC52.

As illustrated in FIG. 1, the refrigerant discharged from the compressor flows into the heat exchanger at the heat source side, the throttle device, and the heat exchanger at the load side and is then sucked into the compressor. On the other hand, the opening/closing mechanism 36 is opened at the time of a start-up of the compressor so that the refrigerant gas discharged from the compressor is introduced into the low pressure receiver. The refrigerant liquid often remains in a stagnant residual state in the low pressure receiver due to the effect of the thermal capacity. Therefore, the gas component of the refrigerant in the low pressure receiver is rich in constituents at a low boiling point while the liquid constituent of the refrigerant in it is rich in constituents at a high boiling point. At the time of a start-up, the compressor sucks the gas component rich in constituents at a low boiling point, and, consequently, the discharge pressure of the compressor rises sharply. However, a part of discharged gas at a high temperature discharged from the compressor is fed to return to the suction side of the low pressure receiver so as to evaporate the liquid component rich in refrigerant constituents at a high boiling point. As a result, the component of refrigerant sucked into the compressor is regulated to suppress the rise of the pressure.

In FIG. 1, the discharged gas is blown into the low pressure receiver through a bypass pipe connected to the low pressure piping disposed between the low pressure receiver 35 and the heat exchanger 34 at the load side (i.e., an evaporator). In addition, the discharge gas is blown into any area where the refrigerant liquid of the low pressure region possibly remain in a stagnant residual state so that a similar effect can be produced in such a case.

Moreover, in the above case, the opening/closing mechanism 36 is opened at the time of a start-up of the compressor, and yet the opening/closing mechanism may be opened when there is any condition that necessitates any adjustment of the composition of the refrigerant, for example, a detection of a physical quantity, such as a decline in the capacity of the system, or for every predetermined time.

Second Embodiment

Figure 2:
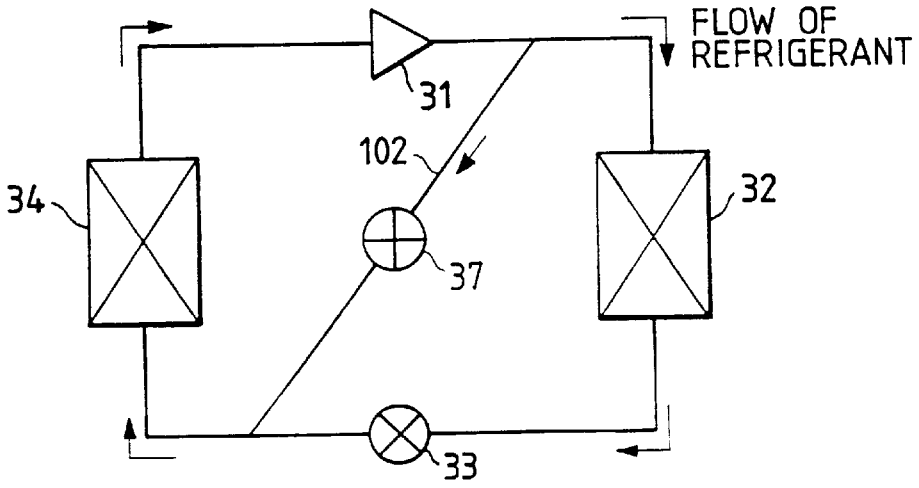
FIG. 2 is a refrigerant circuit diagram of a second embodiment of the present invention.

A second embodiment of a system of the present invention will be described with reference to FIG. 2 as follows. It is noted that those component parts or units shown in FIG. 2 which are identical to those shown in FIG. 1 are merely indicated by the same reference numbers, and their description is omitted. As shown in FIG. 2, in the component elements used in the first embodiment shown in FIG. 1, the refrigerant circulating system is provided with a bypass pipe 102 for connecting the discharge side of the compressor 31 to the outlet port of the main throttle device 33, and an opening/closing mechanism 37 positioned on the bypass pipe. Further, the bypass pipe 101 and the opening/closing mechanism 36 may be eliminated from the refrigerant circulating system, or may be left as they are.

The refrigerant flows in the manner illustrated in FIG. 2. On the other hand, at the time of a start-up of the compressor 31, the opening/closing mechanism 37 is opened so that the refrigerant gas discharged from the compressor 31 is introduced into the inlet port of the heat exchanger 34 at the load side. The refrigerant liquid often remains in a stagnant residual state in the heat exchanger 34 at the load side owing to the effect of the thermal capacity thereof, the liquid component being rich in constituents at a high boiling point. When the compressor is started, its discharge pressure rises sharply because the compressor 31 sucks the gas rich in constituents at a low boiling point. However, a part of the discharge gas at a high temperature is bypassed to the heat exchanger 34 at the load side so that the liquid component rich in refrigerant constituents at a high boiling point is evaporated to regulate the component of the refrigerant sucked into the compressor 31 to suppress the raise of the high pressure.

In FIG. 2, the bypass pipe is connected to a piping between the inlet port of the heat exchanger 32 at the load side and the outlet port of the main throttle device 33. However, in addition to this bypass pipe, if one or more other bypass pipes such as the bypass pipe as indicated in FIG. 1 which connect positions different from positions connected by the bypass of the embodiment is provided, hot gas can flow to the whole area where the refrigerant is easy to be in a stagnant residual state. Accordingly, it is possible to reduce the period until the component of the refrigerant become a constant state.

Moreover, if the room temperature declines when the system is stopped, the heat exchange region and the header of the heat exchanger is filled up with the liquid.

Further, the opening/closing mechanism (36 in FIG. 1 and 37 in FIG. 2) is opened at the time of an adjustment of the composition of the refrigerant or at the time of a start-up of the system, and yet the period of time when the opening/closing mechanism is kept open is detected to close the mechanism after the elapse of a few minutes. Since the refrigerant merely flows during a predetermined period, the system can prevent a loss of its capability due to the bypassing of the refrigerant in its steady-state operation in which the opening/closing mechanism kept closed.

In this regard, the opening/closing mechanism may be closed not only by detecting the period when it is kept open, but also after detecting a change in the temperature or a change in the pressure, for example, such as after a decline or exhaustion of the liquid level in the low pressure receiver, after an increase of superheating at the inlet port of the compressor, or after the stop of the increment of the high pressure.

Namely, when the refrigerant circulating system detects that the composition of the refrigerant become in constant or the refrigerant liquid is not in any stagnant state, the system closes the opening/closing mechanism to restore to its normal operation state.

Moreover, the description of the embodiments shown in FIGS. 1 and 2 is applied to a refrigerating circuit, but it also can be applied to a heating circuit. As described above, if any predetermined physical quantity fails to attain a given value, this system opens and closes the opening/closing mechanism as described above, thereby ensuring that the opening and closing timing is appropriate and thus enabling itself to perform its highly efficient operation.

Third Embodiment

Figure 3:
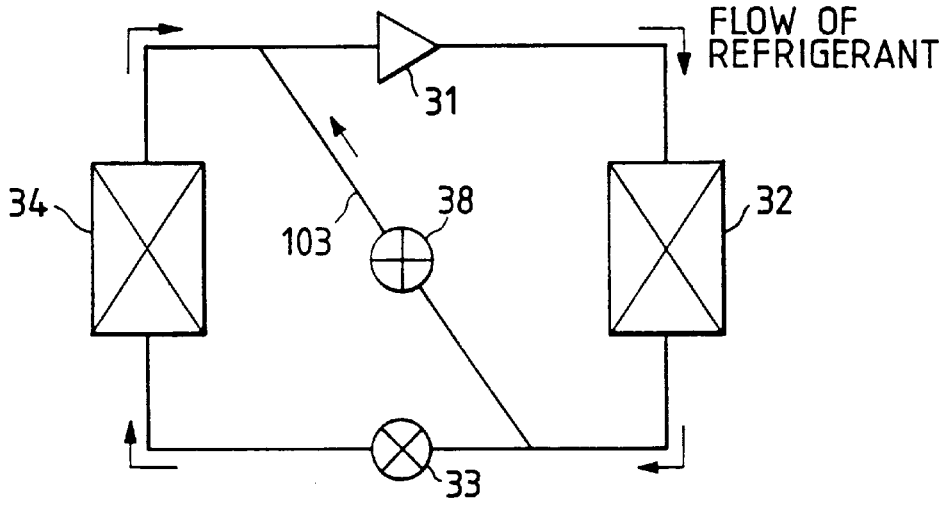
FIG. 3 is a refrigerant circuit diagram of a third embodiment of the present invention.

A third embodiment of a system of the present will be described with reference to FIG. 3 as follows. In FIG. 3, moreover, those component of parts or units in this embodiment which are identical to those described with respect to the first embodiment are indicated with the same reference numbers assigned to them, and their description is omitted. As illustrated in FIG. 3, this refrigerant circulating system includes a bypass pipe 103 which forms a bypass leading from the outlet port side of the heat exchanger 32 at the heat source side and the inlet port side of the compressor 31, and an opening/closing mechanism 38 positioned one the bypass pipe.

The refrigerant flows as indicated in FIG. 3. The system opens the opening/closing mechanism 38 when the compressor is started so as to introduce an uncondensed refrigerant gas rich in constituents at a low boiling point at the outlet port of the condenser 32 into the inlet port of the compressor and thereby inhibiting the pressure to decline to a level below the atmospheric pressure in the inlet port of the compressor and thus preventing the compressor from being damaged.

Moreover, this construction is effective for a heating operation, especially, when the outside air is at a very low temperature.

Fourth Embodiment

Figure 4:
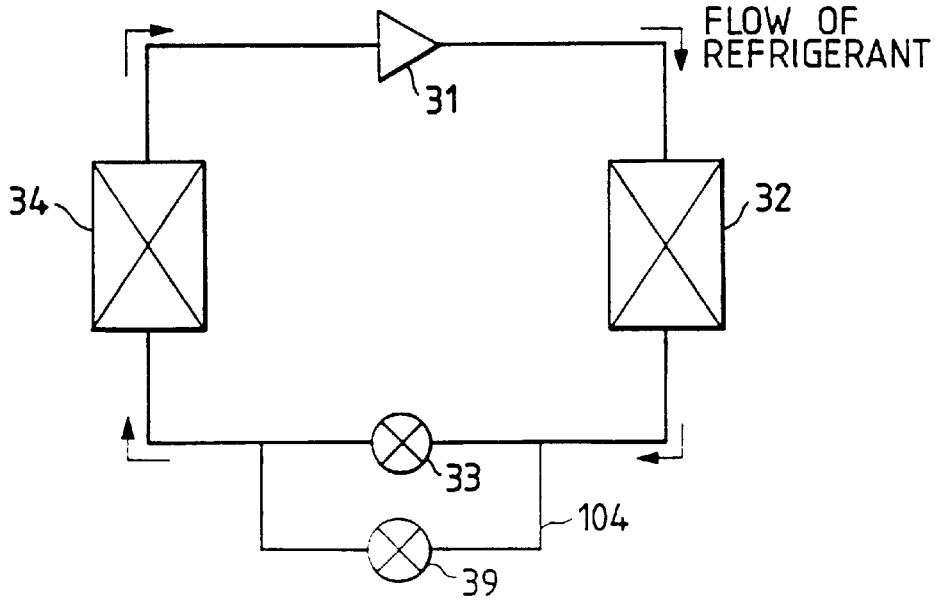
FIG. 4 is a refrigerant circuit diagram of a fourth embodiment of the present invention.

A fourth embodiment of a system of the present invention will be described with reference to FIG. 4 as follows. In this regard, it is to be noted that those component parts or units which are identical to those used in the first embodiment are indicated with the same reference numbers, and a description of those identical parts or units is omitted. As shown in FIG. 4, in this embodiment, the refrigerant circulating system in this example includes a bypass pipe 104 which connects the outlet port side of the heat exchanger 32 at the heat source side and connected to the inlet port of the heat exchanger 34 at the load side with bypassing the main throttle device, and an opening/closing mechanism 39 positioned on the bypass pipe.

The refrigerant flows in the manner illustrated in FIG. 4. The system opens the opening/closing mechanism 39 when the compressor is started so as to reduce the difference between the high pressure and the low pressure, thereby increasing the quantity of the refrigerant in circulation. Therefore, the system suppresses a rise of the high pressure at the time of the start-up and rapidly form a unified distribution of density of the refrigerant in the refrigerant circuit, so that the system can perform stable control of the refrigerating cycle from the start-up time.

In this regard, this construction is effective when the system performs a cooling process and particularly when the system is to be started again in approximately three minutes.

Further, the position of the throttle device is changed when the high pressure receiver (not illustrated) is used, but there is no difference between a cooling process and a heating process.

As a result, this system is capable of improving the stability of the refrigerating cycle by opening the opening/closing mechanism at the time of its start-up.

The reason why the bypass is formed so as to start from the outlet port of the condenser 32 but not to start from the downstream of the outlet port of the throttle device is that the refrigerant otherwise is formed in a dual-phase state at a low pressure and that it is therefore hard for the system to produce any sufficient differential pressure, so that the refrigerant in the bypass does not flow smoothly enough.

The opening/closing mechanism 39 shown in FIG. 4 may be fully opened, but, as a large quantity of the refrigerant flows back if the quantity of the refrigerant flowing in the bypass is excessive, and it is therefore necessary to form the bypass pipe so as to have a throttling function to some extent.

According to the construction formed in the manner described above, a uniform distribution of the refrigerant is attained in a short time with a large quantity of the refrigerant in circulation so as to dissolve an ununity distribution of density of the refrigerant in the refrigerant circuit to form a uniform composition of the refrigerant.

Fifth Embodiment

Figure 5:
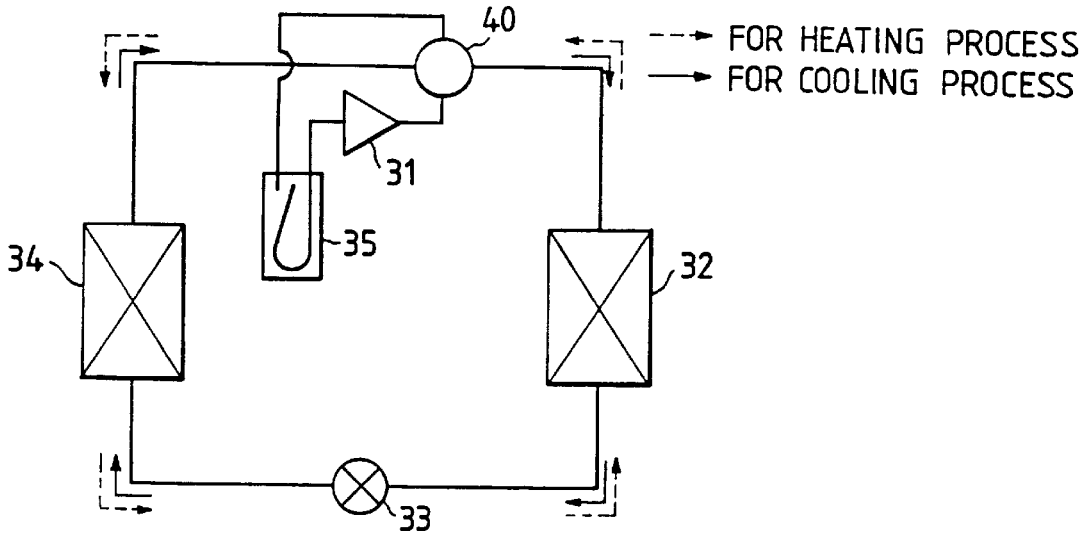
FIG. 5 is a refrigerant circuit diagram of a fifth embodiment of the present invention.

FIG. 5 is a refrigerant circuit diagram illustrating a system of the refrigerant circulating system according to the present invention. In FIG. 5, a compressor 31, a four-way valve 40, a heat exchanger 32 at the heat source side, a main throttle device 33, a heat exchanger 34 at the load side, and a low pressure receiver 35 are connected in the serial order by the refrigerant piping to form a main circuit.

The flows of the refrigerant for a heating process and a cooling process are respectively shown in FIG. 5. The refrigerant is filled in advance in such a manner that a surplus quantity of the refrigerant is held in the low pressure receiver, and the degree of supercooling at the outlet port of the heat exchanger 32 at the heat source side is changed in accordance with the load. When the load is heavy, the degree of supercooling at the heat exchanger outlet port of the heat exchanger 32 at the heat source side is slightly smaller so that the refrigerant circulating system is operated so as to store a surplus quantity of the refrigerant in the low pressure receiver. The surplus liquid refrigerant which is thus stored in the low pressure receiver is rich in constituents at a high boiling point, and therefore the refrigerant circulated in the main circuit is in a refrigerant composition rich in constituents at a low boiling point. For this reason, the density of the refrigerant which is sucked into the compressor is increased, and the quantity of the refrigerant in being circulated is thereby increased, so that the capacity of this refrigerant circulating system is increased.

When the load is light, the degree of superheating at the heat exchanger outlet port of the heat exchanger at the heat source side is kept in a slightly larger so that the surplus refrigerant is moved out of the low pressure receiver to the heat exchanger or the refrigerant piping, and the system reduces the quantity of the refrigerant being circulated by performing an operation for not storing the surplus refrigerant in the low pressure receiver, thereby reducing its capacity.

A change in the degree of superheating is effected, for example, by changing the degree of opening of the throttle device in accordance with data on the basis of the temperature and pressure in the low pressure receiver. Here, the expression, "the load is heavy," means that the air condition (DB/KB) is high, and the expression, "the load is light," means that the air condition is low. Further, the degree of supercooling is defined herein as the difference between the saturated liquid temperature at the pressure of the outlet port of the condenser and the temperature of the refrigerant at the outlet port of the condenser, but, since the saturated liquid temperature mentioned above depends on the composition of the refrigerant, it is necessary to estimate the saturated liquid temperature in advance by a sensing operation, i.e., on the basis of the pressure and temperature in the low pressure receiver mentioned above.

The reason why there occurs a difference between the filled composition (i.e., the composition of the refrigerant filled in the unit) and the circulated composition (i.e., the composition of the refrigerant circulated in the system when the unit is kept in operation) is that a slip occurs between the gas and the liquid in the gas-liquid dual-phase line, which means that the R32 rich gas is higher in speed than the R134a rich liquid. Accordingly, the R134a is in a state close to being stagnant on the spot. The extreme limit to it is the low pressure receiver (i.e., an accumulator).

With the refrigerant liquid thus stored in the low pressure receiver, the system regulates the quantity of the refrigerant including constituents at a high boiling point flowing through the refrigerant circuit, thereby making an adjustment of the capacity of the system in a manner suitable for the load.

The expression, "capacity," denotes the quantity of heat exchanged in the heat exchanger. When the liquid refrigerant in a surplus quantity is stored in the low pressure receiver, liquid refrigerant rich in constituents at a high boiling point is stored there, so that the refrigerant rich in constituents at a low boiling point flows in the refrigerant circuit in the main line. Accordingly, it is possible to change the composition of the refrigerant which flows in the main refrigerant circuit by controlling the quantity of the refrigerant stored in the low pressure receiver.

Further, the throttle is throttled to change the liquid level in the receiver, whereby the refrigerant moves from the receiver to the condenser.

Moreover, the surplus liquid refrigerant is rich in its constituents at a high boiling point, and, provided that the composition of the refrigerant in circulation becomes rich in constituents at a low boiling point, the density of the refrigerant gas which is sucked into the compressor will be increased, and the quantity of the refrigerant in circulation is thereby increased.

Sixth Embodiment

Figure 6:
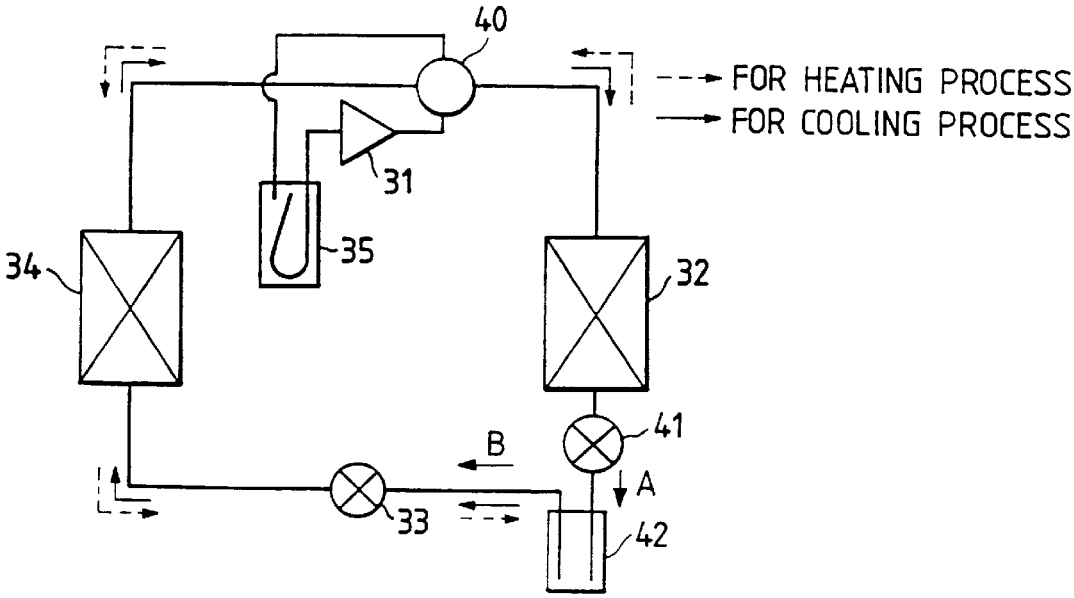
FIG. 6 is a refrigerant circuit diagram of a sixth embodiment of the present invention.

FIG. 6 is a refrigerant circuit diagram showing a basic system according to the present invention. Now, those component parts or units in FIG. 6 which are identical to those described in the fifth example of preferred embodiment as illustrated in FIG. 5 are indicated with the same reference numbers assigned to them, and a description of those parts are omitted here. In addition to the component elements in the fifth embodiment illustrated in FIG. 5, an auxiliary throttle device 41 and a high pressure receiver 42 are newly provided. The auxiliary throttle device 41 and the high pressure receiver 42 are connected between the heat exchanger at the heat source side and the high pressure receiver 42.

The refrigerant flows in the manner indicated in FIG. 6. The refrigerant is filled in advance in such a manner that a surplus quantity of the refrigerant is stored in the low pressure receiver 35 or in the high pressure receiver 42. In case the system performs a cooling operation, the refrigerant gas discharged out of the compressor 31 passes through a four-way valve 40 and condensed into liquid refrigerant in the heat exchanger 32 at the heat source side. Thereafter, the liquid refrigerant is slightly reduced in its circulated quantity by the auxiliary throttle device 41 and is fed into the high pressure receiver 42. The liquid refrigerant which is passed through the high pressure receiver 42 is reduced in its circulated quantity to a low pressure and is then evaporated in the heat exchanger 34 at the load side, then being fed back into the compressor via the four-way valve 40 and the low pressure receiver 35. When the liquid refrigerant is to be stored in the high pressure receiver, the system is controlled so as to keep the degree of superheating constant at a certain level at the outlet port of the evaporator. On the other hand, when the liquid refrigerant is to be stored in the low pressure receiver, the system is operated to control so as to keep the degree of supercooling constant at a certain level at the outlet port of the condenser.

In order to control so as to keep the degree of superheating constant at a certain level at the outlet port of the evaporator, for example, the degree of opening of the throttle device is changed so that the temperature difference is kept constant at a certain level at the outlet port of the evaporator.

In order to control so as to keep the degree of supercooling constant at a certain level at the outlet port of the condenser, for example, the angle of the throttle is changed so that the difference between the temperature in the center of the condenser and the temperature at its outlet port is constant.

When the air temperature is high, the cooling process load is heavy.

When the load is light, the auxiliary throttle device 41 is reduced so tightly that the refrigerant is in a dual-phase state at the outlet port of the auxiliary throttle device 41, the liquid refrigerant is not stored in the high pressure receiver 42, but the liquid refrigerant is moved into the low pressure receiver 35. Consequently, the liquid refrigerant rich in constituents at a high boiling point is stored in the low pressure receiver 35, whereby the refrigerant circulated in the main circuit is rich in constituents at a low boiling point. Therefore, the density of the refrigerant sucked into the compressor 31 is increased, so that the quantity of the refrigerant being circulated is increased and the capacity of the refrigerant circulating system is increased.

Namely, the tight construction of the auxiliary throttle device 41 for making the refrigerant flowing to the high pressure receiver 42 be in the dual-phase state and the movement of the liquid from the high pressure receiver 42 to the low pressure receiver 35 affect to drain the liquid refrigerant form the high pressure receiver 42.

When the load is heavy, the main throttle device 33 is tightly reduced so as to move the liquid refrigerant from the low pressure receiver 35 to the high pressure receiver 42 so that the composition of the refrigerant is come near that of the filled refrigerant, thereby reducing the capacity.

Moreover, when the outside air is at a low temperature when the refrigerant circulating system is performing a heating process, then it is possible for the system to suppress a decline in the low pressure by storing the liquid refrigerant in the low pressure receiver even if the low pressure declines.

Also in the case of a heating process, the refrigerant circulating system can adjust its capacity with the liquid refrigerant stored in the high pressure receiver 42 and in the low pressure receiver 35 in accordance with the load.

With the refrigerant liquid stored in the low pressure receiver in this manner, the refrigerant circulating system is capable of adjusting the quantity of the constituents at a high boiling point in the refrigerant flowing in the refrigerant circuit so as to adjust the capacity of the system in accordance with a load.

With some surplus quantity of the refrigerant liquid stored in the high pressure receiver, the quantity of the change in the composition of the refrigerant flowing in the refrigerant circuit can be reduced, and the system can perform stable control over the refrigerating cycle.

Further, with the operation of the main throttle device and the auxiliary throttle device, this system can make an adjustment of the composition of the refrigerant in the high pressure receiver in a simple manner through utilization of the individual receivers. This means that the system can make an adjustment of the quantity of the refrigerant in the high pressure receiver by using the individual receivers with the operations of the main throttle device and the auxiliary throttle device in the course of the operation of the refrigerant circulating system. This means that the system has the capability of making an adjustment of the quantity of the refrigerant in the high pressure receiver by an operation of the throttle device. That is to say, the system controls the degree of opening of the throttle device so that the degree of superheating of the refrigerant at the outlet of the evaporator is constant at a certain level.

When the load is heavy (i.e., when the air temperature is high), since the refrigerant entering the receiver as indicated by the arrow A in FIG. 6 is in the state of dual phases and the refrigerant flowing out of the receiver as indicated by the arrow B is in a saturated state, the refrigerant flows out in a single phase. Therefore, the quantity of the refrigerant taken out of the receiver 42 is increased so that the level of the refrigerant fluid in the receiver 42 is lowered.

When the load is light (i.e., the air temperature is low), if the throttle device 33 is reduced so that the liquid refrigerant in the single phase entering the receiver 42 indicated by the arrow A is overcooled, the liquid refrigerant in a supercooled state as it enters the receiver 42 condenses the gas refrigerant in the inside of the receiver while the liquid refrigerant turns itself into a saturated single-phase liquid refrigerant and is taken out of the receiver as indicated by the arrow B.

Therefore, the liquid refrigerant in the receiver increased by the amount of the gas thus condensed in the inside of the receiver.

Moreover, the heat exchanger is formed to perform the function of a liquid tank in the construction illustrated in FIG. 4. However, it is possible to achieve a remarkable increase of the adjusted quantity with a receiver provided at the high pressure side.

Further, when the load is heavy in heating process, the main throttle device 33 is reduced so as to form a state in which the above-mentioned load is heavy, and reduce the liquid refrigerant in the high pressure receiver 42. When the load is light on the contrary, the system can develop a state in which the above-mentioned load is light by tightly reducing the auxiliary throttle device 41.

As described above, the high pressure receiver is disposed at the outlet side of the condenser so as to store the liquid refrigerant condensed by the condenser. This liquid refrigerant is in the state of a single liquid phase, with the entire circulated refrigerant being condensed, the composition of the liquid refrigerant is quite similar to that of the circulated refrigerant, and it is thus different from the case in which the surplus refrigerant is stored in the low pressure receiver.

Further, with providing the auxiliary throttle device to the system, it is possible to position the high pressure receiver on the high pressure liquid line for the heating and cooling process. With a means of changing the pressure being thus provided between the condenser and the high pressure receiver, this refrigerant circulating system can change the degree of dryness of the refrigerant flowing into the high pressure receiver and can control the surface level of the refrigerant in the high pressure receiver in a simple and easy manner.

The control procedure described above performs control on the degree of superheating at the outlet port of the condenser by means of the throttle device disposed at the upstream side out of the two-stage throttle devices provided in the system. When the high pressure rises (for example, the high pressure exceeds 25 kgf/cm$^2$ G), this system reduces the value for the degree of the supercooling at the outlet port of the condenser. The throttle device disposed at the downstream side is controlled by a difference in temperature at the inlet and outlet ports of the evaporator.

If the low pressure declines, the system performs the supercooling control at the upstream side while keeping the throttle device at the downstream side fully opened.

As the result of these operations, the constituents at a low boiling point is stored in a large quantity in the low pressure receiver.

In such a case, since the pressure of the refrigerant circuit increases to narrow the operating range becomes, the system perform control first at the high pressure receiver side.

Seventh Embodiment

Figure 7:
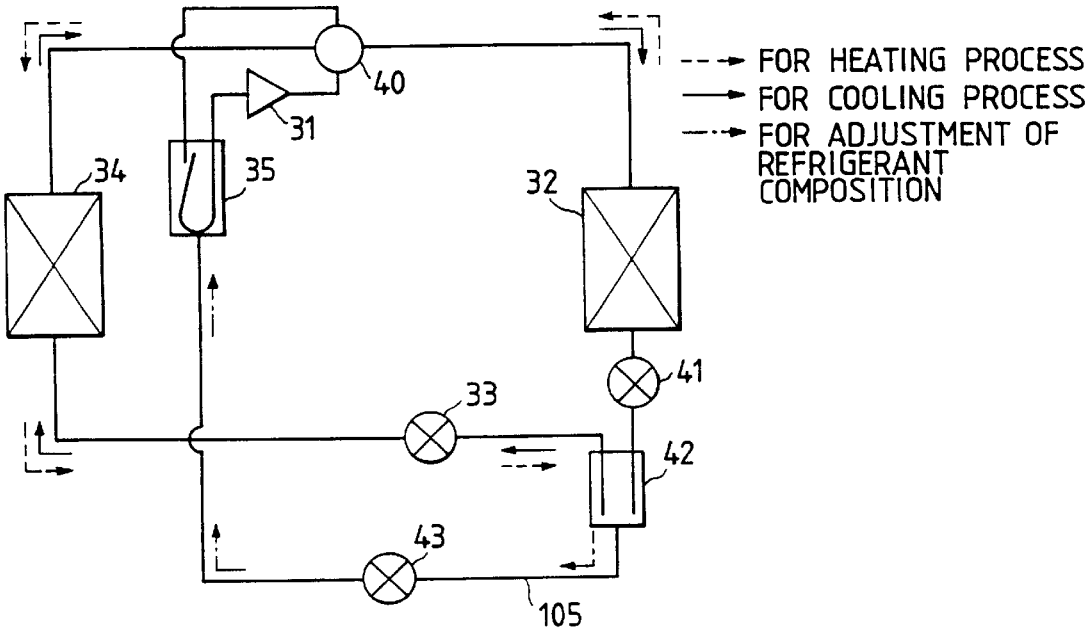
FIG. 7 is a refrigerant circuit diagram of a seventh embodiment of the present invention.

FIG. 7 is a refrigerant circuit diagram showing a basic system according to the present invention. In FIG. 7, those component parts or units shown therein and are identical to those which are described in the sixth embodiment are indicated with the same reference numbers assigned to them, and their descriptions are omitted. In addition to the component elements of the sixth embodiment in FIG. 6, this refrigerant circulating system includes a bypass pipe 105 from the bottom area of the high pressure receiver 42 and leads to the low pressure receiver 35 and an opening/closing mechanism 43 being disposed on the way of the bypass pipe 105.

The refrigerant flows in the manner illustrated in FIG. 7. The surplus refrigerant is stored in advance in a low pressure receiver 35 or in a high pressure receiver 42. In a cooling process, the refrigerant gas discharged from the compressor 32 passes through a four-way valve 40 so as to be condensed into liquid refrigerant in a heat exchanger 32 at the heat source side. Then, the refrigerant is reduced somewhat by an auxiliary throttle device 41 to be fed into a high pressure receiver 42. The liquid refrigerant which has passed through the high pressure receiver 42 is then reduced in the main throttle device 33 so as to be reduced to a low pressure which is vapored in the heat exchanger 34 at the load side, and is fed back to the compressor 31 via the four-way valve 40 and the low pressure receiver 35.

When the load is heavy and the frequency of the compressor 31 is high, the opening/closing mechanism 43 is opened and the auxiliary throttle device 41 is reduced tightly so that the liquid refrigerant in the high pressure receiver 42 is passed through the bypass pipe 105 to be moved into the low pressure receiver 35. If the refrigerant is not in a dual-phase state at the outlet port of the auxiliary throttle device 41, the liquid refrigerant is not stored in the high pressure receiver 42, and the liquid refrigerant is thereby secured in the low pressure receiver 35. Consequently, since refrigerant liquid rich in constituents at a high boiling point is stored in the low pressure receiver 35, the refrigerant being circulated in the main circuit is refrigerant rich in constituents at a low boiling point. Therefore, the density of the refrigerant sucked into the compressor 31 is increased, so that the quantity of the refrigerant kept in circulation is increased, and the capacity of the refrigerant circulating system is thereby increased.

When the load is light and the frequency of the compressor 31 is low, the main throttle 33 is reduced tightly and the liquid refrigerant is moved from the low pressure receiver 35 to the high pressure receiver 42, so that the composition of the refrigerant is thereby made more similar to the composition of the filled refrigerant. Accordingly, it is possible to reduce the capacity of the refrigerant circulating system.

Also in a heating process, it is possible for the refrigerant circulating system to adjust its capacity by storing the liquid refrigerant in the high pressure receiver 42 or in the low pressure receiver 35 in a manner suitable for the load.

As described above, this refrigerating and air conditioning system is capable of making a prompt adjustment of the quantity of the constituents at a high boiling point flowing in the refrigerant circuit, thereby adjusting the capacity in a manner suitable for the load, by adjusting the quantities of the liquid refrigerant stored in the low pressure receiver and the high pressure receiver by means of the bypass pipe which connects the low pressure receiver and the high pressure receiver.

Thus, the refrigerant circulating system in this embodiment is capable of stabilizing the refrigerating cycle by making a prompt adjustment of the composition of the refrigerant with a bypass pipe provided in the manner described above.

Eighth Embodiment

Figure 8:
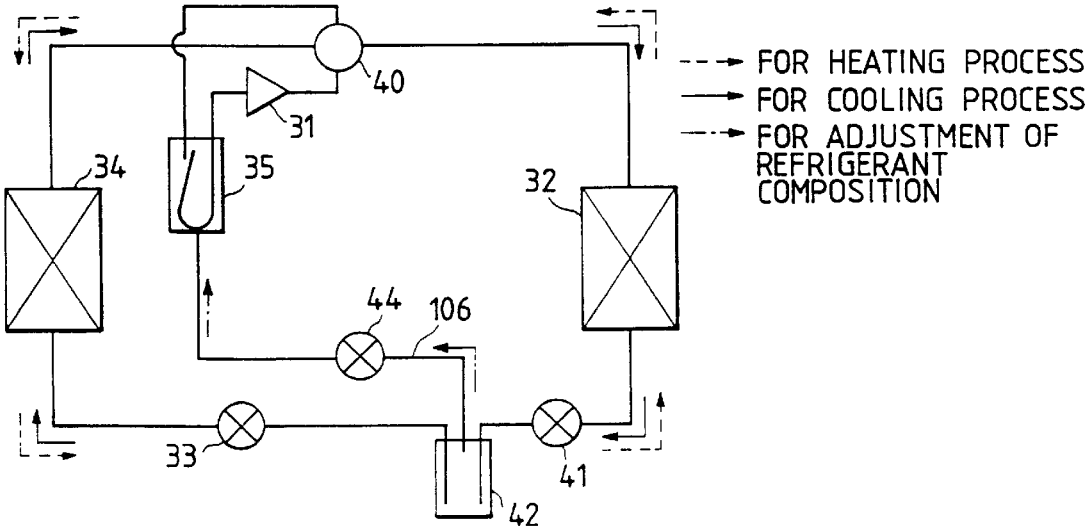
FIG. 8 is a refrigerant circuit diagram of a eighth embodiment of the present invention.

FIG. 8 presents a refrigerant circuit diagram showing a basic system according to the present invention. In FIG. 8, the same reference numbers are assigned to those component parts or units in this example which are the same as those used in the sixth example of embodiment, and their description is omitted. In addition to the component elements described in the sixth embodiment shown in FIG. 6, the construction of the refrigerant circulating system in this embodiment includes a bypass pipe 106 from the upper part of the high pressure receiver 42 to the low pressure receiver and an opening/closing mechanism 44 disposed in the way of the bypass pipe.

The refrigerant is filled in advance so that surplus refrigerant is stored in a low pressure receiver 35 or a high pressure receiver 42. In a cooling process, the refrigerant gas discharged from a compressor 31 passes through a four-way valve 40 and is then condensed into liquid refrigerant in a heat exchanger 32 at the heat source side. Then, the liquid refrigerant is reduced somewhat in an auxiliary throttle device 41 and is thereafter fed into the high pressure receiver. The liquid refrigerant which has passed through the high pressure receiver is reduced to a low pressure in the main throttle device 33 to be evaporated in a heat exchanger 34 at the load side, and is then fed back to the compressor 31 via the four-way valve 40 and the low pressure receiver 35.

In the course of the operation, the refrigerant circulating system opens an opening/closing mechanism 44 and conducts yet uncondensed gas rich in constituents at a high boiling point into the low pressure receiver as illustrated in FIG. 8, thereby suppressing a decline in the pressure for the suction of the refrigerant into the compressor in case the low pressure is low when the outside air is at a low temperature while the system is performing a heating process.

Ninth Embodiment

The ninth embodiment of a system of the present invention is described with reference to FIG. 9 as follows. In the drawing, a compressor 31, a four-way valve 40, a heat exchanger 32 at the heat source side, an auxiliary throttle device 41, a high pressure receiver 42, a main throttle device 33, a heat exchanger 34 at the load side, and a low pressure receiver 35 are connected in the serial sequence and thus formed into a main circuit. An opening/closing mechanisms 47 and 48 opens and closes the inlet port and outlet port of the high pressure receiver. Further, a first bypass pipe 107 is lead from the high pressure receiver 42 to the low pressure receiver 35, and an opening/closing mechanism 45 is disposed on the first bypass pipe 105. A second bypass pipe 108 which bypasses the high pressure receiver 42 and the opening/closing mechanisms 47 and 48, and an opening/closing mechanism 46 is disposed on the second bypass line mentioned above.

Figure 9:
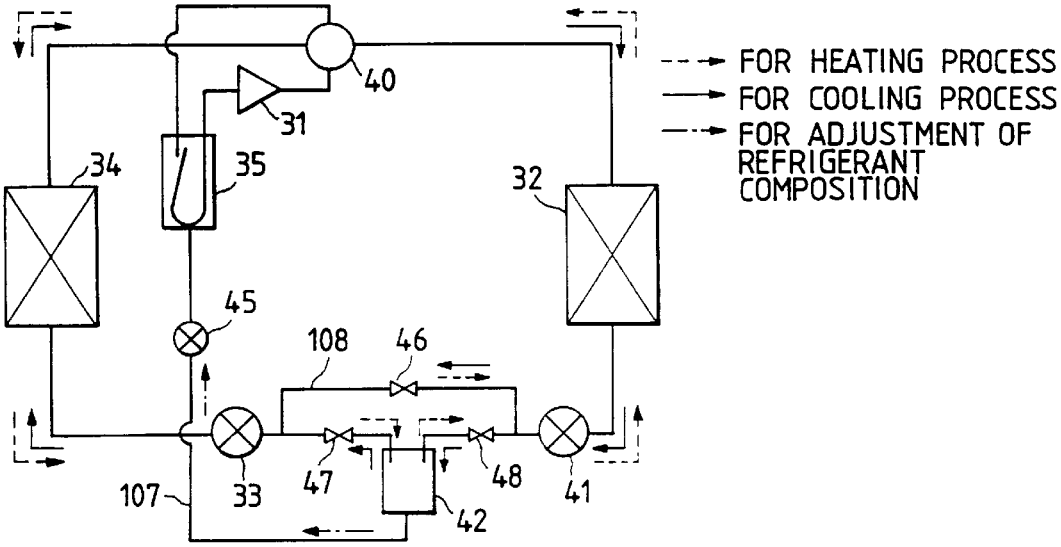
FIG. 9 is a refrigerant circuit diagram of a ninth embodiment of the present invention.

The refrigerant flows in the manner shown in FIG. 9. A surplus refrigerant is stored in the low pressure receiver 35 or in the high pressure receiver 42. In a cooling process, the refrigerant gas discharged from the compressor 31 passes through the four-way valve 40 and is then condensed into liquid refrigerant in the heat exchanger 32 at the heat source side. Thereafter, the liquid refrigerant, which is then reduced somewhat in the auxiliary throttle device 41, is fed into the high pressure receiver. The liquid refrigerant which has passed through the high pressure receiver is reduced to a low level in the main throttle device 33, is evaporated by the heat exchanger at the load side, and is then fed back to the compressor through the four-way valve 40 and the low pressure receiver 35.

When the load is heavy, the opening/closing mechanism 45 is opened while tightly reducing the auxiliary throttle device so as to move the liquid refrigerant in the high pressure receiver 42 into the low pressure receiver via the bypass pipe 107. If the refrigerant is in a dual-phase state at the outlet port of the auxiliary throttle device 41, the liquid refrigerant is not stored in the high pressure receiver, but the liquid refrigerant is stored in the low pressure receiver 35. The liquid refrigerant held in the low pressure receiver 35 is different in composition from the refrigerant circulated in the main circuit, which is a refrigerant rich in constituents at a high boiling point. This refrigerant circulating system closes the opening/closing mechanisms 47 and 48 and opens the opening/closing mechanism 46 after detecting a state in which the liquid refrigerant is secured in the low pressure receiver 35, so that the refrigerant bypasses the high pressure receiver 42 and thereby always maintaining the distribution of refrigerant constant in the refrigerant circuit, and the refrigerant circulating system thus stabilizes its operation.

In order to detect the state of the liquid refrigerant as stored in the receivers, the refrigerant circulating system offers such methods as operating a liquid surface level detecting circuit, thereby applying a certain predetermined quantity of heat to the outer wall of the accumulator and detecting a rise in the temperature and comparing the heated positions, or detecting the composition of the refrigerant in circulation as described later, thereby finding the quantity of the refrigerant in the receiver.

When the load is light, the refrigerant circulating system opens the opening/closing mechanisms 47 and 48 and closes the opening/closing mechanism 46, tightly reducing the main throttle device 33 and thereby turning the state of the refrigerant into a liquid state, so that liquid refrigerant is stored in the high pressure receiver 42. In the state with the liquid refrigerant thus stored in the high pressure receiver 42, the refrigerant circulating system closes the opening/closing mechanisms 47 and 48 and opens the opening/closing mechanism 46, thereby maintaining the state in which the liquid refrigerant is stored in the high pressure receiver 42. At this moment, the composition of the liquid refrigerant which is thus stored in the high pressure receiver is closely similar to that of the refrigerant which is formed when the refrigerant is filled up in the refrigerant circuit, and also that of the refrigerant circulated in the refrigerant circuit is closely similar to that of the refrigerant filled up in the refrigerant circuit.

In a heating process, the refrigerant gas discharged from the compressor 32 passes through the four-way valve 40 so as to be condensed into liquid refrigerant in the heat exchanger 34 at the load side. Then, the liquid refrigerant is slightly reduced in the main throttle device 33 to be into the high pressure receiver. The liquid refrigerant which has passed through the high pressure receiver 42 is then reduced by the auxiliary throttle device 41 and evaporated by the heat exchanger 32 at the heat source side, thereby being fed back to the compressor 31 via the four-way valve 40 and the low pressure receiver 35.

If the load is heavy, the open/closing mechanism 45 is opened and the main throttle device 33 is tightly reduced so that the liquid refrigerant stored in the high pressure receiver 42 is moved to the low pressure receiver 35 through the bypass pipe 107. If the refrigerant is in a dual-phase state at the outlet port of the main throttle device 33, the liquid refrigerant is not accumulated in the high pressure receiver, but held in the low pressure receiver 35. The liquid refrigerant thus held in the low pressure receiver 35 is refrigerant rich in constituents at a high boiling point and thus has a composition different from that of the refrigerant circulated in the main circuit. After an adequate quantity of the refrigerant is moved into the low pressure receiver 35, the opening/closing mechanisms 47 and 48 are closed and the opening/closing mechanism 46 is opened so that the refrigerant bypasses the high pressure receiver 42. As a result, this refrigerant circulating system always keeps the distribution of the refrigerant constant in the refrigerant circuit, thereby stabilizing its operations.

If the load is light, the opening/closing mechanisms 47 and 48 are opened while the refrigerant circulating system 46 is closed and the auxiliary throttle device 41 is tightly reduced, so as to turn the refrigerant into a liquid state at the outlet port of the heat exchanger 32 at the load side, the heat exchanger working as a condenser, thereby storing the liquid refrigerant in the high pressure receiver 42. The opening/closing mechanisms 47 and 48 is closed and the opening/closing mechanism 46 is opened while the high pressure receiver 42 is in a state in which the liquid refrigerant is stored in it so as to maintain the state in which the liquid refrigerant is stored in the high pressure receiver 42. At such a moment, the liquid refrigerant stored in the high pressure receiver 42 have a composition quite similar to that of the refrigerant when it is filled in the refrigerant circuit, and, additionally, the composition of the refrigerant circulated in the refrigerant circuit can be made quite similar to the composition which the refrigerant has when it is filled.

Thus, this refrigerant circulating system is capable of selectively storing the refrigerant liquid in the low pressure receiver or in the high pressure receiver in accordance with the load, thereby changing the composition of the refrigerant circulated in the refrigerant circuit and thereby changing the its capacity without making any change of the frequency for the revolution of the compressor.

As mentioned above, a refrigerating and air conditioning system constructed with any one of these refrigerant circuits adjusts the quantity of the refrigerant liquid to be stored in the low pressure receiver or in the high pressure receiver, as the case may be, by means of a bypass pipe connecting the low pressure receiver and the high pressure receiver respectively mentioned above, thereby making a prompt adjustment of the quantities of the constituents at a high boiling point in the refrigerant flowing in the refrigerant circuit and thus adjusting the capacity of the system in a manner suitable for the load.

Further, these refrigerating and air conditioning systems are capable of preventing a decline in the sucking pressure of the compressor by feeding back refrigerant gas rich in constituents at a low boiling point from the upper part of the high pressure receiver to the inlet port side of the compressor, in the event that any decline occurs in the pressure at the suction side of the compressor, while it makes an adjustment of the refrigerant liquid to be stored in the low pressure receiver and in the high pressure receiver.

In order to open and close the opening/closing mechanism by detecting a load condition or a surrounding environmental condition which requires an adjustment of the composition of the refrigerant in the following manner. The operating mode for the cooling and heating operations detects on the basis of the mode changeover switch or by detecting the state of the load on the basis of the frequency or speed signal of the compressor, or the direction of the flow of the refrigerant or the states of the load is detected by means of the temperature sensors disposed in various parts of the refrigerant circuit.

The system is further capable of opening and closing the at the opening/closing mechanism thereby to make an adjustment of the composition of the refrigerant by detecting the state of the storage of the liquid refrigerant in at least one of the high pressure receiver and the low pressure receiver. Such a detection may be made by theoretically estimating the state of the storage of the refrigerant in the receiver on the basis of the temperature and/or pressure in various parts of the refrigerant circuit, or may be estimated by arithmetic operations, or may be made to determine "high," "middle," or "low" on the basis of the state of the heating temperature in the position of each receiver.

Through utilization of the characteristic feature of the refrigerant that the gas refrigerant can be warmed soon when it is heated but the liquid refrigerant is slow in being warmed by heating, it is possible to judge how high a level the refrigerant has been stored in the particular receiver.

In the seventh, eighth, and ninth embodiments described above, a refrigerant circulating system is provided with an opening/closing mechanism disposed in the bypass pipe, and the timing for the opening and closing operations of the opening/closing mechanism in any of these examples are to be set in such a manner that the mechanism is opened, for example, at the time of the start-up of the system, or when the level of the refrigerant in the high pressure receiver rises in the course of the steady operation, or when the refrigerant level in the low pressure receiver falls to a lower level.

Tenth Embodiment

A tenth embodiment of a system of the present invention will be described with reference to FIG. 10 as follows. In the drawing, a compressor 31, a four-way valve 40, a heat exchanger 32 at the heat source side, an auxiliary throttle device 41, a high pressure receiver 42, a main throttle device 33, a heat exchanger 34 at the load side, and a low pressure receiver 35 are connected in the serial order by the refrigerant piping and are formed into a main circuit. Further, the reference number 109 denotes a first bypass pipe which leads from the high pressure receiver 42 to the low pressure receiver 35, and the reference number 49 denotes a third throttle device provided on the first bypass pipe 109. The reference number 50 denotes a supercooling heat exchanger which performs a heat exchange between the main piping from the main throttle device 33 to the auxiliary throttle device 41, and the bypass pipe from the third throttle device 49 to the low pressure receiver 35.

Figure 10:
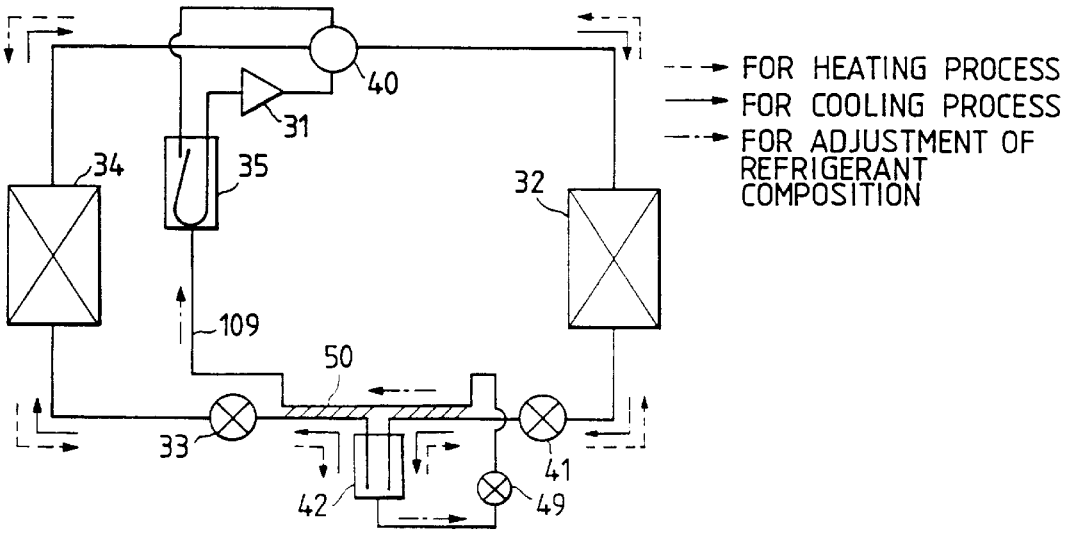
FIG. 10 is a refrigerant circuit diagram of a tenth embodiment of the present invention.

The refrigerant flows as illustrated in FIG. 10. Refrigerant is to be filled in advance so that a surplus quantity of the refrigerant is stored in the low pressure receiver 35 or in the high pressure receiver 42. In a cooling process, the refrigerant gas discharged from the compressor 32 passes through the four-way valve 40 and is then condensed in the heat exchanger 32 at the heat source side, thereby turned into liquid refrigerant. Then, the liquid refrigerant is reduced slightly in the auxiliary throttle device 41 and is thereafter fed into the high pressure receiver 42. The liquid refrigerant thus passed through the high pressure receiver 42 is reduced to be reduced to a low pressure in the main throttle device 33, is evaporated in the heat exchanger 34 at the load side, and is then fed back to the compressor 31 via the four-way valve 40 and the low pressure receiver 35.

At this point, the third throttle device 49 is opened so that the liquid refrigerant in the high pressure receiver 42 is turned into a dual-phase refrigerant at a low pressure to lead into the supercooling heat exchanger 50. In the supercooling heat exchanger 50, a heat exchange takes place between the main piping in which the liquid refrigerant under a high pressure flows, and the bypass pipe in which the dual-phase refrigerant under a low pressure flows. Accordingly, the degree of supercooling of the liquid refrigerant flowing in the main piping can be thereby increased. Therefore, the reliability of the flow rate in the main throttle device 33 and the auxiliary throttle device 41 can be improved.

Further, in case a considerable increase occurs in the refrigerant in the high pressure, the main throttle device 33 and the auxiliary throttle device 41 are set more loosely in its reduced state so that the refrigerant at the outlet port of the heat exchanger 32 at the heat source side working as a condenser is thereby turned into a dual-phase state. At such a time, the liquid refrigerant which is stored in the high pressure receiver 42 is rich in constituents at a high boiling point. The third throttle device 49 is opened so that the refrigerant rich in constituents at a high boiling point is evaporated in the supercooling heat exchanger 50. Thereafter, the evaporated refrigerant is fed back to the low pressure receiver 35, thereby enabling the compressor 31 to suck the gas refrigerant rich in constituents at a high boiling point and thus suppressing the discharge pressure of the compressor 31.

In a heating process, the refrigerant gas discharged from the compressor 32 is passed through the four-way valve 40 and fed into the heat exchanger 34 at the load side in which the refrigerant gas is condensed into liquid refrigerant which is then passed through the main throttle device 33 as slightly reduced and fed into the high pressure receiver 42. The liquid refrigerant thus passed through the high pressure receiver 42 is processed to attain a low pressure in the auxiliary throttle device 41, and the liquid refrigerant is then evaporated in the heat exchanger 32 at the heat source side and is fed back into the compressor via the four-way valve 40 and the low pressure receiver 35.

At this point, the third throttle device 49 is opened so that the liquid refrigerant in the high pressure receiver is turned into a dual-phase refrigerant under a low pressure, which is introduced into the supercooling heat exchanger 50. Heat exchanges are performed between the main piping in which the liquid refrigerant at a high temperature flows and the bypass pipe in which the dual-phase refrigerant under a low pressure flows, and the degree of supercooling of the liquid refrigerant flowing in the main piping can be thereby increased. As a result, the reliability of the control of the flow rate in the main throttle device 33 and the auxiliary throttle device 41 can be improved.

Further, if the refrigerant in the high pressure rises considerably, the main throttle device 33 and the auxiliary throttle device 41 are set in looser reduction and the refrigerant at the outlet port of the heat exchanger 34 at the load side working as a condenser, is turned into a dual-phase state. At such a time, the liquid refrigerant stored in the high pressure receiver 42 is rich in constituents at a high boiling point, and, with the third throttle device 49 kept open, this refrigerant rich in constituents at a high boiling point is evaporated in the superheating heat exchanger 50 and is thereafter fed back into the low pressure receiver 35. As a result, the compressor 31 sucks the gas refrigerant rich in constituents at a high boiling point, the discharge pressure of the compressor 31 can be thereby suppressed.

Namely, this refrigerating and air conditioning system adjust the quantity of the refrigerant liquid stored in the low or high pressure receiver so as to adjust the quantity of refrigerant constituents at a high boiling point flowing in the refrigerant circuit. When the discharge pressure of the compressor increases, the liquid refrigerant in the high pressure receiver is once reduced and then subjected to a heat exchange with the liquid refrigerant under a high pressure in the main piping, and the liquid refrigerant itself is thereby evaporated. Thus, this system is capable of suppressing the discharge pressure of the compressor while maintaining the performance.

In this manner, this refrigerating and air conditioning system is capable of suppressing the discharge pressure of the compressor while keeping its performance capacity intact at the same time as it can increase the reliability of its control of the flow rate of the refrigerant, with a bypass pipe 109 in which the refrigerant is subjected to a heat exchange with the refrigerant in the refrigerant liquid piping under a high pressure as the refrigerant is discharged from the high pressure receiver and passed via the throttle device and then flows together with the refrigerant in the gas piping under a low pressure.

Eleventh Embodiment

Figure 11:
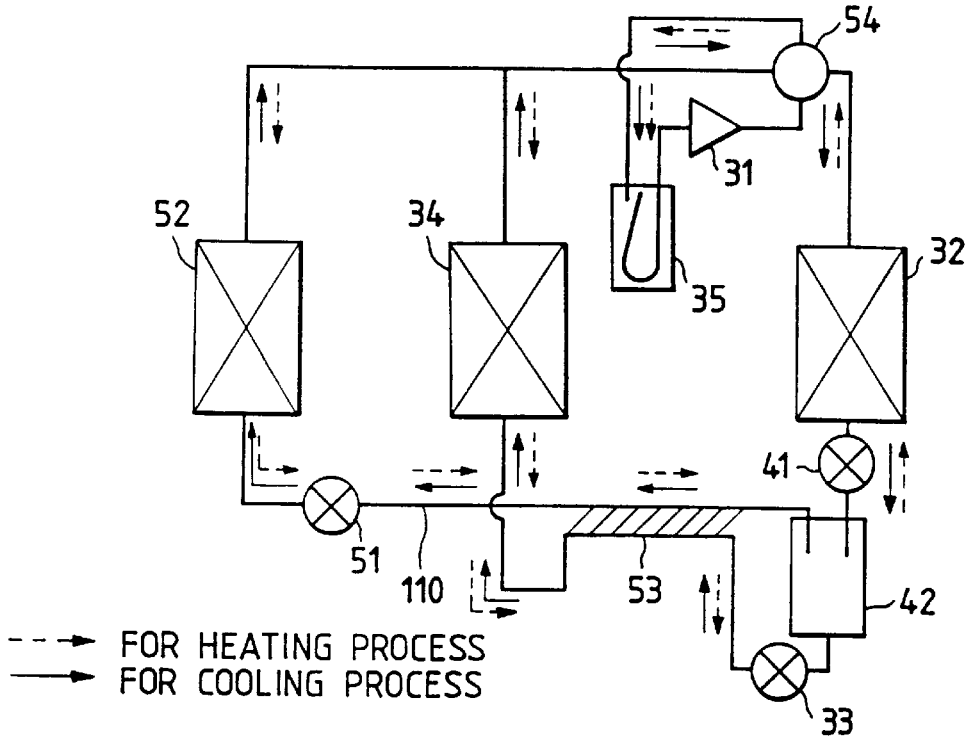
FIG. 11 is a refrigerant circuit diagram of a eleventh embodiment of the present invention.

FIG. 11 is a refrigerant circuit diagram illustrating an eleventh embodiment of a system of the present invention. In FIG. 11, a compressor 31, a four-way valve 54, a heat exchanger 32 at the heat source side, an auxiliary throttle device 41, a high pressure receiver 42, a main throttle device 33, a refrigerant-refrigerant heat exchanger 53, a heat exchanger 34 at the load side, a low pressure receiver 35 are connected in the serial order and are thus formed into a main piping. Further, the reference number 51 denotes a third throttle device, the reference number 52 denotes a second heat exchanger at the load side. The refrigerant-refrigerant heat exchanger 53, the third throttle device 51, and the second heat exchanger at the load side 52 are connected by a refrigerant piping 110, and one end of the refrigerant piping 110 is connected to the high pressure receiver 42 while the other end thereof is connected to the piping between the heat exchanger 34 at the load side and the four-way valve 54.

The flow of the refrigerant is shown in FIG. 11. In a cooling process, the refrigerant led out of the compressor 31 flows via the four-way valve 54 to enter the heat exchanger 32 at the heat source side, in which the refrigerant is condensed and then fed into the auxiliary throttle device 41. Then, the refrigerant is reduced as the auxiliary device is reduced slightly, and the refrigerant is thereafter fed into the high pressure receiver 42. In the high pressure receiver 42, the refrigerant is separated into two parts which are a gas rich in constituents at a low boiling point and a liquid rich in constituents at a high boiling point. The refrigerant rich in constituents at a high boiling point is reduced to attain a low pressure in the main throttle device 33 and is evaporated by its absorption of a moderate amount of heat in the refrigerant-refrigerant heat exchanger 53, and the refrigerant then enter the heat exchanger 34 at the load side. The refrigerant which absorbs heat from the surrounding area in the hat exchanger 34 at the load side and is evaporated into a gaseous state is then fed back into the compressor 31 via the four-way valve 54 and the low pressure receiver 35.

Further, the refrigerant gas rich in refrigerant constituents at a low boiling point as separated in the high pressure receiver 42 is condensed as it is subjected to a heat exchange with the dual-phase refrigerant under a low pressure in the refrigerant-refrigerant heat exchanger 53. This liquid refrigerant rich in constituents at a low boiling point and under a high pressure is reduced in the third throttle device 51 until it attains a low pressure, and the refrigerant is evaporated into a gas as it absorbs heat from the surrounding area in the second heat exchanger 52 at the load side and then flows together with the refrigerant gas rich in constituents at a high boiling point as vaporized in the heat exchanger 34 at the load side, and the refrigerant is fed back into the compressor 31 via the four-way valve 54 and the low pressure receiver 35. Here, since the refrigerant which flows in the second heat exchanger 52 at the load side is rich in constituents at a low boiling point, it is possible for the refrigerant to attain an evaporating temperature different from that of the refrigerant in the heat exchanger 34 at the load side, even under the same low pressure.

As described above, since the refrigerant gas rich in constituents at a low boiling point is condensed by the heat exchanger 53, the refrigerant rich in constituents at a low boiling point flows into the heat exchanger 52, and the refrigerant rich in constituents at a high boiling point flows into the heat exchanger 34. Consequently, if the pressure is the same, the evaporating temperature in the heat exchanger 34 is different from that in the heat exchanger 52 and the evaporating temperature in the heat exchanger 52 is lower in this embodiment.

Moreover, with the amount of heat exchange being controlled by the heat exchanger at the heat source side 32, it is possible to control the composition of the refrigerant gas and liquid which are separated by the high pressure receiver 42 to control the difference between the evaporating temperature attained in the heat exchanger 34 at the load side and the evaporating temperature attained in the second heat exchanger 52 at the load side.

The operations mentioned above may be applied, for example, to an adjustment of the quantity of heat exchange by a division of the heat exchanger or by adjusting the quantity of air (or water) in the construction of the heat exchanger 32. Furthermore, such an adjustment for an increase or a decrease of the heat exchange quantity is to be made, for example, by the degree of superheating at the outlet port for the refrigerant in the heat exchangers 34 and 52.

In this refrigerating and air conditioning system, the refrigerant is separated into two streams in the high pressure receiver, which are liquid refrigerant rich in constituents at a high boiling point and gas refrigerant rich in constituents at a low boiling point. In addition, this system once reduces the flow of the liquid refrigerant rich in constituents at a high boiling point, thereby turning the liquid refrigerant into gas-liquid dual-phase refrigerant and thereafter subjecting the dual-phase refrigerant to a heat exchange with the gas refrigerant rich in constituents at a low boiling point, thereby liquefying the dual-phase refrigerant. Further, the system then reduces the flow of the liquid refrigerant rich in constituents at a low boiling point, thereby turning the refrigerant into a gas-liquid dual-phase refrigerant under a low pressure. Operating in this manner, this system is capable of attaining different evaporating temperatures by obtaining a dual-phase refrigerant rich in constituents at a high boiling point and working under a low pressure and a dual-phase refrigerant rich in constituents at a low boiling point and working under a low pressure.

Twelfth Embodiment

Figure 12:
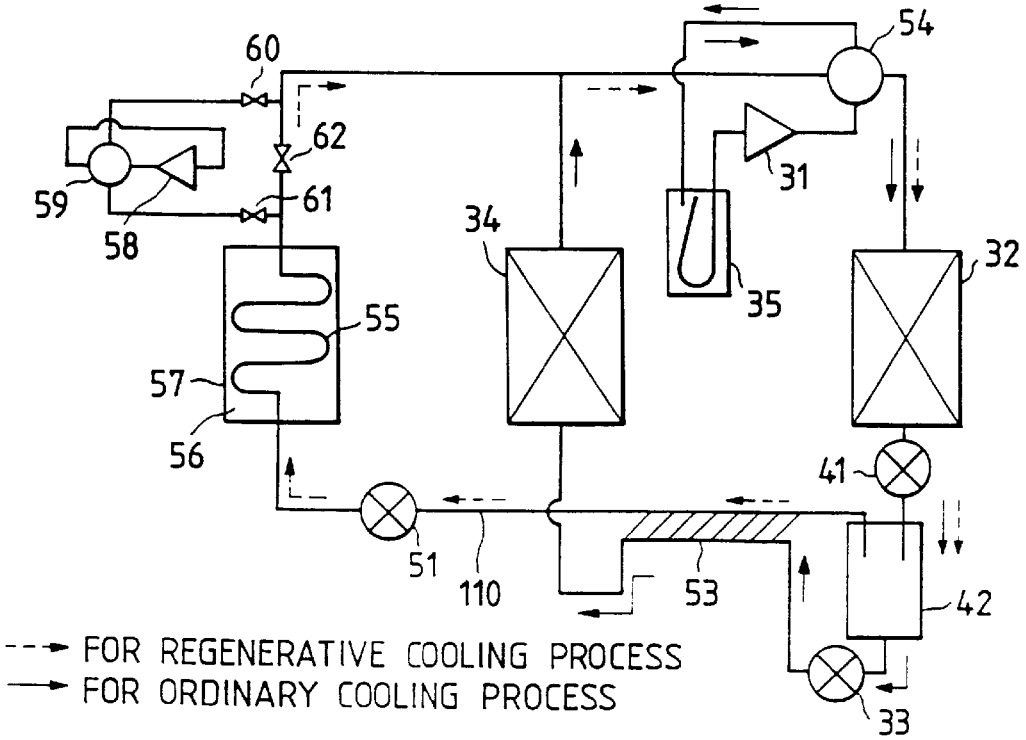
FIG. 12 is a refrigerant circuit diagram of a twelfth embodiment of the present invention.

FIGS. 12 through 15 respectively are refrigerant circuit diagrams illustrating a twelfth embodiment of a system of the present invention. In FIGS. 12 through 15, the flow of the refrigerant in each of the operating conditions are illustrated. In these Figures, those component parts or units which are identical to those described in the eleventh embodiment are indicated by the same reference numbers assigned to them, and their description is omitted here. As shown in FIG. 12, this refrigerant circulating system is provided with a heat accumulating heat exchanger 55, a heat accumulating medium 56, a heat accumulating heat exchanger 55, a heat accumulating medium 56, a heat accumulating tank 57 for housing the heat accumulating heat exchanger 55 and the heat accumulating medium 56 therein, a refrigerant gas pump 58, a heat accumulating four-way valve 59, an opening/closing mechanisms 60, 61, and 62, and this system uses water, for example, as its heat accumulating medium 56. A refrigerant-refrigerant heat exchanger 53, a third throttle device 51, the heat accumulating heat exchanger 55, and the opening/closing mechanism 62 are connected through a refrigerant piping 110, and one end of the refrigerant piping 110 is connected to the high pressure receiver 42 and the other end of the arrangement is connected to the piping between the heat exchanger at the load side 34 and the four-way valve 54. Further, the refrigerant piping 110 connects the heat accumulating four-way valve 59 and the gas pump 58, bypassing the opening/closing mechanism 62, and the end parts of the refrigerant piping 110 are connected to the piping before and after the opening/closing mechanism 62 via the opening/closing mechanisms 60 and 61.

An operation of this system for a heat regenerating freezing process, namely, a process for making ice will be described as follows. In FIG. 12, the system closes the opening/closing mechanisms 60 and 61 and the opening/closing mechanism 62 is opened, and then the compressor 31 is driven. The gas refrigerant at a high temperature under a high pressure discharged from the compressor 31 is condensed in the heat exchanger 32 at the heat source side, and then its flow is reduced somewhat in the auxiliary throttle device 41 and is thereafter conducted into the high pressure receiver 42. When the high pressure receiver 42 is filled up with the liquid refrigerant, the liquid refrigerant is introduced into the piping 110, and the pressure of the liquid refrigerant is reduced to a low pressure through the refrigerant-refrigerant heat exchanger 53 into the third throttle device 51. At this moment, the main throttle device 33 is opened or closed as appropriate so as to adjust the degree of supercooling of the refrigerant flowing through the refrigerant piping by the refrigerant-refrigerant heat exchanger 53. The dual-phase refrigerant at a low temperature which is reduced to a low pressure by the third throttle device 51 deprives heat from the heat accumulating medium 56 in the heat accumulating tank 57 so as to freeze the heat accumulating medium 56 and evaporates itself into a gas. The refrigerant thus turned into a gas is fed back into the compressor 31 via the four-way valve 54 and the low pressure receiver 35. Further, an example of a heat accumulating operation of the system is shown in FIG. 14.

Figure 14:
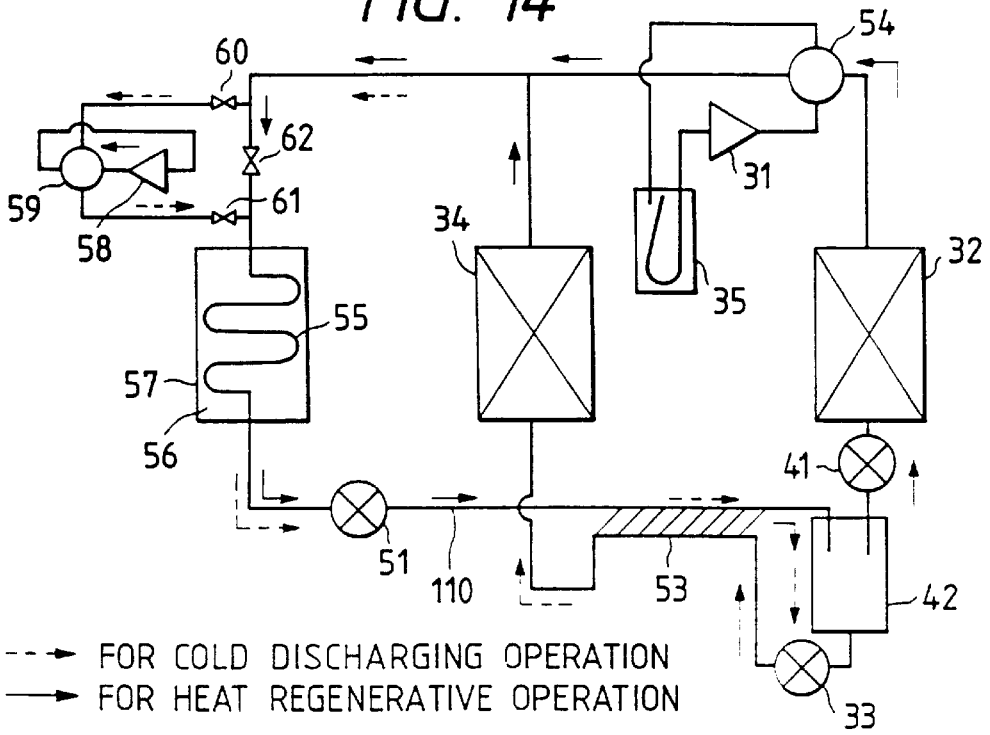
FIG. 14 is a refrigerant circuit diagram of the twelfth embodiment of the present invention.

Now, the cold radiating operation, namely, a cooling operation by the system by discharging the accumulated cold as shown in FIG. 14 is described as follows. The system opens the opening/closing mechanisms 60 and 61 and closes the opening/closing mechanism 62, and then drives the gas pump 58. The refrigerant discharged from the gas pump 58 flows through the heat accumulating four-way valve 59 to lead into the heat accumulating heat exchanger 55. Then, the refrigerant is cooled by the heat accumulating medium provided in the heat accumulating tank 57 so as to be condensed and liquefied into liquid refrigerant at about 9 $kgf/cm^2$ G. This liquid refrigerant is slightly retracted by the third throttle device 51 and is then led into the high pressure receiver 42. The liquid refrigerant led out of the high pressure receiver 42 is retracted by the main throttle device 33 to attain a low pressure and turn into a dual-phase refrigerant at a low temperature and under a low pressure. This dual-phase refrigerant absorbs some amount of heat in the refrigerant-refrigerant heat exchanger 53 and is thereafter conducted into the heat exchanger 34 at the load side. The dual-phase refrigerant at a low temperature and under a low pressure deprives the surrounding area of heat by the heat exchanger 34 at the load side, thereby performing a cooling operation, and the refrigerant itself is evaporated into a gas which passes through the heat accumulating four-way valve 59 and is fed back into the gas pump 58.

Figure 15:
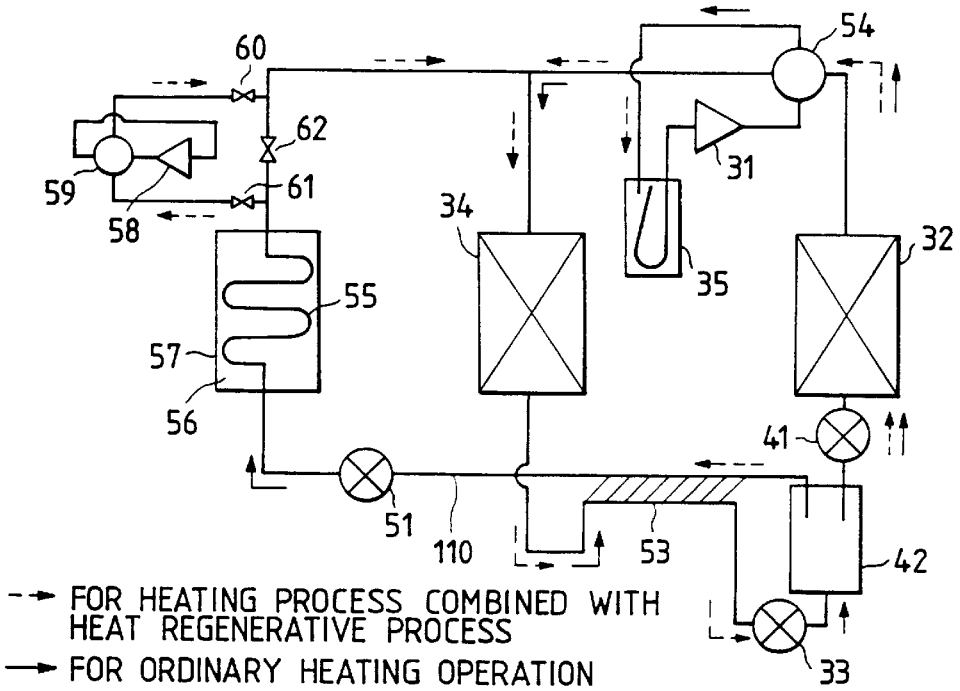
FIG. 15 is a refrigerant circuit diagram of the twelfth embodiment of the present invention.

Now, a description will be given with respect to an ordinary cooling operation, namely, an operation for cooling only with the compressor 31, without utilizing any accumulated cold, as shown in FIG. 12. The system drives the compressor 31 while keeping the opening/closing mechanisms 60, 61, and 62 closed. The refrigerant discharged from the compressor 31 flows via the four-way valve 54 to be led into the heat exchanger 32 at the heat source side, in which the refrigerant is condensed and liquefied, the refrigerant being then reduced somewhat in the auxiliary throttle device 41 and being thereafter introduced into the high pressure receiver 42. The liquid refrigerant led out of the high pressure receiver 42 is reduced by the main throttle device 33 so as to attain a low pressure and is thereby turned into a dual-phase at a low temperature and under a low pressure, and the dual-phase refrigerant is led into the heat exchanger 34 at the load side. The dual-phase refrigerant at a low temperature and under a low pressure then deprives the surrounding area of heat while the refrigerant is held in the heat exchanger 34 at the load side, and the system thereby performs a cooling process while the dual-phase refrigerant itself is evaporated, being thereby turned into a gas, which is fed back to the compressor 31 by way of the four-way valve 54 and the low pressure receiver 35. Moreover, an ordinary heating operation is illustrated in FIG. 15.

Figure 13:
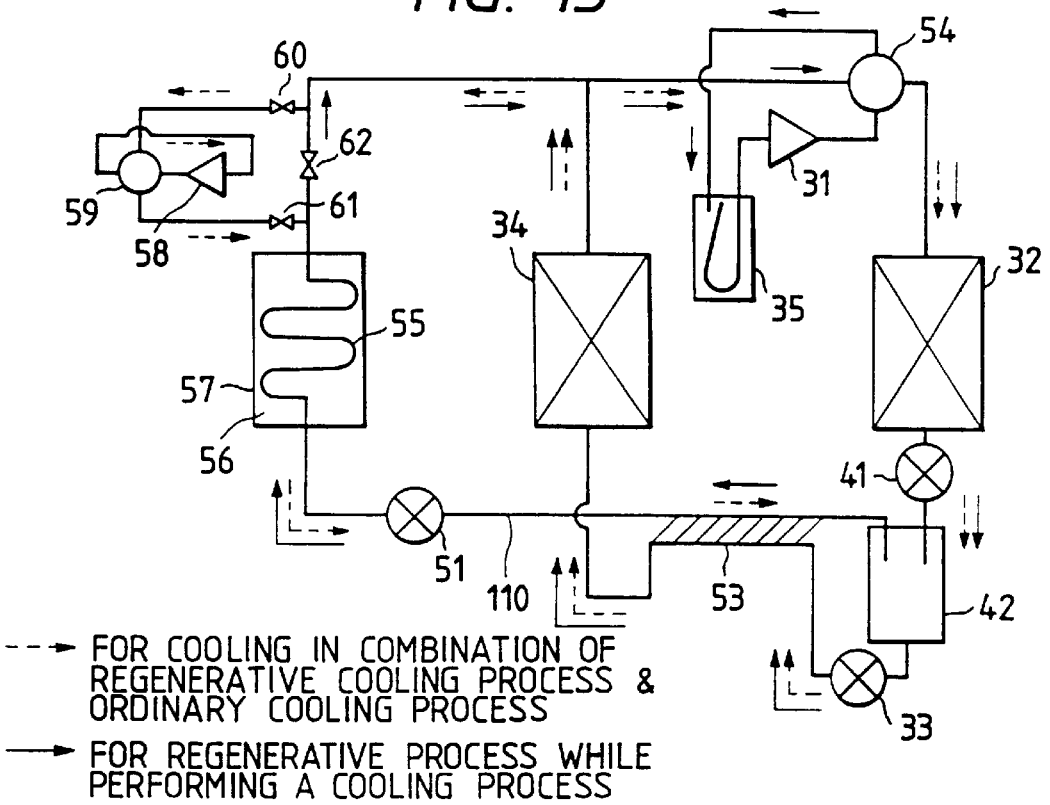
FIG. 13 is a refrigerant circuit diagram of the twelfth embodiment of the present invention.

When the cooling load is light in an ordinary cooling process, the system opens the opening/closing mechanism 62 as shown in FIG. 13, thereby conducting the gas refrigerant rich in constituents at a low boiling point from the upper part of the high pressure receiver 42 into the refrigerant piping 110. This gas refrigerant rich in constituents at a low boiling point radiates heat in the refrigerant-refrigerant heat exchanger 53 and is condensed at the same time, and the gas refrigerant is then reduced by the heat accumulating throttle device 51. Since the refrigerant flowing in the refrigerant piping 110 is rich in constituents at a low boiling point, the temperature of the refrigerant flow as reduced by the heat accumulating throttle device 51 can be lower than the evaporating temperature in the heat exchanger 34 at the load side, so that the refrigerant flowing through the refrigerant piping 110 can deprive the surrounding area of heat, thereby freezing the heat accumulating medium in the heat accumulating tank 57 in the heat accumulating heat exchanger 55 while the refrigerant itself is evaporated to be turned into a gas, and the refrigerant can thus accumulates cold with performing a cooling process.

With reference to FIG. 13, a description will be given in respect of a cooling process performed concurrently with a regenerative process with accumulated cold in which an ordinary cooling process and a cold radiating process are performed at the same time. With opening the opening/closing mechanisms 60 and 61 and closing the opening/closing mechanism 62 kept, the system drives the compressor 31 and the gas pump 58. At this moment, the liquid refrigerant condensed in the heat accumulating heat exchanger 55 at the side of the gas pump 58 is discharged from the compressor 31 and flows together with the refrigerant in a flow reduced in the auxiliary throttle device 41 as the two streams of refrigerant flow into the high pressure receiver 42. Then, the refrigerant is further reduced to a lower pressure in the throttle device 33, and thereafter it is led into the heat exchanger 34 at the load side, in which the refrigerant deprives the surrounding area of heat while the refrigerant itself is evaporated to be turned into a gas. The refrigerant which is thus evaporated turned into a gas in the heat exchanger 34 at the load side is divided into two streams. One of these streams is fed back to the compressor 31 via the four-way valve 54 and the low pressure receiver 42 while the other of these streams is fed back to the gas pump 58 via the heat accumulating four-way valve 59. In addition, an example of a heating process with a regenerative heating process is shown in FIG. 15.

This refrigerating and air conditioning system divides the refrigerant in the high pressure receiver 42 into two streams, one of these streams being a liquid refrigerant rich in constituents at a high boiling point and the other of these streams being a gas refrigerant rich in constituents at a low boiling point. The system once reduces the liquid refrigerant rich in constituents at a high boiling point to turn it into a gas-liquid dual-phase refrigerant under a low pressure and thereafter liquefies the dual-phase refrigerant through a heat exchange with the gas refrigerant rich in constituents at a low boiling point. Then the system reduces this liquid refrigerant rich in constituents at a low boiling point to turn it into the state of a gas-liquid dual-phase refrigerant under a low pressure. In this manner, this system can obtain a dual-phase refrigerant rich in constituents at a high boiling point under a low pressure and a dual-phase refrigerant rich in constituents at a low boiling point under a low pressure, thereby attaining evaporating temperatures at different temperature levels. Further, the system accumulate the thermal energy in the heat accumulating tank 57 when the refrigerating load is light and the system drives the gas pump 58 when the load is heavy by using the accumulated thermal energy stored in the heat accumulating tank 57 so as to perform the air-conditioning.

With respect to the changeover of the various operations, for example, this system first perform a cold storing operation during the night to make ice in the heat accumulating tank. On the other hand, in the day time, the system performs a cooling operation with using the ice accumulated during the night and also drives the compressor in accordance with the load so as to perform a concurrent regenerative and ordinary cooling operation. Moreover, if the system use up the ice water, the system performs its refrigerant circulating operations only with the compressor.

With this operation as the basis, the lightness and heaviness of the load is judged with reference to, for example, a room temperature. If the thermostat in an interior unit is turned off, the system judges that the load is light and performs a heat accumulating operation (ice-making operation) with a cooling operation. On the other hand, when the evaporating temperature rises (for example, to 10° C. or higher), the system performs a concurrent regenerative and ordinary cooling operation. This system is thus capable of performing a cooling operation while it keeps accumulating heat in this manner.

Thirteenth Embodiment

Figure 16:
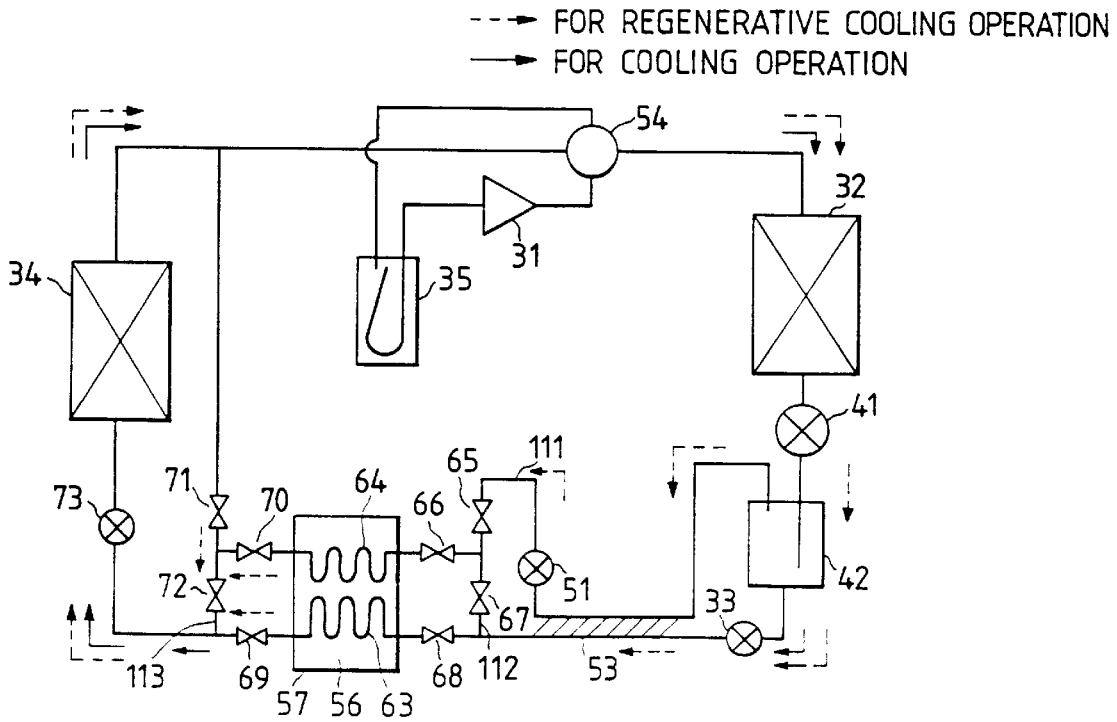
FIG. 16 is a refrigerant circuit diagram of a thirteenth embodiment of the present invention.
Figure 17:
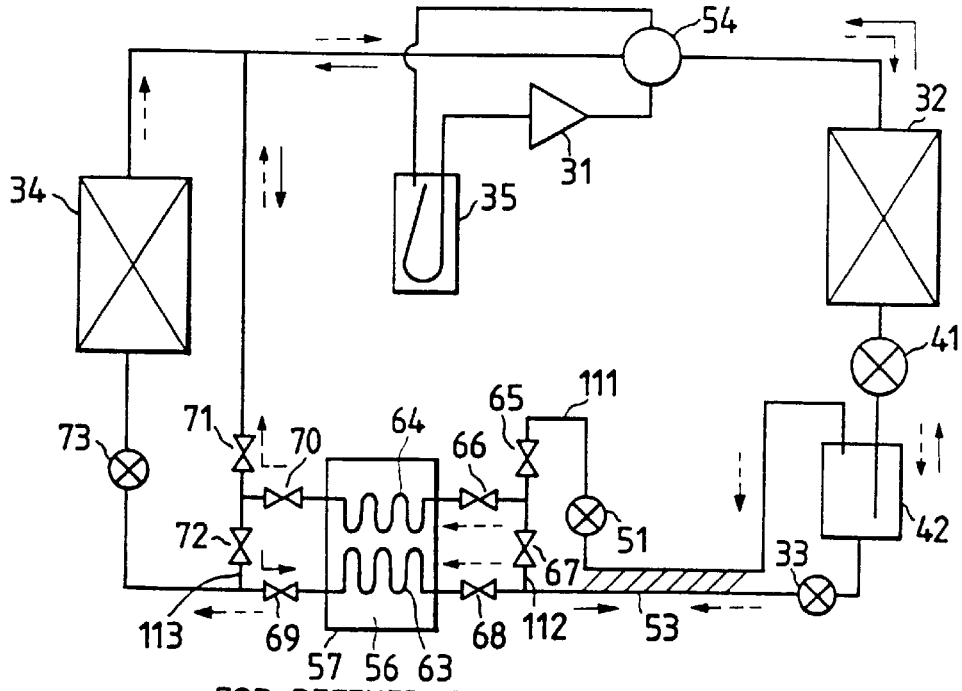
FIG. 17 is a refrigerant circuit diagram of the thirteenth embodiment of the present invention.
Figure 18:
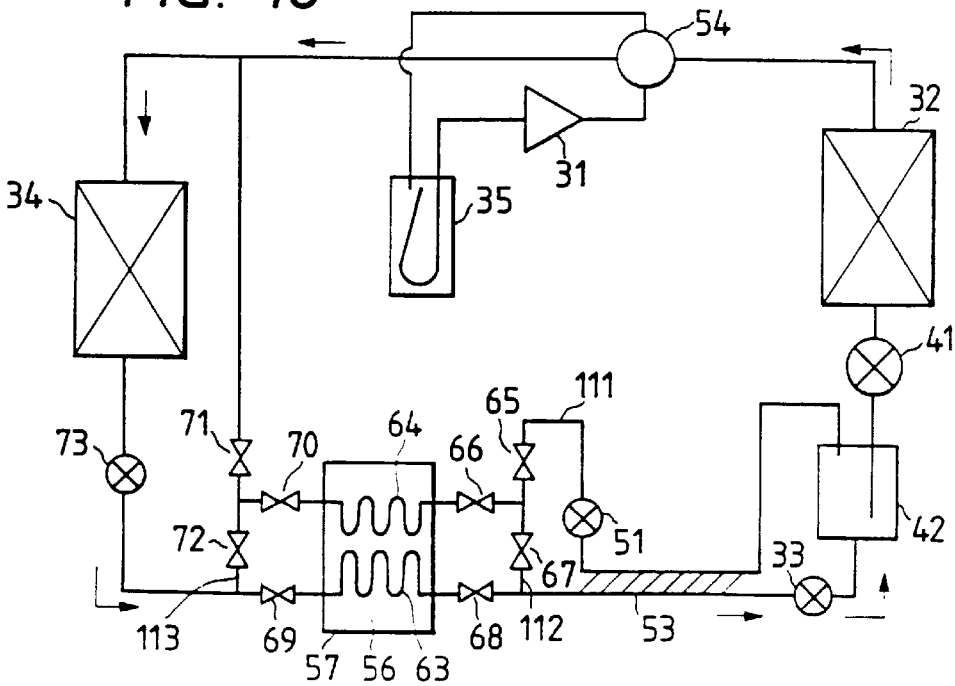
FIG. 18 is a refrigerant circuit diagram of the thirteenth embodiment of the present invention.

FIGS. 16 through 18 present refrigerant circuit diagrams illustrating a refrigerant circulating system described in the thirteenth embodiment of the present invention. In these Figures, a compressor 31, a four-way valve 54, a heat exchanger 32 at the heat source side, an auxiliary throttle device 41, a high pressure receiver 42, a main throttle device 33, a refrigerant-refrigerant heat exchanger 53, a first heat accumulating heat exchanger 63, a third throttle device 73, a heat exchanger 34 at the load side, and a low pressure receiver 35 are connected in the serial order to thereby form a main refrigerant circuit. A heat accumulating throttle device 51, a second heat accumulating heat exchanger 64 are connected by a refrigerant piping 111 One end of this refrigerant piping 111 is connected to the upper part of the high pressure receiver 42 while the other part of this refrigerant piping is connected to the refrigerant piping between the heat exchanger 34 at the load side and the four-way valve 54. An opening/closing mechanism 68 is disposed at one end of the first heat accumulating heat exchanger 56, and an opening/closing mechanism 69 is disposed at the other end of the heat accumulating heat exchanger 56. Opening/closing mechanisms 65 and 66 are disposed at one end of the second heat accumulating heat exchanger 64 while opening/closing mechanisms 70 and 71 are disposed at the other end of the heat exchanger 64. The reference number 112 denotes a refrigerant piping which connects the piping between the opening/closing mechanism 65 and the opening/closing mechanism 66 to the piping between the opening/closing mechanism 68 and the main throttle device 33 by way of the opening/closing mechanism 67. The reference number 113 denotes a refrigerant piping which connects the piping between the opening/closing mechanism 70 and the opening/closing mechanism 71 to the piping between the opening/closing mechanism 69 and the heat exchanger 34 at the load side by way of the opening/closing mechanism 72.

Now, a description will be given with respect to the cold accumulating operation of the system, namely, the operation for making ice. In FIG. 16, the system drives the compressor 31 with closing the opening/closing mechanism 65 and opening the opening/closing mechanisms 66, 67, 68, 70, 71, and 72. The gas refrigerant discharged from the compressor 31 at a high temperature and under a high pressure is condensed in the heat exchanger 32 at the heat source side and is reduced moderately in the auxiliary throttle device 41, and the refrigerant is then led into the high pressure receiver 42. When the high pressure receiver 42 is filled up with the liquid refrigerant, the liquid refrigerant is conducted into the piping 111, which leads the liquid refrigerant further via the refrigerant-refrigerant heat exchanger 53 to the third throttle device 51, in which the liquid refrigerant is reduced until it reaches a low pressure. At this moment, the main throttle device 33 is opened and closed in an appropriate manner so that the system adjusts the degree of supercooling of the refrigerant which flows through the refrigerant piping 110 by the operation of the refrigerant-refrigerant heat exchanger 53. The dual-phase refrigerant at a low temperature reduced to a low pressure by the third throttle device 51 is then divided into two streams, one being fed into the first heat accumulating heat exchanger 56 and the other being fed into the second heat accumulating heat exchanger 64, to deprive the heat accumulating medium 56 in the heat accumulating tank 57 of heat and freezing the heat accumulating medium 56, and the refrigerant itself is evaporated to form a gas. The refrigerant thus turned into a gas is fed back to the compressor 31 via the four-way valve 54 and the low pressure receiver 35. Further, the regenerative operation performed by this system is illustrated in FIG. 17.

Now, a description is given with respect to a cooling operation performed by this system. As shown in FIG. 16, the system drives the compressor 31 with closing the opening/closing mechanisms 65, 66, 67, 70, 71, and 72 and opening the opening/closing mechanisms 68 and 69. The refrigerant discharged from the compressor 31 passes through the four-way valve 54 and is fed into the heat exchanger 32 at the heat source side, in which the refrigerant is condensed to be liquefied, and the liquefied refrigerant is then fed into the auxiliary throttle device 41, in which the flow of the liquid refrigerant is moderately reduced, and the refrigerant is then fed into the high pressure receiver 42. The liquid refrigerant led out of the high pressure receiver 42 deprives the heat accumulating medium of heat, thereby increasing the degree of superheating, in the first heat accumulating heat exchanger 63. The refrigerant is then reduced so as to attain a low pressure in the third throttle device 73 and is thereby turned into a dual-phase refrigerant at a low temperature and under a low pressure and is led into the heat exchanger 34 at the load side. The dual-phase refrigerant at a low temperature and under a low pressure deprives the surrounding area of heat in the heat exchanger at the load side 34 and also evaporates itself into a gas, and the gas refrigerant thus formed is then led through the four-way valve 54 and the low pressure receiver 35 and is then fed back into the compressor 31. Further, the heating operation performed by this system is shown in FIG. 18.

When the refrigerating load is light at the time of the cooling operation, this system opens the opening/closing mechanisms 65, 66, 70, and 71, as shown in FIG. 17, and the system thereby conducts the gas refrigerant rich in constituents at a low boiling point from the high pressure receiver into the refrigerant piping 111. At this moment, the system also tightly reduces the main throttle device 33 and conducts the dual-phase refrigerant at a low temperature and under a low pressure, which is rich in constituents at a high boiling point, into the refrigerant-refrigerant heat exchanger 53. The gas refrigerant rich in constituents at a low boiling point led out of the high pressure receiver into the refrigerant piping 111 radiates heat in the refrigerant-refrigerant heat exchanger 53 so as to be condensed, and the flow of this condensed refrigerant is reduced by the heat accumulating throttle device 51. Since the refrigerant which flows through the refrigerant piping 111 is rich in constituents at a low boiling point, the temperature of the refrigerant reduced in the heat accumulating throttle device 51 is lower than the evaporating temperature in the heat exchanger 34 at the load side. Accordingly, the refrigerant deprives the surrounding area of heat in the second heat accumulating heat exchanger 64, thereby freezing the heat accumulating medium 56 in the heat accumulating tank 57 and evaporating and turning itself into a gas.

This refrigerating and air conditioning system divides the refrigerant into two streams, one being formed of liquid refrigerant rich in constituents at a high boiling point and the other being formed of gas refrigerant rich in constituents at a low boiling point. The system once reduces the flow of the liquid refrigerant rich in constituents at a high boiling point, thereby turning the refrigerant into a gas-liquid dual-phase refrigerant under a low pressure and thereafter subjecting the dual-phase refrigerant to a heat exchange with the gas refrigerant rich in constituents at a low boiling point, thereby liquefying the dual-phase refrigerant, and then the system reduces the flow of this liquid refrigerant rich in constituents at a low boiling point, thereby turning the refrigerant into the state of a gas-liquid dual-phase refrigerant under a low pressure. Thus, the system can obtain a dual-phase refrigerant under a low pressure rich in constituents at a high boiling point and a dual-phase refrigerant under a low pressure rich in constituents at a low boiling point, thereby attaining evaporating temperatures at different temperature levels, and the system also accumulates thermal energy in the heat accumulating tank when the cooling load is light and can increase the degree of supercooling of the refrigerant flowing in the main circuit with the accumulated thermal energy stored in the heat accumulating tank.

In the twelfth and thirteenth embodiments described above, the heat exchanger 53 is formed so as to perform the function of condensing the constituents at a low boiling point. As the result, the system is capable of performing an air conditioning operation at the same time as its accumulation of cold (ice making) by changing the evaporating temperature of the heat exchanger 34 and that of the heat accumulating heat exchanger 55 or the like.

(Evaporating temperature for accumulation of cold: −5 to 0° C., and the evaporating temperature for the air conditioning operation: 5 to 10° C.)

As mentioned above, it is possible for this system, for example, to accumulate cold (to make ice) while performing an air conditioning operation.

Further, the effect of the low pressure receiver 35 is such that it is possible to make the composition of the circulated refrigerant rich in constituents at a low boiling point by storing the liquid refrigerant in the low pressure receiver 35. In other words, the low pressure receiver offers an increase in the capacity of the system by an increase of the quantity of the refrigerant in circulation.

At such a time, the high pressure receiver 42 adjusts the quantity of the surplus refrigerant stored in the low pressure receiver 35 mentioned above and additionally performs a separation of the gas and liquid in the refrigerant.

Fourteenth Embodiment

Figure 19:
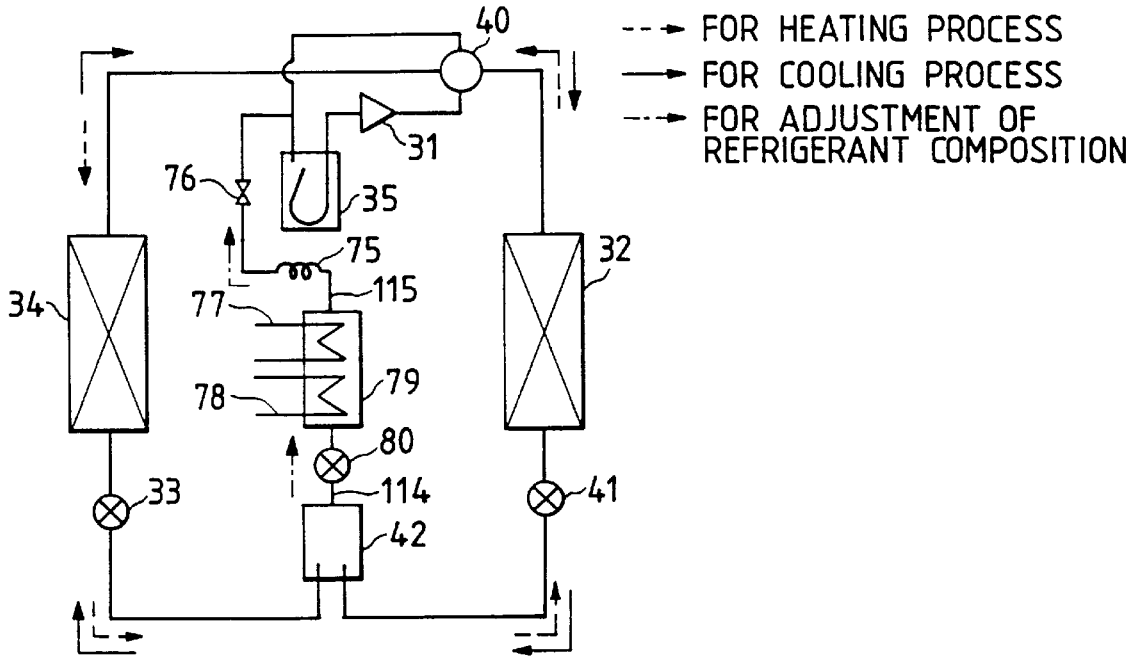
FIG. 19 is a refrigerant circuit diagram of a fourteenth embodiment of the present invention.

A fourteenth embodiment of a system of the present invention will be described on the basis of FIG. 19. In FIG. 19, a compressor 31, a four-way valve 40, a heat exchanger 32 at the heat source side, an auxiliary throttle device 41, a high pressure receiver 42, a main throttle device 33, a heat exchanger 34 at the load side, and a low pressure receiver 35 are connected in the serial order by a refrigerant piping to form a main refrigerant circuit. An intermediate pressure receiver 79 is connected by a refrigerant piping 114 to the upper area of the high pressure receiver 42 via the third throttle device 80 of the intermediate pressure receiver 79. A fourth throttle device 75 and an opening/closing mechanism 76 is connected by a refrigerant piping 115 with one end thereof being connected to the upper part of the intermediate pressure receiver 79 and with the other end thereof being connected to the suction piping of the low pressure receiver 35. The reference number 77 denotes a low temperature heat source, and the reference number 78 denotes a high temperature heat source, which can make an adjustment of its temperature. The flow of the refrigerant is shown in FIG. 19.

Now, a description will be made of the cooling operation of this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger at the heat source side 32 is reduced somewhat in the auxiliary throttle device 41 and is thereafter fed into the high pressure receiver 42. The system then separates the refrigerant into gas and liquid in the high pressure receiver 42 and then reduces the pressure of the gas and liquid refrigerants to a low pressure by the main throttle device 33, and the refrigerant thus turned into the dual-phase state at a low temperature deprives the surrounding area of heat in the heat exchanger 34 at the load side, the refrigerant itself is evaporated and turned into a gas, which is then passed through the four-way valve 40 and the low pressure receiver 35 and being thereby fed back to the compressor 31.

In order to change the composition of the refrigerant flowing through the refrigerant circuit, this system opens the opening/closing mechanism 76 and conducts the gas refrigerant rich in constituents at a high boiling point into the intermediate pressure receiver 79 via the third throttle device 80 through the refrigerant piping 114. The intermediate pressure receiver 79 sets a predetermined temperature with a low temperature heat source so as to condense the refrigerant gas. As the result, the liquid refrigerant rich in constituents at a low boiling point is stored in the intermediate pressure receiver 79, and the uncondensed gas is fed into the suction port of the low pressure receiver 35 through the refrigerant piping 115. Therefore, the composition of the refrigerant circulated in the main circuit is rich in the constituents at a high boiling point.

This fact will be explained with reference to the chart showing the relationship between the ratios of the mixed constituents and the temperature in FIG. 20. In the drawing, the temperature is plotted on the vertical axis while the ratio between the constituents at a high boiling point and the constituents at a low boiling point of the refrigerant are indicated on the horizontal axis. Also, g1 denotes the state of a saturated gas under a high pressure, L1 denotes that of a liquid under a high pressure, g2 denotes that of a saturated gas under an intermediate pressure, L2 denotes that of the liquid under the intermediate pressure. If a refrigerant in the composition A is initially filled up in the refrigerant circuit, the state of the refrigerant in the high pressure receiver is such that the refrigerant is separated between a gas refrigerant having the composition $G_H$ and a liquid refrigerant having the composition $L_H$. Further, this gas refrigerant having the composition $G_H$ separates the liquid refrigerant having the composition $L_M$ therefrom in the intermediate pressure receiver 79. Therefore, the intermediate pressure receiver 79 can store therein a refrigerant richer in constituents at a low boiling point than the composition of the filled refrigerant.

Moreover, in order to make the constituents of the refrigerant flowing in the main circuit rich in constituents at a low boiling point, this system opens the opening/closing mechanism 76 and evaporates the refrigerant in the intermediate pressure receiver 79 by means of the high temperature heat source. After the evaporation, the system closes the opening/closing mechanism 76 so that the surplus refrigerant rich in constituents at a high boiling point is stored in the low pressure receiver. Consequently, the composition of the refrigerant circulated in the main circuit is rich in constituents at a low boiling point.

Further, in this embodiment, an electric heater, a gas discharged from the compressor 31, and a refrigerant liquid under a high pressure can use as the high temperature heat source 78 , and cold water and a dual-phase refrigerant at a low temperature and under a low pressure can use as the low temperature heat source 77.

This refrigerating and air conditioning system of the embodiment controls the temperature and the pressure in the intermediate pressure receiver so as to change the composition of the refrigerant stored in the intermediate pressure receiver 79 to change that of the refrigerant circulated in the refrigerant circuit.

Fifteenth Embodiment

Figure 21:
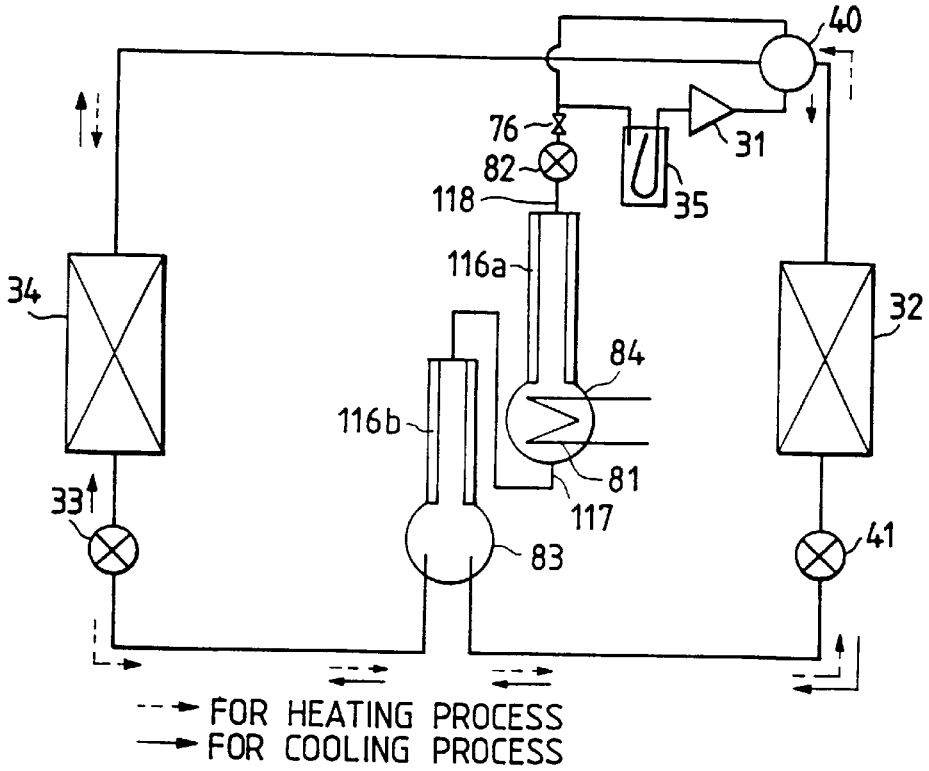
FIG. 21 is a refrigerant circuit diagram of a fifteenth embodiment of the present invention.

A fifteenth embodiment of a system of the present invention will be described with reference to FIG. 21 as follows. In FIG. 21, a compressor 31, a four-way valve 40, a heat exchanger 32 at the heat source side, an auxiliary throttle device 41, a high pressure composition adjusting device 83, a main throttle device 33, a heat exchanger 34 at the load side, a low pressure receiver 35 are connected in the serial order to formed a main circuit for the refrigerant. A intermediate pressure composition adjusting device 84 is connected to the high pressure composition adjusting device 83 via a third throttle device 83 by the refrigerant piping 117. The third throttle device 82 is disposed on the refrigerant piping 118. One end of the refrigerant piping 117 is connected to the upper part of the intermediate pressure composition adjusting device 84 and the other end thereof is connected to the inlet piping of the low pressure receiver 35. The reference numbers 116*a* and 116*b* denote low temperature heat sources respectively connected to the respective upper parts of the intermediate pressure composition adjusting device 84 and the high pressure composition adjusting device 83, and it is possible to adjust the temperature as appropriate. A high temperature heat source 81 is connected to the intermediate pressure composition adjusting device 84.

Now, a description will be given with respect to the cooling operation of this refrigerant circulating system. This system drives the compressor 31 with closing the opening/closing mechanism 76. The gas refrigerant discharged from the compressor 31 is passed through the four-way valve 40 to be led into the heat exchanger 32 at the heat source side. The refrigerant condensed in the heat exchanger 32 at the heat source side is reduced somewhat in the auxiliary throttle device 41 and is then fed into the high pressure composition adjusting device 83. The refrigerant is separated into the gas and the liquid in the high pressure composition adjusting device 83, and the pressure of the liquid refrigerant is reduced to a low pressure by the main throttle device 33. Then, the refrigerant thus formed into a dual-phase refrigerant at a low temperature deprives the surrounding area of heat in the heat exchanger 34 at the load side, thereby performing a cooling operation and also evaporating itself into a gas. The gas is passed through the four-way valve 40 and the low pressure receiver 35 and is then fed back into the compressor 31.

Now, a description will be given with respect to the heating operation of the system. The system drives the compressor 31 with closing opening/closing mechanism 76. The gas refrigerant at a high temperature and under a high pressure discharged from the compressor 31 is passed through the four-way valve 40 to be fed into the heat exchanger 34 at the load side. This gas refrigerant at a high temperature and under a high pressure radiates heat to the surrounding area in the heat exchanger 34 at the load side to perform a heating operation, and the gas refrigerant itself is condensed and then reduced somewhat in the main throttle device 33 and is thereafter fed into the high pressure composition adjusting device 83. The gas refrigerant is separated into the gas and liquid in the high pressure composition adjusting device 83, and the liquid refrigerant has its pressure reduced to a low pressure in the auxiliary throttle device 41. Then, the refrigerant thus turned into a dual-phase refrigerant at a low temperature deprives the surrounding area of heat in the heat exchanger 32 at the heat source side, the refrigerant being thereby evaporated. Finally, the evaporated refrigerant is passed through the four-way valve 40 and the low pressure receiver 35 to fed back into the compressor 31.

In order to change the composition of the refrigerant flowing through the refrigerant circuit, the system opens the opening/closing mechanism 76 and conducts the gas refrigerant rich in constituents at a low boiling point from the upper part of the high pressure composition adjusting device 83 into the intermediate pressure composition adjusting device 84 through the refrigerant piping 117. At this moment, the gas refrigerant rich in constituents at a low boiling point is subjected to a heat exchange with the low temperature heat source 116*b* in the duration of time when the refrigerant reaches the upper part of the high pressure composition adjusting device 83, and the refrigerant rich in constituents at a high boiling point is thereby condensed to be liquefied. Then, the liquefied refrigerant is then led downward to the lower part of the high pressure composition adjusting device 83 so that the gas refrigerant rich in constituents at a low boiling point as rectified to some degree remains in the upper area of the high pressure composition adjusting device 83. The gas refrigerant rich in constituents at a low boiling point is then led into the lower part of the intermediate pressure composition adjusting device 84. Further, during moving upward in the intermediate pressure composition adjusting device 84, the gas refrigerant is condensed to be liquefied as it is subjected to a heat exchange with a low temperature heat source 116*a* radiating heat, for example, at 10° C., so that the refrigerant thus liquefied is stored in the lower part of the intermediate pressure composition adjusting device 84. On the other hand, the uncondensed gas is led into the inlet port side of the low pressure receiver 35 via the third throttle device 82 and the opening/closing mechanism 76. As the result, the liquid refrigerant rich in constituents at a low boiling point is stored in the intermediate pressure receiver 79, and the composition of the refrigerant being circulated through the main circuit is rich in constituents at a high boiling point.

Further, in order to make the composition of the refrigerant flowing through the main refrigerant circuit rich in constituents at a low boiling point, the system opens the opening/closing mechanism 76 and evaporates the refrigerant in the high pressure composition adjusting device 84 by heating the refrigerant at a temperature in the range, for example, from 50 to 100° C., using the high temperature heat source 81. When the opening/closing mechanism 76 is closed after the refrigerant is evaporated, the surplus refrigerant rich in constituents at a high boiling is held in the low pressure receiver 35. Therefore, the composition of the refrigerant flowing through the main circuit can be rich in constituents at a low boiling point.

Further, the high temperature heat source 81 in this embodiment can be an electric heater, a gas discharged from a compressor, or a refrigerant liquid under a high pressure. Cold water or a dual-phase refrigerant at a low temperature and under a low pressure is used for the heat sources at a low temperature 116*a* and 116*b*.

This refrigerating and air conditioning system divides the refrigerant in advance into two streams, one being a liquid refrigerant rich in refrigerant constituents at a high boiling point and the other being a gas refrigerant rich in refrigerant constituents at a low boiling point. They are rectified by a rectifying heat source unit in the intermediate pressure composition adjusting device, and they are selectively stored in the intermediate pressure composition adjusting device so as to adjust the composition of the refrigerant flowing in the main circuit.

If the refrigerant is stored in its liquid phase, the refrigerant is richer in constituents at a high boiling point in consequence of its phase equilibrium. However, in the case of the high pressure receiver, since the refrigerant flows into it in its liquid phase and is discharged out of it in its liquid phase, the refrigerant very similar in composition to that of the refrigerant in circulation is stored in the high pressure receiver.

Therefore, a refrigerant different in composition from that of the refrigerant stored in the intermediate pressure receiver is stored in the low pressure receiver in consequence of the phase equilibrium when the surplus refrigerant in the intermediate pressure receiver is relocated to the low pressure receiver even if any liquid refrigerant includes constituents at a low boiling point is stored in the intermediate pressure receiver.

In FIGS. 19 and 21, the low pressure receiver 35 stores the refrigerant rich in constituents at a high boiling point. Further, this low pressure receiver 35 stores the liquid refrigerant when the load is light. Also, the high pressure receiver performs a gas-liquid separation.

In addition, the intermediate pressure receiver 84 stores the refrigerant rich in constituents at a low boiling point and, when the load is heavy, also stores the liquid refrigerant.

Figure 20:
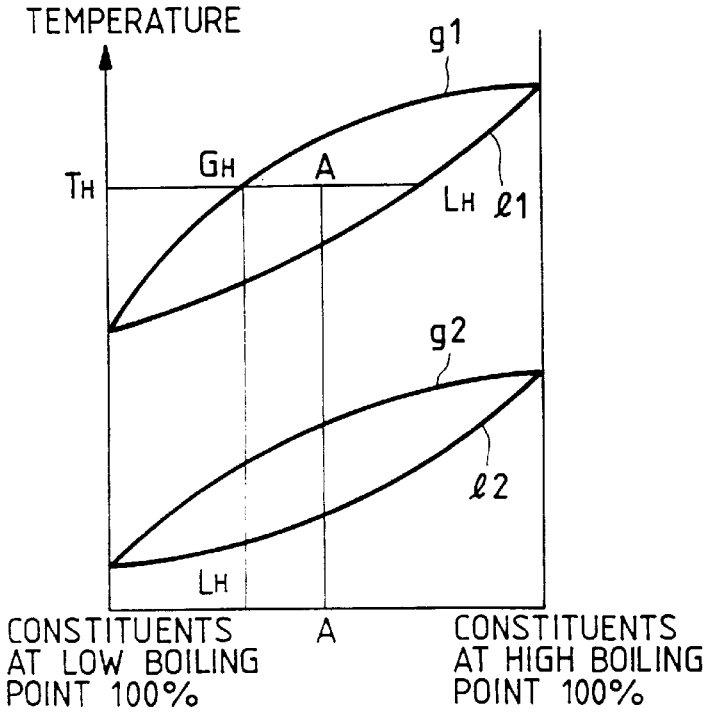
FIG. 20 is a chart relating to the temperature and the composition of the refrigerant described in the fourteenth embodiment of the present invention.

As seen in the phase chart presented in FIG. 20, the composition of the refrigerant gas and that of the refrigerant liquid in the high pressure receiver 42 are different, and the composition of the refrigerant gas is rich in constituents at a low boiling point. Therefore, by taking this refrigerant gas rich in constituents at a low boiling point into the intermediate pressure receiver 79 and condensing the refrigerant gas in it, an adjustment of its composition is possible.

With an intermediate pressure receiver provided as shown in FIGS. 19 and 21, it is possible surely to enclose a refrigerant of a certain composition in the inside of the intermediate pressure receiver 79. Therefore, a transient phenomenon (defrosting or the like) occurs after an adjustment is made of the composition of the refrigerant, and, even if any change occurs in the distribution of the quantity of the refrigerant in the refrigerant circuit, the refrigerant is less liable to a change in its composition.

Moreover, the low temperature heat source is provided so as to increase the speed of the condensing process and to condense even the constituents at a low boiling point where it is difficult to be condensed.

As mentioned so far, this system adjusts the temperatures in the high and low temperature heat sources to change the quantity of the liquid refrigerant in the receiver thereby adjusting the composition thereof in accordance with the temperature and the quantity. Also, this system is capable of changing the pressure in the receiver by adjusting the temperature in the receiver.

Sixteenth Embodiment

Figure 22:
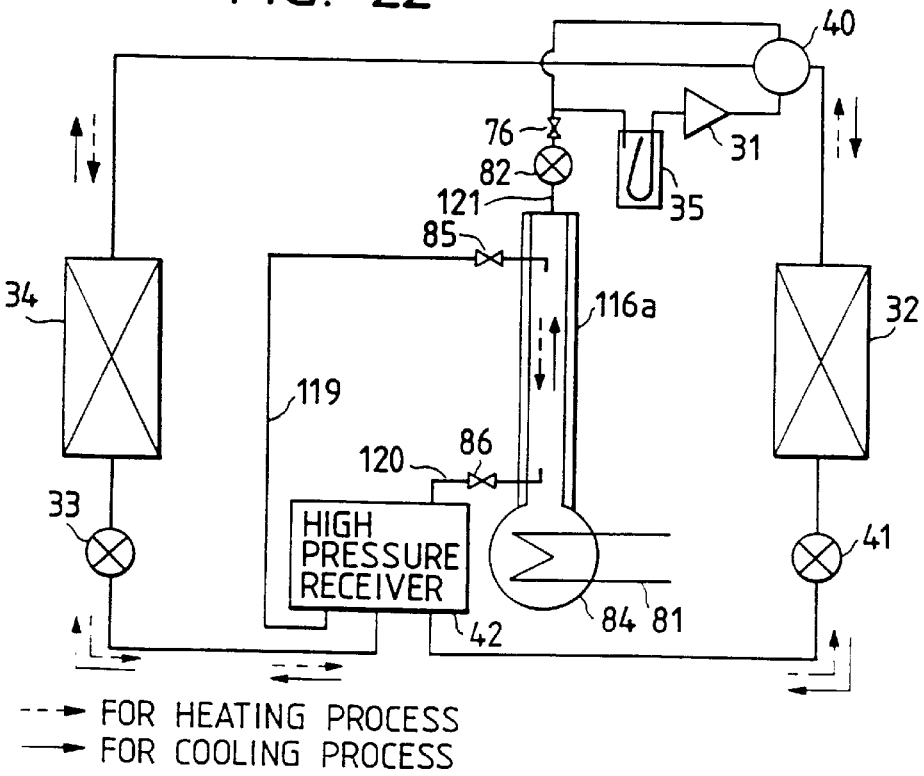
FIG. 22 is a refrigerant circuit diagram of a sixteenth embodiment of the present invention.

In the following part, a description will be given with respect to a sixteenth embodiment of a system of the present invention with reference to FIG. 22. In FIG. 22, a compressor 31, a four-way valve 40, a heat exchanger 32 at the heat source side, an auxiliary throttle device 41, a high pressure receiver 42, a main throttle device 33, a heat exchanger 34 at the load side, and a low pressure receiver 35 are connected in the serial order by the refrigerant piping and to form a main refrigerant circuit. The upper part of an intermediate pressure composition adjusting device 84 is connected to the lower part of the high pressure receiver 42 by a refrigerant piping 119 through an opening/closing mechanism 85. The lower part of the intermediate pressure composition adjusting device 84 is connected to the upper part of high pressure receiver 42 by a refrigerant piping 120 through an opening/closing mechanism 86. The reference number 82 denotes a third throttle device which is disposed on a refrigerant piping 121 with one end thereof being connected to the upper part of the intermediate pressure composition adjusting device 84 and the other end thereof being connected to the suction piping of the low pressure receiver 35. The reference number 116*a* denotes a low temperature heat source which is connected to the upper part of the intermediate pressure composition adjusting device 84, and the reference number 81 denotes a heat source disposed in the intermediate pressure composition adjusting device 84, and the temperature in the heat source can be adjusted in an appropriate manner.

Now, a description will be given with respect to the cooling operation of the system. With the opening/closing mechanism 76 kept closed, the system drives the compressor 31. The gas refrigerant at a high temperature and under a high pressure discharged from the compressor 31 is led through the four-way valve 40 and is then led into the heat exchanger 32 at the heat source side. The refrigerant condensed in the heat exchanger 32 at the heat source side is reduced somewhat in the auxiliary throttle device 41 and is thereafter fed into the high pressure receiver 42. The refrigerant is separated into gas and liquid in the high pressure receiver 42, and the pressure of the liquid refrigerant is reduced to a low pressure in the main throttle device 33. The refrigerant turned into a dual-phase refrigerant at a low temperature deprives the surrounding area of heat while the refrigerant is held in the heat exchanger 34 at the load side, the system thereby performing a cooling operation, and the refrigerant itself is evaporated to be turned into a gas, which is passed through the low pressure receiver 35 and is fed back to the compressor 31.

Now, a description will be given with respect to the heating operation of the system. With the opening/closing mechanism 76 kept closed, the system drives the compressor 31. The gas refrigerant at a high temperature and under a high pressure discharged from the compressor 31 is passed through the four-way valve 40 and is then fed into the heat exchanger 34 at the load side. This gas refrigerant at a high temperature and under a high pressure radiate heat to the surrounding area while the refrigerant is held in the heat exchanger 34 at the load side, and the refrigerant itself is condensed and reduced somewhat in the main throttle device 33, and the refrigerant is then fed into the high pressure receiver 42. The refrigerant is separated into the gas and the liquid in the high pressure receiver 42, and the liquid refrigerant is reduced to have a low pressure in the auxiliary throttle device 41, and the refrigerant thus turned into a dual-phase refrigerant at a low temperature deprives the surrounding area of heat in the heat exchanger 32 at the heat source side, and the refrigerant itself is evaporated and thereby turned into a gas, which is passed through the four-way valve 40 and the low pressure receiver 35 and is then fed back into the compressor 31.

As for a case in which the composition of the refrigerant flowing through the refrigerant circuit is to be changed, a description will first be given with respect to a method for storing a gas refrigerant rich in constituents at a low boiling point in the intermediate pressure composition adjusting device 84. With the opening/closing mechanisms 76 and 86 being kept open, the system conducts the gas refrigerant rich in constituents at a low boiling point from the upper part of the high pressure receiver 42 to the lower part of the intermediate pressure composition adjusting device 84 through the refrigerant piping 120. When the refrigerant moves upward in the inside of the intermediate pressure composition adjusting device 84, the refrigerant performs a heat exchange with the low temperature heat source 116*a*, and the refrigerant is thereby condensed and liquefied to be stored in the lower area of the intermediate pressure composition adjusting device 84. On the other hand, the uncondensed gas is conducted to the suction port side of the low pressure receiver 35 via the third throttle device 82 and the opening/closing mechanism 76. As the result, a liquid refrigerant rich in constituents at a low boiling point is stored in the intermediate pressure composition adjusting device 84, and also the composition of the refrigerant being circulated through the main circuit is richer in constituents at a high boiling point.

Moreover, the constituents at a low boiling point are condensed to be droplets in the intermediate pressure receiver, and the gas rich in constituents at a high boiling point is fed back into the low pressure receiver 35 via the bypass pipe 121.

Now, a description will be given with respect to a method for storing the refrigerant rich in constituents at a high boiling point into the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant flows downward by the action of the force of gravity from the upper area toward the lower area in the intermediate pressure composition adjusting device 84, the refrigerant performs a heat exchange with the high temperature heat source 81 so that some portion of the liquid refrigerant is evaporated and liquefied to be a gas refrigerant rich in constituents at a low boiling point which moves upward in the intermediate pressure composition adjusting device 84. This gas refrigerant rich in constituents at a low boiling point is conducted to be led to the suction port of the low pressure receiver 35 through the refrigerant piping 121. Accordingly, the liquid refrigerant stored in the lower area of the intermediate pressure composition adjusting device 84 is rich in constituents at a high boiling point. As the result, it is possible to make the composition of the refrigerant circulated in the main circuit rich in constituents at a low boiling point.

Further, the high temperature heat source 81 described in this embodiment may be an electric heater, a gas discharged out of the compressor, or a refrigerant liquid under a high pressure. For the low temperature heat sources 116*a* and 116*b*, it is possible to use cold water or a dual-phase refrigerant at a low temperature and under a low pressure.

Seventeenth Embodiment

Figure 23:
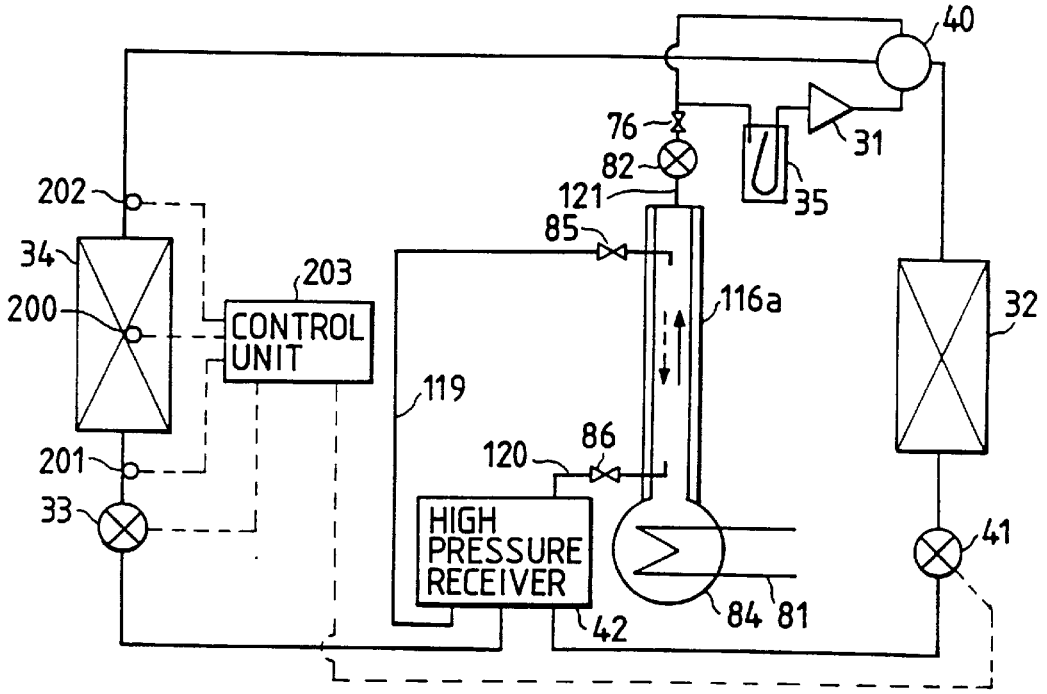
FIG. 23 is a refrigerant circuit diagram of a seventeenth embodiment of the present invention.

A description will be given with respect to a seventeenth example of preferred embodiment of a system of the present invention with reference to FIG. 23 as follows. In the drawing, moreover, those component elements used in the seventeenth embodiment illustrated in FIG. 22 which are the same as those used in the sixteenth embodiment are indicated respectively by the same reference numbers assigned to them, and their description is omitted. In the component elements forming the system as described in the sixteenth example of preferred embodiment shown in FIG. 22, the main throttle device 33 and the auxiliary throttle device 41 are respectively formed of an electronic expansion valve and the this system is further provided with: a temperature sensor 200 for detecting the temperature in the central part of the heat exchanger 34 at the load side, a temperature sensor 201 for measuring the temperature in the piping between the heat exchanger 34 at the load side and the main throttle device 33, a temperature sensor 202 for measuring the temperature in the piping between the heat exchanger 34 at the load side and the four-way valve 40, and a control unit 203 for calculating the respective degrees of opening of the main throttle device 33 and the auxiliary throttle device 41 on the basis of information furnished from these temperature sensors to adjust the opening degrees. Furthermore, electronic expansion valves are adopted for these throttle devices in order to effect linear changes in the opening degree of each throttle device.

Now, a description will be given with respect to the cooling operation of the system. With closing the opening/closing mechanism 76, the system drives the compressor 31. The gas refrigerant at a high temperature and under a high pressure discharged from the compressor 31 is passed through the four-way valve 40 to be fed into the heat exchanger 32 at the heat source side. Then, the refrigerant condensed in the heat exchanger 32 at the heat source side is reduced moderately in the auxiliary throttle device 41 and is thereafter fed into the high pressure receiver 42. The refrigerant is separated into gas and liquid therefrom in the high pressure receiver 42, and the liquid refrigerant is reduced until it attains a low pressure in the main throttle device 33, and the refrigerant thus turned into a dual-phase refrigerant at a low temperature is deprives the surrounding area of heat in the heat exchanger 34 at the load side, the system thereby performing a cooling operation, and the refrigerant itself is thereby evaporated to be turned into a gas. Then the gas is led through the four-way valve 40 and the low pressure receiver 35 and is fed back into the compressor 31. Here, the opening degree of the main throttle device 33 is controlled in such a manner that the difference between the temperature sensors 201 and 202 is in a certain constant value in order to prevent the liquid refrigerant from being fed back into the compressor 31.

Now, a description will be given with respect to the heating operation of the system. With closing the opening/closing mechanism 76, the system drives the compressor 31. The gas refrigerant at a high temperature and under a high pressure discharged from the compressor 31 is passed through the four-way valve 40 and is led into the heat exchanger 34 at the load side. This gas refrigerant at a high temperature and under a high pressure radiates heat to the surrounding area in the heat exchanger 34 at the load side, and the gas refrigerant itself is condensed. Thereafter, the condensed gas refrigerant is reduced moderately in the main throttle device 33, and is then fed into the high pressure receiver 42. The condensed gas refrigerant is separated into the gas and the liquid therefrom in the high pressure receiver 42, and the pressure of the liquid refrigerant is reduced to a low pressure in the auxiliary throttle device 41. The refrigerant thus turned into a dual-phase refrigerant at a low temperature deprives the surrounding area of heat in the heat exchanger 32 at the heat source side, which is evaporated to be turned into a gas. Finally, the gas is passed through the four-way valve 40 and the low pressure receiver 35, and is fed back into the compressor 31. Here, the opening degree of the auxiliary throttle device 41 is controlled so that the difference between the temperature sensor 200 and the temperature sensor 201 maintains a constant value at a certain level.

As to a case where the composition of the refrigerant flowing through the refrigerant circuit is to be changed, a description will be given first with respect to a method for storing a refrigerant rich in constituents at a low boiling point into the intermediate pressure composition adjusting device 84. With opening the opening/closing mechanisms 76 and 86, the gas refrigerant rich in constituents at a low boiling point is conducted from the upper area of the high pressure receiver 42 to the lower area of the intermediate pressure composition adjusting device 84 through the refrigerant piping 120. While the refrigerant moves upward in the inside of the intermediate pressure composition adjusting device 84, the refrigerant performs a heat exchange with the low temperature heat source 116*a* so as to be condensed and liquefied, and the refrigerant thus liquefied is stored in the lower area of the intermediate pressure composition adjusting device 84. The uncondensed gas is conducted to the suction inlet side of the low pressure receiver 35 via the third throttle device 82 and the opening/closing mechanism 76. As the result, the liquid refrigerant rich in constituents at a low boiling point is stored in the intermediate pressure composition adjusting device 84, and the composition of the refrigerant being circulated in the main circuit is rich in constituents at a high boiling point.

Now, a description will be given with respect to a method for storing a refrigerant rich in constituents at a high boiling point in the intermediate pressure composition adjusting device 84. With opening the opening/closing mechanisms 76 and 85, the system conducts a liquid refrigerant moderately rich in constituents at a high boiling point from the lower area of the high pressure receiver 42 into the upper area of the intermediate pressure composition adjusting device 84 through the refrigerant piping 119. After the refrigerant has moved down from the upper area of the intermediate pressure composition adjusting device 84 toward the lower area thereof by the action of the force of gravity, the refrigerant performs a heat exchange with the high temperature heat source 81 so that some portion of the refrigerant is evaporated to be turned into a gas refrigerant rich in constituents at a low boiling point, which moves upward in the intermediate pressure composition adjusting device 84. This gas refrigerant rich in constituents at a low boiling point is conducted through the refrigerant piping 121 and is led to the suction inlet port of the low pressure receiver 35. Accordingly, the refrigerant stored in the lower area of the intermediate pressure composition adjusting device 84 is rich in constituents at a high boiling point. As the result, the composition of the refrigerant circulated in the main circuit is rich in constituents at a low boiling point.

Further, for use as the high temperature heat source 81 which is described in this embodiment, an electric heater, a gas discharged out of a compressor, or a refrigerant liquid under a high pressure is available, and, for the low temperature heat sources 116*a* and 116*b*, cold water or a dual-phase refrigerant at a low temperature and under a low pressure may be used. For example, the system reduces the pressure by changing the composition of the refrigerant if the pressure is equal to or in excess of a value determined in advance. If the composition of the refrigerant is not directly detected, the control can be simpler.

Eighteenth Embodiment

Figure 24:
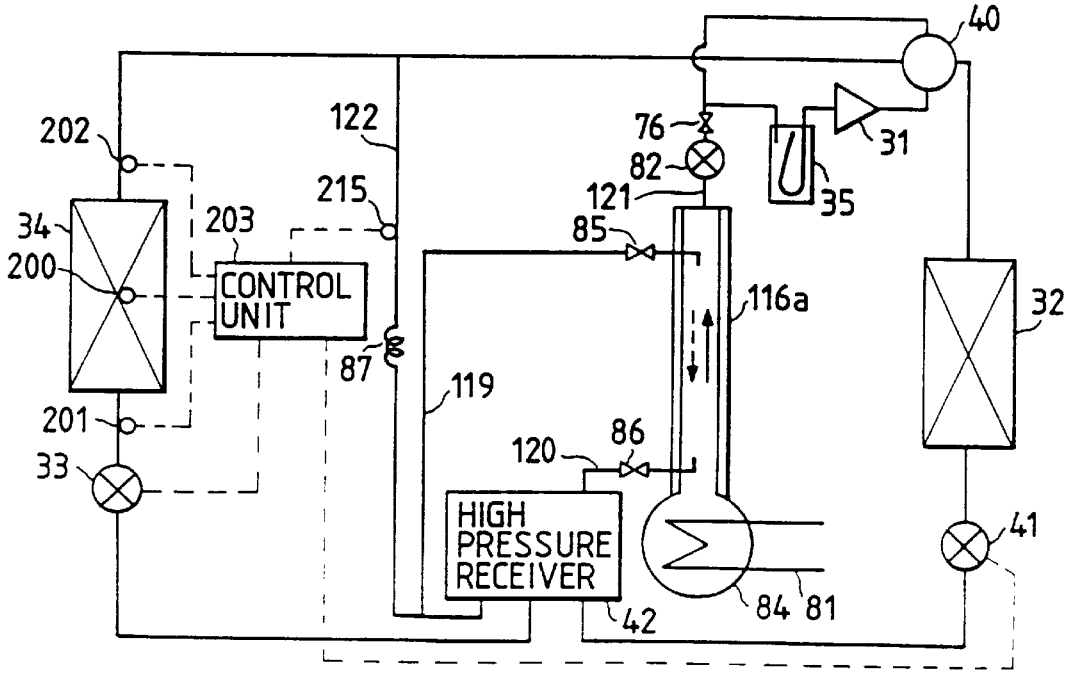
FIG. 24 is a refrigerant circuit diagram of a eighteenth embodiment of the present invention.

In the following part, an eighteenth embodiment of a system of the present invention will be described with reference to FIG. 24. In FIG. 24, moreover, those component elements in this embodiment which are the same as those used in the sixteenth embodiment are indicated by the same reference numbers respectively assigned to them, and their description is omitted. In the component elements of the system described in the sixteenth embodiment in FIG. 22, each of the main throttle device 33 and the auxiliary throttle device 41 are formed of an electronic expansion valve, and the system is further provided with: a temperature sensor 200 for detecting the temperature in the central part of the heat exchanger at the load side 34, a temperature sensor 201 for measuring the temperature in the piping between the heat exchanger 34 at the load side and the main throttle device 33, a temperature sensor 202 for measuring the temperature in the piping between the heat exchanger 34 at the load side and the four-way valve 40, a refrigerant piping 122 which leads from the lower area of the high pressure receiver 42 to the low pressure receiver 35 via a saturating temperature detecting throttle device 87, a temperature sensor 215 for detecting the temperature of the piping between the saturating temperature detecting throttle device 87 and the low pressure receiver 35, and a control unit 203 for calculating the opening degrees of the main throttle device 33 and the auxiliary throttle device 41 on the basis of the information furnished from the respective temperature sensors so as to adjust the opening degrees of these throttle valves.

Now, a description will be given with respect to the cooling operation of the system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is reduced moderately in the auxiliary throttle device 41 and is thereafter fed into the high pressure receiver 42. The refrigerant is separated into gas and liquid in the high pressure receiver 42, and the pressure of the liquid refrigerant is reduced to a low pressure in the main throttle device 33. The refrigerant thus turned into a dual-phase refrigerant at a low temperature deprives the surrounding area of heat in the heat exchanger 34 at the load side, the system thereby performing a cooling operation, and the refrigerant is also evaporated to be turned into a gas refrigerant which is passed through the four-way valve 40 and the low pressure receiver 35 and is fed back into the compressor 31. A part of the liquid refrigerant in the high pressure receiver 42 is reduced to be a dual-phase refrigerant by the saturating temperature detecting throttle device 87. Here, the system controls the opening degree of the main throttle device 33 so that the difference between the temperature sensors 202 and 215 is in a certain constant value.

Now, a description will be given with respect to the heating operation of the system. With closing the opening/closing mechanism 76, the system drives the compressor 31. The gas refrigerant at a high temperature and under a high pressure discharged from the compressor 31 is passed through the four-way valve 40 and is then fed into the heat exchanger 34 at the load side. This gas refrigerant at a high temperature and under a high pressure radiates heat to the surrounding area in the heat exchanger 34 at the load side, thereby performing a heating operation, and the refrigerant itself is condensed and is then reduced moderately in the main throttle device 33. Thereafter, the refrigerant is fed into the high pressure receiver 42. The refrigerant is separated into the gas and the liquid while it is held in the high pressure receiver 42, and the pressure of the liquid refrigerant is reduced to a low pressure in the auxiliary throttle device 41 so that it is turned into a dual-phase refrigerant at a low temperature. This dual-phase refrigerant deprives the surrounding area of heat in the heat exchanger 32 at the heat source side, and then is evaporated and turned into a gas refrigerant which is passed through the four-way valve 40 and the low pressure receiver 35 and is then fed back into the compressor 31. Here, the system controls the opening degree of the auxiliary throttle device 41 so that the difference between the temperature sensor 200 and the temperature sensor 201 is in a certain constant value at a certain level.

With respect to a case where the composition of the refrigerant flowing through the refrigerant circuit is to be changed, a description will be given first as to a method for storing the refrigerant rich in constituents at a low boiling point in the intermediate pressure composition adjusting device 84. With opening the opening/closing mechanisms 76 and 86, the system conducts the gas refrigerant rich in constituents at a low refrigerant from the upper area of the high pressure receiver 42 to the lower area of the intermediate pressure composition adjusting device 84 through the refrigerant piping 120. While the refrigerant moves upward in the intermediate pressure composition adjusting device 84, the refrigerant performs a heat exchange with the low temperature heat source 116*a* to be condensed and liquefied, and the refrigerant thus liquefied is stored in the lower area of the intermediate pressure composition adjusting device 84. The uncondensed gas is conducted to the suction inlet side of the low pressure receiver 35 via the third throttle device 82 and the opening/closing mechanism 76. As the result, the liquid refrigerant rich in constituents at a low boiling point is stored in the intermediate pressure composition adjusting device 84, and the composition of the refrigerant being circulated in the main circuit rich in constituents at a high boiling point.

Now, a description will be given as to a method for storing a refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the upper area of the high pressure receiver 42 to the upper area of the intermediate pressure composition adjusting device 84 through the refrigerant piping 119. While the refrigerant moves downward from the upper area toward the lower area in the intermediate pressure composition adjusting device 84 by the action of the force of gravity, the refrigerant performs a heat exchange with the high temperature heat source 81, and some portion of the refrigerant is thereby evaporated to be turned into a gas refrigerant rich in constituents at a low boiling point, and the gas refrigerant thus formed moves upward in the intermediate pressure composition adjusting device 84. This gas refrigerant rich in constituents at a low boiling point is passed through the refrigerant piping 121 and is led to the suction inlet port of the low pressure receiver 35. Accordingly, the liquid refrigerant stored in the lower area of the intermediate pressure composition adjusting device 84 is rich in constituents at a high boiling point. As the result, it will be possible for the system to make the composition of the refrigerant circulated in the main circuit rich in constituents at a low boiling point by a simple controlling operation.

In this regard, for the high temperature heat source 81 described in this embodiment, an electric heater, a gas discharged from the compressor, or a refrigerant liquid is available, and, for the low temperature heat sources 116*a* and 116*b*, cold water or a dual-phase refrigerant at a low temperature and under a low pressure is available. Further, the system can pass a judgment on the basis of only the inside state of the outside unit in case the compressor operates at a variable speed with control being performed only on the outside of the outside unit.

Nineteenth Embodiment

Figure 25:
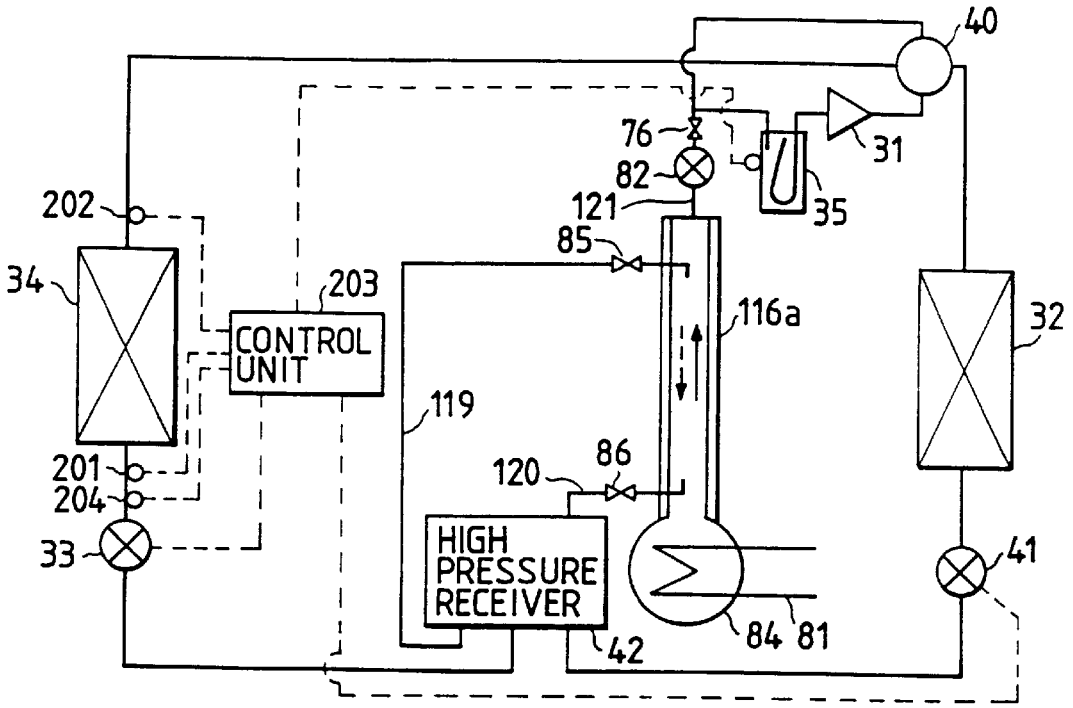
FIG. 25 is a refrigerant circuit diagram of a nineteenth embodiment of the present invention.

In the following part, a nineteenth embodiment of a system of the present invention will be described with reference to FIG. 25. Moreover, those component elements in FIG. 25 which are the same as those described in the sixteenth embodiment are indicated by the same reference numbers assigned to them, and a description of those component elements is omitted here. In the component elements of the sixteenth embodiment as shown in FIG. 22, the main throttle device 33 and the auxiliary throttle device 41 are formed of electronic expansion valves, and this system is further provided with: a temperature sensor 201 for measuring the temperature in the piping between the heat exchanger at the load side 34 and the main throttle device 33, a temperature sensor 202 and a pressure sensor 204 for respectively measuring the temperature and the pressure in the piping between the heat exchanger 34 at the load side and the four-way valve 40, a liquid level detecting unit 216 for detecting the quantity of the surplus refrigerant in the inside of the low pressure receiver 35, and a control unit 203 for calculating the composition of the refrigerant circulated in the refrigerant circuit on the basis of the information on the quantity of the surplus refrigerant and calculating the opening degrees of the main throttle device 33 and the auxiliary throttle device 41 by on the basis of the information furnished by the pressure sensor and the temperature sensors and the information on the above-mentioned composition of the refrigerant in circulation, so as to control the open degrees of these throttle devices. For the liquid level detecting unit 216, a generally known liquid level gauge, such as a supersonic wave type liquid level gauge, an electrostatic liquid level gauge, or a liquid level gauge utilizing a difference in the temperature rise at the time when the refrigerant gas or liquid is heated, may be used.

Now, a description is given with respect to the cooling operation. With closing the opening/closing mechanism 76, the system drives the compressor 31. The gas refrigerant at a high temperature and under a high pressure discharged from the compressor 31 is passed through the four-way valve 40 and is fed into the heat exchanger 32 at the heat source side. The refrigerant condensed in the heat exchanger 32 at the heat source side is reduced moderately in the auxiliary throttle device 41 and is thereafter fed into the high pressure receiver 42. The refrigerant is separated into gas and liquid therefrom in the high pressure receiver 42, and the pressure of the liquid refrigerant is reduced to a low pressure in the main throttle device 33. The refrigerant thus turned into a dual-phase refrigerant at a low temperature deprives the surrounding area of heat when it is in the heat exchanger 34 at the load side 34, the system thereby performing a cooling operation, and the refrigerant itself is evaporated to be turned into a gas, which is led through the four-way valve 40 and the low pressure receiver to be fed back into the compressor 31.

At this point, the system controls the opening degree of the main throttle device 33 in the manner as follows. First, the system detects the level of the surface of the refrigerant liquid in the low pressure receiver 35 so as to recognize the quantity of the surplus refrigerant which is generated in the low pressure receiver 35 to estimate the composition of the refrigerant flowing through the refrigerant circuit (hereinafter referred to as "the circulated refrigerant composition") on the basis of the detected quantity of the surplus refrigerant. Then, the system deduces the relation between the saturating temperature and the pressure from the circulated refrigerant composition as thus estimated. As the result, the system determines the opening degree of the main throttle device 33 so that the difference between the evaporating temperature as obtained from the pressure sensor 204 and the temperature as measured by the temperature sensor 202 is constant at a certain level.

Now, a description will be given with respect to the heating operation of this system. With closing the opening/ closing mechanism 76, the system drives the compressor 31. The gas refrigerant at a high temperature and under a high pressure discharged from the compressor 31 is fed into the heat exchanger 34 at the load side 34 via the four-way valve 40. This gas refrigerant at a high temperature and under a high pressure radiates heat to the surrounding area in the heat exchanger 34 at the load side, thereby performing a heating operation, and the refrigerant itself is condensed and then reduced moderately in the main throttle device 33, and is thereafter fed into the high pressure receiver 42. The refrigerant is separated into gas and liquid in the high pressure receiver 42, and the pressure of the liquid refrigerant is reduced to a low pressure in the auxiliary throttle device 41. The refrigerant thus turned into a dual-phase refrigerant at a low temperature deprives the surrounding area of heat in the heat exchanger 32 at the heat source side 32, and is evaporated to be turned into gas which is fed back into the compressor 31 via the four-way valve 40 and the low pressure receiver 35. Here, the system controls the opening degree of the auxiliary throttle device 41 so that the difference in temperature between the temperature sensor 200 and the temperature sensor 201 is constant at a certain level.

Here, the system controls the opening degree of the main throttle device 33 as follows. First, the system recognizes the quantity of the surplus refrigerant which is generated in the low pressure receiver 35 by detecting the level of the liquid surface of the refrigerant in the low pressure receiver 35, and then the system estimates the composition of the circulated refrigerant on the basis of the estimated quantity of the circulated refrigerant quantity. The system then deduces the relation between the saturating temperature and the pressure from the circulated refrigerant quantity. As the result, the system controls the opening degree of the auxiliary throttle device 41 so that the difference between the condensing temperature obtained from the pressure sensor 204 and the temperature measured by the temperature sensor 201 is constant at a certain level. Many methods are used for a detection of the liquid surface level, and the available methods includes a method which, for example, use of the difference that occurs between the gas and the liquid in the speed of a rise in the temperature when they are respectively heated.

With regard to a case where any change is to be made of the composition of the refrigerant flowing through the refrigerant circuit, a description will be given first of a method for storing the refrigerant rich in constituents at a low boiling point in the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the refrigerant moves upward in the inside of the intermediate pressure composition adjusting device 84, the refrigerant performs a heat exchange with a low temperature heat source 116*a* to be condensed and liquefied, and the refrigerant thus liquefied is stored in the lower area of the intermediate pressure composition adjusting device 84. The uncondensed gas is conducted to the suction inlet side of the low pressure receiver 35 via the third throttle device 82 and the opening/closing mechanism 76. As the result, the liquid refrigerant rich in constituents at a low boiling point is stored in the intermediate pressure composition adjusting device 84, and also the composition of the refrigerant being circulated through the main circuit can be made rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant flows downward by the effect of its force of gravity from the upper area toward the lower area in the intermediate pressure composition adjusting device 84, the liquid refrigerant performs a heat exchange with the high temperature heat source 81, and some portion of the liquid refrigerant is evaporated and turned into a gas refrigerant rich in constituents at a low boiling point, and the gas refrigerant moves upward in the intermediate pressure composition adjusting device 84. This gas refrigerant rich in constituents at a low boiling point is conducted through the refrigerant piping 121 to the low pressure receiver 35. Accordingly, the liquid refrigerant which is stored in the lower area of the intermediate pressure composition adjusting device 84 is rich in constituents at a high boiling point. As the result, the composition of the refrigerant circulated in the main circuit rich in constituents at a low boiling point.

Furthermore, for the high temperature heat source 81 in this embodiment, an electric heater, a gas discharged out of a compressor, or a refrigerant liquid at a high pressure is available, and, for the low temperature heat sources 116*a* and 116*b*, it is possible to use cold water or a dual-phase refrigerant at a low temperature and under a low pressure. Moreover, as regards the method for detecting the surplus refrigerant in the low pressure receiver 35, it is possible to estimate the quantity of the surplus refrigerant, for example, on the basis of the difference in the required quantity of the refrigerant between the cooling operation and the heating operation. This is due to the fact that the required quantity of the refrigerant can be roughly determined on the basis of the set-up of the refrigerant circuit, and fluctuations from the quantity thus determined can be taken into account in the form of the load conditions or the like.

As mentioned above, the system detects the level of the liquid surface in the accumulator and calculates the composition of the refrigerant on the basis of the detecting signals. In the calculation on the composition of the refrigerant, the system calculates the composition of the refrigerant on the basis of the relation between the height of the liquid surface as found in advance and the circulated refrigerant composition. Accordingly, the present invention makes it possible to perform an optimized operation of the refrigerating and air conditioning system, though it is simple in its equipment construction, even when any change occurs in the circulated refrigerant composition.

Twentieth Embodiment

Figure 26:
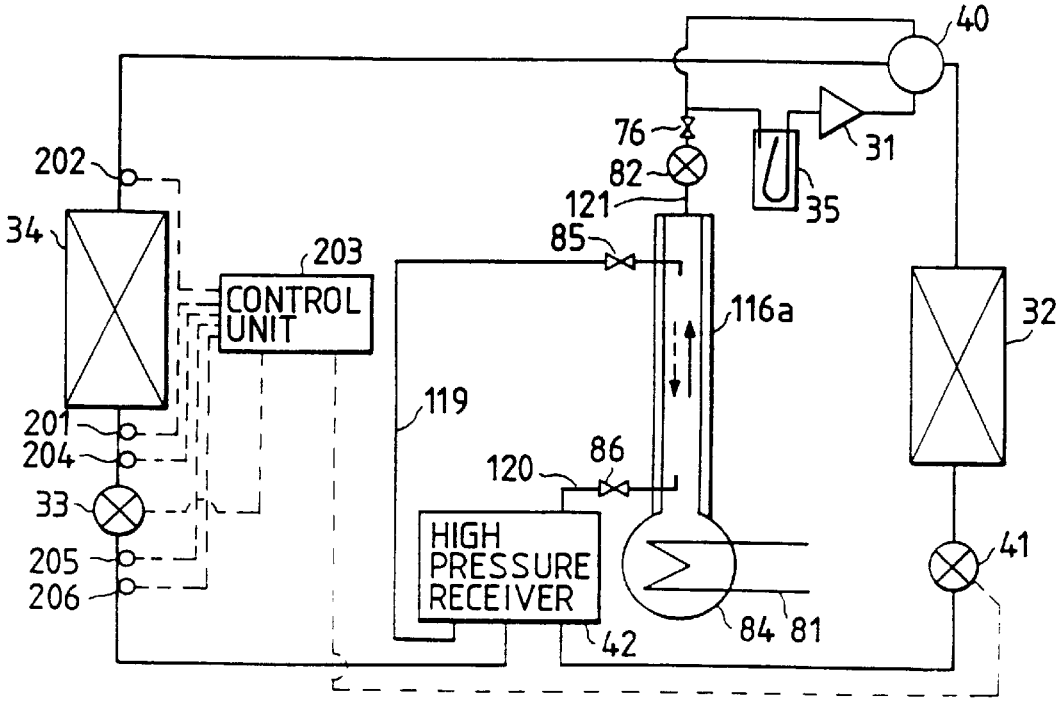
FIG. 26 is a refrigerant circuit diagram of a twentieth embodiment of the present invention.

In the following part, a twentieth embodiment of a system of the present invention will be described with reference to FIG. 26. In this regard, those component units and parts in embodiment as illustrated in FIG. 26 which are the same as those described in the sixteenth embodiment are indicated by the same reference numbers assigned to them, and their description will be omitted here. In the component elements of the sixteenth embodiment in FIG. 22, the main throttle device 33 and the auxiliary throttle device 41 are formed of electronic expansion valves, and the refrigerant circulating system in this embodiment is provided further with: a temperature sensor 201 and a pressure sensor 204 for respectively measuring the temperature and the pressure in the piping disposed between the heat exchanger 34 at the load side and the main throttle device 33, a temperature sensor 202 for measuring the temperature in the piping disposed between the heat exchanger 34 at the load side and the four-way valve 40, a pressure sensor 206 for measuring the pressure in the piping disposed between the high pressure receiver 42 and the main throttle device 33, and a control unit 203 for calculating the composition of the refrigerant being circulated in the refrigerant circuit on the basis of the information on the pressure and the temperature respectively measured as above, and calculating the open degrees of the main throttle device 33 and the auxiliary throttle device 41 on the basis of the information obtained from the pressure sensors and the temperature sensors and the information on the circulated refrigerant composition mentioned above, so as to adjust of the opening degrees of these throttle devices.

Now, a description will be made of the cooling operation of this system. With closing the opening/closing mechanism 76, the system drives the compressor 31. The gas refrigerant at a high temperature and under a high pressure discharged from the compressor 31 is conducted through the four-way valve 40 and is fed into the heat exchanger 32 at the heat source side. The refrigerant condensed in the heat exchanger 32 at the heat source side is reduced moderately in the auxiliary throttle device 41 and is thereafter fed into the high pressure receiver 42. The refrigerant is separated into gas and liquid components in the high pressure receiver 42, and the pressure of the liquid refrigerant is reduced to a low pressure in the main throttle device 33, and the refrigerant thus turned into a dual-phase refrigerant at a low temperature deprives the surrounding area of heat, the system thereby performing a cooling operation, while the refrigerant is held in the heat exchanger 34 at the load side, and the dual-phase refrigerant itself is evaporated to be returned into a gas refrigerant, which is passed through the four-way valve 40 and the low pressure receiver and is then fed back into the compressor 31.

Here, the open degree of the main throttle device 33 is controlled in the manner described as follows. First, the system assumes the circulated refrigerant composition so as to calculate the enthalpies of the refrigerant before and after the main throttle device on the basis of information furnished by the temperature sensors 201 and 205 and the pressure sensors 204 and 206. The system repeats the assumptions of the circulated refrigerant composition until these enthalpies have become equal, thereby determining the composition of the circulated refrigerant. Next, the system recognizes the relation of the saturating temperature and the saturating pressure for the refrigerant in the circulated refrigerant composition, and the system controls the opening degree of the main throttle device 33 so that the difference between the evaporating temperature estimated from the value of the pressure as measured by the pressure sensor 204, and the value measured by the temperature sensor is constant at a certain level. These sensors may be standard items and are available at a low price. The pressure sensor can be used concurrently as a pressure protecting device and also as a low pressure protecting device.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is fed into the heat exchanger 34 at the load side. This gas refrigerant at a high temperature and under a high pressure radiates its heat to the surrounding area while it is held in the heat exchanger 34 at the load side, and the gas refrigerant itself is condensed and is then moderately reduced in the main throttle device 33, being thereafter fed into the high pressure receiver 42. Then, the condensed refrigerant is separated between gas and liquid in the high pressure receiver 42, and the liquid refrigerant is reduced until it attains a low pressure in the auxiliary throttle device 41, and the refrigerant thus turned into a dual-phase refrigerant at a low temperature deprives the surrounding area of heat while the refrigerant is held in the heat exchanger 32 at the heat source side, and the refrigerant itself is thereby evaporated and turned into a gas. Then, the gas refrigerant thus formed is passed through the four-way valve 40 and the low pressure receiver, and is fed back into the compressor 31.

Here, the system controls the opening degree of the auxiliary throttle device 41 in the manner described as follows. First, the system assumes the circulated refrigerant composition so as to calculate the enthalpies of the refrigerant before and after the main throttle device on the basis of information furnished by the temperature sensors 201 and 202 and the pressure sensors 204 and 206. The system repeats this assumption of the circulated refrigerant composition until these enthalpies become equal, thereby determining the composition of the circulated refrigerant. Next, the system recognizes the relation of the saturating temperature and the saturating pressure for the refrigerant in the circulated refrigerant composition, and the system controls the opening degree of the auxiliary throttle device 41 in such a manner that the difference between the evaporating temperature estimated from the value of the pressure as measured by the pressure sensor 204, and the value measured by the temperature sensor is constant at a certain level.

As regards a case where the composition of the refrigerant flowing through the refrigerant circuit is changed, a description will be given first with respect to a method for storing the refrigerant rich in the constituents at a low boiling point into the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a*, being thereby condensed and liquefied. Then, the refrigerant thus liquefied is stored in the lower area of the intermediate pressure composition adjusting device 84. The uncondensed refrigerant gas is conducted to the suction inlet side of the low pressure receiver 35 via the third throttle device 82 and the opening/closing mechanism 76. As the result, the liquid refrigerant rich in constituents at a low boiling point is stored in the intermediate pressure composition adjusting device 84, and the composition of the refrigerant being circulated in the main circuit rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point through the refrigerant piping 119 from the lower area of the high pressure receiver 42 to the upper area of the intermediate pressure composition adjusting device 84. While the liquid refrigerant flows downward by the effect of its force of gravity from the upper area of the intermediate pressure composition adjusting device 84 toward the lower area thereof, the liquid refrigerant performs a heat exchange with the high temperature heat source 81, and some portion of the liquid refrigerant is evaporated and turned into a gas refrigerant rich in constituents at a low boiling point, the gas refrigerant then moving upward in the intermediate pressure composition adjusting device 84. This gas refrigerant rich in constituents at a low boiling point is passed through the refrigerant piping 121 and is then led into the suction inlet port of the low pressure receiver 35. The liquid refrigerant stored in the lower area of the intermediate pressure composition adjusting device 84 is in a composition rich in constituents at a high boiling point. As the result, the composition of the refrigerant circulated in the main circuit is rich in constituents at a high boiling point.

Here, the system estimates the circulated refrigerant composition by the method for estimating the circulated refrigerant composition as described above and adjusts the composition as mentioned above so as to controlling the time for an adjustment of the composition of the refrigerant. Upon the detection of the composition of the refrigerant, the system can get hold of the circulated refrigerant composition on the real-time so as to perform precise control and also the detected composition of the refrigerant is utilized for a protection thereof.

That is to say, the temperature and pressure of the refrigerant at the inlet port part of an evaporator and the temperature of the outlet port part of the condenser is detected so that the composition of the refrigerant being circulated in the refrigerating cycle having the compressor, condenser, expansion valve and evaporator is calculated. The circulated refrigerant composition thus obtained is inputted into the control unit so as to determine the control values for the compressor, the expansion valve, and the like in accordance with the circulated refrigerant composition found in the manner described above. Therefore, the present invention can make it possible for the refrigerating and air conditioning system to perform the optimum operation even if any change is made of the circulated refrigerant composition due to a change in the operating condition, the load condition for the refrigerating and air conditioning system or any change is made of the circulated refrigerant composition in consequence of any error in the operation at the time when the refrigerant is filled up in the system.

Twenty-First Embodiment

Figure 27:
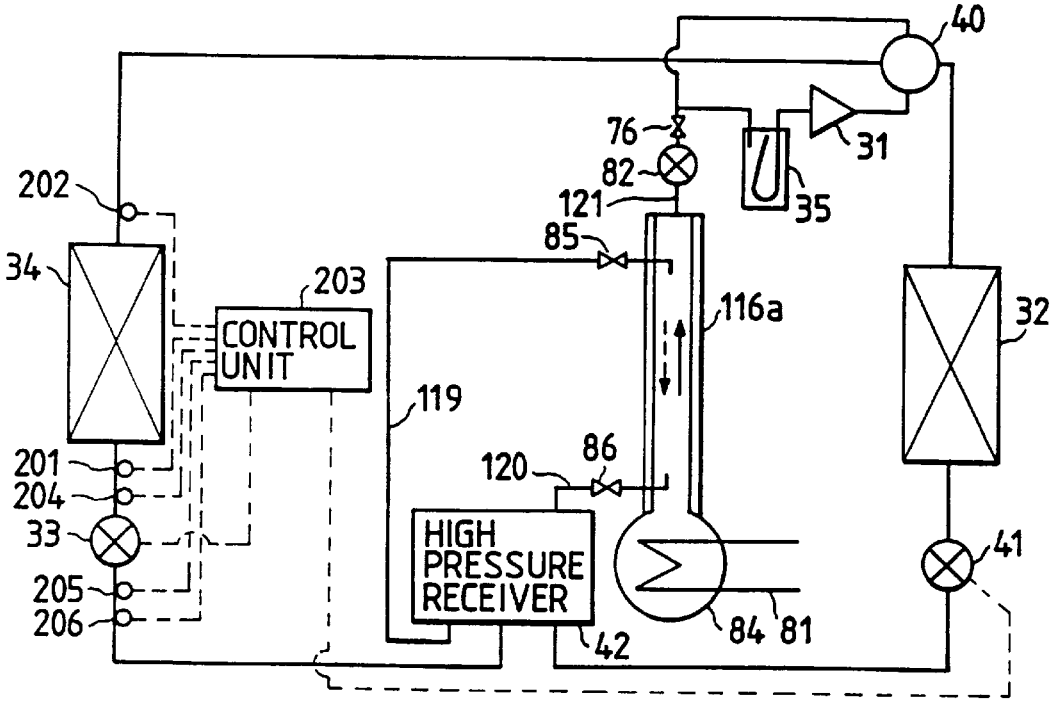
FIG. 27 is a refrigerant circuit diagram of a twenty-first embodiment of the present invention.

In the following part, a description will be made of a twenty-first embodiment of a system of the present invention with reference to FIG. 27. Moreover, those component units or parts described in this embodiment as illustrated in FIG. 27 which are the same as those described in the sixteenth embodiment are indicated by the same reference numbers assigned to them, and a description of those components will be omitted here. In the component elements described in the sixteenth embodiment as illustrated in FIG. 22, the main throttle device 33 and the auxiliary throttle device 41 are respectively formed of an electronic expansion valve, and the system is provided further with: a temperature sensor 201 and a pressure sensor 204 for respectively measuring the temperature and pressure of the piping disposed between the heat exchanger 34 at the load side and the main throttle device 33, a temperature sensor 202 for, measuring the temperature in the piping arranged between the heat exchanger 34 at the load side and the four-way valve 40, a pressure sensor 206 for measuring the pressure in the piping disposed between the high pressure receiver 42 and the main throttle device 33, and a control unit 203 for calculating the composition of the refrigerant being circulated in the refrigerant circuit on the basis of the above-mentioned information on the pressure and the temperature, and calculating to determine the opening degrees of the main throttle device 33 and the auxiliary throttle device 41 on the basis of the information obtained from the pressure sensors and the temperature sensors and the above-mentioned information obtained on the circulated refrigerant composition to adjusts the opening degrees of the main throttle device 33 and the auxiliary throttle device 41.

Now, a description will be given with respect to the cooling operation by this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is moderately reduced in the auxiliary throttle device 41 and is then led into the high pressure receiver 42. The refrigerant is separated into gas and liquid while it is held in the high pressure receiver 42, and the liquid refrigerant is then reduced to a low pressure in the main throttle device 33, and the refrigerant thus turned into a dual-phase refrigerant at a low temperature deprives the surrounding area of heat in the heat exchanger 34 at the load side, the system thereby performing a cooling operation, and the refrigerant itself is evaporated and turned into a gas refrigerant which is conducted through the four-way valve 40 and the low pressure receiver and is then fed back into the compressor 31.

Here, the system controls the opening degree of the main throttle device 33 in the manner described as follows. First, the system assumes that the degree of dryness of the refrigerant between the main throttle device 33 and the heat exchanger 34 at the load side is 0.2. Then, the system estimates the circulated refrigerant composition on the basis of the information from the temperature sensor 201 and pressure sensor 204. Next, the system recognizes the relation between the saturating temperature and the saturating pressure for the refrigerant in the circulated refrigerant composition so as to control the opening degree of the main throttle device 33 in such a manner that the difference between the evaporating temperature estimated from the value measured by the pressure sensor 204 and the value of the evaporating temperature actually measured by the temperature sensor is constant at a certain level.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is then led into the heat exchanger 34 at the load side. This gas refrigerant at a high temperature and under a high pressure radiates its heat to the surrounding area while the refrigerant is held in the heat exchanger 34 at the load side, thereby performing a heating operation, and the gas refrigerant itself is condensed and is then moderately reduced by the main throttle device 33, and the condensed refrigerant is then fed into the high pressure receiver 42. The refrigerant is separated into gas and liquid in the high pressure receiver 42, and the pressure of the liquid refrigerant is reduced to a low pressure in the auxiliary throttle device 41, and the refrigerant thus turned into a dual-phase refrigerant at a low temperature deprives the surrounding area of heat in the heat exchanger 32 at the heat source side to be evaporated and turned into a gas refrigerant. Finally it is led through the four-way valve 40 and the low pressure receiver and is then fed back into the compressor 31.

Here, the system controls the opening degree of the auxiliary throttle device 41 in the following manner. First, the system assumes a circulated refrigerant composition, and calculates the enthalpies of the refrigerant before and after the main throttle device 33 on the basis of the information obtained by the temperature sensors 201 and 202 and the information obtained by the pressure sensors 204 and 206 with using thus assumed circulated refrigerant composition. The system repeats the assumption of the circulated refrigerant composition until these enthalpies become equal to determine the circulated refrigerant composition. Next, the system recognizes the relation between the saturating temperature and the saturating pressure of the refrigerant in the circulated refrigerant composition to control the opening degree of the auxiliary throttle device 41 in such a manner that the difference between the condensing temperature estimated from the value measured by the pressure sensor 204 and the value measured by the temperature sensor 201 is constant.

As to a case where the composition of the refrigerant flowing through the refrigerant circuit is changed, a description will be given first with respect to a method for storing the refrigerant rich in constituents at a low boiling point in the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a* to be thereby condensed and liquefied. Then, the liquefied refrigerant is stored in the lower area of the intermediate pressure composition adjusting device 84. On the other hand, the uncondensed gas is conducted into the suction inlet port side of the low pressure receiver 35 via the third throttle device 82 and the opening/closing mechanism 76. As the result, the liquid refrigerant rich in constituents at a low boiling point is stored in the intermediate pressure composition adjusting device 84, and the composition of the refrigerant being circulated in the main circuit is rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant moves downward from the upper area of the intermediate pressure composition adjusting device 84 to the lower area thereof by the effect of its force of gravity, the liquid refrigerant performs a heat exchange with the high temperature heat source 81 so that some portion of the liquid refrigerant is evaporated and turned into a gas refrigerant rich in constituents at a low boiling point, and the gas refrigerant moves upward in the intermediate pressure composition adjusting device 84. This gas refrigerant rich in constituents at a low boiling point flows through the refrigerant piping 121 and is led into the suction inlet port of the low pressure receiver 35. Accordingly, the liquid refrigerant stored in the lower area of the intermediate pressure composition adjusting device 84 is rich in constituents at a high boiling point. As the result, the composition of the refrigerant which is circulated through the main circuit can be rich in constituents at a low boiling point.

As this system makes an adjustment of the opening degrees of the throttle devices in the manner as described above, this system is capable of dealing properly with complicated control.

Here, this system estimates the circulated refrigerant composition by the method for estimating the circulated refrigerant composition as described above, then making an adjustment of the composition of the refrigerant as described above, depending on the magnitude of the load, and controlling the time required for such an adjustment of the composition of the refrigerant.

Twenty-Second Embodiment

Figure 28:
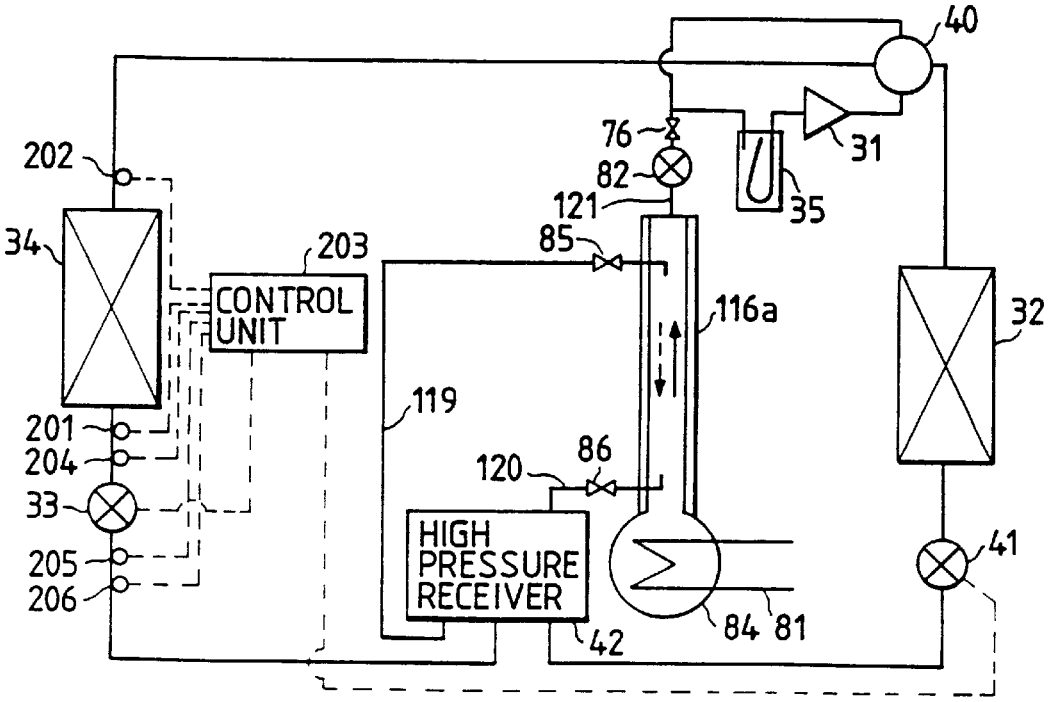
FIG. 28 is a refrigerant circuit diagram of a twenty-second embodiment of the present invention.

A description will be given with respect to a twenty-second embodiment of a system of the present invention with reference to FIG. 28 as follows. Moreover, those component units or parts described in this embodiment as illustrated in FIG. 28 which are the same as those described in the sixteenth embodiment are indicated by the same reference numbers assigned to them, and a description of those components will be omitted here. In the component elements described in the sixteenth example of preferred embodiment as illustrated in FIG. 22, the main throttle device 33 and the auxiliary throttle device 41 are respectively formed of an electronic expansion valve, and the system is provided further with: a temperature sensor 201 and a pressure sensor 204 for respectively measuring the temperature and the pressure in the piping disposed between the heat exchanger 34 at the load side and the main throttle device 33, a temperature sensor 202 for measuring the temperature in the piping disposed between the heat exchanger 34 at the load side and the four-way valve 40, a temperature sensor 205 and a pressure sensor 206 for respectively measuring the temperature and the pressure in the piping disposed between the high pressure receiver 42 and the main throttle device 33, and a control unit 203 for calculating the composition of the refrigerant being circulated in the refrigerant circuit on the basis of the above-mentioned information on the pressure and the temperature, calculating the opening degrees of the main throttle device 33 and the auxiliary throttle device 41 on the basis of the information obtained from the pressure sensors and the temperature sensors and the above-mentioned information obtained on the circulated refrigerant composition, and adjusting the opening degrees of the main throttle device 33 and the auxiliary throttle device 41.

Now, a description will be given with respect to the cooling operation by this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is moderately reduced in the auxiliary throttle device 41 and is then led into the high pressure receiver 42. The refrigerant is separated into gas and liquid in the high pressure receiver 42, and the liquid refrigerant is then reduced to a low pressure in the main throttle device 33, and the refrigerant thus turned into a dual-phase refrigerant at a low temperature deprives the surrounding area of heat in the heat exchanger 34 at the load side, the system thereby performing a cooling operation. Then, the dual-phase refrigerant itself is evaporated and turned into a gas refrigerant, which is conducted through the four-way valve 40 and the low pressure receiver and is then fed back into the compressor 31.

Here, the system controls the opening degree of the main throttle device 33 in the following manner. First, the system assumes that the degree of dryness of the refrigerant between the main throttle device 33 and the heat exchanger 34 at the load side is 0.2. Then, the system estimates the circulated refrigerant composition on the basis of the information obtained by a temperature sensor 201 and the pressure sensor 204. Next, the system recognizes the relation between the saturating temperature and the saturating pressure for the refrigerant in the circulated refrigerant composition and controls the opening degree of the main throttle device 33 in such a manner that the difference between the evaporating temperature estimated from the value measured by the pressure sensor 204 and the value of the evaporating temperature actually measured by the temperature sensor 202 is constant at a certain level.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is then led into the heat exchanger 34 at the load side. This gas refrigerant at a high temperature and under a high pressure radiates its heat to the surrounding area in the heat exchanger 34 at the load side. The gas refrigerant itself is condensed and is then moderately reduced by the main throttle device 33. The condensed refrigerant is then fed into the high pressure receiver 42. The refrigerant is separated into gas and liquid in the high pressure receiver 42, and the pressure of the liquid refrigerant is reduced to a low pressure in the auxiliary throttle device 41. The refrigerant thus turned into a dual-phase refrigerant at a low temperature deprives the surrounding area of heat in the heat exchanger 32 at the heat source side, and then the refrigerant is thereby evaporated and turned into a gas refrigerant, which is led through the four-way valve 40 and the low pressure receiver and is then fed back into the compressor 31.

Here, the system controls the opening degree of the auxiliary throttle device 41 in the following manner. First, the system assumes that the degree of dryness between the auxiliary throttle device 41 and the high pressure receiver 42 is 0. Then, the system estimates the circulated refrigerant composition on the basis of the values detected respectively by the temperature sensor 205 and by the pressure sensor 206. Next, the system recognizes the relation between the saturating temperature and the saturating pressure for the refrigerant in the circulated refrigerant composition thus estimated, and the system controls the opening degree of the auxiliary throttle device 41 in such a manner that the difference between the condensing temperature estimated from the value measured by the pressure sensor 204 and the value measured by the temperature sensor 201 is constant.

As to a case where the composition of the refrigerant which flows through the refrigerant circuit is changed, a description will be given first with respect to a method for storing the refrigerant rich in constituents at a low boiling point in the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a*, and the gas refrigerant is thereby condensed and liquefied. Accordingly, it is stored in the lower area of the intermediate pressure composition adjusting device 84. The uncondensed gas is conducted into the suction inlet port side of the low pressure receiver 35 via the third throttle device 82 and the opening/closing mechanism 76. As the result, the system stores the liquid refrigerant rich in constituents at a low boiling point in the intermediate pressure composition adjusting device 84 and the composition of the refrigerant being circulated in the main circuit is rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant moves downward from the upper area of the intermediate pressure composition adjusting device 84 to the lower area of the same composition adjusting device 84 by the effect of its force of gravity, the liquid refrigerant performs a heat exchange with the high temperature heat source 81, some portion of the liquid refrigerant being thereby evaporated and turned into a gas refrigerant rich in constituents at a low boiling point. This gas refrigerant moves upward in the intermediate pressure composition adjusting device 84. This gas refrigerant rich in constituents at a low boiling point flows through the refrigerant piping 121 and is led into the suction inlet port of the low pressure receiver 35. The liquid refrigerant stored in the lower area of the intermediate pressure composition adjusting device 84 is in a composition rich in constituents at a high boiling point. As result, the composition of the refrigerant which is circulated through the main circuit can be made rich in constituents at a low boiling point.

This system estimates the circulated refrigerant composition by the method for estimating the circulated refrigerant composition as described above and then makes an adjustment of the composition of the refrigerant in the manner as described above, depending on the magnitude of the load, and performs control on the time which is required for such an adjustment of the composition of the refrigerant.

In this manner, this system calculates the composition of the refrigerant on the assumption that the degree of dryness of the refrigerant which flows into the evaporator is in a predetermined value only on the basis of the temperature and the pressure of the refrigerant at the inlet port part of the evaporator in a refrigerating cycle. Therefore, this system, though simple in its construction, is capable of performing its optimum operation even if the circulated refrigerant composition is changed.

Twenty-Third Embodiment

Figure 29:
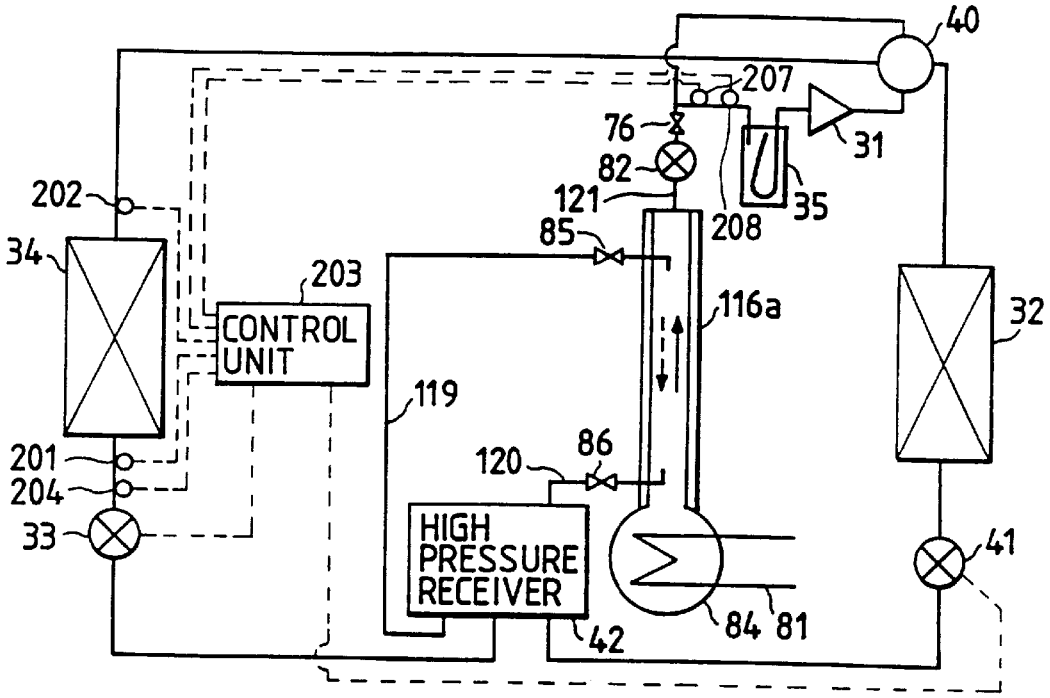
FIG. 29 is a refrigerant circuit diagram of a twenty-third embodiment of the present invention.

A description will be given with respect to a twenty-third embodiment of a system of the present invention with reference to FIG. 29 as follows. Moreover, those component units or parts described in this embodiment as illustrated in FIG. 29 which are the same as those described in the sixteenth embodiment are indicated by the same reference numbers assigned to them, and a description of those components is omitted here. In the component elements described in the sixteenth embodiment as illustrated in FIG. 22, the main throttle device 33 and the auxiliary throttle device 41 are respectively formed of an electronic expansion valve, and the system is provided further with: a temperature sensor 201 and a pressure sensor 204 for respectively measuring the temperature and the pressure in the piping disposed between the heat exchanger 34 at the load side and the main throttle device 33, a temperature sensor 202 for measuring the temperature in the piping disposed between the heat exchanger 34 at the load side and the four-way valve 40, a temperature sensor 207 and a pressure sensor 208 disposed at the suction inlet port side of the low pressure receiver 35, and a control unit 203 for calculating the composition of the refrigerant being circulated in the refrigerant circuit on the basis of the above-mentioned information on the pressure and the temperature, calculating the opening degrees of the main throttle device 33 and the auxiliary throttle device 41 on the basis of the information obtained from the pressure sensors and the temperature sensors and the above-mentioned information obtained on the circulated refrigerant composition, and then adjusting the opening degrees of the main throttle device 33 and the auxiliary throttle device 41.

Now, a description will be given with respect to the cooling operation by this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is moderately reduced in the auxiliary throttle device 41 and is then led into the high pressure receiver 42. Then, the refrigerant is separated into gas and liquid in the high pressure receiver 42, and the liquid refrigerant is then reduced to a low pressure in the main throttle device 33. The refrigerant thus turned into a dual-phase refrigerant at a low temperature deprives the surrounding area of heat in the heat exchanger 34 at the load side, the system thereby performing a cooling operation. The dual-phase refrigerant itself is evaporated and turned into a gas refrigerant, which is conducted through the four-way valve 40 and the low pressure receiver and is then fed back into the compressor 31.

Here, the system controls the opening degree of the main throttle device 33 in the following manner. First, the system assumes that the degree of dryness of the refrigerant at the inlet side of the low pressure receiver 35 is in the range from 0.9 to 1.0. Then, the system estimates the circulated refrigerant composition on the basis of the information obtained by a temperature sensor 207 and the pressure sensor 208. Next, the system recognizes the relation between the saturating temperature and the saturating pressure for the refrigerant in the circulated refrigerant composition and controls the opening degree of the main throttle device 33 in such a manner that the difference between the evaporating temperature estimated from the value measured by the pressure sensor 204 and the value of the evaporating temperature actually measured by the temperature sensor 202 is constant at a certain level.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is then led into the heat exchanger 34 at the load side. This gas refrigerant at a high temperature and under a high pressure radiates its heat to the surrounding area in the heat exchanger 34 at the load side, and the gas refrigerant itself is condensed and is then moderately reduced by the main throttle device 33. The condensed refrigerant is then fed into the high pressure receiver 42. The refrigerant is separated into gas and liquid in the high pressure receiver 42, and the pressure of the liquid refrigerant is reduced to a low pressure in the auxiliary throttle device 41. The refrigerant thus turned into a dual-phase refrigerant at a low temperature deprives the surrounding area of heat in the heat exchanger 32 at the heat source side, the refrigerant being thereby evaporated and turned into a gas refrigerant. Finally, it is led through the four-way valve 40 and the low pressure receiver and is then fed back into the compressor 31.

Here, the system controls the opening degree of the auxiliary throttle device 41 in the following manner. First, the system assumes that the degree of dryness at the inlet port of the low pressure receiver 35 is in the range from 0.9 to 1.0. Next, the system recognizes the relation between the saturating temperature and the saturating pressure for the refrigerant in the circulated refrigerant composition thus estimated, and the system controls the opening degree of the auxiliary throttle device 41 in such a manner that the difference between the condensing temperature estimated from the value measured by the pressure sensor 204 and the value measured by the temperature sensor 201 is constant.

As to a case where the composition of the refrigerant which flows through the refrigerant circuit is changed, a description will be given first with respect to a method for storing the refrigerant rich in constituents at a low boiling point in the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a*, and the gas refrigerant is thereby condensed and liquefied to be stored in the lower area of the intermediate pressure composition adjusting device 84. The uncondensed gas is conducted into the suction inlet port side of the low pressure receiver 35 via the third throttle device 82 and the opening/closing mechanism 76. As the result, the system stores the liquid refrigerant rich in constituents at a low boiling point in the intermediate pressure composition adjusting device 84, and the composition of the refrigerant being circulated in the main circuit is rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant moves downward from the upper area of the intermediate pressure composition adjusting device 84 to the lower area thereof by the effect of its force of gravity, the liquid refrigerant performs a heat exchange with the high temperature heat source 81, some portion of the liquid refrigerant being thereby evaporated and turned into a gas refrigerant rich in constituents at a low boiling point. This gas refrigerant moves upward in the intermediate pressure composition adjusting device 84. This gas refrigerant rich in constituents at a low boiling point flows through the refrigerant piping 121 and is led into the suction inlet port of the low pressure receiver 35. The liquid refrigerant which is stored in the lower area of the intermediate pressure composition adjusting device 84 is rich in constituents at a high boiling point. As the result, the composition of the refrigerant being circulated through the main circuit can be made rich in constituents at a low boiling point.

According to this method, the system is capable of estimating the circulated refrigerant composition in the same position for the cooling operation and the heating operation.

Here, the system estimates the circulated refrigerant composition by the method for estimating the composition of the refrigerant as described above, and then makes an adjustment of the composition of the refrigerant in the manner as described above, depending on the magnitude of the load, and performs control on the time which is required for such an adjustment of the composition of the refrigerant.

Now, as this system is provided with a control unit which calculates the composition of the refrigerant being circulated in the cycle by detecting the temperature and pressure of the refrigerant in the low pressure receiver (namely, an accumulator) or the refrigerant between the low pressure receiver (namely, an accumulator) and the suction inlet piping for the compressor and performs control on the operation of a refrigerating cycle in a manner suitable for the circulated refrigerant composition thus calculated, this system, though simple in its construction, is capable of always performing its optimum operation even if any change occurs in the circulated refrigerant composition in the cycle.

Twenty-Fourth Embodiment

Figure 30:
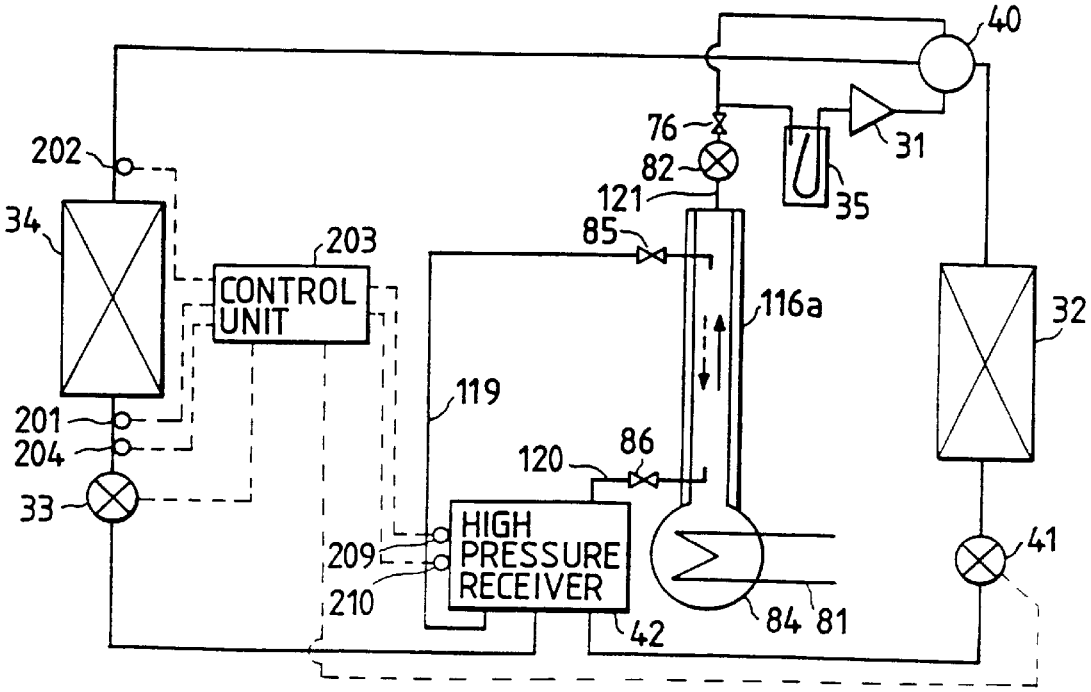
FIG. 30 is a refrigerant circuit diagram of a twenty-fourth embodiment of the present invention.

A description will be given with respect to a twenty-fourth embodiment of a system of the present invention with reference to FIG. 30 as follows. Moreover, those component units or parts described in this embodiment as illustrated in FIG. 30 which are the same as those described in the sixteenth embodiment are indicated by the same reference numbers assigned to them, and a description of those components will be omitted here. In the component elements described in the sixteenth embodiment as illustrated in FIG. 22, the main throttle device 33 and the auxiliary throttle device 41 are respectively formed of an electronic expansion valve, and the system is provided further with: a temperature sensor 201 and a pressure sensor 204 for respectively measuring the temperature and the pressure in the piping disposed between the heat exchanger 34 at the load side and the main throttle device 33, a temperature sensor 202 measuring the temperature in the piping disposed between the heat exchanger 34 at the load side and the four-way valve 40, a temperature sensor 209 and a pressure sensor 210 for respectively measuring the saturating temperature and pressure of the refrigerant held in the high pressure receiver 34, and a control unit 203 for calculating the composition of the refrigerant being circulated in the refrigerant circuit on the basis of the above-mentioned information on the pressure and the temperature, calculating the opening degrees of the main throttle device 33 and the auxiliary throttle device 41 by on the basis of the information obtained from the pressure sensors and the temperature sensors and the above-mentioned information obtained on the circulated refrigerant composition, and then adjusting the opening degrees of the main throttle device 33 and the auxiliary throttle device 41.

Now, a description will be given with respect to the cooling operation by this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is moderately reduced in the auxiliary throttle device 41 and is then led into the high pressure receiver 42. Then, the refrigerant is separated into gas and liquid while it is held in the high pressure receiver 42, and the liquid refrigerant is then reduced to a low pressure in the main throttle device 33. The refrigerant thus turned into a dual-phase refrigerant at a low temperature deprives the surrounding area of heat in the heat exchanger 34 at the load side, the system thereby performing a cooling operation, and the dual-phase refrigerant itself is evaporated and turned into a gas refrigerant, which is conducted through the four-way valve 40 and the low pressure receiver and is then fed back into the compressor 31.

Here, the system controls the opening degree of the main throttle device 33 in the following manner. First, as there is a liquid surface of the refrigerant in the high pressure receiver 42 and as the refrigerant is in a saturated state, it is possible for the system to estimate the circulated refrigerant composition by the temperature sensor 209 and the pressure sensor 210. Next, the system recognizes the relation between the saturating temperature and the saturating pressure for the refrigerant in the circulated refrigerant composition and controls the opening degree of the main throttle device 33 in such a manner that the difference between the evaporating temperature estimated from the value measured by the pressure sensor 204 and the value of the evaporating temperature actually measured by the temperature sensor 202 is constant at a certain level.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is then led into the heat exchanger 34 at the load side. This gas refrigerant at a high temperature and under a high pressure radiates its heat to the surrounding area in the heat exchanger 34 at the load side, and the gas refrigerant itself is condensed and is then moderately reduced by the main throttle device 33. The condensed refrigerant is then fed into the high pressure receiver 42. The refrigerant is separated into gas and liquid in the high pressure receiver 42, and the liquid refrigerant is reduced to a low pressure in the auxiliary throttle device 41. The refrigerant thus turned into a dual-phase refrigerant at a low temperature deprives the surrounding area of heat in the heat exchanger 32 at the heat source side, and the refrigerant is thereby evaporated and turned into a gas refrigerant. Finally, it is led through the four-way valve 40 and the low pressure receiver and is then fed back into the compressor 31.

Here, the system controls the opening degree of the auxiliary throttle device 41 in the following manner. First, as there is a liquid surface of the refrigerant in the high pressure receiver 42 and as the refrigerant is in a saturated state, it is possible for the system to estimate the circulated refrigerant composition by the temperature sensor 209 and the pressure sensor 210. Next, the system recognizes the relation between the saturating temperature and the saturating pressure for the refrigerant in the circulated refrigerant composition thus estimated, and the system controls the opening degree of the auxiliary throttle device 41 in such a manner that the difference between the condensing temperature estimated from the value measured by the pressure sensor 204 and the value measured by the temperature sensor 201 is constant.

As to a case where the composition of the refrigerant which flows through the refrigerant circuit is changed, a description will be given first with respect to a method for storing the refrigerant rich in constituents at a low boiling point in the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a* to be condensed and liquefied, thereby being then stored in the lower area of the intermediate pressure composition adjusting device 84. The uncondensed gas is conducted into the suction inlet port side of the low pressure receiver 35 via the third throttle device 82 and the opening/closing mechanism 76. As the result, the system stores the liquid refrigerant rich in constituents at a low boiling point in the intermediate pressure composition adjusting device 84 and the composition of the refrigerant being circulated in the main circuit is rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant moves downward from the upper area of the intermediate pressure composition adjusting device 84 to the lower area thereof by the effect of its force of gravity, the liquid refrigerant performs a heat exchange with the high temperature heat source 81, some portion of the liquid refrigerant being thereby evaporated and turned into a gas refrigerant rich in constituents at a low boiling point. This gas refrigerant moves upward in the intermediate pressure composition adjusting device 84. This gas refrigerant rich in constituents at a low boiling point flows through the refrigerant piping 121 and is led into the suction inlet port of the low pressure receiver 35. The liquid refrigerant which is stored in the lower area of the intermediate pressure composition adjusting device 84 is rich in constituents at a high boiling point. As the result, the composition of the refrigerant being circulated through the main circuit can be made rich in constituents at a low boiling point.

Here, the system estimates the circulated refrigerant composition by the method for estimating the composition of the refrigerant as described above, and then makes an adjustment of the composition of the refrigerant in the manner as described above, depending on the magnitude of the load, and performs control on the time which is required for such an adjustment of the composition of the refrigerant. Further, even though a method for estimating the circulated refrigerant composition by a measurement of the pressure and temperature in the high pressure receiver 42 is described here, the present invention also includes a method for estimating the circulated refrigerant composition by the pressure and temperature in the low pressure receiver 35. Further, as there is surely a saturated liquid surface, the system is capable of performing the sensing operation in the same position for the cooling operation and the heating operation.

Twenty-Fifth Embodiment

Figure 31:
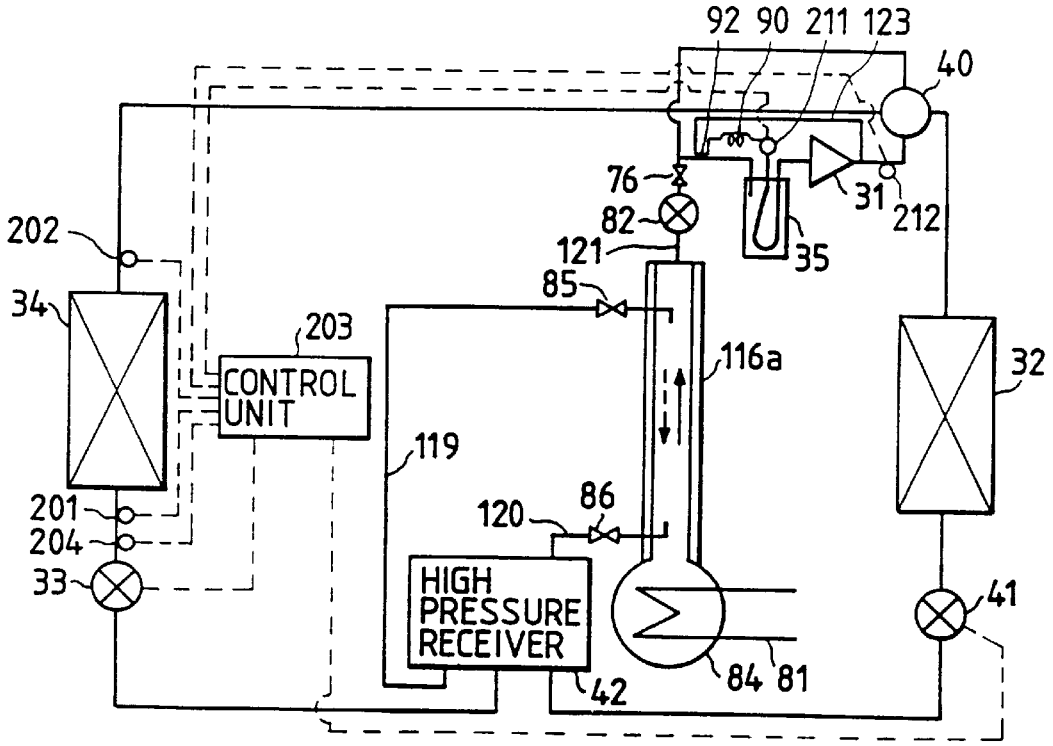
FIG. 31 is a refrigerant circuit diagram of a twenty-fifth embodiment of the present invention.

In the following part, a description will be given with respect to a twenty-fifth embodiment of a system of the present invention with reference to FIG. 31. Moreover, those component units or parts described in this embodiment as illustrated in FIG. 31 which are the same as those described in the sixteenth embodiment are indicated by the same reference numbers assigned to them, and a description of those components will be omitted here. In the component elements described in the sixteenth embodiment as illustrated in FIG. 22, the main throttle device 33 and the auxiliary throttle device 41 are respectively formed of an electronic expansion valve, and the system is provided further with: a temperature sensor 201 and a pressure sensor 204 for respectively measuring the temperature and the pressure in the piping between the heat exchanger 34 at the load side and the main throttle device 33, a temperature sensor 202 for measuring the temperature in the piping between the heat exchanger 34 at the load side and the four-way valve 40, a refrigerant piping 123 which branches off from the discharge port side of the compressor 31 and is connected to the suction inlet port side of the low pressure receiver 35 by way of the third throttle device 90 and the refrigerant heat exchanger 92, a temperature sensor 211 for measuring the temperature in the piping between the third throttle device 90 and the suction inlet port of the low pressure receiver 35 in the refrigerant piping 123, a pressure sensor 212 for measuring the discharge pressure of the compressor 31, and a control unit 203 for calculating the composition of the refrigerant being circulated in the refrigerant circuit on the basis of the above-mentioned information on the pressure and the temperature, calculating the opening degrees of the main throttle device 33 and the auxiliary throttle device 41 on the basis of the information obtained from the pressure sensors and the temperature sensors and the above-mentioned information obtained on the circulated refrigerant composition, and adjusting the opening degrees of the main throttle device 33 and the auxiliary throttle device 41.

Now, a description will be given with respect to the cooling operation by this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is moderately reduced in the auxiliary throttle device 41 and is then led into the high pressure receiver 42. Then, the refrigerant is separated of the gas and the liquid in the high pressure receiver 42, and the liquid refrigerant is then reduced to a low pressure in the main throttle device 33, and the refrigerant thus turned into a dual-phase refrigerant at a low temperature deprives the surrounding area of heat in the heat exchanger 34 at the load side, the system thereby performing a cooling operation. The dual-phase refrigerant itself is evaporated and turned into a gas refrigerant, which is conducted through the four-way valve 40 and the low pressure receiver 35 and is then fed back into the compressor 31.

Here, the system controls the opening degree of the main throttle device 33 in the following. First, if it is assumed that the degree of dryness of the refrigerant in the inside region of the refrigerant piping 123 is in the range from 0.1 to 0.5 in the proximity of the measuring part of the temperature sensor 211, it is possible for the system to estimate the circulated refrigerant composition on the basis of information on the results of measurements by the temperature sensor 211 and by the pressure sensor 212. Next, the system recognizes the relation between the saturating temperature and the saturating pressure for the refrigerant in the circulated refrigerant composition, and controls the opening degree of the main throttle device 33 in such a manner that the difference between the evaporating temperature estimated from the value measured by the pressure sensor 204 and the value of the evaporating temperature actually measured by the temperature sensor 202 is constant at a certain level.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is then led into the heat exchanger 34 at the load side. This gas refrigerant at a high temperature and under a high pressure radiates its heat to the surrounding area in the heat exchanger 34 at the load side, and the gas refrigerant itself is condensed and is then moderately reduced by the main throttle device 33. The condensed refrigerant is then fed into the high pressure receiver 42. The refrigerant is separated into gas and liquid in the high pressure receiver 42, and the pressure of the liquid refrigerant is reduced to a low pressure in the auxiliary throttle device 41 The refrigerant thus turned into a dual-phase refrigerant at a low temperature deprives the surrounding area of heat in the heat exchanger 32 at the heat source side, and the refrigerant is thereby evaporated and turned into a gas refrigerant, which is led through the four-way valve 40 and the low pressure receiver and is then fed back into the compressor 31.

Here, the system controls the opening degree of the auxiliary throttle device 41 in the following manner. First, the system assume that the degree of dryness of the refrigerant in the inside of the refrigerant piping 123 is in the range from 0.1 to 0.5 in the proximity of the measuring part of the temperature sensor 211, and then it is possible for the system to estimate the circulated refrigerant composition on the basis of information on results of the measurement by the temperature sensor 211 and the pressure sensor 212. Next, the system recognizes the relation between the saturating temperature and the saturating pressure for the refrigerant in the circulated refrigerant composition thus estimated, and the system controls the opening degree of the auxiliary throttle device 41 in such a manner that the difference between the condensing temperature estimated from the value measured by the pressure sensor 204 and the value measured by the temperature sensor 201 is constant.

As to a case where the composition of the refrigerant which flows through the refrigerant circuit is changed, a description will be given first with respect to a method for storing the refrigerant rich in constituents at a low boiling point in the intermediate pressure composition adjusting device 84. With opening the opening/closing mechanisms 76 and 86, the system conducts from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a* to be condensed and liquefied, and is then stored in the lower area of the intermediate pressure composition adjusting device 84. The uncondensed gas is conducted into the suction inlet port side of the low pressure receiver 35 via the third throttle device 82 and the opening/closing mechanism 76. As the result, the system stores the liquid refrigerant rich in constituents at a low boiling point in the intermediate pressure composition adjusting device 84 and the composition of the refrigerant being circulated in the main circuit is rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point through the refrigerant piping 119 from the lower area of the high pressure receiver 42 to the upper area of the intermediate pressure composition adjusting device 84. While the liquid refrigerant moves downward from the upper area of the intermediate pressure composition adjusting device 84 to the lower area there of by the effect of its force of gravity, the liquid refrigerant performs a heat exchange with the high temperature heat source 81, some portion of the liquid refrigerant being thereby evaporated and turned into a gas refrigerant rich in constituents at a low boiling point. This gas refrigerant moves upward in the intermediate pressure composition adjusting device 84. This gas refrigerant which is rich in constituents at a low boiling point flows through the refrigerant piping 121 and is led into the suction inlet port of the low pressure receiver 35. Accordingly, the liquid refrigerant which is stored in the lower area of the intermediate pressure composition adjusting device 84 is rich in constituents at a high boiling point. As the result, the composition of the refrigerant which is circulated through the main circuit can be made rich in constituents at a low boiling point.

Here, the system estimates the circulated refrigerant composition by the method for estimating the composition of the refrigerant as described above, and then makes an adjustment of the composition of the refrigerant in the manner as described above, depending on the magnitude of the load, and performs control on the time which is required for such an adjustment of the composition of the refrigerant.

Twenty-Sixth Embodiment

Figure 32:
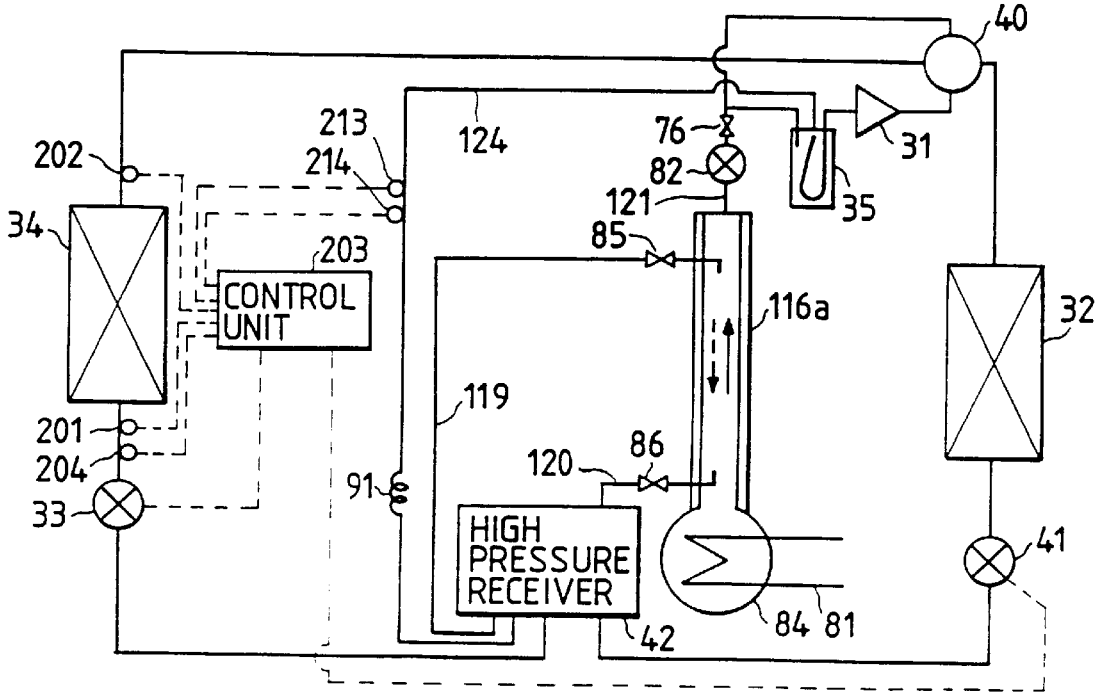
FIG. 32 is a refrigerant circuit diagram of a twenty-sixth embodiment of the present invention.

A description will be given with respect to a twenty-sixth embodiment of a system of the present invention with reference to FIG. 32 as follows. Moreover, those component units or parts described in this embodiment as illustrated in FIG. 32 which are the same as those described in the sixteenth embodiment are indicated by the same reference numbers assigned to them, and a description of those components will be omitted here. In the component elements described in the sixteenth embodiment as illustrated in FIG. 22, the main throttle device 33 and the auxiliary throttle device 41 are respectively formed of an electronic expansion valve, and the system is provided further with: a temperature sensor 201 and a pressure sensor 204 for respectively measuring the temperature and the pressure in the piping disposed between the heat exchanger 34 at the load side and the main throttle device 33, a temperature sensor 202 for measuring the temperature in the piping between the heat exchanger 34 at the load side and the four-way valve 40, a refrigerant piping 124 which branches off from the bottom area of the high pressure receiver 42 and is connected to the low pressure receiver 35 by way of the third throttle device 91, a temperature sensor 213 and the pressure sensor 214 for respectively measuring the temperature and pressure in the piping between the third throttle device 91 and the low pressure receiver 35 in the refrigerant piping 124, and a control unit 203 for calculating the composition of the refrigerant being circulated in the refrigerant circuit on the basis of the above-mentioned information on the pressure and the temperature, calculating the opening degrees of the main throttle device 33 and the auxiliary throttle device 41 on the basis of the information obtained from the pressure sensors and the temperature sensors and the above-mentioned information obtained on the circulated refrigerant composition, and then adjusting the opening degrees of the main throttle device 33 and the auxiliary throttle device 41.

Now, a description will be given with respect to the cooling operation by this system. With closing the opening/closing mechanism 76, the system drives the compressor 31. The gas refrigerant at a high temperature and under a high pressure discharged from the compressor 31 is passed through the four-way valve 40 and is then fed into the heat exchanger 32 at the heat source side. The refrigerant condensed in the heat exchanger 32 at the heat source side is moderately reduced in the auxiliary throttle device 41 and is then led into the high pressure receiver 42. Then, the refrigerant is separated into gas and liquid in the high pressure receiver 42, and the liquid refrigerant is then reduced to a low pressure in the main throttle device 33. The refrigerant thus turned into a dual-phase refrigerant at a low temperature deprives the surrounding area of heat in the heat exchanger 34 at the load side, the system thereby performing a cooling operation, and the dual-phase refrigerant itself is evaporated and turned into a gas refrigerant, which is conducted through the four-way valve 40 and the low pressure receiver and is then fed back into the compressor 31.

Here, the system controls the opening degree of the main throttle device 33 in the following manner. First, it is assumed that the degree of dryness of the refrigerant in the downstream of the third throttle device 91 in the refrigerant piping 124 is in the range from 0.1 to 0.5, the system estimates the circulated refrigerant composition on the basis of information on the results of measurements by the temperature sensor 213 and the pressure sensor 214. Next, the system recognizes the relation between the saturating temperature and the saturating pressure for the refrigerant in the circulated refrigerant composition, and controls the opening degree of the main throttle device 33 in such a manner that the difference between the evaporating temperature estimated from the value measured by the pressure sensor 204 and the value of the evaporating temperature actually measured by the temperature sensor 202 is constant at a certain level.

Now, a description will be given with respect to the heating operation of this system. With closing the opening/closing mechanism 76, the system drives the compressor 31. The gas refrigerant at a high temperature and under a high pressure discharged from the compressor 31 is passed through the four-way valve 40 and is then led into the heat exchanger 34 at the load side. This gas refrigerant at a high temperature and under a high pressure radiates its heat to the surrounding area in the heat exchanger 34 at the load side, and the gas refrigerant itself is condensed and is then moderately reduced by the main throttle device 33, and the condensed refrigerant is then fed into the high pressure receiver 42. The refrigerant is separated into gas and liquid in the high pressure receiver 42, and the pressure of the liquid refrigerant is reduced to a low pressure in the auxiliary throttle device 41. The refrigerant thus turned into a dual-phase refrigerant at a low temperature deprives the surrounding area of heat in the heat exchanger 32 at the heat source side and the refrigerant is thereby evaporated and turned into a gas refrigerant, which is led through the four-way valve 40 and the low pressure receiver and is then fed back into the compressor 31.

Here, the system controls the opening degree of the auxiliary throttle device 41 in the following manner. First, the system assumes that the degree of dryness of the refrigerant in the downstream of the third throttle device 91 in the inside of the refrigerant piping 124 is in the range from 0.1 to 0.5, and then it is possible for the system to estimate the circulated refrigerant composition on the basis of information measured by the temperature sensor 213 and the pressure sensor 214. Next, the system recognizes the relation between the saturating temperature and the saturating pressure for the refrigerant in the circulated refrigerant composition thus estimated, and the system controls the opening degree of the auxiliary throttle device 41 in such a manner that the difference between the condensing temperature which can be estimated from the value measured by the pressure sensor 204 and the value measured by the temperature sensor 201 is constant.

As to a case where the composition of the refrigerant which flows through the refrigerant circuit is changed, a description will be given first with respect to a method for storing the refrigerant rich in constituents at a low boiling point in the intermediate pressure composition adjusting device 84. With opening the opening/closing mechanisms 76 and 86, the system conducts the gas refrigerant rich in constituents at a low boiling point from the upper area of the high pressure receiver 42 to the lower area of the intermediate pressure composition adjusting device 84 through the refrigerant piping 120. While the gas refrigerant moves upward in the inside of the intermediate pressure composition adjusting device 84, the gas refrigerant performs a heat exchange with the low temperature heat source 116*a*, and the gas refrigerant is thereby condensed and liquefied. Then, it is stored in the lower area of the intermediate pressure composition adjusting device 84. The uncondensed gas is conducted into the suction inlet port side of the low pressure receiver 35 via the third throttle device 82 and the opening/closing mechanism 76. As the result, the system stores the liquid refrigerant rich in constituents at a low boiling point in the intermediate pressure composition adjusting device 84, and the composition of the refrigerant being circulated in the main circuit is rich in constituents at a high boiling point.

Now, a description will be given with respect to a method for storing the refrigerant rich in constituents at a high boiling point in the intermediate pressure composition adjusting device 84. With opening the opening/closing mechanisms 76 and 85, the system conducts the liquid refrigerant moderately rich in constituents at a high boiling point from the lower area of the high pressure receiver 42 to the upper area of the intermediate pressure composition adjusting device 84 through the refrigerant piping 119. While the liquid refrigerant moves downward from the upper area of the intermediate pressure composition adjusting device 84 to the lower area thereof by the effect of its force of gravity, the liquid refrigerant performs a heat exchange with the high temperature heat source 81, some portion of the liquid refrigerant being thereby evaporated and turned into a gas refrigerant rich in constituents at a low boiling point. This gas refrigerant moves upward in the intermediate pressure composition adjusting device 84. This gas refrigerant rich in constituents at a low boiling point flows through the refrigerant piping 121 and is led into the suction inlet port of the low pressure receiver 35. The liquid refrigerant which is stored in the lower area of the intermediate pressure composition adjusting device 84 is rich in constituents at a high boiling point. As the result, the composition of the refrigerant which is circulated through the main circuit can be made rich in constituents at a low boiling point.

Here, the system estimates the circulated refrigerant composition by the method for estimating the composition of the refrigerant as described above, and then the system makes an adjustment of the composition of the refrigerant in the manner as described above, depending on the magnitude of the load, and performs control on the time which is required for such an adjustment of the composition of the refrigerant.

Twenty-Seventh Embodiment

Figure 33:
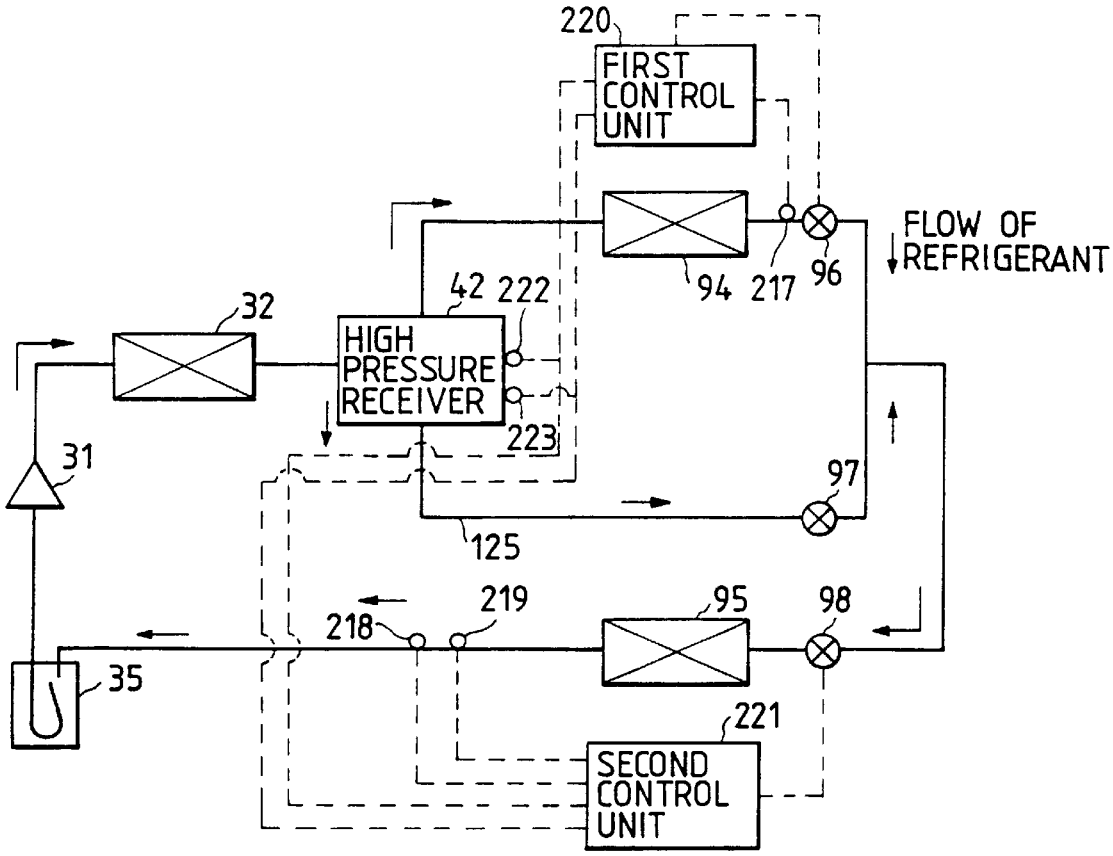
FIG. 33 is a refrigerant circuit diagram of a twenty-seventh embodiment of the present invention.

In the following part, a description will be given with respect to a twenty-seventh embodiment of a system of the present invention with reference to FIG. 33. Moreover, in FIG. 33, a compressor 41, a heat exchanger 32 at the heat source side, a high pressure receiver 42, a heat exchanger 94 for the heating operation, a throttle device 96 for the heating operation, a throttle device 98 for the cooling operation, a heat exchanger 95 for the cooling operation, and a low pressure receiver 35 are connected in the serial order to form a main circuit for the refrigerant. In addition, this system is provided further with: a refrigerant piping 125 which branches off from the high pressure receiver 42, bypasses the heat exchanger 94 for the heating operation and the throttle device 96 for the heating operation, and is connected to the piping between the throttle device 96 for the heating operation and the throttle device 98 for the cooling operation, and a bypass throttle device 97 which controls the flow rate of the refrigerant in the bypass line on the refrigerant piping 125. Further, this system is provided with a pressure sensor 222 and a temperature sensor 223 which respectively measure the pressure and temperature of the refrigerant in the high pressure receiver, a temperature sensor 217 which measures the temperature of the refrigerant between the heat exchanger 94 for the heating operation and the throttle device 96 for the heating operation, a pressure sensor 218 and a temperature sensor 219 which respectively measure the pressure and the temperature between the heat exchanger 95 for the cooling operation and the low pressure receiver 35, a first control unit 220 which estimates the circulated refrigerant composition on the basis of the ratio of the cooling capacity to the heating capacity mentioned above and the values measured by the pressure sensor 222 and the temperature sensor 223, and controls the opening degree of the throttle device 96 for the heating operation, and a second control unit 221 which estimates the circulated refrigerant composition on the basis of the ratio of the cooling capacity to the heating capacity mentioned above and the values measured by the pressure sensor 222 and the temperature sensor 223, and controls the opening degree of the throttle device 98 for the cooling operation.

Now, a description will be given with respect to the working of this system. The refrigerant gas at a high temperature and under a high pressure discharged from the compressor 31 is condensed to a certain degree of dryness in the heat exchanger 32 at the heat source side, and is turned into a dual-phase refrigerant including gas and liquid streams. This dual-phase refrigerant is fed into the high pressure receiver 42. This dual-phase refrigerant including the gas and liquid is separated into gas and liquid in the high pressure receiver 42. The gas refrigerant is led into the heat exchanger 94 for the heating operation, in which the gas radiates heat to perform a heating operation, and the gas refrigerant itself is condensed and liquefied. Then, the liquefied refrigerant is moderately reduced in the throttle device 96. Further, the liquid refrigerant in the high pressure receiver 42 is led through the refrigerant piping 125 to the bypass throttle device 97 in which it is moderately reduced. Thereafter, thus reduced liquid refrigerant flows together with the refrigerant which is discharged from the throttle device 96 for the heating operation. The liquid refrigerant flown together with the other stream of the refrigerant is reduced to a low pressure in the throttle device 98 for the cooling operation and deprives the surround area of heat in the heat exchanger 95 for the cooling operation, the system thereby performing a cooling operation, and the liquid refrigerant itself is evaporated and turned into a gas refrigerant, which is fed back into the compressor 31 via the low pressure receiver 35.

Here, in order to estimate the circulated refrigerant composition, the system first calculates the degree of dryness of the refrigerant stored in the high pressure receiver 42 on the basis of the ratio of the cooling operation and the heating operation. Then, the system estimates the circulated refrigerant composition on the basis of the degree of dryness as calculated and the values measured respectively by the pressure sensor 222 and the temperature sensor 223. Further, in case the system controls on the throttle device 96 for the heating operation, the system calculates the saturating temperature for the pressure sensor 222, and the system determines the opening degree of the throttle device 96 for the heating operation so that the difference between this saturating temperature and the temperature detected by the temperature sensor 217 is constant at a certain level. Further, in case the system controls on the throttle device 98 for the cooling operation, the system calculates the saturating temperature for the pressure sensor 218, and the system determines the opening degree of the throttle device 98 for the cooling operation so that the difference between this saturating temperature and the temperature detected by the temperature sensor 219 is constant at a certain level. The system estimates the degree of dryness of the refrigerant in the gas-liquid separator on the basis of the ratio of the cooling capacity/the heating capacity. As the result of the separation of the gas and the liquid as described above, the system can perform controls which are deal properly with the concurrent cooling and heating operations even if the composition of the refrigerant flowing in the heating indoor unit is different from the composition of the refrigerant flowing in the cooling indoor unit.

The system estimates the degree of dryness of the refrigerant in the gas-liquid separator on the basis of the cooling capacity and the heating capacity, and it is simple if the capacity ratio is determined theoretically with the respective capacities of the heat exchangers for both the cooling and heating operations being set up in advance. Else, the ratio of their capacities may be found by an actual measurement, such as a measurement of the quantity of the air stream or the temperature of the air.

This system, which is formed in a simple circuit construction, is capable of performing its concurrent cooling and heating operations with a nonazeotropic mixed refrigerant. Further, this system can properly controls the refrigerating cycle even if the composition of the refrigerant flowing in the heating indoor unit is different from the composition of the refrigerant flowing in the cooling indoor unit as the result of the separation of the gas and the liquid.

Twenty-Eighth Embodiment

In the following part, a description will be given with respect to a twenty-eighth embodiment of a system of the present invention with reference to FIG. 34. In this FIG. 34, a compressor 1, a four-way valve 40, a heat exchanger 32 at the heat source side, a throttle device 33, a heat exchanger 34 at the load side, and a low pressure receiver 35 are connected in the serial order and are formed into the main refrigerant circuit. Moreover, the reference number 400 denotes a control unit, which determines the opening degree of the throttle device on the basis of the information obtained from a first temperature sensor 401, the second temperature sensor 402, and the pressure sensor 403 to control the circulation of the refrigerant.

In this regard, the flow of the refrigerant is in reverse for a cooling operation and a heating operation in case the system is characterized in that the sensing position is different or in common for the operations. Therefore, it is impossible to specify the condenser and the evaporator respectively for the operations. Hence, the heat exchanger which works as a condenser at the time of the cooling operation but works as an evaporator at the time of the heating operation is taken as the heat exchanger 32 at the heat source side. Further, the heat exchanger 34 at the load side is represented to the contrary.

Figure 34:
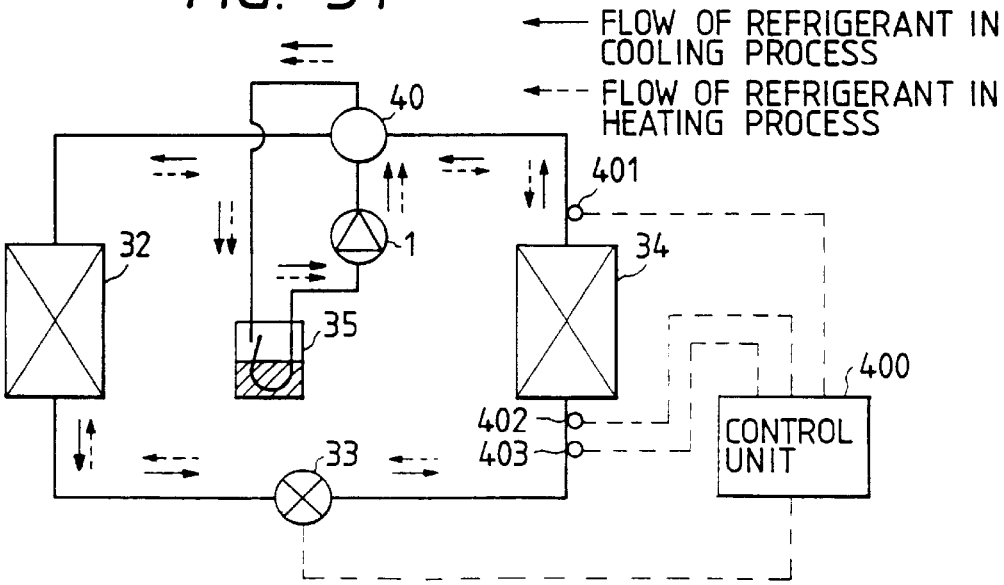
FIG. 34 is a configuration diagram of the refrigerant circuit in a refrigerating and air conditioning system in the twenty-eighth embodiment of the present invention.

When the system performs the cooling operation, the refrigerant discharged from the compressor 1, as observed in the flow of the refrigerant shown in FIG. 34, is condensed in the heat exchanger 32 at the heat source side, and is reduced in the throttle device 33 so as to be turned into a dual-phase refrigerant at a low temperature and under a low pressure. This dual-phase refrigerant at a low temperature and under a low pressure is fed into the heat exchanger 34 at the load side and deprives the surrounding area of heat, the system thereby performing a cooling operation and the refrigerant itself being evaporated and turned into a gas The gas refrigerant thus formed is fed back into the compressor 1 by way of the four-way valve 40 and the heat exchanger at the load side 35.

On the other hand, in the heating operation of the system, the refrigerant discharged from the compressor 1 radiates heat to the surrounding area in the heat exchanger 34 at the load side, the system thereby performing a heating operation and the refrigerant itself being condensed and liquefied. The liquified refrigerant is reduced in the throttle device 33 to be turned into the state of a dual-phase refrigerant at a low temperature and under a low pressure. This dual-phase refrigerant at a low temperature and under a low pressure flows into the heat exchanger 32 at the heat source side to be evaporated and turned into a gas. The gas refrigerant thus formed is then fed back into the compressor 1 via the four-way valve 40 and the low pressure receiver 35.

Further, in order to detect the operating condition of the system by judging the state of the operation, the system has a mode switching to determine a mode as a cooling operation or a heating operation. Also, the temperature of the inlet or outlet of the heat exchanger is detected to judge the flowing direction of the refrigerant to determine the mode. Further, it is possible to judge the state of the operation of this system on the basis of the ON-OFF state of the four-way valve.

Figure 35:
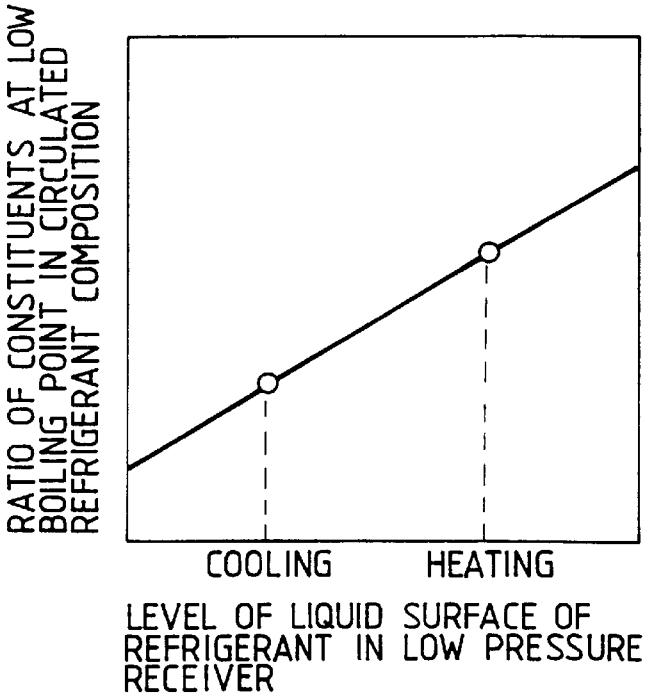
FIG. 35 is a chart of the relationship between the refrigerant composed of a nonazeotropic mixture and the circulated refrigerant composition as described in the twenty-eighth embodiment of the present invention.

Now, a description will be given with respect to the changes in the quantity of the surplus refrigerant and the changes in the composition of the refrigerant. First, as regards the generated quantity of the surplus refrigerant, the quantity of the surplus refrigerant can be determined, if a refrigerant circuit is specifically set up, generally on the basis of the point whether the circuit is in a cooling operation or a heating operation. Therefore, the quantity of the surplus refrigerant to be generated in the cooling operation or the heating operation can be estimated in advance. Further, FIG. 35 illustrates the relation between the level of the liquid surface of the refrigerant in the low pressure receiver 35 and the circulated refrigerant composition. As shown in FIG. 35, the circulated refrigerant composition increases as the quantity of the refrigerant in the low pressure receiver increases. Accordingly, with reference to these relations, it is possible to make an approximate estimate in advance for the point how the circulated refrigerant composition is for a cooling operation or a heating operation.

Namely, the system set up the states of the refrigerant composition in advance and stored it in a memory, and can select one from them in accordance with the judged state of the operation of the system.

Figure 36:
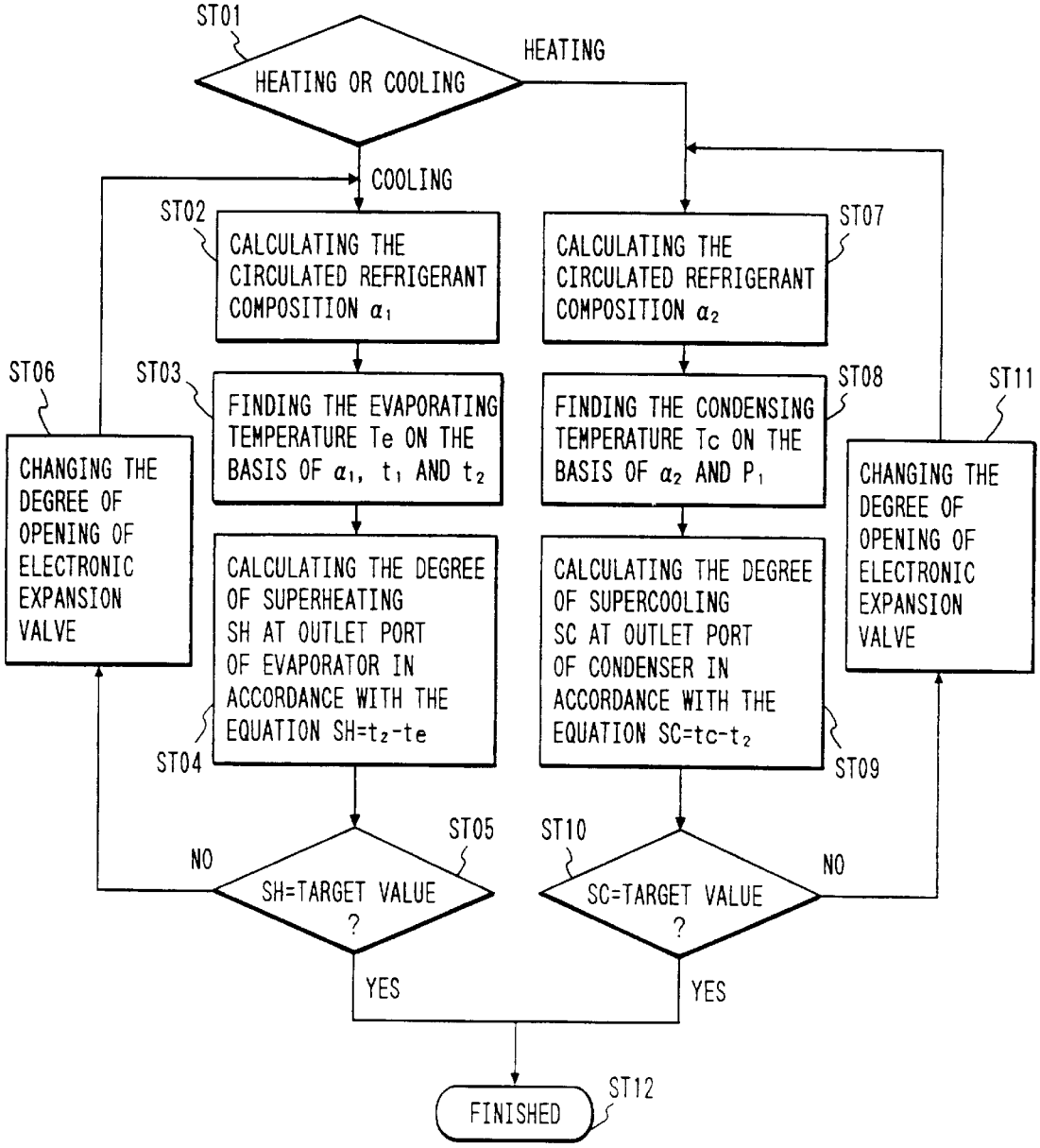
FIG. 36 is a flow chart of the operating steps taken by the control unit described in the twenty-eighth embodiment of the present invention.

FIG. 36 presents a flow chart illustrating the process for determining the opening degree for the throttle device 33 at the time of a cooling operation and a heating operation of this system. A decision on the opening degree of the throttle device 33 is to be made in the manner described below on the basis of the circulated refrigerant composition as estimated in advance in the manner described above. First, it is judged whether the operation to be performed is a cooling operation or a heating operation (ST 01). At the time of a cooling operation, the circulated refrigerant composition is specified as $\alpha_1$ (ST 02), and the system calculates the evaporating temperature $t_e$ (ST 03) on the basis of this $\alpha_1$, the temperature t1 detected by the first temperature sensor 401, and the temperature T2 detected by the second temperature sensor 402. Next, the system determines the opening degree of the throttle device 33 in such a manner that the degree of superheating at the outlet port of the evaporator (the heat exchanger 34 at the load side), which is expressed by the equation of $SH=T2-T_e$, is equal to the desired value set up in accordance with the composition $\alpha_1$ (ST 05 and ST 06).

At the time of a heating operation (St 01), the circulated refrigerant composition is to be set at $\alpha_2$ (ST 07), and the system calculates the condensing temperature TC on the basis of this $\alpha_2$ and the pressure P which the pressure sensor 403 detects (ST 08). The system calculates the degree of superheating at the outlet port of the condenser (the heat exchanger 34 at the load side) in accordance with the equation of SC=TC−T2 on the basis of the value of TC and the temperature T2 which the second temperature sensor detects (ST 09). The system determines the opening degree of the throttle device 33 (ST 11) in such a manner that this degree of superheating at the outlet port of the condenser SC is constant at a certain level in relation to the desired value (ST 10). As the result, this system is capable of performing a highly efficient operation by a simple control process.

As mentioned above, the surplus refrigerant moves from the low pressure receiver 35 into the condenser (the heat exchanger 34 at the load side), or conversely from the condenser into the low pressure receiver, when a change is made, for example, of the value of SC in particular, as described above. Therefore, the level of the liquid surface of the refrigerant in the low pressure receiver 35 is changed so as to change the composition of the refrigerant.

Next, the procedure for the operations mentioned above will be described. First, the throttle device 33 is reduced to increase the SC. Accordingly, the level of the liquid in the low pressure receiver 35 is lowered. This means that the ratio of the constituents at a low boiling point decreases in the circulated refrigerant composition. Such a change in the opening degree of the throttle device 33 leads to a change in the composition of the refrigerant through an increase or a decrease of the SC and through a rise or a decline of the liquid level.

In this case, the control unit detects directly or indirectly the composition of the circulated refrigerant to adjust the circulated refrigerant composition.

Also, it should be noted that the circulated refrigerant composition generally means the ratio of the constituents at a low boiling point. When the liquid refrigerant in the low pressure receiver decreases, the constituents at a high boiling point increase in the refrigerant circulating circuit so that the ratio of the constituents at a low boiling point decreases.

In case any change is to be made of the set values for the control operations, the desired values for SH and SC are changed, or, in the case of the multiple operation model, it is a generally accepted idea that a change is to be made of the target high pressure, which is the pressure taken as an object for the control of the discharge pressure of the compressor for maintaining the condensing temperature at a constant level.

Moreover, SC means $T_C$ (a condensing temperature, which means a saturated liquid temperature in a strict sense of the term)$-T_{C\ out}$ (a temperature at the outlet port of the condenser), and SH means $T_{e\ out}$ (a temperature at the outlet port of the evaporator)$-T_e$ (an evaporating temperature, which means a saturated gas temperature in a strict sense of the term).

In the case of a nonazeotropic mixed refrigerant, the saturating temperature may vary in its meaning from the boiling start temperature (the temperature at the boiling point) and the condensation start temperature (the dew point).

In this embodiment, the system performs control operations for maintaining the degree of superheating SH constant at the outlet port of the evaporator in the performance of a cooling operation and control operations for maintaining the degree of supercooling SC constant at the outlet port of the condenser in the performance of a heating operation. However, it is possible to form an arbitrary combination of the control for maintaining the degree of superheating at the outlet port of the evaporator at a constant level or the control for maintaining the degree of supercooling at the outlet port of the condenser at a constant level with a cooling process or a heating process.

Twenty-Ninth Embodiment

Figure 37:
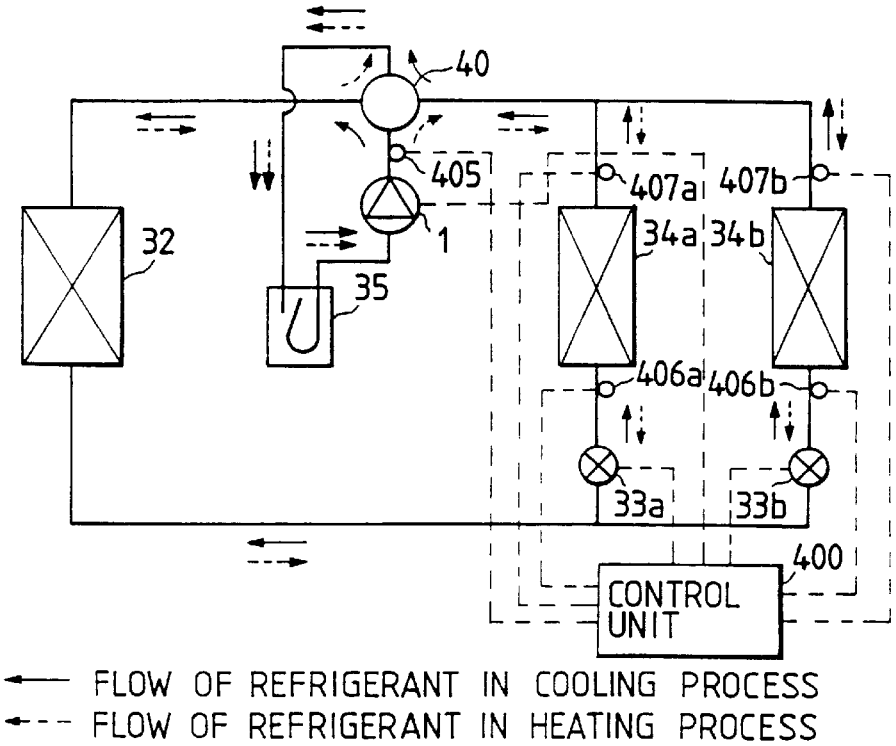
FIG. 37 is a configuration diagram of the refrigerant circuit in a refrigerating and air conditioning system in the twenty-ninth embodiment of the present invention.

In the following part, a description will be given with respect to a twenty-ninth embodiment of a system of the present invention with reference to FIG. 37. In FIG. 37, a compressor 1, a four-way valve 40, a heat exchanger 32 at the heat source side, throttle devices 33*a* and 33*b*, heat exchangers 34*a* and 34b at the load side, and a low pressure receiver 35 are connected in the serial order to form the main refrigerant circuit. Moreover, a control unit 400 determines the opening degree of the throttle device on the basis of the information obtained from a first temperature sensor 406*a* or 406*b*, a second temperature sensor 407*a* or 407*b*, and a pressure sensor 405 to perform control on the circulation of the refrigerant. In addition, the heat exchanger section at the load side includes two systems of multiple circuits a and b.

When the system performs a cooling operation, the refrigerant discharged from the compressor 1 as observed in the flow of the refrigerant shown in FIG. 37 is condensed in the heat exchangers 32 at the heat source side, and is reduced in the throttle device *s*33*a* and 33*b*. The refrigerant is then turned into a dual-phase refrigerant at a low temperature and under a low pressure. This dual-phase refrigerant at a low temperature and under a low pressure is fed into the heat exchangers 34*a* and 34*b* at the load side and deprives the surrounding area of heat, the system thereby performing a cooling operation and the refrigerant itself being evaporated and turned into a gas. The gas refrigerant thus formed is fed back into the compressor 1 by way of the four-way valve 40 and the heat exchanger at the load side 35. In this regard, it is possible for this system to operate only the 34*a* portion or the 34*b* portion of the heat exchanger at the load side.

At the time of a heating operation of the system, the refrigerant discharged from the compressor 1 radiates heat to the surrounding area in the heat exchangers 34*a* and 34*b* at the load side, the system thereby performing a heating operation and the refrigerant itself being condensed and liquefied. The liquefied refrigerant is reduced in the throttle device 33*a* and 33*b*, and turned into the state of a dual-phase refrigerant at a low temperature and under a low pressure. This dual-phase refrigerant at a low temperature and under a low pressure flows into the heat exchanger 32 at the heat source side to be evaporated and turned into a gas. The gas refrigerant is then fed back into the compressor 1 via the four-way valve 40 and the heat exchanger at the load side 35. It is possible for this system to operate only the 34*a* portion or the 34*b* portion of the heat exchanger at the load side.

Figure 38:
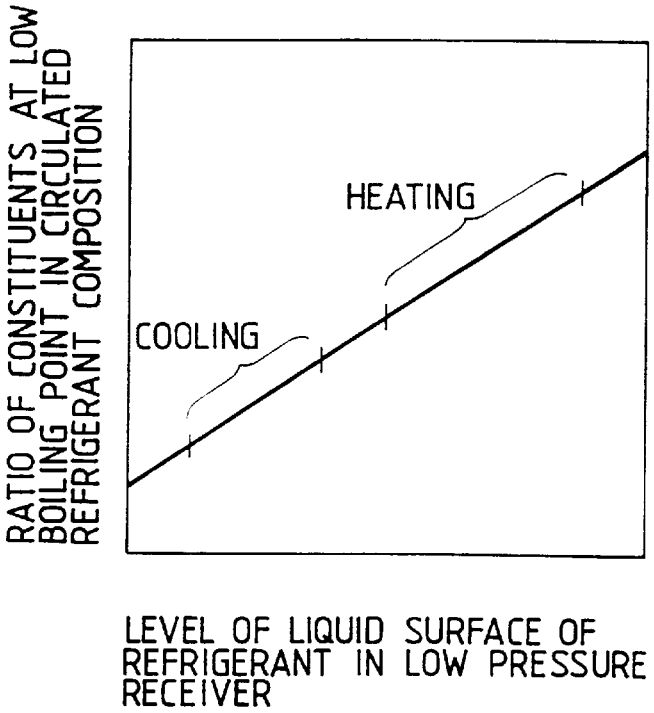
FIG. 38 is a chart of the relationship between the level of the refrigerant liquid surface in the low pressure receiver and the circulated refrigerant composition described in the twenty-ninth embodiment of the present invention.

Now, a description will be given with respect to the changes in the quantity of the surplus refrigerant and the changes in the composition of the refrigerant. First, as regards the generated quantity of the surplus refrigerant, the quantity of the surplus refrigerant can be determined, if a refrigerant circuit is specifically set up, generally on the basis of the point whether the operation to be performed is a cooling operation or a heating operation. Therefore, the quantity of the surplus refrigerant to be generated in a cooling operation or in a heating operation can be estimated in advance. Further, since the quantity of the surplus refrigerant depends also on the number of operated units of the heat exchangers at the load side, the system has a grasp of the number of operated units of the heat exchangers at the load side on the basis of the operating frequency of the compressor. As the result, it is possible for this system to estimate in advance the generated quantity of the surplus refrigerant in a cooling operation or in a heating operation with higher accuracy, provided that such an estimate is based on information including information on the operating frequency of the compressor. Further, FIG. 38 illustrates the relation between the level of the liquid surface of the refrigerant in the low pressure receiver 35 and the circulated refrigerant composition. As shown in FIG. 38, the circulated refrigerant composition increases when the quantity of the refrigerant in the low pressure receiver increases. Hence, it is possible for the system to make an estimate of the circulated refrigerant composition on the basis of the operating frequency of the compressor in the cooling operation and the heating operation.

The opening degree of the throttle device 33*a* and 33*b* is decided in the following manner on the basis of the circulated refrigerant composition as estimated on the basis for the operating frequency of the compressor in the manner described above. The system calculates the circulated refrigerant composition $\alpha_1$ at the time of a cooling operation from the operating frequency of the compressor and determines the opening degree of the throttle device 33*a* and 33*b* in such a manner that the difference between the temperature T1 detected by the first temperature sensors 407*a* and 407*b*, and the temperature T2 detected by the second temperature sensors 406*a* and 406*b*, namely, SH=T1−T2, is constant at a certain level.

In addition, the system calculates the circulated refrigerant composition $\alpha_2$ from the operating frequency of the compressor at the time of a heating operation and calculates the condensing temperature TC on the basis of the pressure P detected by the pressure sensor 405. The system then calculates the degree of superheating at the outlet port of the condenser in accordance with the equation, SC=$T_C$−T2, on the basis of the SC and the temperature T2 detected by the second temperature sensors 406*a* and 406*b*. The system determines the opening degree of the throttle device 33 in such a manner that the degree of superheating SC at the outlet port of the condenser is constant at a certain level. As the result, this system can perform a highly efficient operation by simple control even in a multiple refrigerant circuits formed of a plural number of heat exchangers.

Figure 40:
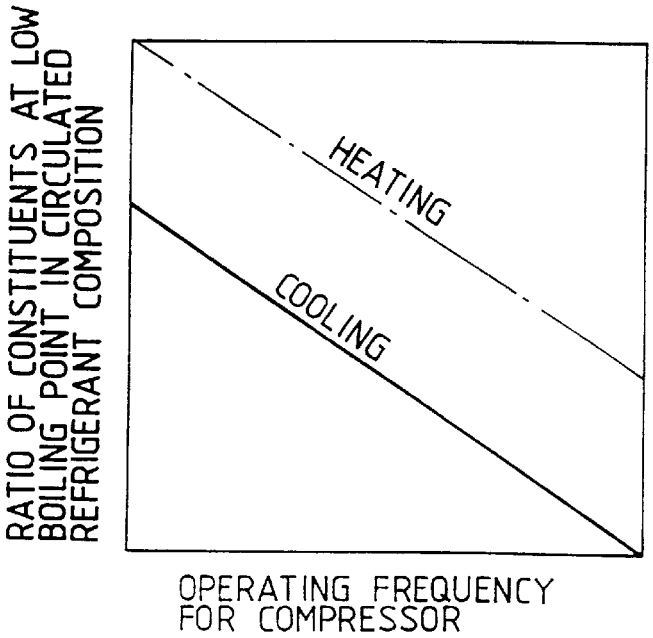
FIG. 40 is a chart of the relationship between the operating frequency and the circulated refrigerant composition described in the twenty-ninth embodiment of the present invention.
Figure 39:
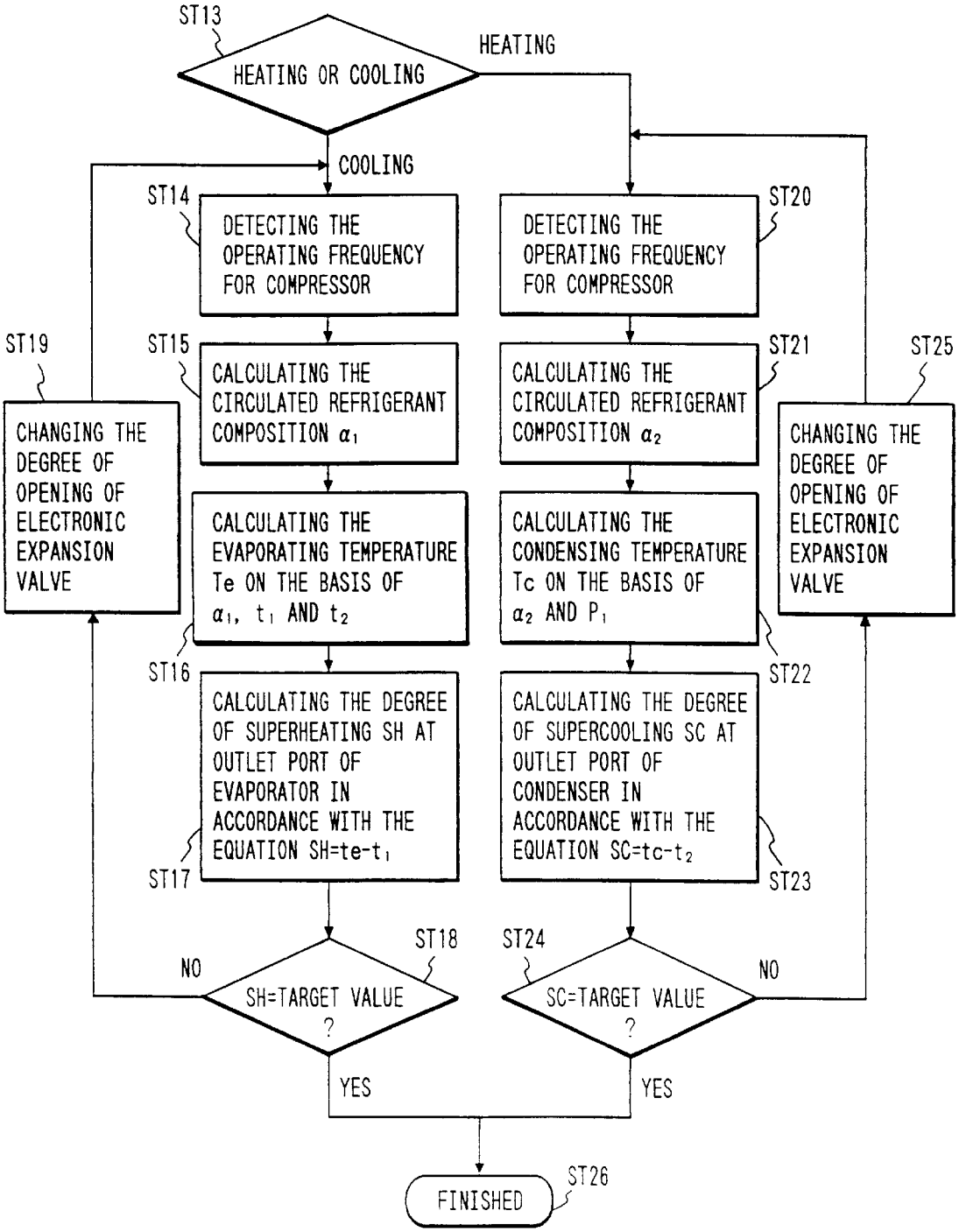
FIG. 39 is a flow chart of the operating steps taken by the control unit described in the twenty-ninth embodiment of the present invention.

An example of the operating steps for estimating the composition of the refrigerant in the operating states shown in FIG. 38 is given in FIGS. 39 and 40. The data shown in FIG. 40 can be determined in advance on the basis of experiments or the like.

At the time of a cooling operation or a heating operation (ST 13), the system can specify the circulated refrigerant composition stored in memory (ST 15 and ST 21) in accordance with the particular level of the frequency of the compressor (ST 14 and ST 20).

The system measures the temperature and the pressure to find the evaporating temperature and the condensing temperature (ST 16 and ST 22), calculates the SH and the SC (ST 17 and ST 23), and changes the opening degree in a manner suitable for the desired value (ST 18 and ST 24), so that the system establish relations among the operating frequency of the compressor, the operating mode of the system, and the circulated refrigerant composition on the basis of these data.

Figure 41:
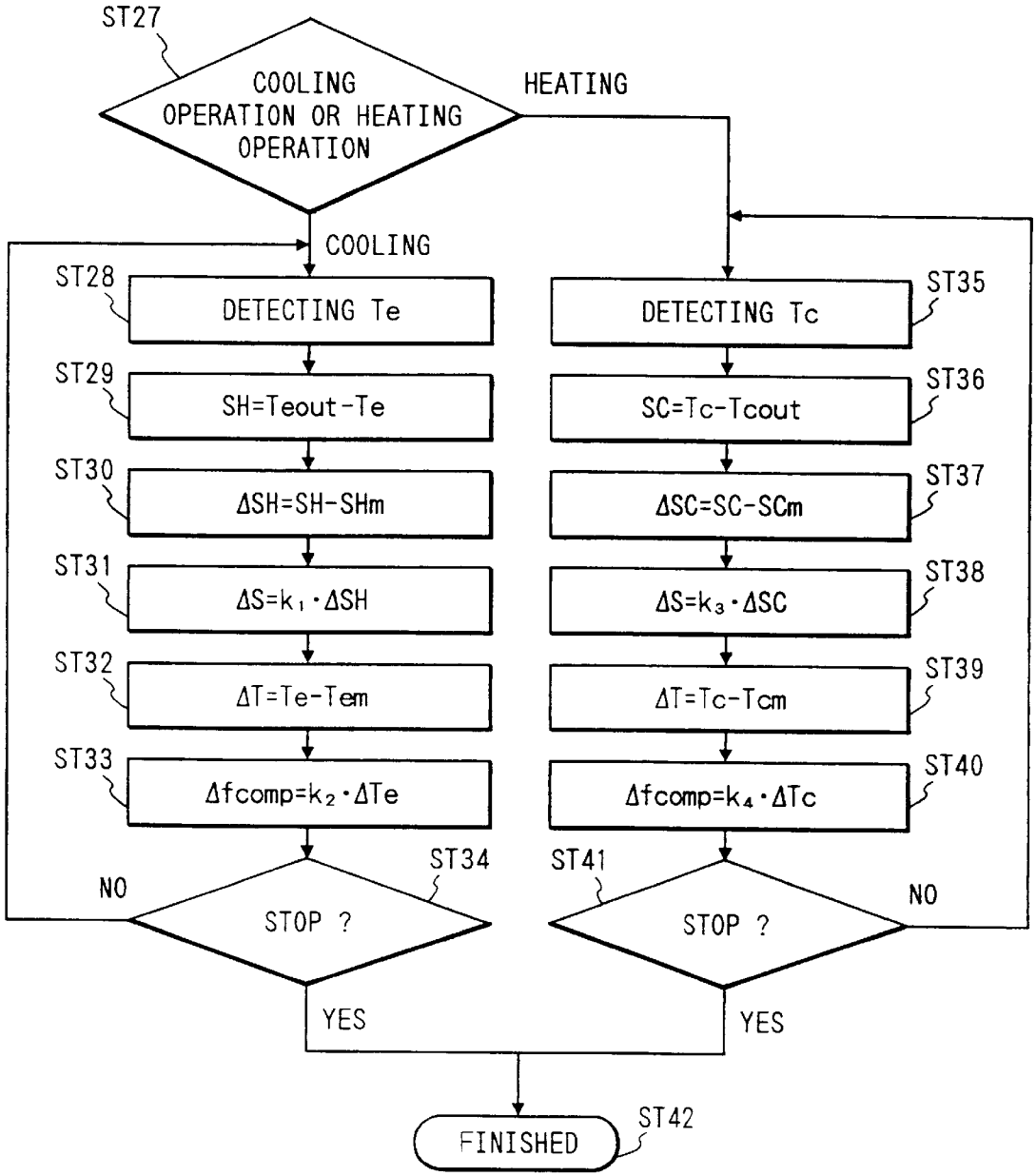
FIG. 41 is a flow chart of another sequence of operating steps taken by the control unit described in the twenty-ninth embodiment of the present invention.

Further, an example of changes made of items other than the opening degree is given in FIG. 41, in which $k_1$ and $k_2$ are constants and ΔS expresses the amount of change in the opening degree.

At the time of a cooling operation, the system detects the evaporating temperature Te and finds SH as the difference between the Te thus detected and the temperature at the outlet port of the evaporator. Then, the system calculates the difference ΔSH between the value of SH and the desired value of the SH to change the opening degree of the throttle device in accordance with the quantity of this ΔSH. The system also calculates the frequency Δfcomp for the revolutions of the compressor in a manner suitable for the difference ΔTe between the desired value for the Te and the value of Te.

At the time of a heating operation, the system detects the condensing temperature Tc, and finds the SC as the difference between the Tc thus detected and the temperature at the outlet port of the condenser. Then, the system calculates the value of ΔSC which is the difference between the value of the SC and the desired value for the SC to change the opening degree of the throttle device in accordance with the quantity of this ΔSC. Further, the system finds the value of Δfcomp (the frequency for the revolutions of the compressor) in accordance with the ΔTc (the difference between the desired value for the TC and the value of the TC). In this manner, the system sets the desired value at the evaporating temperature at the time of a cooling operation and sets the desired value at the condensing temperature at the time of a heating operation, and changes the frequency for the operation of the compressor so that the respective desired values can be attained for the cooling operation and the heating operation.

As mentioned above, the changes of the SC and the SH lead to a change of the liquid surface level of the refrigerant in the low pressure receiver, and, in addition, the system estimates, on the basis of the operating frequency of the compressor, the capacity in which the indoor unit is operating if the unit is a multiple operation apparatus. If a quantity of the refrigerant to remain in the indoor unit is not to be taken into account, it can be considered that the smaller the operating capacity of the indoor unit is, the larger the surplus quantity of the refrigerant is. In other words, the smaller the operating frequency of the compressor is, the larger the quantity of the surplus refrigerant is in the low pressure receiver, so that the circulated refrigerant composition is richer in constituents at a low boiling point.

Further, when the operating frequency of the compressor is large, the number (or capacity) of the indoor units in operation may be large. The difference between the number of units and the capacity of the unit may be found in the point that one indoor unit displaying a large capacity may be in operation in some cases for a given total capacity or a large number of indoor units each in a small capacity may be in operation in other cases. This difference may result more or less in a dispersion, but the tendency towards a decrease of the surplus refrigerant according as the capacity of the unit increases remains unchanged.

The set value for the opening degree of the throttle devices 33*a* and 33*b* can be changed in accordance with a particular operating mode or the frequency condition or the like.

That is to say, the system operates in accordance with the set value and changes the opening degree so as to be suitable for the set value. Along with this, the circulated refrigerant composition undergoes a gradual change into a corresponding composition.

On this occasion, a change of the opening degree causes a change in the load condition for the system. In addition, a change in the composition of the refrigerant causes a similar change in the load, and, as the result, the frequency is changed. In dealing with this, it is feasible to detect the opening degree of the throttle device and to detect the operating frequency of the compressor at every predetermined interval (for example, every one minute) and to make a change of the set value as appropriate. However, this period does not necessarily correspond to the period for a change of the operating frequency of the compressor or the period for a change of the opening degree of the throttle device. Else, it is feasible to change the set value only at the time of a change of the operating mode and only when there occurs any considerable fluctuation in the operating frequency of the compressor. With these control operations, it is possible for the system to perform highly accurate control in accordance with the changes in the operating condition.

Thirtieth Embodiment

Figure 42:
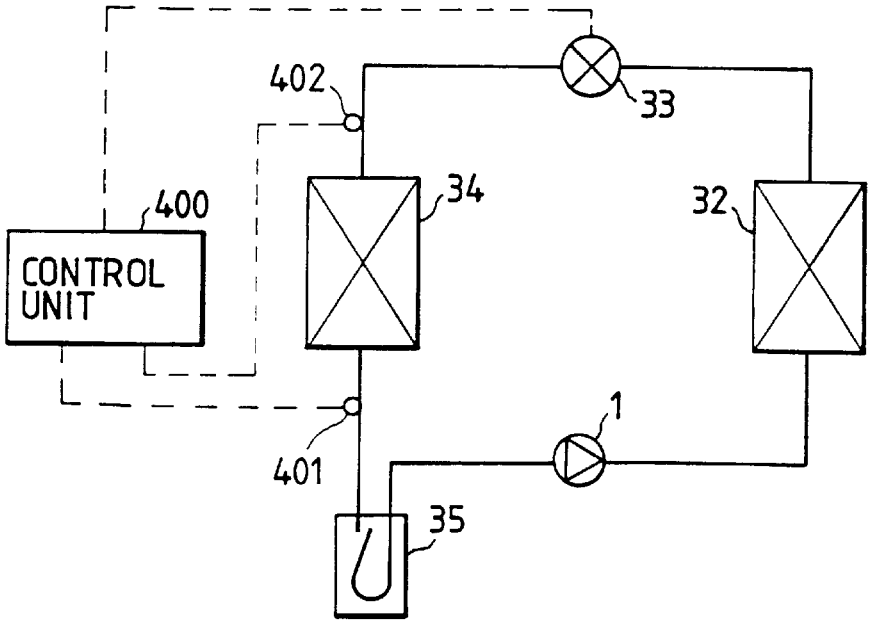
FIG. 42 is a configuration diagram of the refrigerant circuit in the refrigerating and air conditioning system described in the thirtieth embodiment of the present invention.

In the following part, a description will be given with respect to a thirtieth embodiment of a system of the present invention with reference to FIG. 42. In FIG. 42, a compressor 1, a heat exchanger 32 at the heat source side, a throttle device 33, a heat exchanger 34 at the load side, and a low pressure receiver 35 are connected in the serial order to form a main refrigerant circuit. In addition, a control unit 400 determines the opening degree of the throttle device 33 on the basis of the information furnished by the first and second temperature sensor 401 and 402 to control.

The refrigerant discharged from the compressor 1 is condensed in the heat exchanger 32 at the heat source side and is reduced in the throttle device 33 to be turned into a dual-phase refrigerant at a low temperature and under a low pressure. This dual-phase refrigerant at a low temperature and under a low pressure is led into the heat exchanger 34 at the load side, in which the refrigerant deprives the surrounding area of heat, the system thereby performing a cooling operation, and the refrigerant itself is evaporated and turned into a gas. Then, the gas refrigerant is fed back into the compressor 1 via the low pressure receiver 35.

Figure 43:
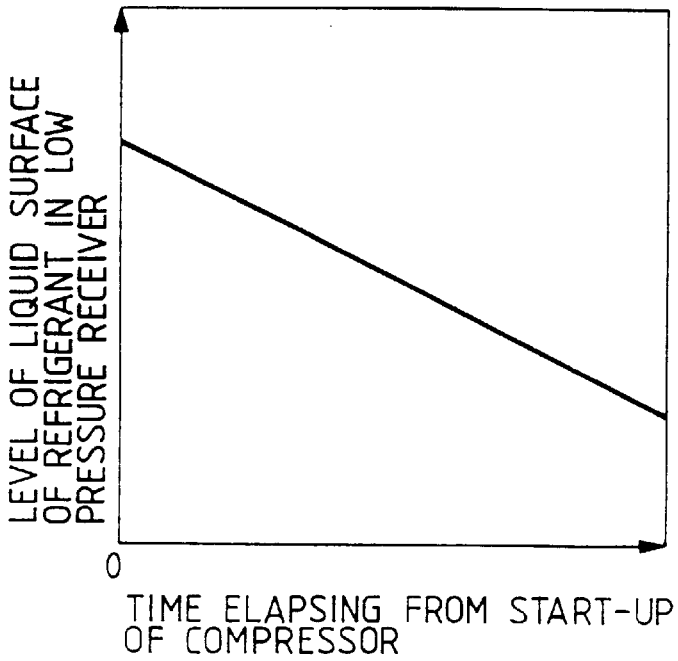
FIG. 43 is a chart of the relationship between the time elapsing after the start-up of the compressor and the level of the liquid surface of the refrigerant in the low pressure receiver in the thirtieth embodiment of the present invention.

At the time of start-up of the compressor 1, refrigerant liquid is stored in the low pressure receiver 35 as there is a remaining quantity of the refrigerant in it and also as the result of a feedback of the refrigerant. Thereafter, the distribution of the refrigerant in the refrigerant circuit changes for a more appropriate distribution. Along with this, the quantity of the refrigerant in the low pressure receiver decreases. As the quantity of the refrigerant in the low pressure receiver decreases, also the circulated refrigerant composition undergoes a decrease, and also the circulated refrigerant composition decreases, for example, as shown in FIG. 43, in accordance with the period of time elapsing after the start-up of the compressor. Therefore, the system estimates the circulated refrigerant composition α on the basis of the period of time elapsing from the start-up of the compressor, and determines the opening degree of the throttle device 33 so that the difference SH, as expressed by the equation SH=T1−T2, between the temperature T1 detected by the first temperature sensor 401 and the temperature T2 detected by the second temperature sensor 402, is constant at a certain level. At this moment, the desired value for the degree of superheating SH at the outlet port of the heat exchanger 34 at the load side is changed in accordance with the circulated refrigerant composition which changes along with the elapse of time. As the result, the period of time from the start-up of the compressor to the attainment of a steady state in the refrigerant circuit can be reduced.

Further, the liquid refrigerant often remains in the low pressure receiver as the result of a feedback of the liquid refrigerant to the low pressure receiver at the time of the start-up of the compressor or as the result of the natural retention of the liquid refrigerant in the low pressure receiver 35. Consequently, the circulated refrigerant composition is therefore rich in constituents at a low boiling point. Accordingly, the system prevents the throttle device from its excessive reduction or its excessive opening by setting the desired value as expressed by the equation SH=T1−T2 in a manner suitable for the refrigerant composition. As the result, the system is capable of moving the liquid refrigerant stored in the low pressure receiver at the time of the start-up of the compressor smoothly into the condenser.

Therefore, this system can reduce the period of time leading from the start-up of the compressor to the time when the refrigerant circuit attains a steady state.

Moreover, the system may be designed so that it distinguishes the start-up state in which the system performs controlling operations as described above, and the state which can be regarded as a steady state on the basis of data based on the elapse of time from the start-up or on the basis of data on a case in which the high pressure is detected every one minute and the magnitude of the fluctuation in three minutes has fallen below a predetermined value (the time interval is not necessarily limited to every one minute).

The twenty-eighth to thirtieth embodiments permit an estimate of the surplus quantity of the refrigerant in the low pressure receiver to some extent. Generally, the refrigerant in a low pressure receiver such as an accumulator in a cooling cycle using a nonazeotropic mixed refrigerant is separated into the liquid phase rich in constituents at a high boiling point and the gas phase rich in constituents at a low boiling point, and the refrigerant in the liquid phase rich in constituents at a high boiling point is stored in the accumulator. Consequently, the composition of the refrigerant which is circulated in the refrigerating cycle shows a tendency towards an increase of constituents at a low boiling point (an increase of the circulated refrigerant composition) if there is liquid refrigerant in the accumulator. The relation between the height h of the refrigerant liquid surface level in the accumulator and the circulated refrigerant composition α is such that the height of the refrigerant liquid surface in the accumulator increases. That is to say, the more the quantity of the liquid refrigerant in the accumulator increases, the more the circulated refrigerant composition increases. Therefore, if this relation is examined in advance by experiments or the like, it is possible for the system to estimate the circulated refrigerant composition α on the basis of the height h of the refrigerant liquid surface in the accumulator as detected by a liquid surface level detector or the like.

As described above, this system is capable of adjusting the circulated refrigerant composition in a manner suitable for the operating condition and thereby always maintaining the state of the composition of a nonazeotropic mixed refrigerant as adapted to the operating condition, and this system can therefore perform stable operation with a high degree of operational reliability. Thus, the present invention can provide a refrigerant circulating system which can always fully displaying its capability in its operation.

Thirty-First Embodiment

Figure 44:
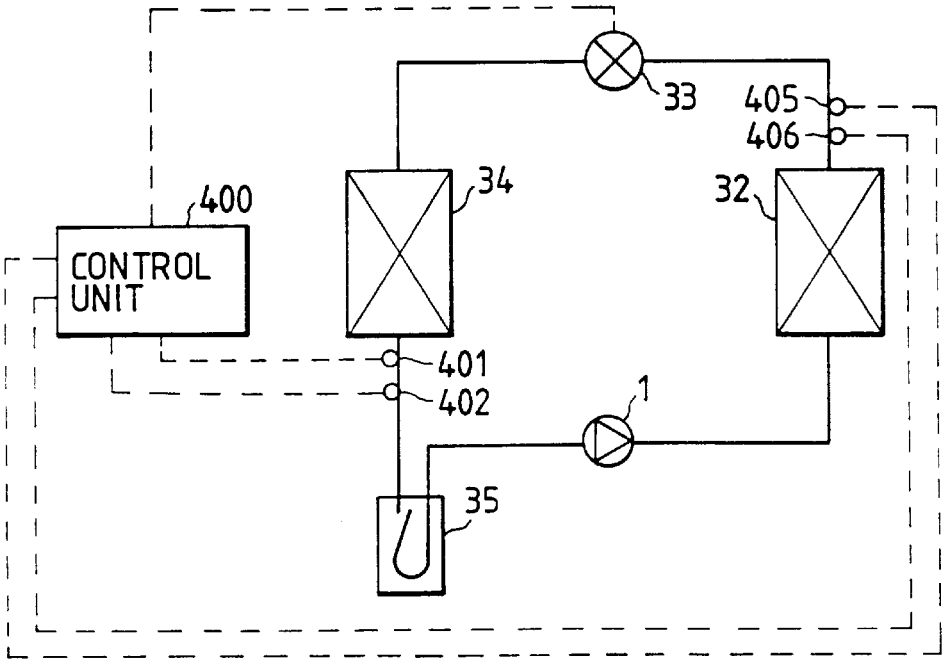
FIG. 44 is a configuration diagram of the refrigerant circuit in a refrigerating and air conditioning system in the thirty-first embodiment of the present invention.

In the following part, a description will be given with respect to a thirty-first embodiment of a system of the present invention with reference to FIG. 44. In FIG. 44, a compressor 1, a heat exchanger 32 at the heat source side, a throttle device 33, a heat exchanger 34 at the load side, and a low pressure receiver 35 are connected in the serial order to form a main refrigerant circuit. The circuit is further provided with a first temperature sensor 401, a first pressure sensor 403, a second temperature sensor 406, a second pressure sensor 405, and a control unit 400 which calculates the circulated refrigerant composition and also determine the opening degree of the throttle device 33 on the basis of the information furnished by the first temperature sensor 401 and the first pressure sensor 403.

The refrigerant discharged from the compressor 1 is condensed in the heat exchanger 32 at the heat source side and is reduced in the throttle device 33. Then the refrigerant is turned into a dual-phase refrigerant at a low temperature and under a low pressure. This dual-phase refrigerant at a low temperature and under a low pressure is led into the heat exchanger 34 at the load side, in which the refrigerant deprives the surrounding area of heat, the system thereby performing a cooling operation, and the refrigerant itself is evaporated and turned into a gas. Then, the gas refrigerant is fed back into the compressor 1 via the low pressure receiver 35.

Figure 45:
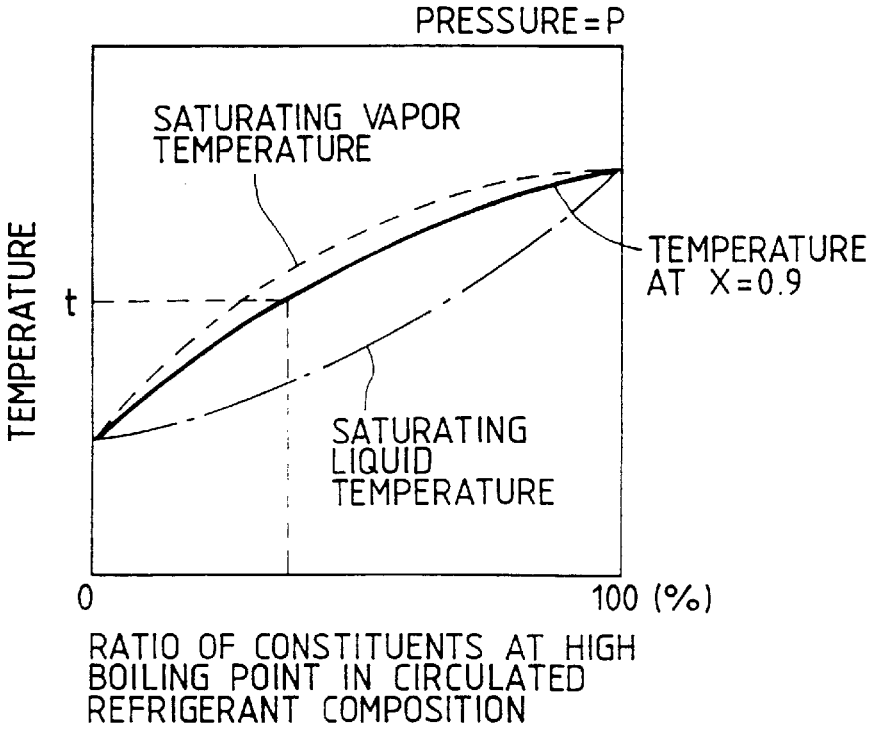
FIG. 45 is a chart of the relationship between the temperature of the refrigerant composed of a nonazeotropic mixture and the circulated refrigerant composition described in the thirty-first embodiment of the present invention.

The control unit 400 has the function for calculating the circulated refrigerant composition α and the function for driving the throttle device 33. The calculation of the circulated refrigerant composition α is performed on the basis of the temperature T1 detected by the first temperature sensor 401, and the pressure P detected by the first pressure sensor 403. FIG. 45 is a chart showing the composition of the refrigerant plotted on the horizontal axis and the temperature plotted on the vertical axis under a certain constant pressure. In FIG. 45, the saturated vapor temperature is indicated by the broken line and the saturated liquid temperature is indicated by a single dot chain line, and the line showing the degree of dryness X=0.9 of the refrigerant is indicated by the solid line. It is observed in this chart in FIG. 45 that the composition of the refrigerant is determined uniquely when the pressure, the temperature, and the degree of dryness of the refrigerant are determined. Accordingly, if it is considered that generally the degree of dryness of the refrigerant at the outlet port of the evaporator is approximately 0.9, it is possible to find the circulated refrigerant composition on the basis of the temperature T and the pressure P as respectively mentioned above.

The control unit 400 calculates the condensing temperature Tc on the basis of the circulated refrigerant composition thus calculated and the value P2 detected by the second pressure sensor 405. Then, the control unit 400 calculates the value SC of the degree of supercooling at the outlet port of the condenser in accordance with the difference between the value T2 detected by the second temperature sensor and the condensing temperature Tc (SC=Tc−T2). As the result, the system can set the degree of supercooling of the refrigerant at the outlet port of the condenser in an appropriate value and thereby performing a highly efficient operation.

In FIG. 45, the ratio (%) of the constituents at a high boiling point is indicated on the horizontal axis. Further, it is to be noted that setting the degree of supercooling of the refrigerant in an appropriate value means controlling the degree of supercooling of the refrigerant so as to make it more equal to the desired value. Therefore, the control unit first calculates the circulated refrigerant composition α, next calculating the value of Tc to find the value of SC. If the difference between the value of SC thus found and the desired value of the SC is considerable, the control unit repeats the calculation to find the value of the circulated refrigerant composition α again in search for a opening degree that accounts for the difference, thereby making the value of SC appropriate.

If the SC is too large, the ratio of the liquid portion, which is among the gas portion, the dual-phase portion, and the liquid portion of the refrigerant, in the heat exchanger becomes larger. Accordingly, the operating efficiency of the heat exchanger is thereby deteriorated. On the other hand, too small a value of the SC causes the refrigerant at the outlet port of the heat exchanger to be put into a dual-phase state, which tends to result in the occurrence of refrigerant noises and, in the case of a multiple operation apparatus, a failure in the proper distribution of the refrigerant. Therefore, with the SC set in an appropriate value, it is possible to form a system which operates with high efficiency and is not liable to the occurrence of a trouble in its operation.

Thirty-Second Embodiment

Figure 46:
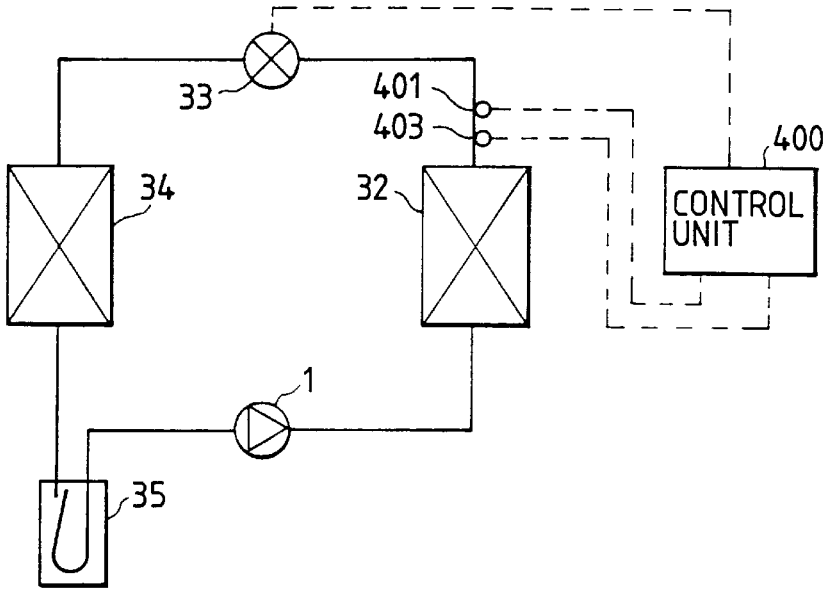
FIG. 46 is a configuration diagram of the refrigerant circuit in a refrigerating and air conditioning system described in the thirty-second embodiment of the present invention.

In the following part, a description will be given with respect to a thirty-second embodiment of a system of the present invention with reference to FIG. 46. In FIG. 46, a compressor 1, a heat exchanger 32 at the heat source side, a throttle device 33, a heat exchanger 34 at the load side, and a low pressure receiver 35 are connected in the serial order to form a main refrigerant circuit. In addition, a control unit 400 calculates the circulated refrigerant composition on the basis of the information furnished by the temperature sensor 401 and the pressure sensor 403 and determines the opening degree of the throttle device on the basis of the information to control.

The refrigerant discharged from the compressor 1 is condensed in the heat exchanger 32 at the heat source side and is reduced in the throttle device 33. The refrigerant is turned into a dual-phase refrigerant at a low temperature and under a low pressure. This dual-phase refrigerant at a low temperature and under a low pressure is led into the heat exchanger 34 at the load side, in which the refrigerant deprives the surrounding area of heat, the system thereby performing a cooling operation, and the refrigerant itself is evaporated and turned into a gas. The gas refrigerant is fed back into the compressor 1 via the low pressure receiver 35.

Figure 47:
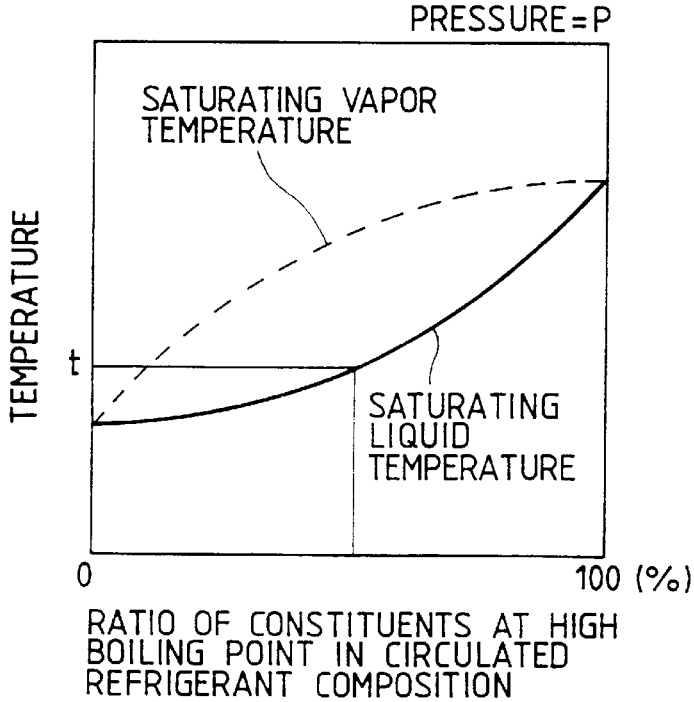
FIG. 47 is a chart of the relationship between the temperature of the refrigerant composed of a nonazeotropic mixture and the circulated refrigerant composition described in the thirty-second embodiment of the present invention.

The control unit 400 has the function for calculating the circulated refrigerant composition α and driving the throttle device 33. The circulated refrigerant composition a is calculated on the basis of the temperature T detected by the temperature sensor 401, and the pressure P detected by the pressure sensor 403. FIG. 47 is a chart showing the composition of the refrigerant plotted on the horizontal axis and the temperature plotted on the vertical axis under a certain constant pressure. In the drawing, the saturated vapor temperature is indicated by the broken line and the saturated liquid temperature is indicated by a single dot chain line. It is observed in this chart that the composition of the refrigerant is determined uniquely when the pressure, the temperature, and the degree of dryness of the refrigerant are determined. When it is considered that generally the degree of dryness of the refrigerant at the outlet port of the evaporator is approximately 0, it is possible to find the circulated refrigerant composition on the basis of the temperature T and the pressure P as respectively mentioned above. In this regard, the degree of dryness 0 indicates the state of the saturated liquid.

The control unit 400 calculates the condensing temperature Tc on the basis of the circulated refrigerant composition thus calculated and the value P detected by the pressure sensor 403. Then, the control unit 400 calculates the value of SC which expresses the degree of supercooling at the outlet port of the condenser in accordance with the equation, SC=Tc−T (the difference between the condensing temperature and the temperature T detected by the temperature sensor 401). As the result, the system can setting the degree of supercooling of the refrigerant at the outlet port of the condenser in an appropriate value by repeating the calculation in the same manner as in the twenty-eighth embodiment to perform a highly efficient operation.

Moreover, the opening degree of the throttle device is determined by using the SC as the desired value, and yet it is assumed that the SC as used at the time when the opening degree is determined and the degree of dryness 0 (SC=0) in the estimate of the composition are separate matters.

In the thirty-first and thirty-second embodiments, the system estimates the composition of the refrigerant on the basis of the temperature and pressure at the location where a saturated state is formed in the refrigerating cycle. Accordingly, it is possible for this system to achieve a considerable simplification of the calculations and thereby to simplify the program and the values to be set up in advance for the control unit 400. Therefore, the present invention can provides a system which is not only available at a low cost but also can achieve a high reliability of the refrigerating cycle in realization of a high cost benefit for the cost since the system performs control on the basis of an estimated composition of the refrigerant.

Thirty-Third Embodiment

Figure 48:
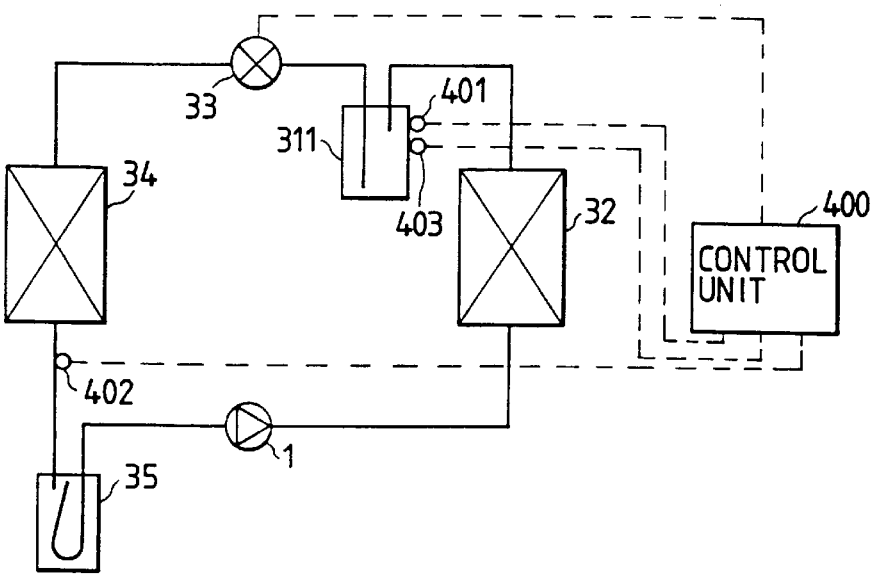
FIG. 48 is a configuration diagram of the refrigerant circuit in a refrigerating and air conditioning system in the thirty-third embodiment of the present invention.

In the following part, a description will be given with respect to a thirty-third embodiment of a system of the present invention with reference to FIG. 48. In FIG. 48, a compressor 1, a heat exchanger 32 at the heat source side, a high pressure receiver 311, a throttle device 33, a heat exchanger 34 at the load side, and a low pressure receiver 35 are connected in the serial order to form a main refrigerant circuit. In addition, a temperature sensor 401 and a pressure sensor 403 measure the pressure and temperature in the inside area of the high pressure receiver, respectively. A control unit 400 calculates the circulated refrigerant composition and determines the opening degree of the throttle device on the basis of the information furnished by the temperature sensor 401 and the pressure sensor 403 to control.

The refrigerant discharged from the compressor 1 is condensed in the heat exchanger 32 at the heat source side, and then is once fed into the high pressure receiver 311. The liquid refrigerant which flows out of the high pressure receiver 311 is reduced in the throttle device 33, and then the refrigerant is turned into a dual-phase refrigerant at a low temperature and under a low pressure. This dual-phase refrigerant at a low temperature and under a low pressure is led into the heat exchanger 34 at the load side, in which the refrigerant deprives the surrounding area of heat, the system thereby performing a cooling operation, and the refrigerant itself is evaporated and turned into a gas. Then, the gas refrigerant is fed back into the compressor 1 via the low pressure receiver 35.

The control unit 400 has the function for calculating the circulated refrigerant composition $\alpha$ and driving the throttle device 33. The calculation of the circulated refrigerant composition $\alpha$ is performed on the basis of the temperature T detected by the temperature sensor 401, and the pressure P detected by the pressure sensor 403. When it is considered that generally the degree of dryness of the refrigerant at the outlet port of the evaporator is approximately 0, then the degree of dryness in the high pressure receiver will also be 0. Hence, it is possible to find the circulated refrigerant composition on the basis of the temperature T and the pressure P as respectively mentioned above.

The control unit 400 calculates the condensing temperature Tc on the basis of the circulated refrigerant composition thus calculated and the value P detected by the pressure sensor 403. Then, the control unit 400 calculates the value of SC of the degree of supercooling at the outlet port of the condenser in accordance with the equation, SC=Tc−T. As the result, the system can set the degree of supercooling of the refrigerant at the outlet port of the condenser in an appropriate value and thereby performing a highly efficient operation.

Since it is certain that a saturated liquid surface appears in the high pressure receiver 311, this system achieves greater certainty in its performance of a detection of the pressure and higher accuracy in the calculation of the circulated refrigerant composition, and the present invention can therefore provide a refrigerating plant having still higher reliability.

Further, this high pressure receiver 311 may be installed in any location between the condenser and the throttle device, and yet it is necessary to secure a saturated liquid surface.

In the twenty-eighth through thirty-third embodiments, the SH at the outlet port of the evaporator or the SC at the outlet port of the condenser is constant so that the system maintains the condition of the refrigerant distributed in the refrigerant circuit in an appropriate state.

Thirty-Fourth Embodiment

Figure 49:
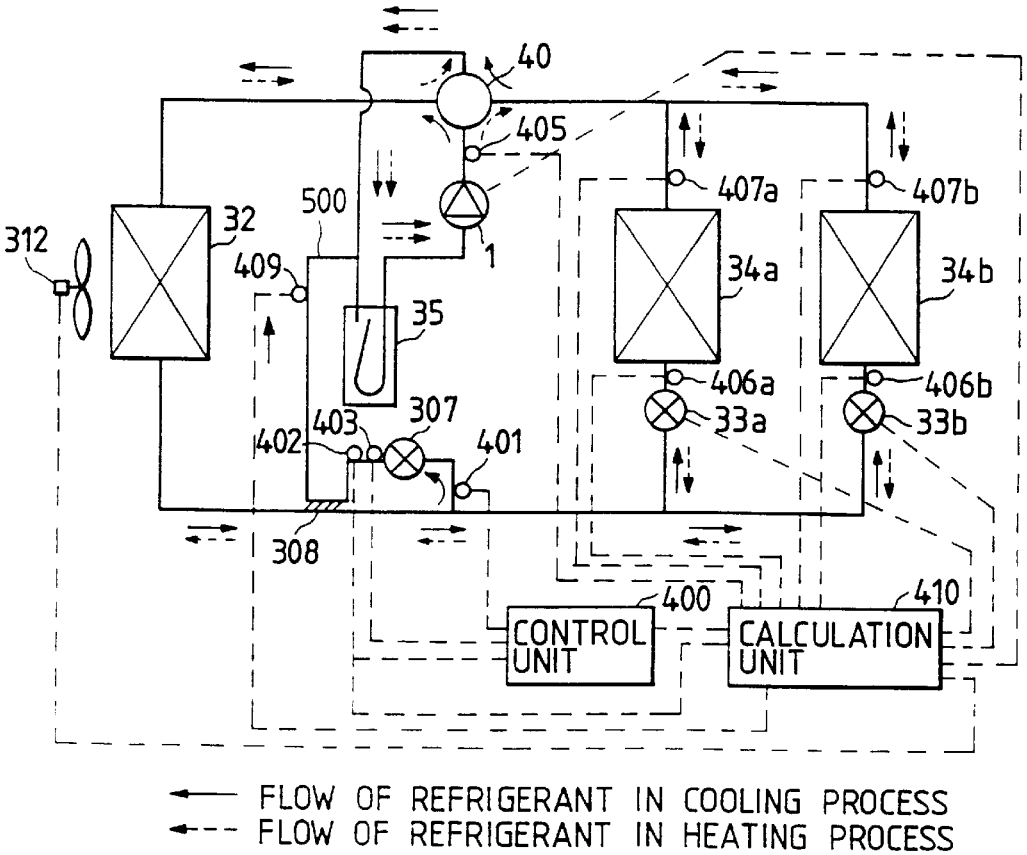
FIG. 49 is a configuration diagram of the refrigerant circuit in a refrigerating and air conditioning system in the thirty-fourth embodiment of the present invention.

In the following part, a description will be given with respect to a thirty-fourth embodiment of a system of the present invention with reference to FIG. 49. In FIG. 49, a compressor 1, a four-way valve 40, a heat exchanger 32 at the heat source side, a supercooling heat exchanger 308, first throttle devices 33*a* and 33*b*, heat exchangers 34*a* and 34*b* at the load side, and a low pressure receiver 35 are connected in the serial order to form a main refrigerant circuit. Further, the heat exchanger section at the load side has two systems of refrigerant circuits a and b. A bypass piping which branches off from the refrigerant circuit and leads to the low pressure gas piping on the main refrigerant circuit via a second throttle device 307 and the superheating heat exchanger 308 is connected between the first throttle device 33*a* and 33*b* and the heat exchanger 32 at the heat source side on the main refrigerant circuit mentioned above. In addition, the system of this embodiment is further provided with a first temperature sensor 401, a second temperature sensor 402, a first pressure sensor 403, a second pressure sensor 405, third temperature sensors 407*a* and 407*b*, fourth temperature sensors 406*a* and 406*b*, and a fifth temperature sensor 409. A calculation device 400 calculates to determine the circulated refrigerant composition on the basis of the information furnished by the first and second temperature sensors 401 and 402 and by the first pressure sensor 403. A control unit 410 calculates to determine the opening degree of the throttle device on the basis of the above-mentioned circulated refrigerant composition and the values detected by the third and fourth temperature sensors 406*a*, 406*b*, 407*a* and 407*b*.

At the time of a cooling operation, the refrigerant discharged from the compressor 1 is condensed in the heat exchanger 32 at the heat source side and is reduced in the throttle devices 33*a* and 33*b*, and then the refrigerant is turned into a dual-phase refrigerant at a low temperature and under a low pressure. This dual-phase refrigerant at a low temperature and under a low pressure is led into the heat exchangers 34*a* and 34*b* at the load side, in which the refrigerant deprives the surrounding area of heat, the system thereby performing a cooling operation, and the refrigerant itself is evaporated and turned into a gas. Then, the gas refrigerant is fed back into the compressor 1 via the four-way valve 40 and the low pressure receiver 35. A part of the refrigerant flows into a bypass pipe 500, the pressure of which is then reduced to a low pressure in the second throttle device 307, and is then led into the supercooling heat exchanger 308. The supercooling heat exchanger 308 performs a heat exchange between the liquid refrigerant flowing under a high temperature through the main refrigerant circuit and the dual-phase refrigerant at a low temperature and under a low pressure in the bypass pipe 500. Accordingly, the enthalpy of the refrigerant flowing through the bypass pipe 500 is transferred to the refrigerant flowing through the main refrigerant circuit, eliminating a loss in the energy.

The control unit 410 and the calculation device 400 have the function for calculating the circulated refrigerant composition $\alpha$ and adjusting the opening degree of the throttle devices 33*a* and 33*b*, the operating frequency of the compressor 1, and the number of revolutions of the blower 312. The circulated refrigerant composition $\alpha$ is calculated in the following manner. The calculation device 400 uses the data on the bypass circuit 500. First, the calculation device 400 takes into itself the values T1, T2, and P1 respectively detected by the first temperature sensor 401, the second temperature sensor 405, and the first pressure sensor 403. Then, the control unit estimates the circulated refrigerant composition $\alpha_1$ on the premise that the initial value is to be found in the filled composition of the refrigerant and assumes further that the enthalpy of the liquid refrigerant depends only on the temperature of the refrigerant. Upon these assumptions, the calculation device 400 calculates the enthalpy H1 on the basis of T1. When it is assumed that the enthalpy of the refrigerant at the outlet port of the second throttle device 307 is equal to the enthalpy at the inlet port of the second throttle device 307, it is possible to calculate the degree of dryness X at the outlet port of the second throttle device 307 from the values T2, P1, and H1. This result of the calculation, namely, the degree of dryness X, and the values T2 and P1, are then applied to an inverse calculation for finding the circulated refrigerant composition $\alpha_2$. The control unit 400 performs calculations by repeating the assumption relating to $\alpha_1$, for example, $\alpha_1=(\alpha_1+\alpha_2)/2$, until the value $\alpha_1$ becomes equal to the value $\alpha_2$, taking the result thus obtained as the circulated refrigerant composition $\alpha$.

When the circulated refrigerant composition α is thus determined, the control unit 410 can obtain the condensing temperature Tc from the value P1 and the value α and to obtain the evaporating temperature Te from the value T1. The control unit 410 has the respective desired values for the condensing temperature and for the evaporating temperature set up in advance and performs corrections of the operating frequency for the compressor 1 and the revolutions of the blower 312, respectively, in accordance with their deviations from the desired values. Further, the control unit 410 controls the opening degree of the throttle devices 33*a* and 33*b* so that the difference between the values detected by the third temperature sensors 407*a* and 407*b* and the fourth temperature sensor 408*a* and 408*b* is constant at a certain level.

As described above, the temperature of the refrigerant depends on the control of the compressor 1 and the blower 312, and the circulated refrigerant composition depends on the control of the opening degree of the throttle devices 33*a* and 33*b*. However, in the case of a multiple operation apparatus, the throttle devices also control the flow rate of the refrigerant. If an operation of the throttle device causes a change in the level of the liquid surface of the refrigerant in the low pressure receiver 35, a change occurs as the result in the composition of the refrigerant. Now, the reference number 409 denotes a fifth temperature sensor, and the control unit 410 controls the flow rate of the refrigerant flowing through the bypass passing through the supercooling heat exchanger 308 by keeping the difference between the temperatures detected respectively by the first temperature sensor 401 and the fifth temperature sensor 409 in a constant value and thereby improving the efficiency in the heat exchange operation. The influence exerted on the value α is such that the liquid refrigerant in the low pressure receiver increases, making the circulated refrigerant composition larger in its quantity when the liquid refrigerant is bypassed from the bypass to the low pressure receiver.

The flow of the refrigerant at the time of a heating operation is indicated by the broken line in FIG. 49. The refrigerant flows in a dual-phase state into the bypass pipe 500. Accordingly, the calculation for the circulated refrigerant composition α are performed in the following manner. The control unit takes into itself the values T1 and P1 which are respectively detected by the first temperature sensor 401 and the first pressure sensor 403. Here, the calculation device 400 sets the degree of dryness of the refrigerant which flows into the bypass pipe 500 in a value approximately in the range from 0.1 to 0.4, and the calculation device 400 calculates the circulated composition α of the refrigerant on the basis of this degree of dryness X and the values T2 and P1.

Here, the calculation device 400 determines the degree of dryness by assuming the state of the refrigerant immediately after its reduction in volume, namely, an isenthalpic change from the high pressure liquid portion into the dual-phase state under a low pressure.

Moreover, in the system described above, the calculation device 400 detects the temperature and pressure of the refrigerant in its state after the reduction in volume, and this operation reflects the consideration that the sensors can be used in common for the cooling operation and the heating operation. If such a common use of the sensors is not to be taken into consideration, it is, of course, feasible to estimate the composition of the circulated refrigerant on the basis of its state in the bypass pipe at the time of a cooling operation and to estimate the composition of the circulated refrigerant on the basis of its state at the inlet port (or at the outlet port) of the evaporator.

When the circulated refrigerant composition α is calculated, it is possible for the system to find the condensing temperature Tc on the basis of P1 and α and the evaporating temperature Te on the basis of T1. The control unit 410 has a desired value for the condensing temperature and a desired value for the evaporating temperature set up in advance, and the control unit 410 corrects the operating frequency of the compressor 1 and the number of revolutions of the blower 312 respectively in accordance with the deviations of their measured values from their desired values. Further, the control unit 4q0 controls the opening degree of the throttle device 33 so that the condensing temperature mentioned above and the value detected by the fourth temperature sensor 406 mentioned above is constant at a certain level.

The control unit 410 finds the condensing temperature as a function of the discharge pressure of the compressor 1 and the composition of the refrigerant. The control unit 410 also finds the evaporating temperature by measuring the temperature of the dual-phase refrigerant after a reduction of the refrigerant. Further, the control unit 410 has the desired value for the condensing temperature set, for example, at 50° C. and the desired value for the evaporating temperature set, for example, at 0° C.

Accordingly, this system can attain a high degree of accuracy in estimating the circulated refrigerant and performing its highly efficient operation with unfailing certainty.

Figure 50:
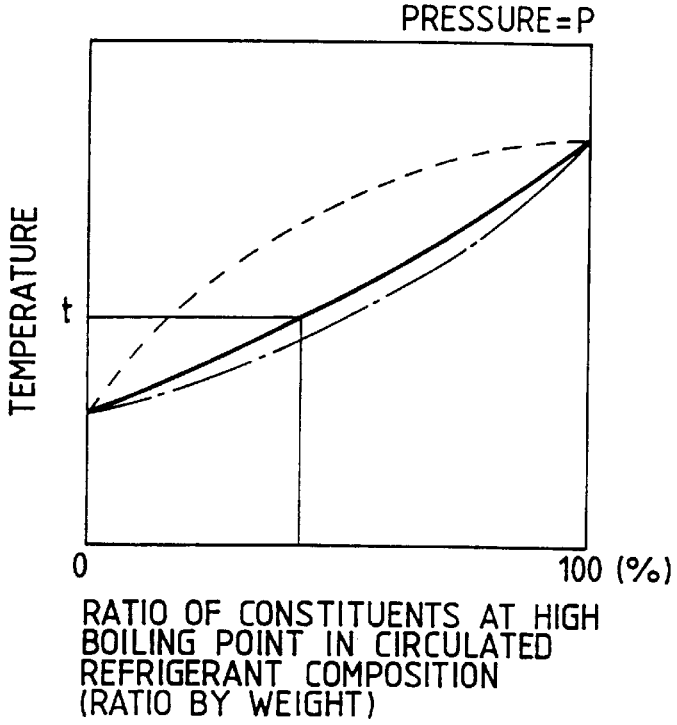
FIG. 50 is a chart of the relationship between the temperature of the refrigerant composed of a nonazeotropic mixture and the circulated refrigerant composition described in the thirty-fourth embodiment of the present invention.

FIG. 50 shows the temperature and the ratios in weight of the constituents at a high boiling point in the composition of the refrigerant circulated in the refrigerant circuit. This drawing shows the ratio of the constituents at a high boiling point, for example, in a case for which it is assumed that the degree of dryness is 0.25 for the refrigerant and in which the temperature in the proximity of the outlet port of the second throttle device 307 is expressed as "t" under a constant pressure P in the low pressure receiver. With such characteristics as these being stored in advance, the calculation device 400 can determine the composition of the circulated refrigerant.

Thirty-Fifth Embodiment

Figure 51:
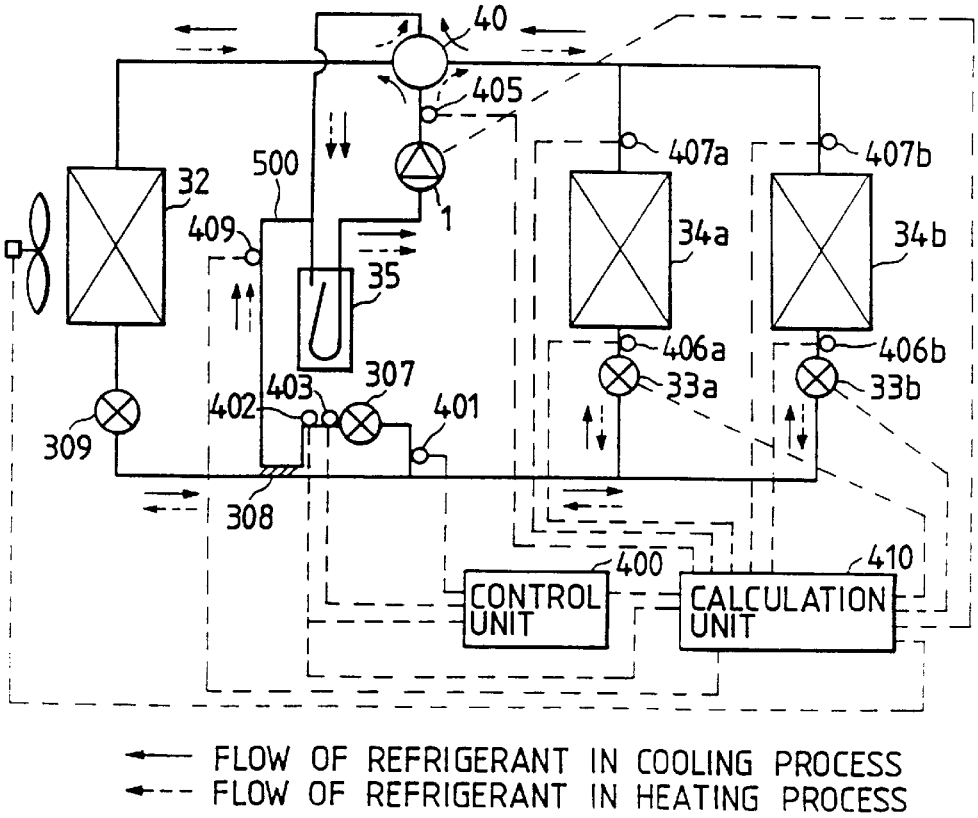
FIG. 51 is a configuration diagram of the refrigerant circuit in a refrigerating and air conditioning system in the thirty-fifth embodiment of the present invention.

In the following part, a description will be given with respect to a thirty-fifth embodiment of a system of the present invention with reference to FIG. 51. In FIG. 51, those component units or parts which are the same as those described in the thirty-fourth embodiment are respectively indicated with the same reference numbers, and a description of those parts is omitted here. As shown in FIG. 51, the refrigerant circulating system in this embodiment is provided further with: a third throttle device 309 which is disposed between the heat exchanger 32 at the heat source side and the supercooling heat exchanger, in addition to the component units of the system described in the thirty-fourth embodiment in FIG. 49.

Now, a description will be given with respect to the working of this system. As regards the cooling operation, this system works in the same manner as the system described in the thirty-fourth embodiment except that the third throttle device is fully opened, and a description of the cooling operation is omitted here.

At the time of a heating operation, the refrigerant is discharged from the compressor 1 is condensed in the heat exchangers 34*a* and 34*b* at the load side and is reduced moderately in the throttle devices 33*a* and 33*b*. This moderately reduced liquid refrigerant under a high pressure is further reduced to attain a low pressure in the third throttle device 309, and the refrigerant is thereby turned into a dual-phase refrigerant at a low temperature and under a low pressure. Then, this dual-phase refrigerant at a low temperature and under a low pressure is led into the heat exchanger 32 at the heat source side, in which the refrigerant is evaporated and turned into a gas, and the gas refrigerant is fed back into the compressor 1 via the four-way valve 40 and the low pressure receiver 35. A part of the refrigerant flows into the bypass pipe 500 and is reduced to a low pressure in the second throttle device 307, and the refrigerant is then led into the supercooling heat exchanger 308. The supercooling heat exchanger 308 performs a heat exchange between the liquid refrigerant under a high temperature flowing through the main refrigerant circuit mentioned above, and the dual-phase refrigerant at a low temperature and under a low pressure flowing flows through the bypass pipe 500 mentioned above. This operating feature enables the system to use the sensors in common for the cooling operation and for the heating operation.

The same method for calculating the circulated refrigerant composition as at the time of the cooling operation in the thirty-fourth embodiment is applied to the system of this embodiment. When the circulated refrigerant composition $\alpha$ is calculated, this system can obtain the condensing temperature Tc from P1 and $\alpha$ and the evaporating temperature Te from T1. The control unit 410 has the desired values for the condensing temperature and the evaporating temperature set in advance and corrects the operating frequency of the compressor 1 and the number of revolutions of the blower 312, respectively, in accordance with the deviations of their measured values from the corresponding desired values. Further, the control unit 410 controls the opening degree of the throttle devices 33*a* and 33*b* so that the difference between the condensing temperature Tc mentioned above and the value T4 detected by the fourth temperature sensor is constant at a certain level. The control unit 410 controls the opening degree of the second throttle device 307 so that the difference between the value detected by the first temperature sensor 401 and the value detected by the fifth temperature sensor 409 is constant at a certain level.

Therefore, owing to the addition of a throttle device to this system, this system is enabled to operate by the same method for estimating the circulated refrigerant composition for the cooling operation and for the heating operation and also to perform highly efficient operation.

Thirty-Sixth Embodiment

Figure 52:
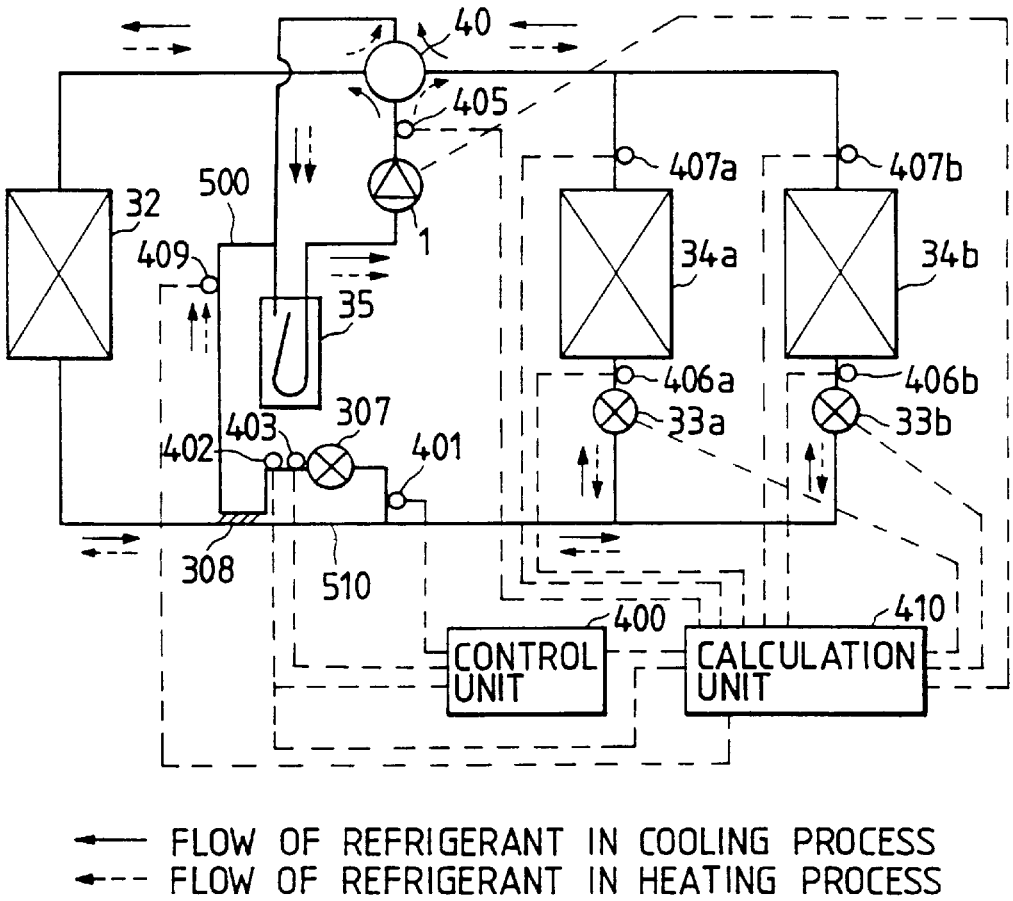
FIG. 52 is a configuration diagram of the refrigerant circuit in a refrigerating and air conditioning system in the thirty-sixth embodiment of the present invention.
Figure 53:
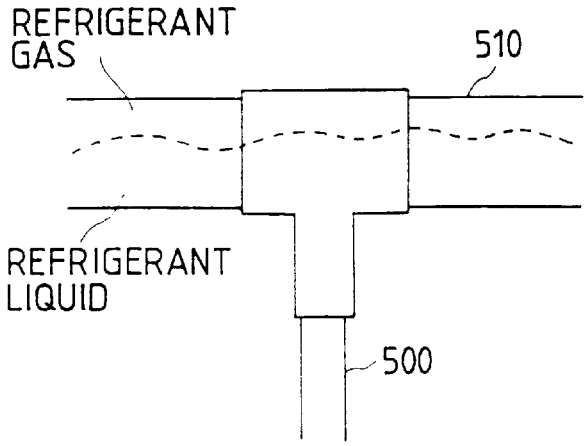
FIG. 53 is a chart of the details of the branching part of the bypass piping described in the thirty- sixth embodiment of the present invention.

In the following part, a description will be given with respect to a thirty-sixth embodiment of a system of the present invention with reference to FIG. 52. In FIG. 52, those component units or parts which are the same as those described in the thirty-fourth embodiment are respectively indicated with the same reference numbers, and a description of those parts is omitted here. Then, FIG. 53 illustrates a part of FIG. 52 where the main refrigerant piping 510 and the bypass piping 500 branch off from each other. As shown in FIG. 53, the bypass piping 500 is connected in a downward-looking position with the main refrigerant piping 510. Namely, the inlet port for the bypass piping 500 is formed in the lower part of the main refrigerant piping.

Figure 54:
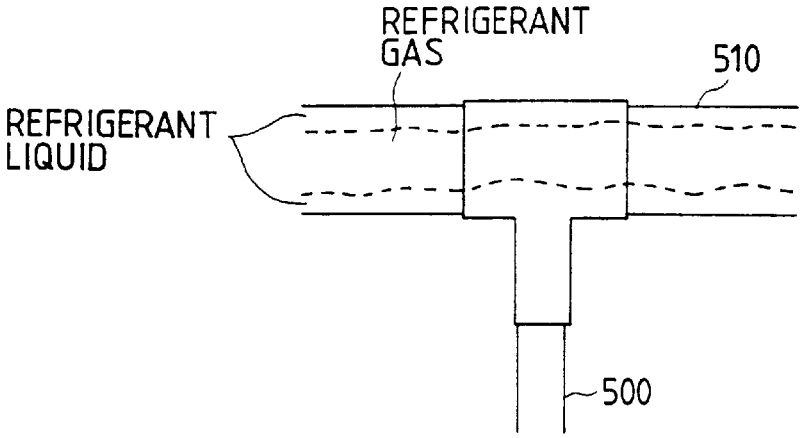
FIG. 54 is a chart of the details of the branching part of the bypass piping described in the thirty- sixth embodiment of the present invention.

As this system performs the cooling operation in the same manner as described in the thirty-fourth embodiment, and its description is omitted here. The flow of the refrigerant in this system at the time of a heating operation is indicated by a broken line in FIG. 52. At the time of a heating operation, the refrigerant is turned into a gas-liquid dual phase state at a low temperature and under a low pressure in the main refrigerant piping which connects the first throttle devices 33*a* and 33*b* and the heat exchanger 32 at the heat source side. In this regard, the pattern of flow of the refrigerant at this moment is either a flow of the refrigerant with its gas and liquid separated so as to form its upper part and its lower part, as indicated by a broken line in FIG. 53, or an annular flow which forms a liquid membrane on the pipe wall, as indicated by a broken line in FIG. 54. Therefore, the liquid refrigerant of the refrigerant in the gas-liquid dual-phase state flows into the bypass pipe in whichever of these forms the refrigerant may be. That is to say, it can be said that the degree of dryness of the refrigerant which flows into the bypass piping is 0.

Now, this system calculate the circulated refrigerant composition $\alpha$ in the following manner. The calculation device 400 takes into itself the value of T1 detected by the first temperature sensor 401 and the value of P1 detected by the first pressure sensor 402. Here, the calculation device 400 sets the degree of dryness of the refrigerant flowing into the bypass piping 500 at 0 and calculates the composition $\alpha_L$ of the refrigerant flowing in the bypass piping 500 on the basis of the degree of dryness X and the value of T2 and the value of P1. Then, the calculation device 400 estimates the composition $\alpha$ of the refrigerant of the refrigerant flowing through the main piping 510 (i.e., the circulated refrigerant composition) on the basis of this $\alpha_L$.

When the circulated refrigerant composition $\alpha$ is thus obtained, it is possible for the control unit to find the condensing temperature on the basis of the value P1 and the value $\alpha$ and to find the evaporating temperature Te on the basis of the value T1. The control unit 410 has the desired values for the condensing temperature and the evaporating temperature recorded in advance. In accordance with the deviations of the found values from the corresponding desired values, the control unit 410 corrects the operating frequency of the compressor 1 and the number of revolutions of the blower 312. Further, the control unit 410 controls the opening degree of the throttle device 33 so that the difference between the value of the condensing temperature mentioned above and the value detected by the fourth temperature sensor 406 is constant at a certain level. Thus, the control unit 410 can perform a VPM control for determining the number of revolutions of the compressor and the gain (i.e., a quantity of a change) of the gas quantity of the outdoor fan on the basis of the high pressure value (i.e., the condensing temperature value) and the low pressure value (i.e., the evaporating temperature).

Hence, this system can achieve an improvement at a low cost on the accuracy in the formation of an estimate of the circulated refrigerant composition at a heating operation.

Although the control operation is different between the cooling and heating operation, this control unit can estimate the circulated refrigerant composition without changing the construction of the refrigerant circuit.

The systems described in the thirty-fourth to the thirty-sixth embodiments of the present invention is provided with a bypass pipe for causing the liquid refrigerant to flow between the heat exchanger at the heat source side (i.e., a condenser) and the throttle device, and the control unit calculates the value repeatedly through utilization of the isenthalpic changes before and after a reduction of the refrigerant flow in the bypass pipe by utilizing the fact that the main piping and the bypass pipe, etc., have the same circulated refrigerant composition, calculates the condensing temperature and the evaporating temperature on the basis of the value $\alpha$, and controls the compressor, the blower, and so on in such a manner that the condensing temperature and the evaporating temperature may be properly adjusted to the respective desired values.

Thirty-Seventh Embodiment

Figure 55:
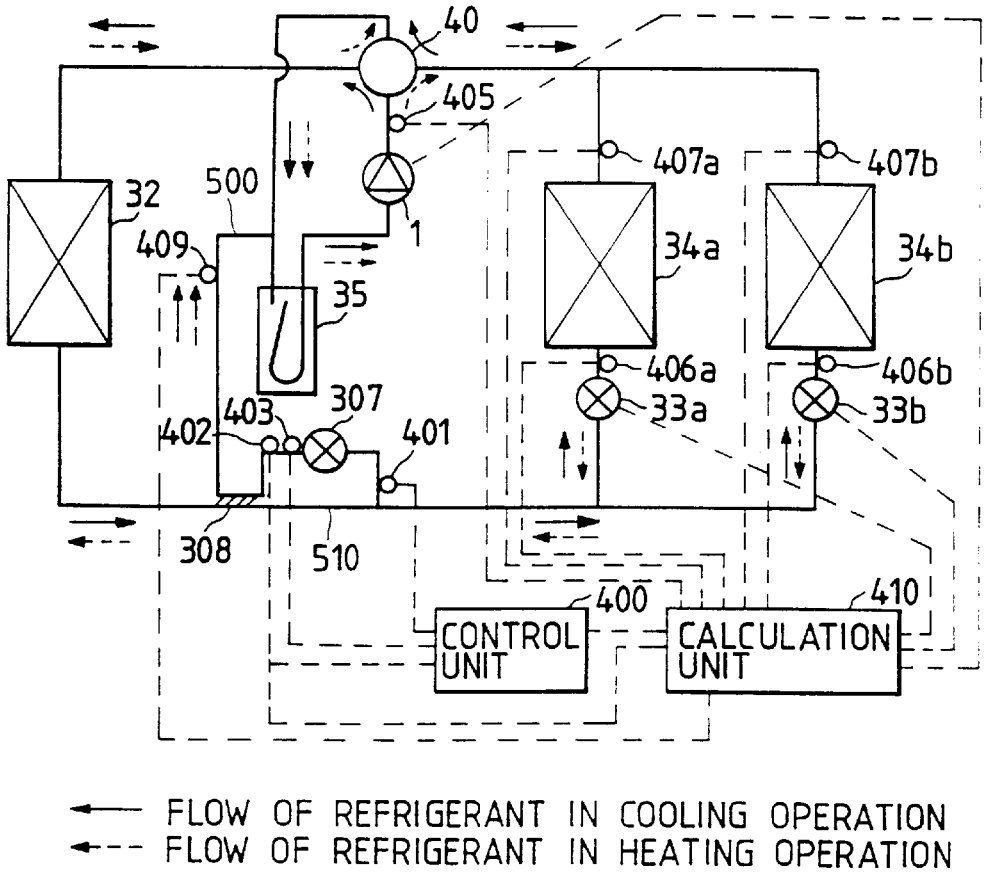
FIG. 55 is a configuration diagram of the refrigerant circuit in a refrigerating and air conditioning system in the thirty-seventh embodiment of the present invention.
Figure 56:
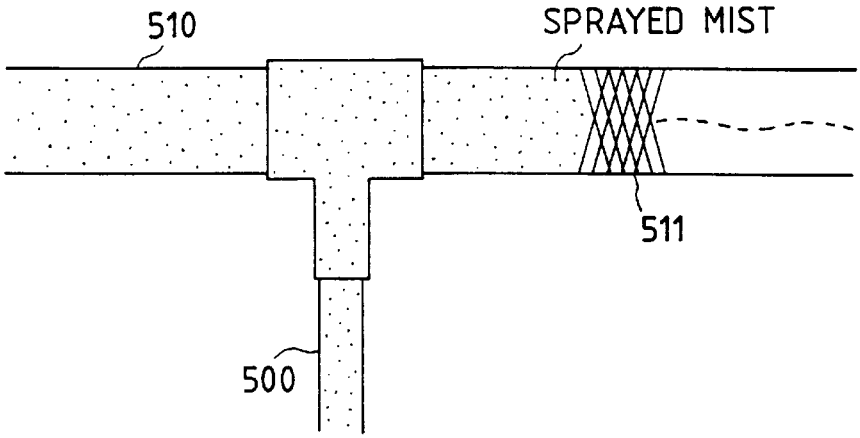
FIG. 56 is a chart of the details of the branching part of the bypass piping described in the thirty-seventh embodiment of the present invention.

In the following part, a description will be given with respect to a thirty-seventh embodiment of a system of the present invention with reference to FIG. 55. In FIG. 55, those component units or parts which are the same as those described in the thirty-fourth embodiment are respectively indicated with the same reference numbers, and a description of those parts is omitted here. Then, FIG. 56 illustrates a part of FIG. 55 where the main refrigerant piping 510 and the bypass piping 500 branch off from each other in this example of preferred embodiment. As shown in FIG. 56, a mesh 511 is disposed at the upstream of the branching part of the main piping in the proximity of the part where the bypass piping 500 branches off from the main piping 510.

The cooling operation performed by this system is the same as that which is described in the thirty-fourth embodiment, and a description of the cooling process is omitted here. The flow of the refrigerant is indicated by the broken line in FIG. 55. The mesh 511 is disposed in the proximity of a part where the bypass piping 500 branches off from the main piping 510 so that the refrigerant which is in a separated form between the gas and the liquid at the upstream of the mesh 511 is transformed into a sprayed mist state after the refrigerant has passed through the mesh. As the result, the refrigerant which has the same degree of dryness as that of the refrigerant flowing through the main refrigerant piping 510 flows into the bypass piping 500.

Therefore, this system performs the calculation of the circulated refrigerant composition $\alpha$ in the following manner. The calculation device 400 takes into itself the value of T1 detected by the first temperature sensor 401 and the value of P1 detected by the first pressure sensor 403. Here, the calculation device 400 sets the degree of dryness of the refrigerant flowing into the bypass piping 500 at a value ranging approximately from 0.1 to 0.4, and then calculates the circulated composition $\alpha_L$ of the refrigerant on the basis of this degree of dryness X of the refrigerant and the value T2 and the value P1 mentioned above.

When the circulated refrigerant composition $\alpha$ is thus obtained, the control unit 410 can calculates the condensing temperature Tc on the basis of the value P1 and the value $\alpha$ and also to find the evaporating temperature Te on the basis of the value T1. The control unit 410 has the desired values for the condensing temperature and the evaporating temperature set up in it in advance, and, in accordance with the deviations of the found values from the corresponding desired values, the control unit 410 corrects the operating frequency of the compressor 1 and the number of revolutions of the blower 312. Further, the control unit 410 controls the opening degree of the throttle devices 33*a* and 33*b* so that the difference between the value of the condensing temperature mentioned above and the value detected by the fourth temperature sensor 406 is constant at a certain level.

Therefore, with the addition of the mesh, this system is capable of attaining an equal degree of dryness in the refrigerant flowing in the main refrigerant piping in the proximity of the part where the bypass piping 500 branches off from the main refrigerant piping and in the refrigerant flowing through the bypass pipe 500 at a heating operation, thereby achieving an improvement on the accuracy in the formation of an estimate of the circulated refrigerant composition at the time of a heating operation and performing highly efficient operations at a high degree of reliability.

Although this embodiment has a system provided with a mesh is described above, it goes without saying that this system can be constructed, for example, with a weir formed on the circumferential wall or with a component unit moving so as to agitate the refrigerant so long as the system is constructed so as to turn the refrigerant as separated between the gas and the liquid into a sprayed mist state.

Thirty-Eighth Embodiment

Figure 57:
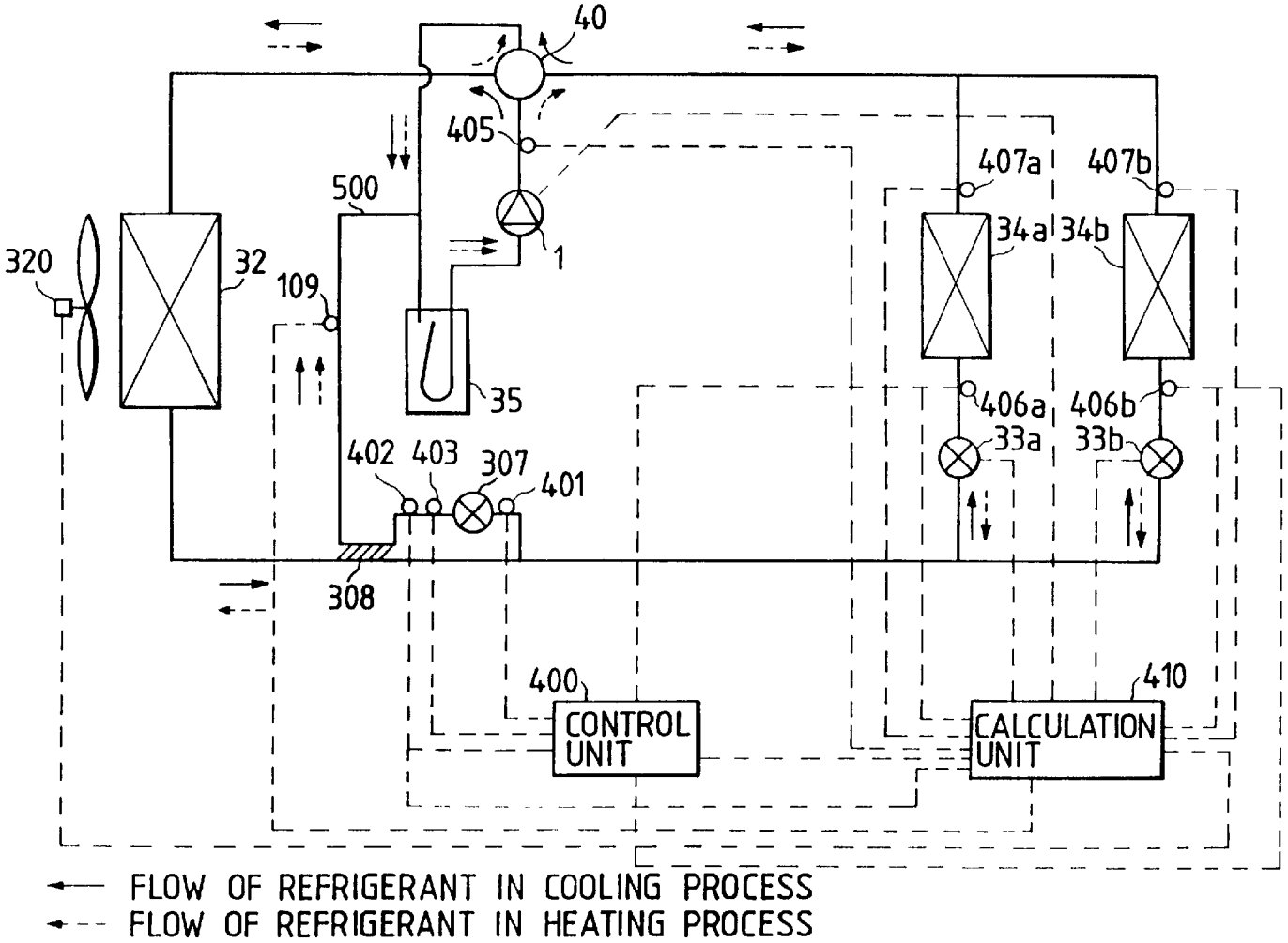
FIG. 57 is a configuration diagram of the refrigerant circuit in a refrigerating and air conditioning system in the thirty-eighth embodiment of the present invention.

In the following part, a description will be given with respect to a thirty-eighth embodiment of a system of the present invention with reference to FIG. 57. Moreover, in FIG. 57, those component units or parts which are the same as those described in the thirty-fourth embodiment are respectively indicated with the same reference numbers, and a description of those parts is omitted here. The system in this embodiment takes the information furnished by the second temperature sensors 406*a* and 406*b* into a calculation unit 400.

The cooling operation performed by this system is the same as that performed by the system described in the thirty-fourth embodiment, and a description thereof is omitted here. The heating operation performed by this system is different only in the working of the control unit 410, and, accordingly, also a description of the working of the control unit is omitted here. The circulated refrigerant composition $\alpha$ at a heating operation is calculated in the following manner. The calculation device 400 takes into itself the values T1, T2, and P1, which are respectively detected by the fourth temperature sensors 406*a* and 406*b*, the second temperature sensor 402, and the first pressure sensor 403. In respect of the circulated refrigerant composition $\alpha_1$, it is assumed that the enthalpy of the liquid refrigerant is dependent only on the temperature of the refrigerant, the calculation device 400 calculates the enthalpy H1 from the value T1. When it is assumed here that the enthalpy of the refrigerant at the outlet port of the second throttle device 307 is equal to the enthalpy of the refrigerant at the inlet port of the second throttle device 307, the calculation device 400 calculates the degree of dryness X at the outlet port of the second throttle device 7 on the basis of the values T2, P1, and H1. From this calculated result X and the values T2 and P1, the control unit calculates the circulated refrigerant composition $\alpha_2$ by performing an inverse operation. The calculation device 400 repeats calculations based on the assumption relating to the value $\alpha_1$, until each of the value $\alpha_1$ and the value $\alpha_2$ become equal to the other, and determines the obtained result as the circulated refrigerant composition $\alpha$.

Therefore, this refrigerant circulating system can estimate the composition of the refrigerant with a high degree of accuracy also at the time of a heating operation, thereby performing highly efficient operations.

Thirty-Ninth Embodiment

Figure 58:
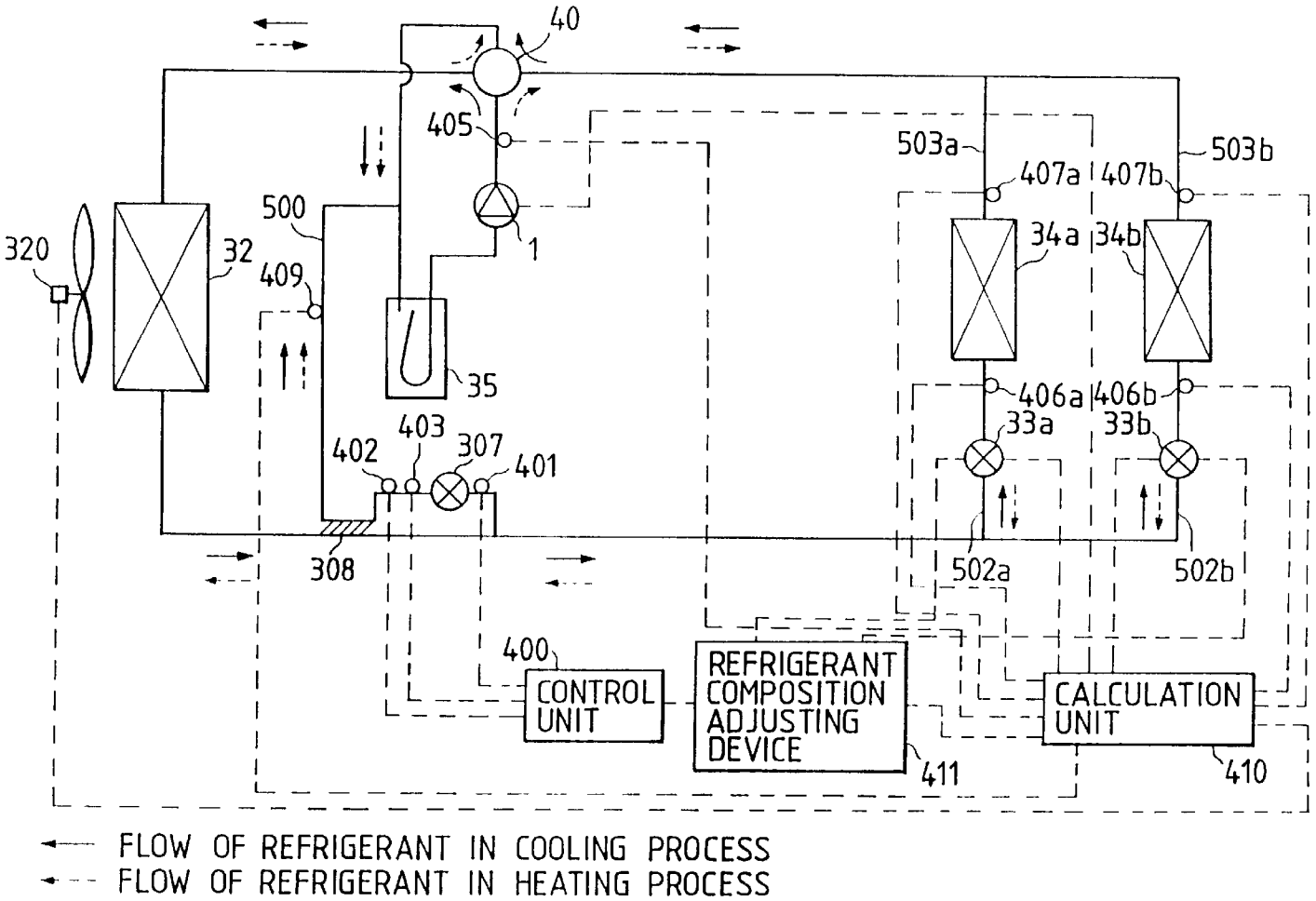
FIG. 58 is a configuration diagram of the refrigerant circuit in a refrigerating and air conditioning system in the thirty-ninth embodiment of the present invention.

In the following part, a description will be given with respect to a thirty-ninth embodiment of a system of the present invention with reference to FIG. 58. In FIG. 58, a compressor 1, a four-way valve 40, a heat exchanger 32 at the heat source side, a superheating heat exchanger 308, first throttle devices 33*a* and 33*b*, and a low pressure receiver 35 are connected in the serial order to form a main refrigerant circuit. In addition, the heat exchanger portion at the load side has two systems of the refrigerant circuits a and b. A bypass piping 500, which branches off from the refrigerant circuit and leads to the gas piping under a low pressure via a second throttle device 307 and the supercooling heat exchanger 308, is connected between the first throttle devices 33*a* and 33*b* and the heat exchanger 32 at the heat source side on the main refrigerant circuit mentioned above. Further, the system is further provided with a first temperature sensor 401, a second temperature sensor 402, a first pressure sensor 403, a second pressure sensor 405, third temperature sensors 407*a* and 407*b*, and fourth temperature sensors 406*a* and 406*b*. A calculation unit 400 calculates the circulated refrigerant composition on the basis of the information furnished by the first temperature sensor 401, the second temperature sensor 403, and the first pressure sensor 403 respectively mentioned above. A refrigerant composition adjusting device 411 adjusts the composition of the refrigerant. A control unit 410 determines the opening degree of the throttle devices 33*a* and 33*b*, the operating frequency of the compressor 1, and the number of revolutions of the fan 320 in the outdoor unit on the basis of the values detected by the third and fourth temperature sensors 407*a*, 407*b* and 406*a*, 406*b*, and the second pressure sensor 405.

At the time of a cooling operation, the refrigerant discharged from the compressor 1 is condensed in the heat exchanger 32 at the heat source side and is reduced in the throttle device 33, and then the refrigerant is turned into a dual-phase refrigerant at a low temperature and under a low pressure. This dual-phase refrigerant at a low temperature and under a low pressure is led into the heat exchanger 34 at the load side, in which the refrigerant deprives the surrounding area of heat, the system thereby performing a cooling operation, and the refrigerant itself is evaporated and turned into a gas. The gas refrigerant is fed back into the compressor 1 via the four-way valve 40 and the low pressure receiver 35. A part of the refrigerant flows into the bypass piping 500, and the refrigerant is reduced until it attains a low pressure in the second throttle device 307 and is then led into the supercooling heat exchanger 309. The supercooling heat exchanger 308 performs a heat exchange between the liquid refrigerant flowing in the main refrigerant circuit and the dual-phase refrigerant flowing through the bypass piping 500 mentioned above. Therefore, the enthalpy of the refrigerant flowing through the bypass piping 500 is transferred to the refrigerant flowing through the main refrigerant circuit, and an energy loss is prevented from occurring in the system.

The calculation unit 400 calculates the circulated refrigerant composition $\alpha$. Therefore, the calculation unit 400 calculates the circulated refrigerant composition $\alpha$ in the following manner. The calculation unit 400 uses the data on the bypass circuit 500. First, this calculation unit 400 takes into itself the values T1, T2, and P1 detected by the first temperature sensor 401, the second temperature sensor 402, and the first pressure sensor 403, respectively. The calculation unit 400 assumes a circulated refrigerant composition $\alpha_1$ and further assumes that the enthalpy of the liquid refrigerant depends only on the temperature of the refrigerant so as to calculate the value of the enthalpy H1 on the basis of the value T1. Now, when it is assumed here that the enthalpy of the refrigerant at the outlet port of the second throttle device 307 is equal to the enthalpy at the inlet port of the second throttle device 307, the calculation unit 400 can calculates the degree of dryness X of the refrigerant at the outlet port of the second throttle device 307 on the basis of the values T2, P1, and H1. Then, the calculation unit 400 calculates the value $\alpha_2$ of the circulated refrigerant composition by an inverse operation from this calculated result X and the values T2 and P1. The calculation unit 400 repeats the calculation based on the assumption stated above until the value $\alpha_1$ and the value $\alpha_2$ become equal to each other, and takes the obtained result as the value of the circulated refrigerant composition $\alpha$.

Now, a description will be given with respect to the working of the refrigerant composition adjusting device 411 at a cooling operation. Only if any heat exchanger at the load side is suspended from its operation, among a plural number of heat exchangers at the load side installed in the system, the refrigerant composition adjusting device is operated. Now, it is assumed that the heat exchanger 34*a* at the load side is suspended. The refrigerant composition adjusting device 411 adjusts the refrigerant composition in accordance with the difference between the circulated refrigerant composition $\alpha$ and the desired value of the circulated refrigerant composition $\alpha^*$. The first step in the method for adjusting the refrigerant composition is to store the liquid refrigerant in the low pressure receiver 35. At this time, the level of the liquid surface in the low pressure receiver 35 rises, and consequently the refrigerant rich in constituents at a low boiling point is circulated in the refrigerant circuit. At this point, the system closes the first throttle device 33*a*, thereby leading the liquid refrigerant at a high temperature and under a high pressure into the piping 502*a*. At this point in time, the refrigerant discharged from the compressor 1 is rich in constituents at a low boiling point, and, consequently, the refrigerant stored in the inside of the piping 502*a* is rich in constituents at a low boiling point. As the result, the refrigerant being circulated in the refrigerant circuit changes from a composition rich in constituents at a low boiling point to a composition rich in constituents at a high boiling point. Here, in case $\alpha<\alpha^*$ in the comparison of the circulated refrigerant composition $\alpha$, which is calculated by the calculation unit 410, with the desired value $\alpha^*$ of the circulated refrigerant composition, the system opens the first throttle device 33*a*, but, in case $\alpha>\alpha^*$, the system performs a control operation for closing the first throttle device 33*a*, so that the circulated refrigerant composition is balanced in the proximity of the desired value.

The control unit 410 calculates the condensing temperature Tc on the basis of the circulated refrigerant composition $\alpha$ and the value P1, both of which is obtained by the calculation unit 400, and also calculates the evaporating temperature Te on the basis of the value T1. Further, the desired value for the condensing temperature and that for the evaporating temperature is set in advance, and the control unit 410 corrects the operating frequency of the compressor 1 and the number of revolutions of the blower 312 in accordance with the deviations of these from the respective desired values. The control unit 410 also controls the opening degree of the first throttle devices 33*a* and 33*b* in such a manner that the values respectively detected by the third and fourth temperature sensors 407*a*, 407*b* and 406*a*, 406*b* is respectively constant at a certain level. In addition, the control unit 410 further controls the opening degree of the second throttle device 307 in such a manner that the values detected by the first and second temperature sensor 401 and 402.

The flow of the refrigerant at the time of a heating operation is indicated by the broken line in FIG. 58. The refrigerant flows in its dual-phase state into the bypass pipe 500. Therefore, this system calculates to determine the circulated refrigerant composition $\alpha$ in the following manner. The calculation unit 400 takes into itself the values T1 and P1, which are respectively detected by the first temperature sensor 401 and the first pressure sensor 403. Here, the control unit 410 sets the degree of dryness of the refrigerant which flows into the bypass pipe 500 in the range approximately from 0.1 to 0.4 and calculates the circulated refrigerant composition $\alpha$ bon the basis of this degree of dryness X and the values T2 and P1.

Now, a description will be given with respect to the working of the refrigerant composition adjusting device 411 at the time of a heating operation. Only if any of the plural number of heat exchangers at the load side is suspended, the refrigerant composition adjusting device 411 is operated. Now, it is assumed that the heat exchanger 34*a* at the load side is suspended. The refrigerant composition adjusting device 411 makes an adjustment of the composition of the refrigerant in accordance with the difference between the circulated refrigerant composition $\alpha$ calculated by the calculation unit 400 and the desired value $\alpha^*$ for the circulated refrigerant composition. The first step to be taken in the method for adjusting the composition of the refrigerant in circulation is to store the liquid refrigerant in the low pressure receiver 35. In order to store the liquid refrigerant in the low pressure receiver 35, the system starts up the compressor 1 while keeping the throttle device 33 fully open. At this time, the level of the liquid surface in the low pressure receiver 35 rises, by which the circulated refrigerant composition is changed in such a manner that the refrigerant rich in constituents at a low boiling point is circulated in the refrigerant circuit. Here, the control unit 410 closes the first throttle device 33*a*, thereby leading the liquid refrigerant at a high temperature and under a high pressure into the piping 502*b*. At this point in time, the refrigerant discharged from the compressor 1 is rich in constituents at a low boiling point, and consequently the refrigerant stored in the inside of the piping 502*b* is rich in constituents at a low boiling points. As the result, the composition of the refrigerant which is circulated through the refrigerant circuit changes from a composition rich in constituents at a low boiling point to a composition rich in constituents at a high boiling point. Here, in case $\alpha<\alpha^*$ in the comparison of the circulated refrigerant composition $\alpha$ calculated by the calculation unit 400, with the desired value $\alpha^*$ of the circulated refrigerant composition, the control unit 410 controls to open the first throttle device 33*a*, but, in case $\alpha>\alpha^*$, the control unit controls to close the first throttle device 33*a*, so that the circulated refrigerant composition may be balanced in the proximity of the desired value.

When the circulated refrigerant composition $\alpha$ is calculated, the control unit 410 can calculate the condensing temperature Tc on the basis of the values P1 and $\alpha$ and the evaporating temperature Te on the basis of the value T1. The control unit 410 has the desired values for the condensing temperature and the evaporating temperature set in advance and makes corrections of the operating frequency of the compressor 1 and the number of revolutions of the blower 312, respectively, in accordance with the deviation of each of these from its desired value. Moreover, the control unit 410 also controls the opening degree of the throttle device 33 in such a manner that the condensing temperature mentioned above and the value detected by the fourth temperature sensors 406*a* and 406*b* is constant at a certain level. Accordingly, this system can achieve high accuracy in estimating the circulated refrigerant composition and can perform highly efficient operations with a high degree of reliability.

In case the composition of the refrigerant is to be adjusted, it is necessary to retain the refrigerant in the composition of the refrigerant flowing in the system at the particular moment. That is to say, when the refrigerant rich in constituents at a low boiling point is stored in the indoor unit as put out of its operation, the refrigerant in the deficient quantity is evaporated from the low pressure receiver 35. Since this evaporated refrigerant is rich in constituents at a high boiling point, the composition of the refrigerant is changed. If the throttle device of the indoor unit suspended from its operation is opened, the refrigerant in the same composition as that of the circulated refrigerant flows into the indoor unit suspended from its operation. As the result, the effect of the change in the composition of the refrigerant mentioned above is reduced.

Fortieth Embodiment

Figure 59:
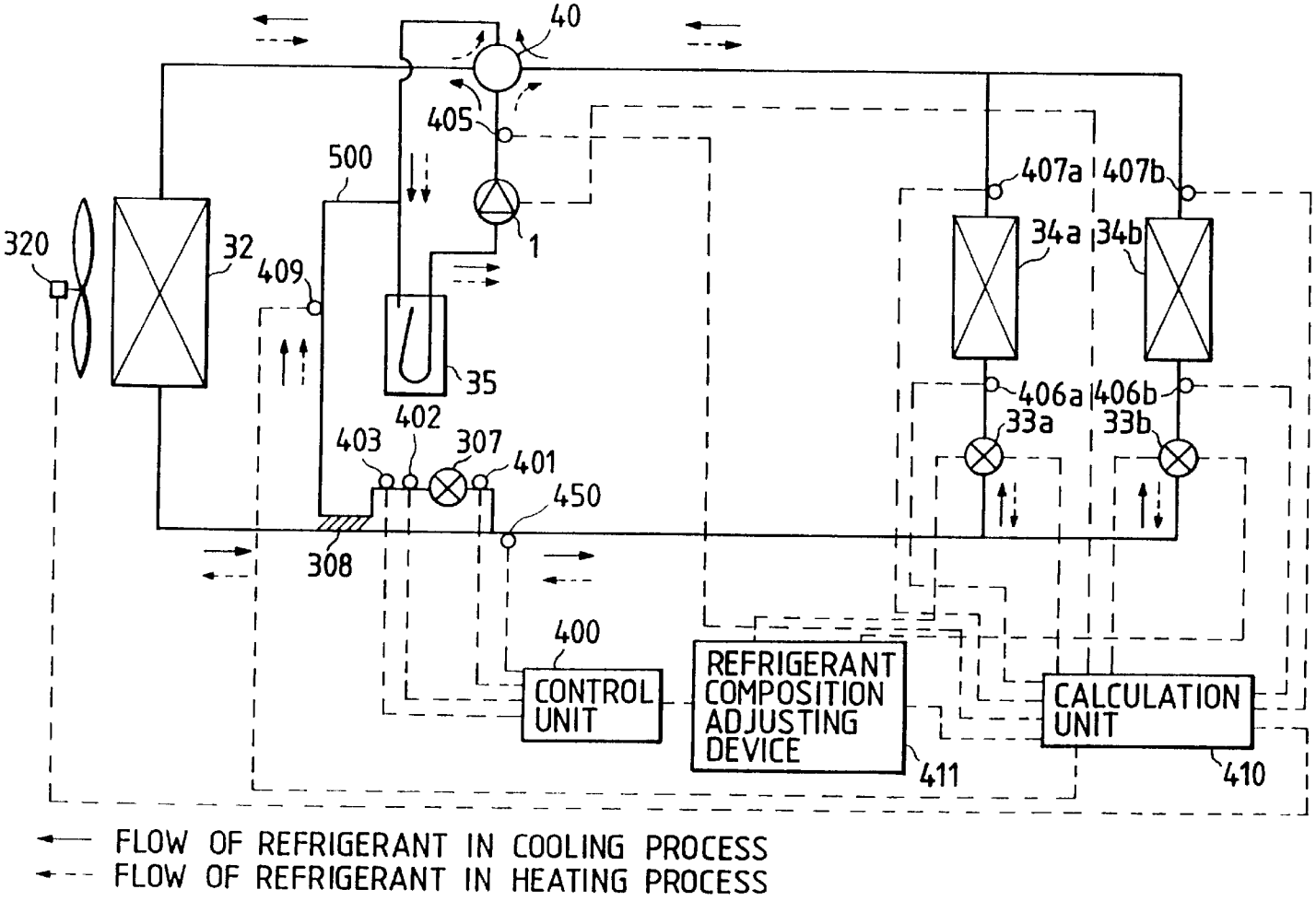
FIG. 59 is a configuration diagram of the refrigerant circuit in a refrigerating and air conditioning system in the fortieth embodiment of the present invention.

In the following part, a description will be given with respect to a fortieth embodiment of a system of the present invention with reference to FIG. 59. In FIG. 59, those component units or parts which are the same as those described in the thirty-ninth embodiment are respectively indicated with the same reference numbers, and a description of those parts is omitted here. In the system in the thirty-ninth embodiment in FIG. 58, a refrigerant dryness degree sensor 450 is added to the proximity of the branching part between the main refrigerant piping and the bypass piping 500.

Now, a description will be given with respect to the working of the system in this embodiment. In a cooling operation, as the working of the refrigerant is the same as that of the refrigerant described in the thirty-ninth embodiment. Further, in a heating operation, the flow for the refrigerant, the working of the refrigerant composition control unit, and the working of the control unit are the same as those described in the thirty-ninth embodiment. Therefore, a description will be given here only with respect to the working of the calculation unit 400 at the time of a heating operation by this system. The circulated refrigerant composition $\alpha$ are calculated in the following manner. The calculation unit 400 takes into itself the value T1 and the value P1 which the first temperature sensor 401 and the first pressure sensor 403 respectively detect. Here, the part from which the bypass piping 500 branches off is disposed in a downward-looking position or in a similar manner so that the refrigerant flowing into it is only the liquid of the refrigerant. In view of this state, the degree of dryness X of the refrigerant which flows into the bypass piping 500 is set at 0, and the calculation unit 400 calculates the circulated refrigerant composition $\alpha^-$ of the refrigerant flowing through the bypass piping 500 on the basis of this degree of dryness X of the refrigerant and the values T2 and P1. On the basis of this value $\alpha^-$ and the degree of dryness $X^-$ which the dryness degree sensor 450 detects, the calculation unit 400 calculates the circulated refrigerant composition $\alpha$ of the refrigerant which flows through the main piping.

Therefore, the refrigerant circulating system in this embodiment can achieves high accuracy in its estimation of the circulated refrigerant composition, even if the system performs a heating operation, and it is possible to perform a highly efficient operation.

In the thirty-fourth to fortieth embodiments, the opening degree of the second throttle device 307 is controlled so the difference between the temperature at the outlet port and the temperature at the inlet port for the heat exchanger 308 installed in the bypass piping 500 is in a certain predetermined value (for example, 10° C.). Specifically, the control unit 410 calculates the difference between the temperatures which are respectively detected, for example, by the temperature sensors 401 and 409, which are installed in the bypass piping 500, and calculates a corrected value for the opening degree of the throttle device 307 by a feedback control, such as the PID control. In accordance with the difference between this temperature difference and a predetermined value (for example, 10° C.), and, by the effect of these operations, the refrigerant which flows from the bypass piping 500 to the low pressure receiver 35 is always kept in the state of vapor, and thus this system achieves the advantageous effect that it can make effective use of energy and can also prevent the liquid refrigerant from flowing back into the compressor 1.

In this regard, it should be noted that this refrigerant circulating system, which has been described with reference to a system operated with a dual-constituent refrigerant, can be applied also to a system operated with a multiple-constituent refrigerant, such as a refrigerant composed of three constituents, and that this system can produce a similar effect with such a refrigerant.

Forty-First Embodiment

Figure 60:
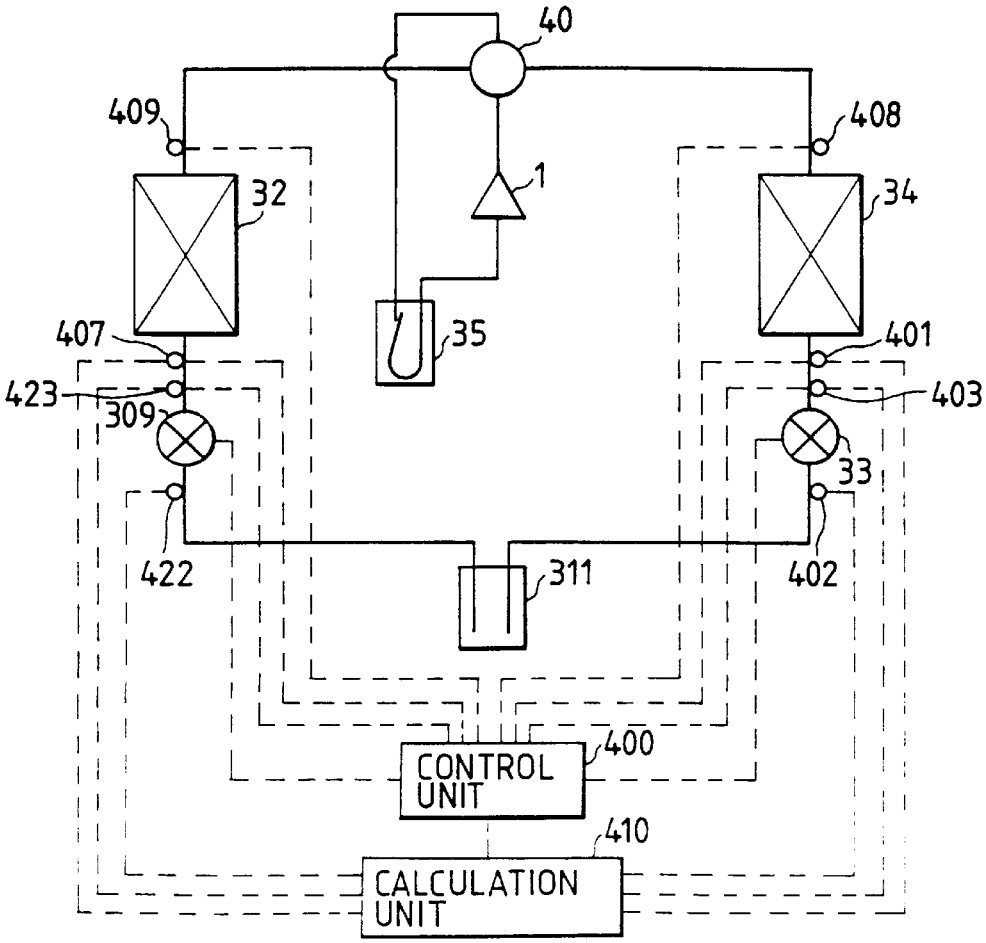
FIG. 60 is a configuration diagram of the refrigerant circuit in a refrigerating and air conditioning system in the forty-first embodiment of the present invention.

In the following part, a description will be given with respect to a forty-first embodiment of a system of the present invention with reference to FIG. 60. In FIG. 60, a compressor 1, a four-way valve 40, a heat exchanger 32 at the heat source side, a second throttle device 209, a high pressure receiver 311, a first throttle device 33, a heat exchanger 34 at the load side, and a low pressure receiver 35 are connected in the serial order to form a main refrigerant circuit. In addition, the system is further provided with a first temperature sensor 401, a second temperature sensor 402, a first pressure sensor 403, a third temperature sensor 407, a fourth temperature sensor 422, a second pressure sensor 423, a fifth temperature sensor 408, and a sixth temperature sensor 409. The reference number 400 denotes an calculation device which determines the circulated refrigerant composition by calculating on the basis of the information obtained from the first, the second, the third, and the fourth temperature sensors and from the first and the second pressure sensors. The reference number 410 denotes a control unit, which determines the opening degrees of the first throttle device 33 and the second throttle device to control 209.

At the time of a cooling operation, the refrigerant discharged from the compressor 1 is condensed in the heat exchanger 32 at the heat source side. Here, when the value detected in the second pressure sensor 423 is at or above a certain preset value, the control unit 410, acting on the basis of its judgment, operates the second throttle device so as to be fully opened. Then, the liquid refrigerant flows into the high pressure receiver 311 to be stored therein. Then, the liquid refrigerant flows out of the high pressure receiver 311 and is reduced in the first throttle device 33, and the liquid refrigerant is thereby in a dual-phase state at a low temperature and under a low pressure. This dual-phase refrigerant at a low temperature and under a low pressure is led into the heat exchanger 34 at the load side, in which the refrigerant deprives the surrounding area of heat, the system thereby performing a cooling operation, and the refrigerant itself is evaporated and turned into a gas. The gas refrigerant is fed back into the compressor 1 via the four-way valve 40 and the low pressure receiver 35. As the result, the liquid refrigerant is no longer present in the low pressure receiver 35, so that the circulated refrigerant composition is richer in constituents at a high boiling temperature, and the high pressure is reduced. At this time, the control unit 410 controls the opening degree of the first throttle device in such a manner that the different between the value detected by the first temperature sensor 401 and the value detected by the fifth temperature sensor 408 is constant at a certain level.

When the value detected by the second pressure sensor 423 is not any higher than a certain preset value at the time of a cooling operation, the control unit 410 operates by its judgment to set the first throttle device 33 in a fully opened state. The liquid refrigerant is condensed in the heat exchanger 32 at the heat source side, and the condensed refrigerant is turned into a dual-phase state at a low temperature and under a low pressure in the second throttle device 309. The dual-phase refrigerant flows into the high pressure receiver 311, and, as the liquid refrigerant flows out of the high pressure receiver 311, in which the liquid refrigerant is no longer stored therein. The dual-phase refrigerant at a low temperature and under a low pressure flown out of the high pressure receiver 311 flows into the low pressure receiver 34, in which the refrigerant deprives the surrounding area of heat, the system thereby performing a cooling operation, and the refrigerant itself is evaporated and turned into a gas. Then, the gas refrigerant is fed back into the compressor 1 via the four-way valve and the low pressure receiver 35. As the result, the liquid refrigerant is stored in the low pressure receiver 35, and the constituents at a low boiling point is richer in the circulated refrigerant composition, with the result that the high pressure is increased.

The calculation device 400 calculates the circulated refrigerant composition $\alpha$ in the following manner. The calculation unit 400 takes into itself the values T1, T2, and P1 which the third temperature sensor 407, the fourth temperature sensor 422, and the first pressure sensor 423 respectively detect. The calculation unit 400 assumes a circulated refrigerant composition $\alpha_1$ and further assumes that the enthalpy of the liquid refrigerant depends only on the temperature of the refrigerant and finds the value of the enthalpy H1 on the basis of the value T1. Now, when it is assumed here that the enthalpy of the refrigerant at the outlet port of the second throttle device 309 is equal to the enthalpy at the inlet port of the second throttle device 309, then the calculation unit 400 can calculate the degree of dryness X of the refrigerant at the outlet port of the first throttle device 33 on the basis of the values T2, P1, and H1. Then, the calculation unit 400 calculates the value $\alpha_2$ of the circulated refrigerant composition by an inverse operation from this calculated result X and the values T2 and P1. The calculation unit 400 repeats the calculations based on the assumption stated above until the value $\alpha_1$ and the value $\alpha_2$ become equal to each other, and takes the obtained result as the value of the circulated refrigerant composition $\alpha$.

The control unit 410 obtains the condensing temperature Tc on the basis of the value P1 and the circulated refrigerant composition $\alpha$, when the calculation unit 400 can obtains the circulated refrigerant composition $\alpha$. The control unit 410 also controls the opening degree of the second throttle device 309 in such a manner that the difference between the condensing temperature mentioned above and the value detected by the third temperature sensor 421 is constant at a certain level.

At the time of a heating operation, the refrigerant discharged from the compressor 1 is condensed in the heat exchanger 34 at the load side. Here, in case the value detected by the first pressure sensor 403 is equal to or in excess of a certain preset value, the control unit 410 operates by its judgment to put the first throttle device 33 in a fully opened state. The liquid refrigerant flows into the high pressure receiver 311, and the liquid refrigerant is stored therein. The liquid refrigerant flown out of the high pressure receiver 311 is reduced in the second throttle device 309 and turned into a dual-phase state at a low temperature and under a low pressure. This dual-phase refrigerant at a low temperature and under a high pressure flows into the heat exchanger 32 at the heat source side, in which the refrigerant is evaporated and turned into a gas, and the gas refrigerant is fed back into the compressor 1 by way of the four-way valve 40 and the low pressure receiver 35. As the result, the liquid refrigerant ceases to be present in the low pressure receiver 35, so that the circulated refrigerant composition is richer in the constituents at a high boiling point, and the high pressure is reduced. At this time, the control unit 410 controls the opening degree of the second throttle device 309 in such a manner that the difference between the value detected by the third temperature sensor 407 and the value detected by the sixth temperature sensor 409 is constant at a certain level.

When the value detected in the first pressure sensor 403 is at or below a certain preset value at the time of a heating operation, the control unit 410, acting on the basis of its judgment, operates the second throttle device 309 so as to be fully opened. Then, the liquid refrigerant which condensed in the heat exchanger 34 at the load side is turned into a dual-phase refrigerant at a low temperature and under a low pressure in the first throttle device 33. The dual-phase refrigerant flows into the high pressure receiver 311, and the liquid refrigerant flows out of the high pressure receiver 311, so that the liquid refrigerant is no longer stored in the high pressure receiver 311. Thus, the dual-phase refrigerant flown out of the high pressure receiver 311 flows into the heat exchanger 32 at the heat source side, in which the refrigerant deprives the surrounding area of heat, the system thereby performing a cooling operation, and the refrigerant itself is evaporated and turned into a gas. The gas refrigerant is fed back into the compressor 1 via the four-way valve 40 and the low pressure receiver 35. As the result, the liquid refrigerant is stored in the low pressure receiver 35, so that the circulated refrigerant composition is richer in constituents at a low boiling temperature, and the high pressure is increased.

The calculation unit 400 calculates the circulated refrigerant composition $\alpha$ in the following manner. The calculation unit 400 takes into itself the values T1, T2, and P1 which the first temperature sensor 401, the second temperature sensor 402, and the first pressure sensor 403 respectively detect. The calculation unit 400 assumes a circulated refrigerant composition $\alpha_1$ and further assumes that the enthalpy of the liquid refrigerant depends only on the temperature of the refrigerant, and the calculation unit 400 calculates the value of the enthalpy H1 on the basis of the value T1. Now, when it is assumed here that the enthalpy of the refrigerant at the outlet port of the first throttle device 33 is equal to the enthalpy at the inlet port of the first throttle device 33, then the calculation unit 400 can calculate the degree of dryness X of the refrigerant at the outlet port of the first throttle device 33 on the basis of the values T2, P1, and H1. Then, the calculation unit 400 calculates the value $\alpha_2$ of the circulated refrigerant composition by an inverse operation from this calculated result X and the values T2 and P1. The calculation unit 400 repeats the calculations based on the assumption stated above until the value $\alpha_1$ and the value $\alpha_2$ become equal to each other, and takes the obtained result as the value of the circulated refrigerant composition $\alpha$.

When the calculation unit 400 obtains the circulated refrigerant composition $\alpha$, the control unit obtains the condensing temperature Tc by arithmetic operations on the basis of the value P1 and the circulated refrigerant composition $\alpha$. The control unit 410 also controls the opening degree of the first throttle device 33 in such a manner that the difference between the condensing temperature mentioned above and the value detected by the first temperature sensor 401 is constant at a certain level.

Therefore, the refrigerant circulating system described in this example of preferred embodiment is capable of achieving a high degree of accuracy in its estimation of the circulated refrigerant composition and controlling the high pressure in an appropriate manner, and thereby performing highly efficient operations.

Forty-Second Embodiment

Figure 61:
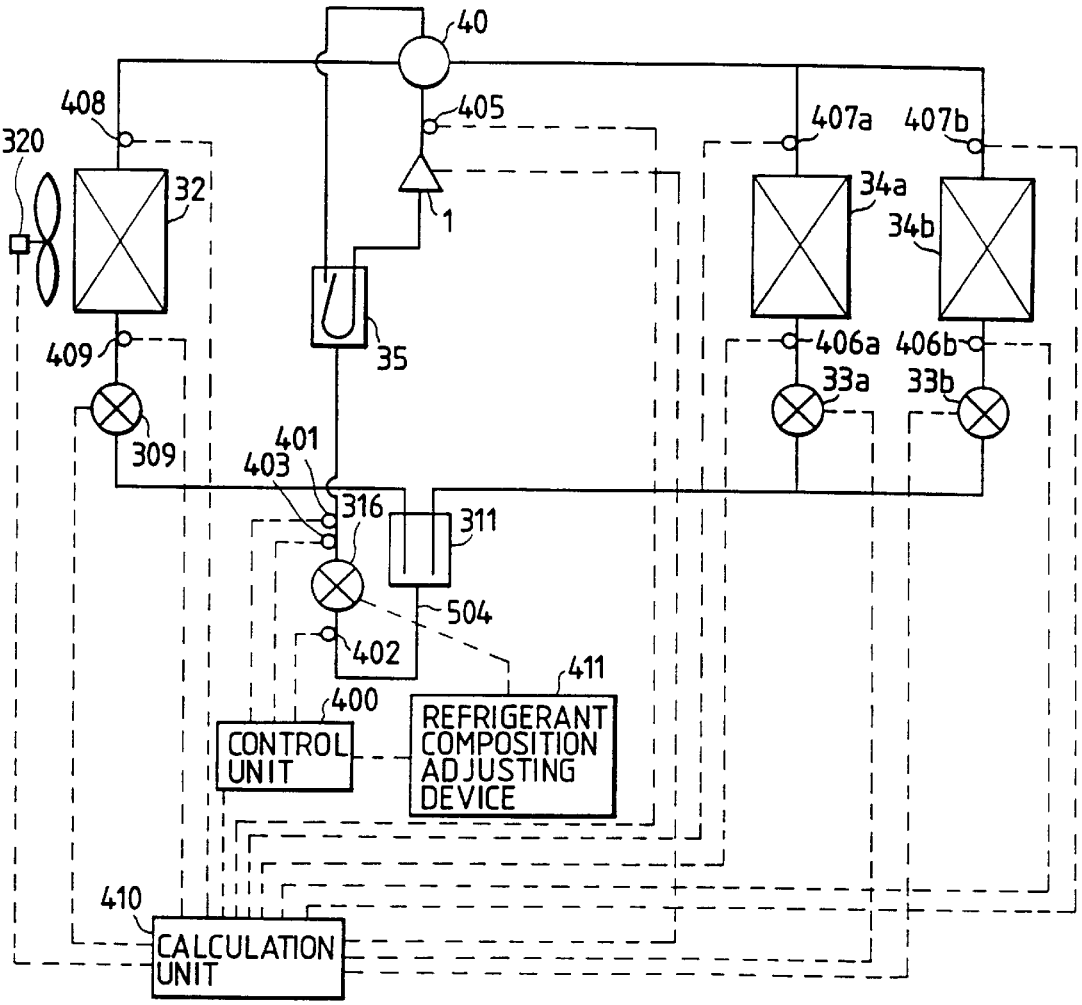
FIG. 61 is a configuration diagram of the refrigerant circuit in a refrigerating and air conditioning system in the forty-second embodiment of the present invention.

In the following part, a description will be given with respect to a forty-second embodiment of the present invention with reference to FIG. 61. In FIG. 61, a compressor 1, a four-way valve 40, a heat exchanger 32 at the heat source side, a second heat exchanger 309, a high pressure receiver 311, first throttle devices 33*a* and 33*b*, heat exchangers 34*a* and 34*b* at the load side, and a low pressure receiver 35 are connected in the serial order to form a main refrigerant circuit. In addition, the heat exchanger portion at the load side has two systems of the refrigerant circuits a and b. The reference number 504 denotes a bypass piping, which branches off from the high pressure receiver 311 and leads to the low pressure receiver 35 via a third throttle device 316. The reference numbers 401 denotes a first temperature sensor, 402 denotes a second temperature sensor, 403 denotes a first pressure sensor, 405 denotes a second pressure sensor, 407 denotes a fourth temperature sensor, 406 denotes a third temperature sensor, 408 denotes a sixth temperature sensor, and 409 denotes a fifth temperature sensor. An calculation device 400 calculates the circulated refrigerant composition on the basis of the information furnished respectively by the first temperature sensor 401, the second temperature sensor 402, and the first pressure sensor 403. A refrigerant composition control unit 411 opens and closes the third throttle device in accordance with the difference between the circulated refrigerant composition mentioned above and the desired value for the circulated refrigerant composition. A control unit 410 determines the opening degree of the throttle devices 33*a* and 33*b*, the operating frequency for the compressor 1, and the number of revolutions for the fan 320 in the outdoor unit on the basis of the values detected respectively by the third, fourth, fifth and sixth temperature sensors 406, 407, 409 and 408 and by the second pressure sensor 405 to control.

At the time of a cooling operation, the refrigerant discharged from the compressor 1 is condensed in the heat exchanger 32 at the heat source side. Here, if the second throttle device 309 is fully opened, the liquid refrigerant flows into the high pressure receiver 311, and the liquid refrigerant is stored therein. The liquid refrigerant flown out of the high pressure receiver 311 is reduced in the first throttle devices 33 and is and the refrigerant is thereby turned into a dual-phase state at a low temperature and under a low pressure. This dual-phase refrigerant at a low temperature and under a low pressure is then led into the heat exchangers 34*a* and 34*b* at the load side, in which the refrigerant deprives the surrounding area of heat, the system thereby performing a cooling operation, and the refrigerant itself is evaporated and turned into a gas, and the gas refrigerant thus formed is fed back into the compressor 1 via the four-way valve 40 and the low pressure receiver 35.

The calculation unit 400 calculates the circulated refrigerant composition $\alpha$. The calculation unit 400 uses the data found on the bypass circuit 504. First, this calculation unit 400 takes into itself the values T1, T2, and P1 which the first temperature sensor 401, the second temperature sensor 402, and the first pressure sensor 403 respectively detect. The calculation unit 400 assumes a circulated refrigerant composition $\alpha_1$ and further assumes that the enthalpy of the liquid refrigerant depends only on the temperature of the refrigerant and calculates the value of the enthalpy H1 on the basis of the value T1. Now, when it is assumed here that the enthalpy of the refrigerant at the outlet port of the second throttle device 309 is equal to the enthalpy at the inlet port of the third throttle device 316, then the calculation unit 400 can calculate the degree of dryness X of the refrigerant at the outlet port of the second throttle device 309 on the basis of the values T2, P1, and H1. Then, the calculation unit 400 calculates the value $\alpha_2$ of the circulated refrigerant composition by an inverse operation from this calculated result X and the values T2 and P1. The calculation unit 400 repeats the calculation based on the assumption stated above until the value $\alpha_1$ and the value $\alpha_2$ become equal to each other, and takes the obtained result as the value of the circulated refrigerant composition $\alpha$.

The refrigerant composition control unit 411 makes an adjustment of the composition of the refrigerant in accordance with the difference between the circulated refrigerant composition $\alpha$ as calculated by the calculation unit 400 and the desired value of the circulated refrigerant composition $\alpha^*$. When the relation between $\alpha$ and $\alpha^*$ is $\alpha<\alpha^*$, refrigerant composition control unit 411 opens the third throttle device 316 in accordance with the difference, namely, $\alpha-\alpha^*$, between the calculated circulated refrigerant composition $\alpha$ and the desired value $\alpha^*$ of the circulated refrigerant composition. Then, the liquid refrigerant in the high pressure receiver 311 moves into the low pressure receiver 35. As the result, the ratio of the constituents at a low boiling point increases in the circulated refrigerant composition, and the circulated refrigerant composition $\alpha$ increases. Also, when the relation between $\alpha$ and $\alpha^*$ is $\alpha>\alpha^*$, the refrigerant composition control unit 411 closes the third throttle device 316 in accordance with the difference between the values $\alpha$and $\alpha^*$, namely, $\alpha-\alpha^*$. The liquid refrigerant in the low pressure receiver 35 moves into the high pressure receiver 311. As the result of this movement of the liquid refrigerant, the ratio of the constituents at a high boiling point increases in the circulated refrigerant composition, and, accordingly, the circulated refrigerant composition $\alpha$ decreases.

When the circulated refrigerant composition $\alpha$ is obtained, this system can obtain the condensing temperature Tc on the basis of the values P1 and $\alpha$ and can also obtain the evaporating temperature Te on the basis of the value T1. The control unit 410 has the desired values for the condensing temperature and the evaporating temperature set in it in advance and can make corrections of the operating frequency of the compressor 1 and the number of revolutions of the blower 312 in accordance with the respective deviations of the condensing temperature and the evaporating temperature from their desired values. Further, the control unit 410 determines the opening degree of the throttle devices 33*a* and 33*b* in such a manner that the values which the third temperature sensor and the fourth temperature sensor have respectively detected is constant at a certain level.

At the time of a heating operation, the refrigerant discharged from the compressor 1 is condensed in the heat exchanger 34*a* and 34*b* at the load side. The liquid refrigerant is moderately reduced in the first throttle devices 33*a* and 33*b* and is thereafter fed into the high pressure receiver 311 and stored in it. The liquid refrigerant flown out of the high pressure receiver 311 is reduced by the second throttle device 309 and is thereby turned into a dual-phase state at a low temperature and under a low pressure. This dual-phase refrigerant at a low temperature and under a low pressure flows into the heat exchangers 34*a* and 34*b* at the load side, in which the refrigerant deprives the surrounding area of heat, the system thereby performing a cooling operation and the refrigerant itself being evaporated and turned into a gas. The gas refrigerant thus formed is fed back into the compressor 1 via the four-way valve 40 and the low pressure receiver 35.

The functions of the calculation unit 400 and those of the refrigerant composition adjusting device 411 at the time of a heating operation are the same as their respective functions at the time of a cooling operation, and a description of their functions is omitted here. When the circulated refrigerant composition $\alpha$ is obtained, it is possible for this system to find the condensing temperature Tc from the value P2, which is detected by the first temperature sensor 401 and the value $\alpha$ for the circulated refrigerant composition. The control unit 410 has the desired values for the condensing temperature and the evaporating temperature set in it in advance and can correct the operating frequency of the compressor 1 and the number of revolutions of the blower 312 in accordance with the respective deviations of the condensing temperature and the evaporating temperature from their desired values. Further, the control unit 412 determines the opening degree of the throttle devices 33*a* and 33*b* in such a manner that the condensing temperature mentioned above and the value detected by the second temperature sensor is constant. The control unit 410 also determines the opening degree of the second throttle device 309 in such a manner that the difference of the value detected by the fifth temperature sensor and the value detected by the sixth temperature sensor is constant.

Therefore, the system described in this embodiment can realize its highly efficient operations owing to its capability of detecting the circulated refrigerant composition at a high degree of accuracy and making an adjustment of the composition of the refrigerant.

Forty-Third Embodiment

Figure 62:
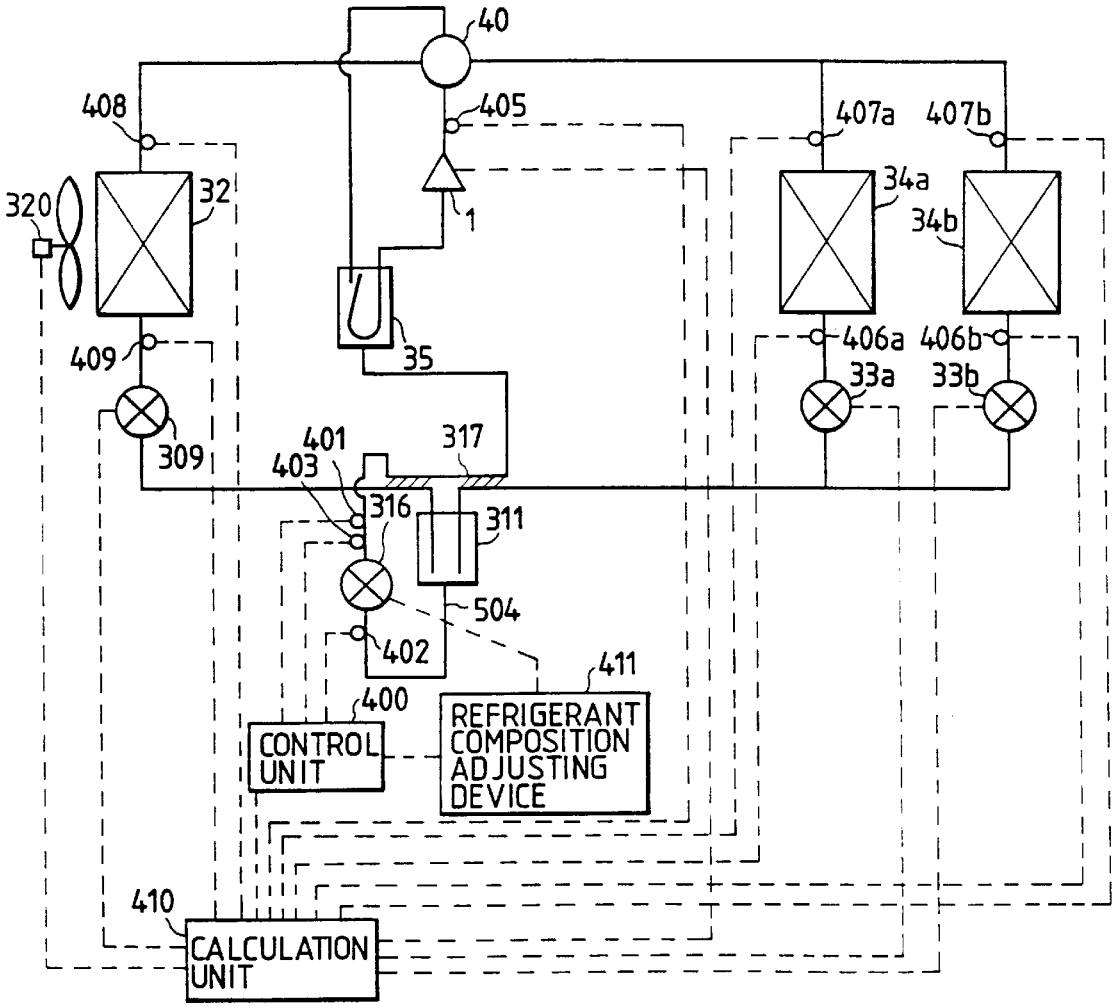
FIG. 62 is a configuration diagram of the refrigerant circuit in a refrigerating and air conditioning system in the forty-third embodiment of the present invention.

In the following part, a description will be given with respect to a forty-eighth embodiment of a system of the present invention with reference to FIG. 62. In FIG. 62, those component units or parts which are the same as those described in the forty-second embodiment are respectively indicated with the same reference numbers, and a description of those parts is omitted here. In addition to the system in the forty-second embodiment, the system of the embodiment is further provided with a superheating heat exchanger 317 for performing a heat exchange between a piping leading from the second throttle device 309 to the high pressure receiver 311 and a piping leading from the high pressure receiver 311 to the first throttle device 33 as well as a piping leading from the third throttle device 316 to the low pressure receiver 35.

The flow of the refrigerant and the actions of the calculation device 400, the refrigerant composition adjusting device 411, and the control unit 410 are the same as those described in the forty-second embodiment, and a description of these component units is omitted here. The superheating heat exchanger 317 performs a heat exchange between the liquid refrigerant flowing under a high pressure in the main refrigerant circuit and the dual-phase refrigerant flowing at a low temperature and under a low pressure in the bypass pipe 504 mentioned above. Therefore, the enthalpy of the refrigerant which flows in the bypass pipe 504 is transferred to the refrigerant which flows in the main refrigerant circuit, and this system can eliminate a loss of energy and can perform highly efficient operations.

Forty-Fourth Embodiment

Figure 63:
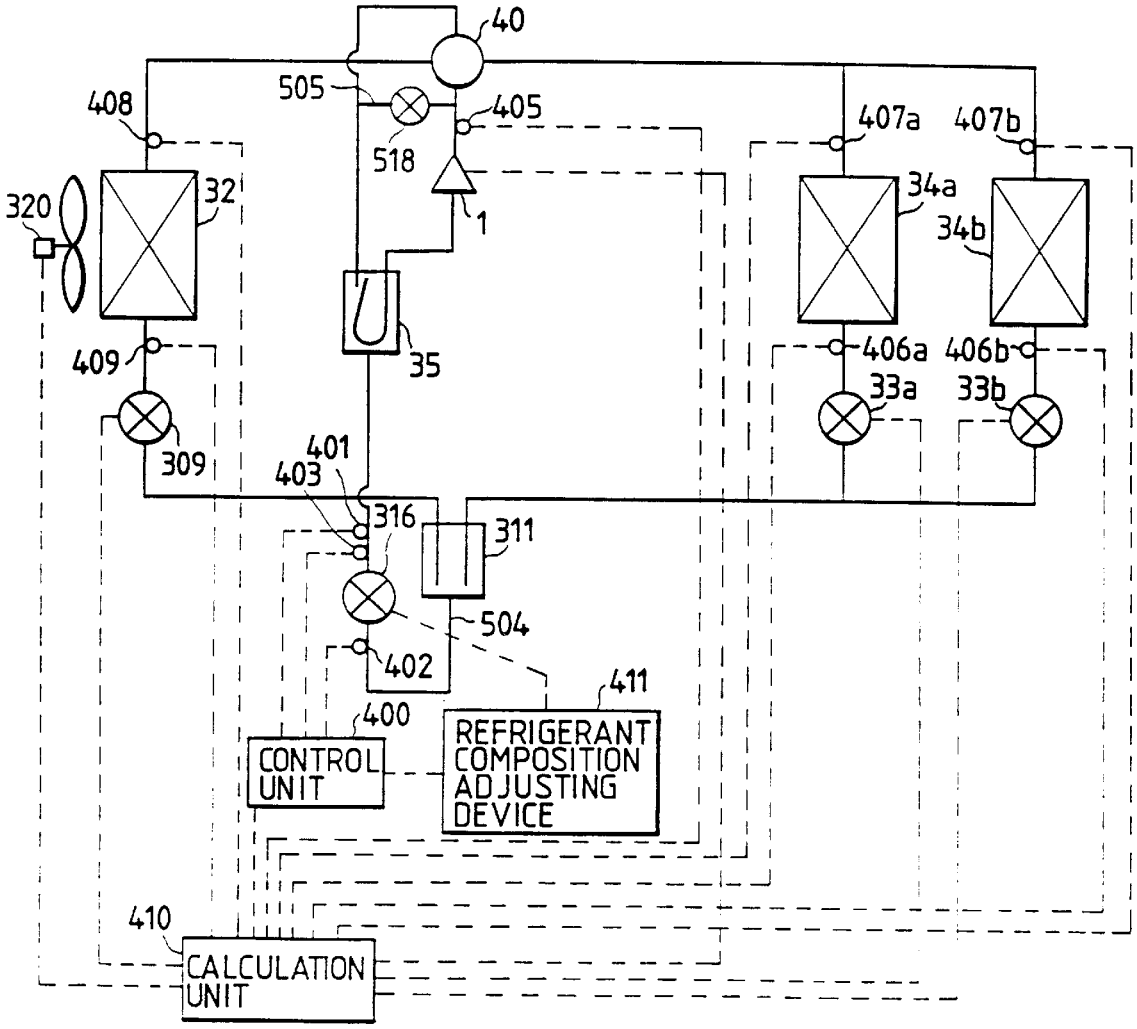
FIG. 63 is a configuration diagram of the refrigerant circuit in a refrigerating and air conditioning system in the forty-fourth embodiment of the present invention.

In the following part, a description will be given with respect to a forty-fourth embodiment of a system of the present invention with reference to FIG. 63. In FIG. 63, those component units or parts which are the same as those described in the forty-second embodiment are respectively indicated with the same reference numbers, and a description of those parts is omitted here. In addition to the system in the forty-second embodiment, the system in this example of embodiment is provided further with a bypass piping 505 which forms a bypass from the discharge piping of the compressor 1 to the suction inlet piping of the low pressure receiver 35, and also with an opening/closing mechanism 318 disposed on the bypass piping 505.

The flow of the refrigerant and the actions of the calculation device 400, the refrigerant composition adjusting device 411, and the control unit 410 are the same as those described in the forty-second embodiment, and a description of these component units is omitted here. When the liquid refrigerant in the low pressure receiver 35 is to be evaporated promptly and to be stored in the high pressure receiver 311, this system opens the opening/closing mechanism 318 and leads the refrigerant gas at a high temperature discharged from the compressor 1 into the low pressure receiver 35 and evaporates the refrigerant. Consequently, even in a case in which the high pressure rises in any unusual manner, this system can produce the effect of promptly suppressing the high pressure.

Forty-Fifth Embodiment

Figure 64:
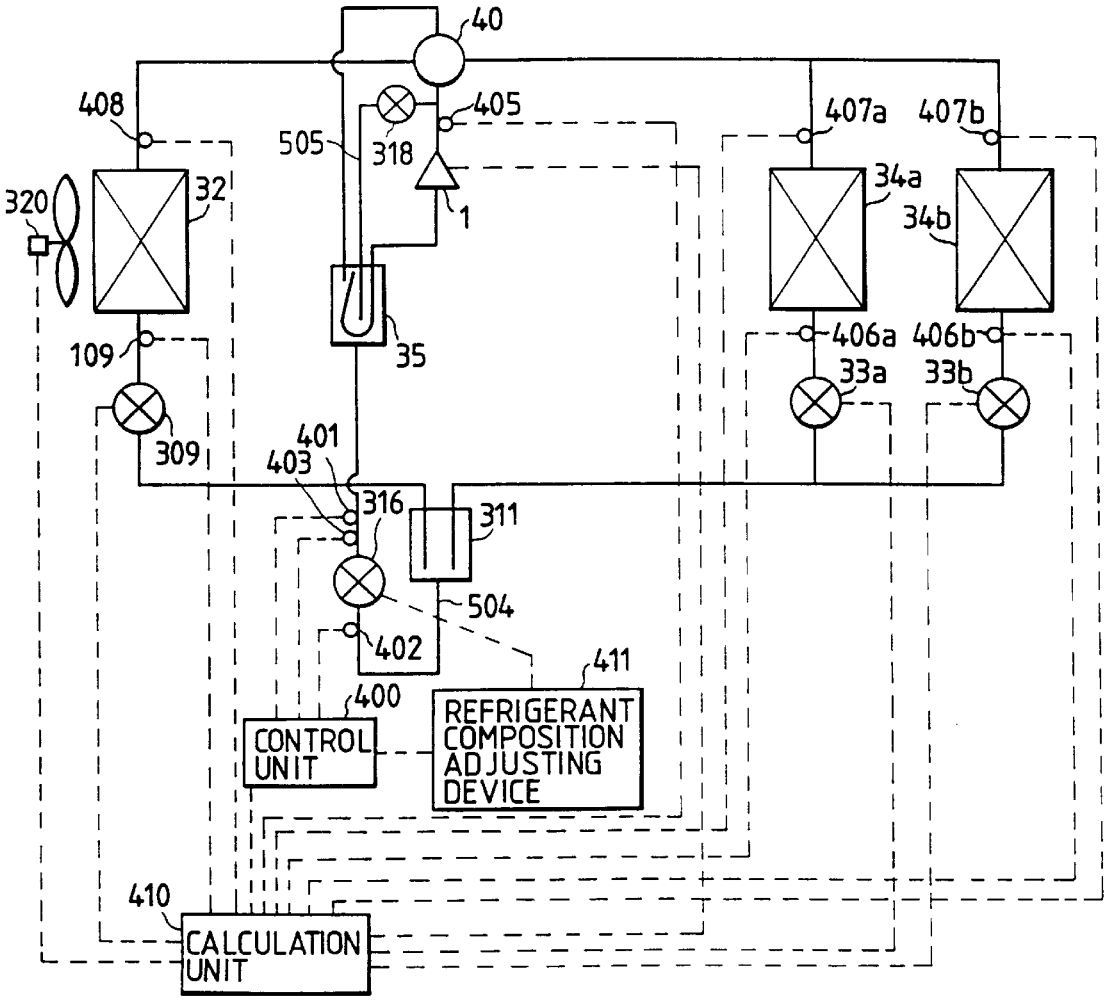
FIG. 64 is a configuration diagram of the refrigerant circuit in a refrigerating and air conditioning system in the forty-fifth embodiment of the present invention.

In the following part, a description will be given with respect to a forty-fifth embodiment of the present invention with reference to FIG. 64. In FIG. 64, those component units or parts which are the same as those described in the forty-second embodiment are respectively indicated with the same reference numbers, and a description of those parts is omitted here. In addition to the system in the forty-second embodiment, the system in this is further provided with a bypass piping 505, which forms a bypass from the discharge piping of the compressor 1 to the inside area of the low pressure receiver 35, and also with an opening/closing mechanism 318 disposed on the bypass piping 505.

Now, a description will be given with respect to the working of this system. The flow of the refrigerant and the actions of the calculation device 400, the refrigerant composition adjusting device 411, and the control unit 410 are the same as those described in the forty-second example of preferred embodiment, and a description of these component units is omitted here. When the liquid refrigerant in the low pressure receiver 35 is to be evaporated promptly and to be stored in the high pressure receiver 311, this system opens the opening/closing mechanism 318 and leads the refrigerant gas at a high temperature discharged from the compressor into the low pressure receiver 35 and evaporates the refrigerant. Consequently, even in a case in which the high pressure rises in any unusual manner, this system can produce the effect of promptly suppressing the high pressure.

Forty-Sixth Embodiment

Figure 65:
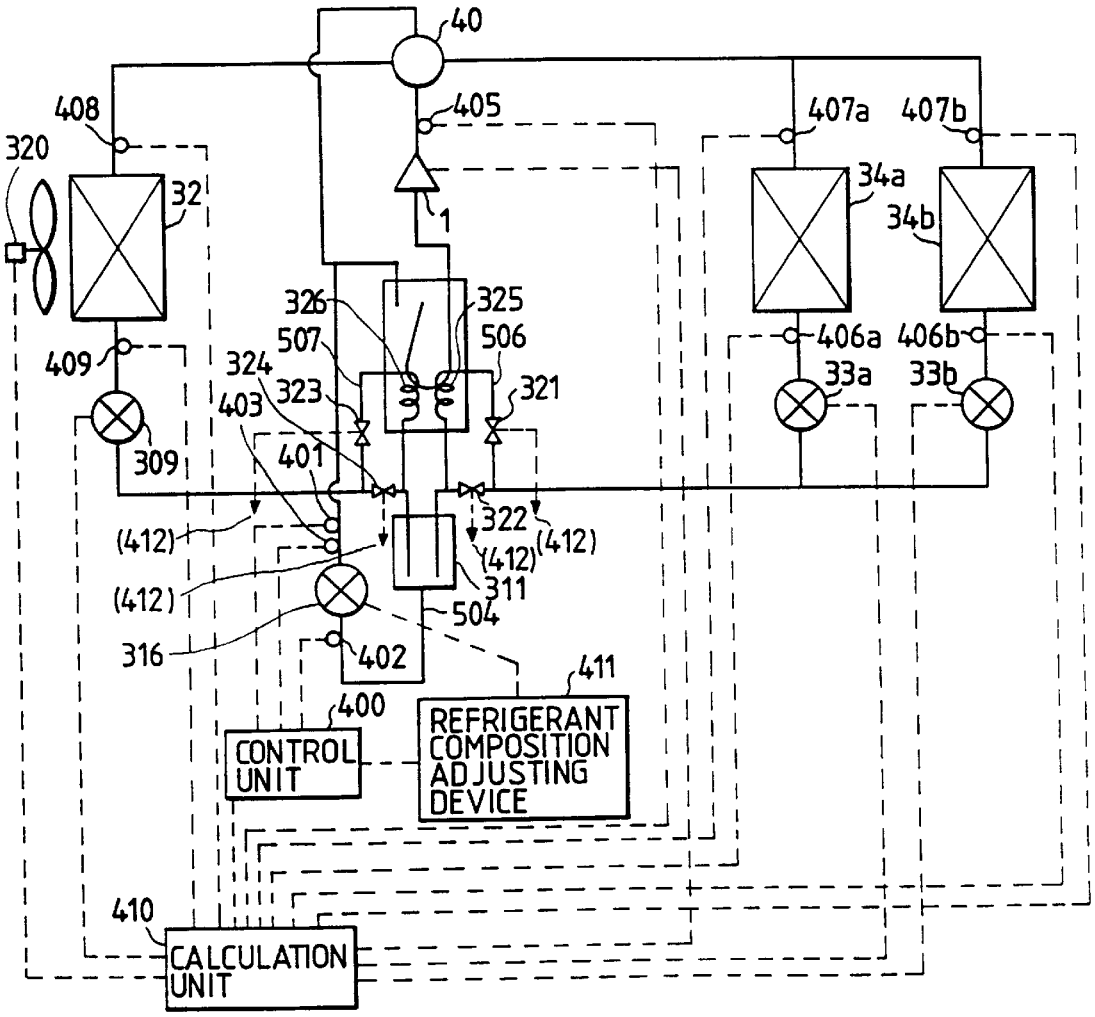
FIG. 65 is a configuration diagram of the refrigerant circuit in a refrigerating and air conditioning system in the forty-sixth embodiment of the present invention.

In the following part, a description will be given with respect to a forty-sixth embodiment of the present invention with reference to FIG. 65. In FIG. 65, those component units or parts which are the same as those described in the forty-second embodiment are respectively indicated with the same reference numbers, and a description of those parts is omitted here. In addition to the system of the forty-second embodiment, the system in this embodiment is further provided with an opening/closing mechanism 322 disposed between the high pressure receiver 311 and the first throttle device 33, an opening/closing mechanism 324 disposed between the high pressure receiver 311 and the first throttle device 33, a bypass piping 506 which bypasses the opening/closing mechanism 322 and communicates between the opening/closing mechanism 321 and the first superheating heat exchanger 325, and a bypass piping 507 which communicates between the opening/closing mechanism 323 and the second superheating heat exchanger 326, with the first superheating heat exchanger and the second superheating heat exchanger built into the low pressure receiver 35.

The flow of the refrigerant and the actions of the calculation device 400, the refrigerant composition adjusting device 411, and the control unit 410 are the same as those described in the forty-second embodiment, and a description of these component units is omitted here. When the liquid refrigerant in the low pressure receiver 35 is to be evaporated promptly and to be stored in the high pressure receiver 311, this system opens the opening/closing mechanisms 321 and 324 and closes the opening/closing mechanisms 322 and 323, and leads the liquid refrigerant under a high temperature into the bypass piping 506 for its circulation in it. As the result, this system effectively evaporates the liquid refrigerant in the inside of the low pressure receiver and also absorbs the latent heat generated when the liquid refrigerant is evaporated in the inside of the low pressure receiver as the enthalpy of the liquid refrigerant in the main refrigerant circuit, thereby making an improvement on the operating efficiency in the circulation of the refrigerant. At the time of a heating operation, this system opens the opening/closing mechanisms 322 and 323 and closes the opening/closing mechanisms 321 and 324, thereby circulating the liquid refrigerant under a high pressure into the bypass piping 507, when this system is promptly to evaporate the liquid refrigerant in the low pressure receiver and to store the liquid refrigerant in the high pressure receiver 311. As the result, this system is capable of effectively evaporating the liquid refrigerant in the low pressure receiver.

Therefore, the system in this embodiment can produce the same effect as the system described in the forty-third and forty-fourth embodiments and can also make an improvement on the operating efficiency of the system at the time of a cooling operation.

Forty-Seventh Embodiment

Figure 66:
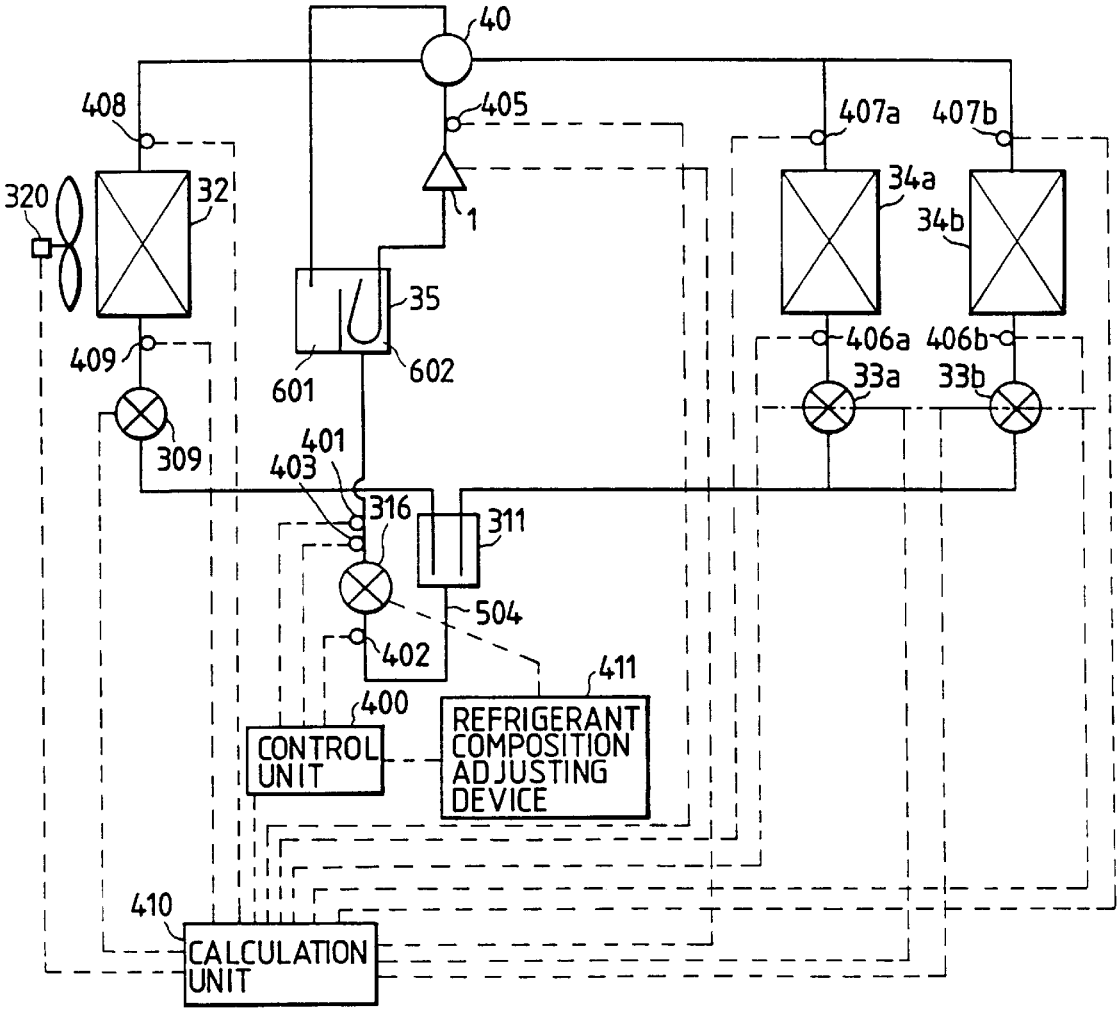
FIG. 66 is a configuration diagram of the refrigerant circuit in a refrigerating and air conditioning system in the forty-seventh embodiment of the present invention.
Figure 67:
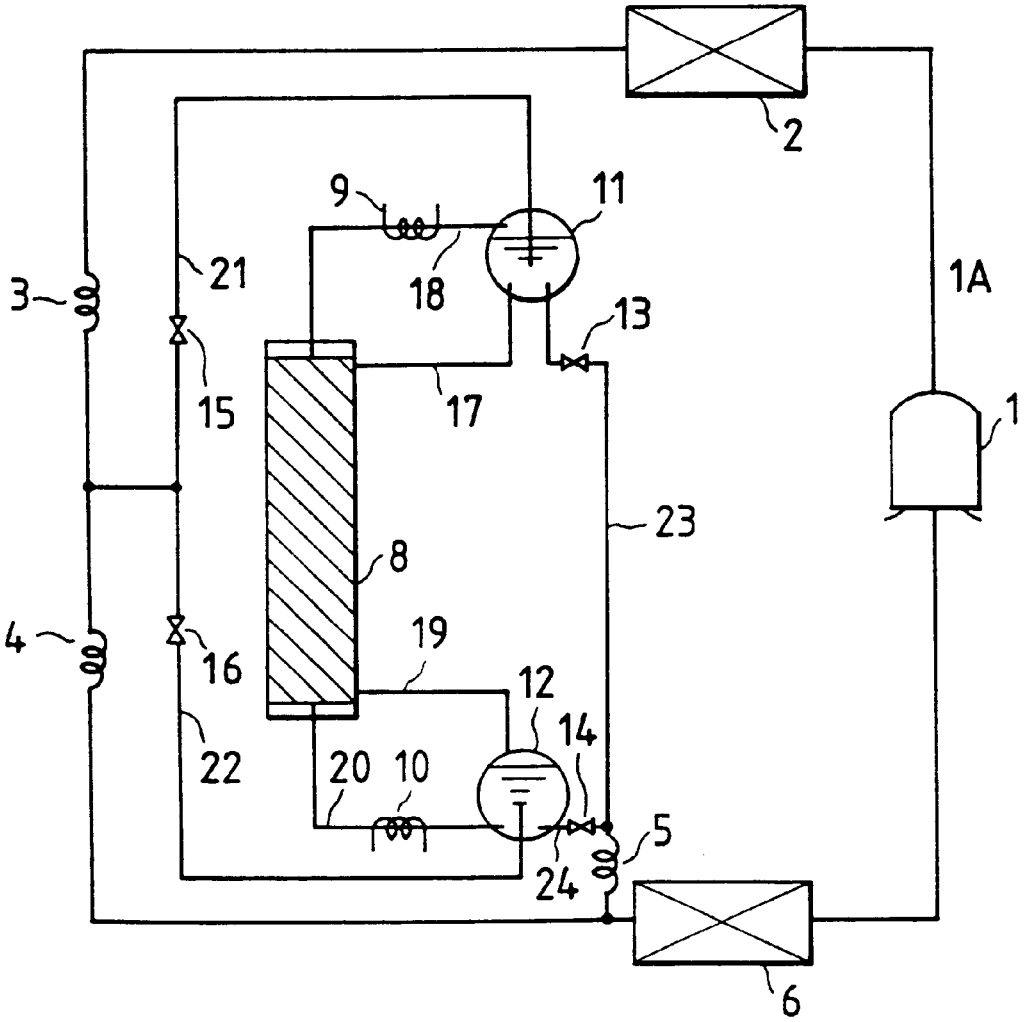
FIG. 67 PRIOR ART
FIG. 67 is a configuration diagram of the refrigerant circuit in a conventional refrigerating and air conditioning system using a refrigerant composed of a nonazeotropic mixture.

In the following part, a description will be given with respect to a forty-seventh example of preferred embodiment of the present invention with reference to FIG. 66. In FIG. 66, those component units or parts which are the same as those described in the forty-second embodiment are respectively indicated with the same reference numbers, and a description of those parts is omitted here. In addition to the system described in the forty-second embodiment, the system in this embodiment is further provided with a low pressure receiver 35 with its inside area divided into a storing part 602 for storing the liquid refrigerant therein, and a buffer part 601 which does not ordinarily store any liquid in it but works as a buffer for preventing the liquid refrigerant from temporarily flowing back into the compressor 1. In this regard, it is to be noted that the height of the opening of the piping should be greater than the height of the partition dividing the inside area of the low pressure receiver 35 as mentioned above.

The flow of the refrigerant and the actions of the calculation device 400, the refrigerant composition adjusting device 411, and the control unit 410 are the same as those described in the forty-second example of preferred embodiment, and a description of these component units is omitted here. The system in this embodiment is provided with a low pressure receiver 35 the inside area of which is divided into the storing part 602 and buffer part 601 as described above. Accordingly, it can be prevented that the liquid refrigerant from temporarily flowing back into the compressor 1 at the time of a non-steady operation, such as an operation performed at the time of an adjustment of the refrigerant composition so that this system can attain a higher degree of reliability in its performance.

What is claimed is:

1. A refrigerating/air conditioning system using a refrigerant made of a nonazeotriptic mixture refrigerant in which several types of refrigerants are mixed, comprising:

a compressor;

a valve device for changing a cycle of the refrigerant;

a heat source side heat exchanger;

a second throttle device;

a high pressure receiver;

a first throttle device;

a load side heat exchanger which is an evaporator when said heat source side heat exchanger is a condenser, and is said condenser when said heat source side heat exchanger is said evaporator;

a low pressure receiver; and controlling means for calculating a composition of the refrigerant circulating in said cycle on the basis of detected temperature pressure, and degree of dryness of the refrigerant; and for changing at least one of a capacity of said compressor, a capacity of said heat source side heat exchanger and an opening degree of said first and second throttle device in accordance with thus calculated values of the composition to control said cycle.

2. A refrigerating/air conditioning system using a refrigerant made of a nonazeotropic mixture refrigerant in which several types of refrigerants are mixed, comprising:

a compressor;

a valve device for changing a cycle of the refrigerant;

a heat source side heat exchanger;

a second throttle device;

a high pressure receiver;

a first throttle device;

a load side heat exchanger which is an evaporator when said heat source side heat exchanger is a condenser, and is said condenser when said heat source side heat exchanger is said evaporator;

a low pressure receiver; and controlling means for calculating a composition of the refrigerant circulating in said cycle on the basis of detected temperature and pressure of the refrigerant; and for changing at least one of a capacity of said compressor, a capacity of said heat source side heat exchanger and an opening degree of said first and second throttle device in accordance with thus calculated values of the composition to control said cycle;

first temperature detecting means for detecting a temperature of the refrigerant between said load side heat exchanger and said first throttle device;

second temperature detecting means for detecting a temperature of the refrigerant between said first throttle device and said high pressure receiver;

third temperature detecting means for detecting a temperature of the refrigerant between said heat source side heat exchanger and said second throttle device;

fourth temperature detecting means for detecting a temperature of the refrigerant between said second throttle device and said high pressure receiver;

fifth temperature detecting means for detecting a temperature of the refrigerant between said valve device and said load side heat exchanger;

sixth temperature detecting means for detecting a temperature of the refrigerant between said valve device and said heat source side exchanger;

first pressure detecting means for detecting a pressure of the refrigerant between said load side heat exchanger and said first throttle device; and second pressure detecting means for detecting a pressure of the refrigerant between said heat source side heat exchanger and said second throttle device;

wherein said controlling means comprises a calculating device and a main controlling device;

further wherein said calculating device calculates the composition of the refrigerant circulating in this system; and said main control device controls the refrigerating cycle by calculating and determining the opening degree of said first and second throttle device.

3. A refrigerating/air conditioning system using a refrigerant made of a nonazeotropic mixture refrigerant in which several types of refrigerants are mixed, comprising:

a compressor;

a valve device for changing a cycle of the refrigerant;

a heat source side heat exchanger;

a second throttle device;

a high pressure receiver;

a first throttle device;

a load side heat exchanger which is an evaporator when said heat source side heat exchanger is a condenser, and is said condenser when said heat source side heat exchanger is said evaporator;

a low pressure receiver; and controlling means for calculating a composition of the refrigerant circulating in said cycle on the basis of detected temperature and pressure of the refrigerant; and for changing at least one of a capacity of said compressor, a capacity of said heat source side heat exchanger and an opening degree of said first and second throttle device in accordance with thus calculated values of the composition to control said cycle;

a bypass piping which connects said high pressure receiver and said low pressure receiver;

a third throttle device which is disposed on said bypass piping;

first temperature detecting means for detecting a temperature of the refrigerant between said low pressure receiver and said third throttle device;

second temperature detecting means for detecting a temperature of the refrigerant between said third throttle device and said high pressure receiver;

fourth temperature detecting means for detecting a temperature of the refrigerant between said load side heat exchanger and said first throttle device;

third temperature detecting means for detecting a temperature of the refrigerant between said valve device and said heat load side heat exchanger;

fifth temperature detecting means for detecting a temperature of the refrigerant between said second throttle device and said heat source side heat exchanger;

sixth temperature detecting means for detecting a temperature of the refrigerant between said valve device and said heat source side heat exchanger;

first pressure detecting means for detecting a pressure of the refrigerant between said third throttle device and said low pressure receiver; and second pressure detecting means for detecting a pressure of the refrigerant at the discharge side of said compressor;

wherein said controlling device comprises a calculating device, a composition adjusting device and a main control device;

further wherein said calculating device calculates the composition of the refrigerant circulating in the refrigerating cycle; said composition adjusting device determines an opening degree of said third throttle device to adjust the composition of the refrigerant; and said main control device controls the refrigerating cycle by calculating and determining the opening degree of said first and second throttle device.

4. A refrigerating/air conditioning system according to claim 3, further comprising:

a bypass piping which connects between a piping at a discharge side of said compressor and a piping at a suction side or an inside of said low pressure receiver; and an opening/closing mechanism installed on said bypass piping.

5. A refrigerating/air conditioning system according to claim 3, further comprising:

a first opening/closing mechanism which is disposed between said high pressure receiver and said first throttle device;

a second opening/closing mechanism which is disposed between said high pressure receiver and said second throttle device;

a first bypass piping which bypasses said first opening/closing mechanism;

a third opening/closing mechanism;

a first supercooling heat exchanger, said first bypass piping communicating said third opening/closing mechanism and said first supercooling heat exchanger;

a second bypass piping which bypasses said second opening/closing mechanism;

a fourth opening/closing mechanism; and a second supercooling heat exchanger, said second bypass piping communicating said fourth opening/closing mechanism and said second supercooling heat exchanger;

wherein said first superheating heat exchanger and said second superheating heat exchanger is provided in said low pressure receiver.

6. A refrigerating/air conditioning system according to claim 3, wherein said low pressure receiver is divided into parts, one being a part for storing the liquid refrigerant and the other being a buffer part for preventing the liquid refrigerant from a temporary return to the compressor.

7. A refrigerating/air conditioning system using a refrigerant made of a nonazeotropic mixture refrigerant in which several types of refrigerants are mixed, comprising:

a compressor;

a valve device for changing a cycle of the refrigerant;

a heat source side heat exchanger;

a second throttle device;

a high pressure receiver;

a first throttle device;

a load side heat exchanger which is an evaporator when said heat source side heat exchanger is a condenser, and is said condenser when said heat source side heat exchanger is said evaporator;

a low pressure receiver;

controlling means for calculating a composition of the refrigerant circulating in said cycle on the basis of detected temperature and pressure of the refrigerant; and for changing at least one of a capacity of said compressor, a capacity of said heat source side heat exchanger and an opening degree of said first and second throttle device in accordance with thus calculated values of the composition to control said cycle; and a supercooling heat exchanger which performs heat exchanges between a main piping of said refrigerating cycle before and after said high pressure receiver and a piping between a third throttle device and said low pressure receiver.

* * * * *

UNITED STATES PATENT AND TRADEMARK OFFICE

CERTIFICATE OF CORRECTION

PATENT NO. : 6,032,473

DATED : March 7, 2000

INVENTOR(S): Osamu MORIMOTO, et al.

It is certified that an error appears in the above-identified patent and that said Letters Patent is hereby corrected as shown below:

Column 7, line 18, change "an azeotropic" to --a nonazeotropic--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*